US008444445B2

(12) United States Patent
Amidon et al.

(10) Patent No.: US 8,444,445 B2
(45) Date of Patent: May 21, 2013

(54) COAXIAL CABLE CONNECTOR HAVING ELECTRICAL CONTINUITY MEMBER

(75) Inventors: Jeremy Amidon, Marcellus, NY (US); Brian K. Hanson, East Syracuse, NY (US); Noah Montena, Syracuse, NY (US); Eric Purdy, Constantia, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 244 days.

(21) Appl. No.: 13/072,350

(22) Filed: Mar. 25, 2011

(65) Prior Publication Data

US 2011/0230089 A1 Sep. 22, 2011

Related U.S. Application Data

(63) Continuation-in-part of application No. 12/633,792, filed on Dec. 8, 2009, now Pat. No. 8,287,320.

(60) Provisional application No. 61/180,835, filed on May 22, 2009.

(51) Int. Cl.
*H01R 11/03* (2006.01)

(52) U.S. Cl.
USPC ..... 439/792; 439/583

(58) Field of Classification Search
USPC ..... 439/792, 583–585
See application file for complete search history.

(56) References Cited

U.S. PATENT DOCUMENTS

| | | | |
|---|---|---|---|
| 331,169 | A | 11/1885 | Thomas |
| 1,371,742 | A | 3/1921 | Dringman |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 2,102,495 | A | 12/1937 | England |
| 2,258,737 | A | 10/1941 | Browne |

(Continued)

FOREIGN PATENT DOCUMENTS

| | | | |
|---|---|---|---|
| CA | 2096710 | A1 | 11/1994 |
| CN | 201149936 | Y | 11/2008 |

(Continued)

OTHER PUBLICATIONS

Patent Application No. GB1109575.9 Examination Report Under Section 18(3); Date of Report Jun. 23, 2011. 3 pp.

(Continued)

*Primary Examiner* — Tho D Ta
*Assistant Examiner* — Travis Chambers
(74) *Attorney, Agent, or Firm* — Schmeiser, Olsen & Watts LLP

(57) ABSTRACT

A coaxial cable connector comprising a connector body a post engageable with connector body, wherein the post includes a flange, a coupling member, axially rotatable with respect to the post and the connector body, the coupling member having a first end, an opposing second end portion, and an internal lip, a continuity member disposed only axially rearward of a surface of the internal lip of the coupling member that faces the flange, an outer sleeve engageable with the coupling member, the sleeve configured to rotate the coupling member, and a compression portion structurally integral with the connector body, wherein the compression portion is configured to break apart from the body when axially compressed is provided. Furthermore, an associated method is also provided.

19 Claims, 127 Drawing Sheets

U.S. PATENT DOCUMENTS

| | | | |
|---|---|---|---|
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,015,794 | A | 1/1962 | Kishbaugh |
| 3,091,748 | A | 5/1963 | Takes et al. |
| 3,094,364 | A | 6/1963 | Lingg |
| 3,184,706 | A | 5/1965 | Atkins |
| 3,194,292 | A | 7/1965 | Borowsky |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,444 | A | 7/1972 | Stevens et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,706,958 | A | 12/1972 | Blanchenot |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,858,156 | A | 12/1974 | Zarro |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,017,139 | A | 4/1977 | Nelson |
| 4,022,966 | A | 5/1977 | Gajajiva |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,109,126 | A | 8/1978 | Halbeck |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann et al. |
| 4,307,926 | A | 12/1981 | Smith |
| 4,322,121 | A | 3/1982 | Riches et al. |
| 4,326,769 | A | 4/1982 | Dorsey et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |

4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,650,228 A 3/1987 McMills et al.
4,655,159 A 4/1987 McMills
4,655,534 A 4/1987 Stursa
4,660,921 A 4/1987 Hauver
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gallusser et al.
4,703,988 A 11/1987 Raux et al.
4,717,355 A 1/1988 Mattis
4,720,155 A 1/1988 Schildkraut et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,746,305 A 5/1988 Nomura
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,797,120 A 1/1989 Ulery
4,806,116 A 2/1989 Ackerman
4,807,891 A 2/1989 Neher
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,838,813 A 6/1989 Pauza et al.
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,747 A 10/1991 Bawa et al.
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang 5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hse
5,702,263 A 12/1997 Baumann et al.
5,722,856 A 3/1998 Fuchs et al.
5,735,704 A 4/1998 Anthony
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,769 A 4/2000 Kubota et al.
6,053,777 A 4/2000 Boyle
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena
6,210,216 B1 4/2001 Tso-Chin et al.
6,210,222 B1 4/2001 Langham et al.
6,217,383 B1 4/2001 Holland et al.
6,239,359 B1 5/2001 Lilienthal, II et al.
6,241,553 B1 6/2001 Hsia
6,261,126 B1 7/2001 Stirling
6,267,612 B1 7/2001 Arcykiewicz et al.
6,271,464 B1 8/2001 Cunningham
6,331,123 B1 12/2001 Rodrigues
6,332,815 B1 12/2001 Bruce
6,358,077 B1 3/2002 Young
D458,904 S 6/2002 Montena
6,406,330 B2 6/2002 Bruce
D460,739 S 7/2002 Fox
D460,740 S 7/2002 Montena
D460,946 S 7/2002 Montena
D460,947 S 7/2002 Montena
D460,948 S 7/2002 Montena
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,468,100 B1 10/2002 Meyer et al.
6,491,546 B1 12/2002 Perry
D468,696 S 1/2003 Montena
6,506,083 B1 1/2003 Bickford et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Twiss et al.
6,619,876 B2 9/2003 Vaitkus et al.
6,634,906 B1 10/2003 Yeh
6,676,446 B2 1/2004 Montena
6,683,253 B1 1/2004 Lee
6,692,285 B2 2/2004 Islam
6,692,286 B1 2/2004 De Cet
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,767,248 B1 7/2004 Hung
6,769,926 B1 8/2004 Montena
6,780,068 B2 8/2004 Bartholoma et al.
6,786,767 B1 9/2004 Fuks et al.
6,790,081 B2 9/2004 Burris et al.
6,805,584 B1 10/2004 Chen
6,817,896 B2 11/2004 Derenthal
6,848,939 B2 2/2005 Stirling
6,848,940 B2 2/2005 Montena
6,884,113 B1 4/2005 Montena
6,884,115 B2 4/2005 Malloy
6,929,508 B1 8/2005 Holland
6,939,169 B2 9/2005 Islam et al.
6,971,912 B2 12/2005 Montena et al.
7,029,326 B2 4/2006 Montena
7,070,477 B2 7/2006 Morisawa et al.
7,086,897 B2 8/2006 Montena
7,097,499 B1 8/2006 Purdy
7,102,868 B2 9/2006 Montena
7,114,990 B2 10/2006 Bence et al.
7,118,416 B2 10/2006 Montena et al.
7,125,283 B1 10/2006 Lin
7,131,868 B2 11/2006 Montena
7,144,271 B1 12/2006 Burris et al.
7,147,509 B1 12/2006 Burris et al.
7,156,696 B1 1/2007 Montena
7,161,785 B2 1/2007 Chawgo
7,179,121 B1 2/2007 Burris et al.
7,229,303 B2 6/2007 Vermoesen et al.
7,252,546 B1 8/2007 Holland
7,255,598 B2 8/2007 Montena et al.
7,299,550 B2 11/2007 Montena
7,375,533 B2 5/2008 Gale
7,393,245 B2 7/2008 Palinkas et al.
7,404,737 B1 7/2008 Youtsey
7,452,239 B2 11/2008 Montena
7,455,550 B1 11/2008 Sykes
7,462,068 B2 12/2008 Amidon

| | | | |
|---|---|---|---|
| 7,476,127 | B1 | 1/2009 | Wei |
| 7,479,035 | B2 | 1/2009 | Bence et al. |
| 7,488,210 | B1 | 2/2009 | Burris et al. |
| 7,494,355 | B2 | 2/2009 | Hughes et al. |
| 7,497,729 | B1 | 3/2009 | Wei |
| 7,507,117 | B2 | 3/2009 | Amidon |
| 7,544,094 | B1 | 6/2009 | Paglia et al. |
| 7,566,236 | B2 | 7/2009 | Malloy et al. |
| 7,607,942 | B1 | 10/2009 | Van Swearingen |
| 7,674,132 | B1 | 3/2010 | Chen |
| 7,682,177 | B2 | 3/2010 | Berthet |
| 7,727,011 | B2 | 6/2010 | Montena et al. |
| 7,753,705 | B2 | 7/2010 | Montena |
| 7,753,727 | B1 | 7/2010 | Islam et al. |
| 7,794,275 | B2 | 9/2010 | Rodrigues |
| 7,806,714 | B2 | 10/2010 | Williams et al. |
| 7,806,725 | B1 | 10/2010 | Chen |
| 7,811,133 | B2 | 10/2010 | Gray |
| 7,824,216 | B2 | 11/2010 | Purdy |
| 7,828,595 | B2 | 11/2010 | Mathews |
| 7,830,154 | B2 | 11/2010 | Gale |
| 7,833,053 | B2 | 11/2010 | Mathews |
| 7,845,976 | B2 | 12/2010 | Mathews |
| 7,845,978 | B1 | 12/2010 | Chen |
| 7,850,487 | B1 | 12/2010 | Wei |
| 7,857,661 | B1 | 12/2010 | Islam |
| 7,874,870 | B1 | 1/2011 | Chen |
| 7,887,354 | B2 | 2/2011 | Holliday |
| 7,892,004 | B2 | 2/2011 | Hertzler et al. |
| 7,892,005 | B2 | 2/2011 | Haube |
| 7,892,024 | B1 | 2/2011 | Chen |
| 7,927,135 | B1 | 4/2011 | Wlos |
| 7,950,958 | B2 | 5/2011 | Mathews |
| 7,955,126 | B2 | 6/2011 | Bence et al. |
| 7,972,158 | B2 | 7/2011 | Wild et al. |
| 8,029,315 | B2 | 10/2011 | Purdy et al. |
| 8,062,044 | B2 | 11/2011 | Montena et al. |
| 8,062,063 | B2 | 11/2011 | Malloy et al. |
| 8,075,337 | B2 | 12/2011 | Malloy et al. |
| 8,075,338 | B1 | 12/2011 | Montena |
| 8,079,860 | B1 | 12/2011 | Zraik |
| 8,113,875 | B2 | 2/2012 | Malloy et al. |
| 8,152,551 | B2 | 4/2012 | Zraik |
| 8,157,588 | B1 | 4/2012 | Rodrigues et al. |
| 8,167,635 | B1 | 5/2012 | Mathews |
| 8,167,636 | B1 | 5/2012 | Montena |
| 8,167,646 | B1 | 5/2012 | Mathews |
| 8,172,612 | B2 | 5/2012 | Bence et al. |
| 8,192,237 | B2 | 6/2012 | Purdy et al. |
| 8,287,320 | B2 * | 10/2012 | Purdy et al. ..... 439/792 |
| 2002/0013088 | A1 | 1/2002 | Rodrigues et al. |
| 2002/0038720 | A1 | 4/2002 | Kai et al. |
| 2003/0214370 | A1 | 11/2003 | Allison et al. |
| 2003/0224657 | A1 | 12/2003 | Malloy |
| 2004/0077215 | A1 | 4/2004 | Palinkas et al. |
| 2004/0102089 | A1 | 5/2004 | Chee |
| 2004/0209516 | A1 | 10/2004 | Burris et al. |
| 2004/0219833 | A1 | 11/2004 | Burris et al. |
| 2004/0229504 | A1 | 11/2004 | Liu |
| 2005/0042919 | A1 | 2/2005 | Montena |
| 2005/0208827 | A1 | 9/2005 | Burris et al. |
| 2005/0233636 | A1 | 10/2005 | Rodrigues et al. |
| 2006/0099853 | A1 | 5/2006 | Sattele et al. |
| 2006/0110977 | A1 | 5/2006 | Matthews |
| 2006/0154519 | A1 | 7/2006 | Montena |
| 2007/0026734 | A1 | 2/2007 | Bence et al. |
| 2007/0049113 | A1 | 3/2007 | Rodrigues et al. |
| 2007/0123101 | A1 | 5/2007 | Palinkas |
| 2007/0155232 | A1 | 7/2007 | Burris et al. |
| 2007/0175027 | A1 | 8/2007 | Khemakhem et al. |
| 2007/0243759 | A1 | 10/2007 | Rodrigues et al. |
| 2007/0243762 | A1 | 10/2007 | Burke et al. |
| 2008/0102696 | A1 | 5/2008 | Montena |
| 2008/0289470 | A1 | 11/2008 | Aston |
| 2009/0029590 | A1 | 1/2009 | Sykes et al. |
| 2009/0098770 | A1 | 4/2009 | Bence et al. |
| 2010/0055978 | A1 | 3/2010 | Montena |
| 2010/0081321 | A1 | 4/2010 | Malloy et al. |
| 2010/0081322 | A1 | 4/2010 | Malloy et al. |
| 2010/0105246 | A1 | 4/2010 | Burris et al. |
| 2010/0233901 | A1 | 9/2010 | Wild et al. |
| 2010/0233902 | A1 | 9/2010 | Youtsey |
| 2010/0255720 | A1 | 10/2010 | Radzik et al. |
| 2010/0255721 | A1 | 10/2010 | Purdy et al. |
| 2010/0279548 | A1 | 11/2010 | Montena et al. |
| 2010/0297871 | A1 | 11/2010 | Haube |
| 2010/0297875 | A1 | 11/2010 | Purdy |
| 2011/0021072 | A1 | 1/2011 | Purdy |
| 2011/0027039 | A1 | 2/2011 | Blair |
| 2011/0053413 | A1 | 3/2011 | Mathews |
| 2011/0117774 | A1 | 5/2011 | Malloy et al. |
| 2011/0143567 | A1 | 6/2011 | Purdy et al. |
| 2011/0230091 | A1 | 9/2011 | Krenceski et al. |
| 2012/0021642 | A1 | 1/2012 | Zraik |
| 2012/0094532 | A1 | 4/2012 | Montena |
| 2012/0122329 | A1 | 5/2012 | Montena |
| 2012/0145454 | A1 | 6/2012 | Montena |
| 2012/0171894 | A1 | 7/2012 | Malloy et al. |
| 2012/0196476 | A1 | 8/2012 | Haberek et al. |
| 2012/0222302 | A1 | 9/2012 | Purdy et al. |
| 2012/0225581 | A1 | 9/2012 | Amidon et al. |

FOREIGN PATENT DOCUMENTS

| | | | |
|---|---|---|---|
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| DE | 4439852 | A1 | 5/1996 |
| DE | 19957518 | A1 | 9/2001 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1548898 | | 6/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 2002075556 | A | 3/2002 |
| JP | 3280369 | B2 | 5/2002 |
| JP | 4503793 | B9 | 4/2010 |
| KR | 2006100622526 | B1 | 9/2006 |
| TW | 427044 | B | 3/2001 |
| WO | 8700351 | | 1/1987 |
| WO | 0186756 | A1 | 11/2001 |
| WO | 02069457 | A1 | 9/2002 |
| WO | 2004013883 | A2 | 2/2004 |
| WO | 2006081141 | A1 | 8/2006 |
| WO | 2011128665 | A1 | 10/2011 |
| WO | 2011128666 | A1 | 10/2011 |
| WO | 2012061379 | A2 | 5/2012 |

OTHER PUBLICATIONS

Office Action (Mail Date: Oct 24, 2011);U.S. Appl. No. 12/633,792, filed Dec. 8, 2009, Conf. No. 6319.

Final Office Action (Mail Date: Oct. 25, 2011); U.S. Appl. No. 13/033,127, filed Feb. 23, 2011, Conf. No. 8230.
Patent No. ZL201020597847; Evaluation Report of Utility Model Patent; Date of Report; Sep. 2, 2011. 8 pages. (Chinese version with English Translation (10 pages) provided).
Request for Inter Partes Reexamination (filed Sep. 13, 2012) of Purdy et al. US Patent No. 8,192,237 issued Jun. 5, 2012. 150 pages.
Declaration of Michael G. Littman, Ph.D., Inter Partes Reexamination (filed Sep. 13, 2012) of Purdy et al. US Patent No. 8,192,237 issued Jun. 5, 2012. 116 pages.
Response dated Jun. 24, 2011 to Office Action (Mail Date: Jun. 2, 2011) for U.S. Appl. No. 13/033,127 filed Feb. 23, 2011.
U.S. Appl. No. 13/459,711, filed Apr. 30, 2012.
U.S. Appl. No. 13/461,779, filed May 1, 2012.
U.S. Appl. No. 13/523,668, filed Jun. 14, 2012.
Notice of Allowance (Date Mailed: Jun. 25, 2012) for U.S. Appl. No. 12/633,792, filed Dec. 8, 2009.
Digicon AVL Connector. ARRIS Group Inc. [online]. 3 pages [retrieved on Apr. 22, 2010]. Retrieved from the Internet< URL: http://www.arrisi.com/special/digiconAVL.asp>.
Office Action (Mail Date: Jun. 2, 2011); U.S. Appl. No. 13/033,127, filed Feb. 23, 2011, Conf. No. 8230.
PCT/US2010/034870; International Filing Date May 14, 2010. International Search Report and Written Opinion. Date of Mailing: Nov. 30, 2010. 7 pages.
Notice of Allowance (Date Mailed: Feb. 24, 2012) for U.S. Appl. No. 13/033,127, filed Feb. 23, 2011.

* cited by examiner

COAXIAL CABLE CONNECTOR HAVING ELECTRICAL CONTINUITY MEMBER

CROSS-REFERENCE TO RELATED APPLICATIONS

This application is a continuation-in-part of U.S. Non-Provisional application Ser. No. 12/633,792, filed Dec. 8, 2009, and entitled COAXIAL CABLE CONNECTOR HAVING ELECTRICAL CONTINUITY MEMBER, which claims the priority benefit of U.S. Provisional Patent Application No. 61/180,835 filed May 22, 2009, and entitled COAXIAL CABLE CONNECTOR HAVING ELECTRICAL CONTINUITY MEMBER.

FIELD OF TECHNOLOGY

The following relates to connectors used in coaxial cable communication applications, and more specifically to coaxial connectors having electrical continuity members that extend continuity of an electromagnetic interference shield from the cable and through the connector.

BACKGROUND

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotatable operation of an internally threaded nut of the connector about a corresponding externally threaded interface port. Fully tightening the threaded connection of the coaxial cable connector to the interface port helps to ensure a ground connection between the connector and the corresponding interface port. However, often connectors are not properly tightened or otherwise installed to the interface port and proper electrical mating of the connector with the interface port does not occur. Moreover, typical component elements and structures of common connectors may permit loss of ground and discontinuity of the electromagnetic shielding that is intended to be extended from the cable, through the connector, and to the corresponding coaxial cable interface port. Hence a need exists for an improved connector having structural component elements included for ensuring ground continuity between the coaxial cable, the connector and its various applicable structures, and the coaxial cable connector interface port.

SUMMARY

The invention is directed toward a first aspect of providing a coaxial cable connector comprising; a connector body; a post engageable with connector body, wherein the post includes a flange; a nut, axially rotatable with respect to the post and the connector body, the nut having a first end and an opposing second end, wherein the nut includes an internal lip, and wherein a second end portion of the nut corresponds to the portion of the nut extending from the second end of the nut to the side of the lip of the nut facing the first end of the nut at a point nearest the second end of the nut, and a first end portion of the nut corresponds to the portion of the nut extending from the first end of the nut to the same point nearest the second end of the nut of the same side of the lip facing the first end of the nut; and a continuity member disposed within the second end portion of the nut and contacting the post and the nut, so that the continuity member extends electrical grounding continuity through the post and the nut.

A second aspect of the present invention provides a coaxial cable connector comprising a connector body; a post engageable with connector body, wherein the post includes a flange; a nut, axially rotatable with respect to the post and the connector body, the nut having a first end and an opposing second end, wherein the nut includes an internal lip, and wherein a second end portion of the nut starts at a side of the lip of the nut facing the first end of the nut and extends rearward to the second end of the nut; and a continuity member disposed only rearward the start of the second end portion of the nut and contacting the post and the nut, so that the continuity member extends electrical grounding continuity through the post and the nut A third aspect of the present invention provides a coaxial cable connector comprising a connector body; a post operably attached to the connector body, the post having a flange; a nut axially rotatable with respect to the post and the connector body, the nut including an inward lip; and an electrical continuity member disposed axially rearward of a surface of the internal lip of the nut that faces the flange.

A fourth aspect of the present invention provides a method of obtaining electrical continuity for a coaxial cable connection, the method comprising: providing a coaxial cable connector including: a connector body; a post operably attached to the connector body, the post having a flange; a nut axially rotatable with respect to the post and the connector body, the nut including an inward lip; and an electrical continuity member disposed axially rearward of a surface of the internal lip of the nut that faces the flange; securely attaching a coaxial cable to the connector so that the grounding sheath of the cable electrically contacts the post; extending electrical continuity from the post through the continuity member to the nut; and fastening the nut to a conductive interface port to complete the ground path and obtain electrical continuity in the cable connection.

A fifth general aspect relates to a coaxial cable connector comprising: a connector body; a post engageable with connector body, wherein the post includes a flange; a coupling member, axially rotatable with respect to the post and the connector body, the coupling member having a first end, an opposing second end portion, and an internal lip; a continuity member disposed only axially rearward of a surface of the internal lip of the coupling member that faces the flange; an outer sleeve engageable with the coupling member, the sleeve configured to rotate the coupling member; and a compression portion structurally integral with the connector body, wherein the compression portion is configured to break apart from the body when axially compressed.

A sixth general aspect relates to a coaxial cable connector comprising; a connector body; a post engageable with connector body, wherein the post includes a flange; a coupling member, axially rotatable with respect to the post and the connector body, the coupling member having a first end, an opposing second end portion, and an internal lip; a continuity member disposed only axially rearward of a surface of the internal lip of the coupling member that faces the flange; and an outer sleeve engageable with the coupling member, the sleeve configured to rotate the coupling member.

A seventh general aspect relates to a coaxial cable connector comprising; a connector body; a post engageable with connector body, wherein the post includes a flange; a coupling member, axially rotatable with respect to the post and the connector body, the coupling member having a first end, an opposing second end portion, and an internal lip; a continuity member disposed only axially rearward of a surface of the internal lip of the coupling member that faces the flange; and a compression portion structurally integral with the connector body, wherein the compression portion is configured to break apart from the body when axially compressed.

An eighth general aspect relates to a method of obtaining electrical continuity for a coaxial cable connection, the method comprising: providing a coaxial cable connector including: a connector body; a post operably attached to the connector body, the post having a flange; a coupling member axially rotatable with respect to the post and the connector body, the coupling member including a lip; a continuity member located between the post and the coupling member; an outer sleeve engageable with the coupling member; and a compression portion structurally integral with the connector body, wherein the compression portion is configured to break apart from the body when axially compressed; securely attaching a coaxial cable to the connector so that the grounding shield of the cable electrically contacts the post, by axially compressing the compression portion so that the compression portion breaks away from the body and securely connects to the coaxial cable; extending electrical continuity from the post through the continuity member to the coupling member; and fastening the coupling member to a conductive interface port to complete the ground path and obtain electrical continuity in the cable connection.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments will be described in detail, with reference to the following figures, wherein like designations denote like members, wherein:

FIG. 109 depicts a cross-section view of the first embodiment of a coaxial cable connector including an embodiment of a continuity member, an embodiment of a compression portion, and an embodiment of a sleeve, in a compressed position;

FIG. 110 depicts a cross-section view of the first embodiment of a coaxial cable connector including an embodiment of a continuity member, an embodiment of a compression portion, and an embodiment of a sleeve, in a compressed position on a coaxial cable;

FIG. 111A depicts a cross-section view of an embodiment of a coaxial cable connector including an embodiment of a continuity member and a first embodiment of a compression portion;

FIG. 111B depicts a cross-section view of an embodiment of a coaxial cable connector including an embodiment of a continuity member and a second embodiment of a compression portion;

Figure 112:
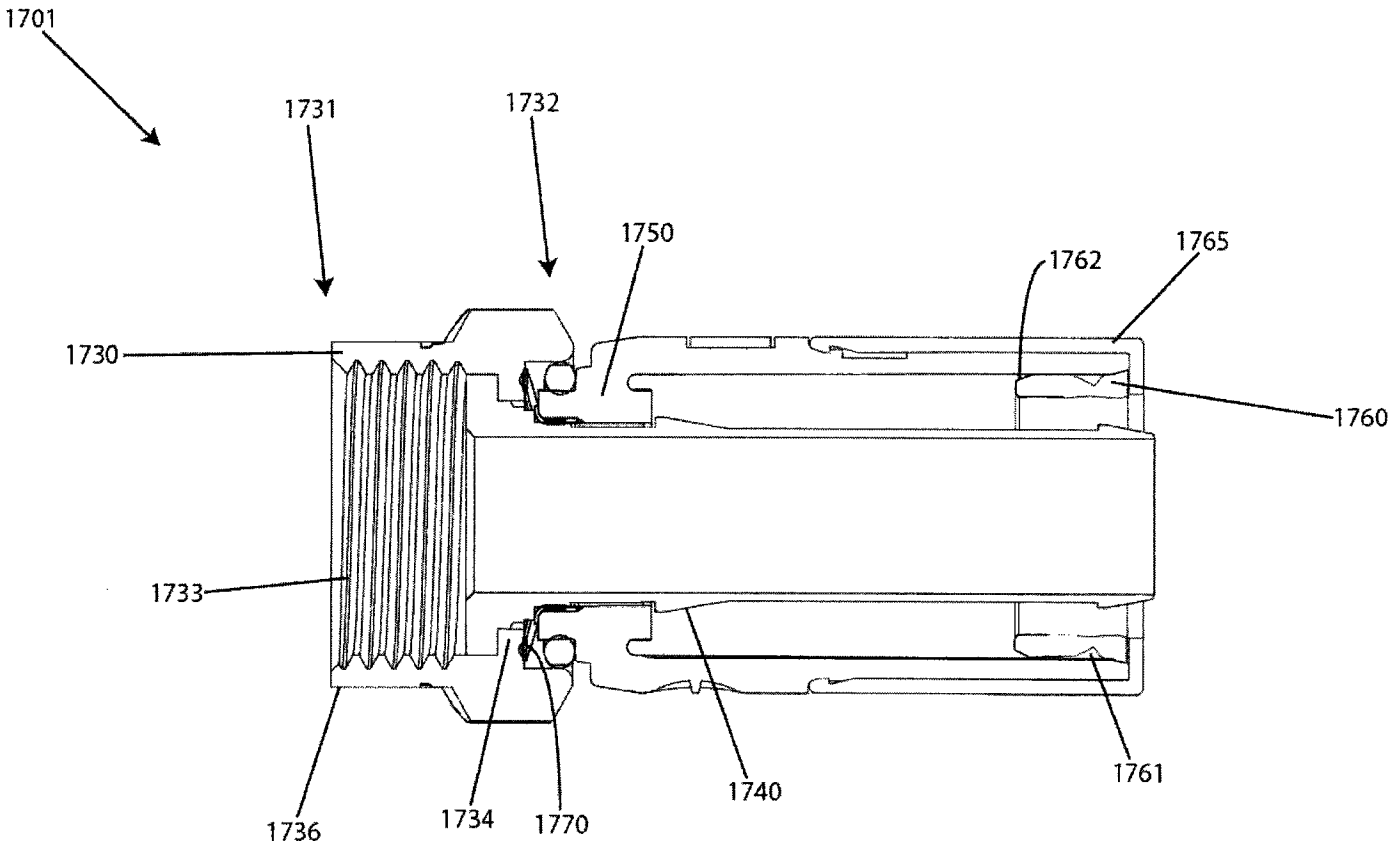
Figure 113:
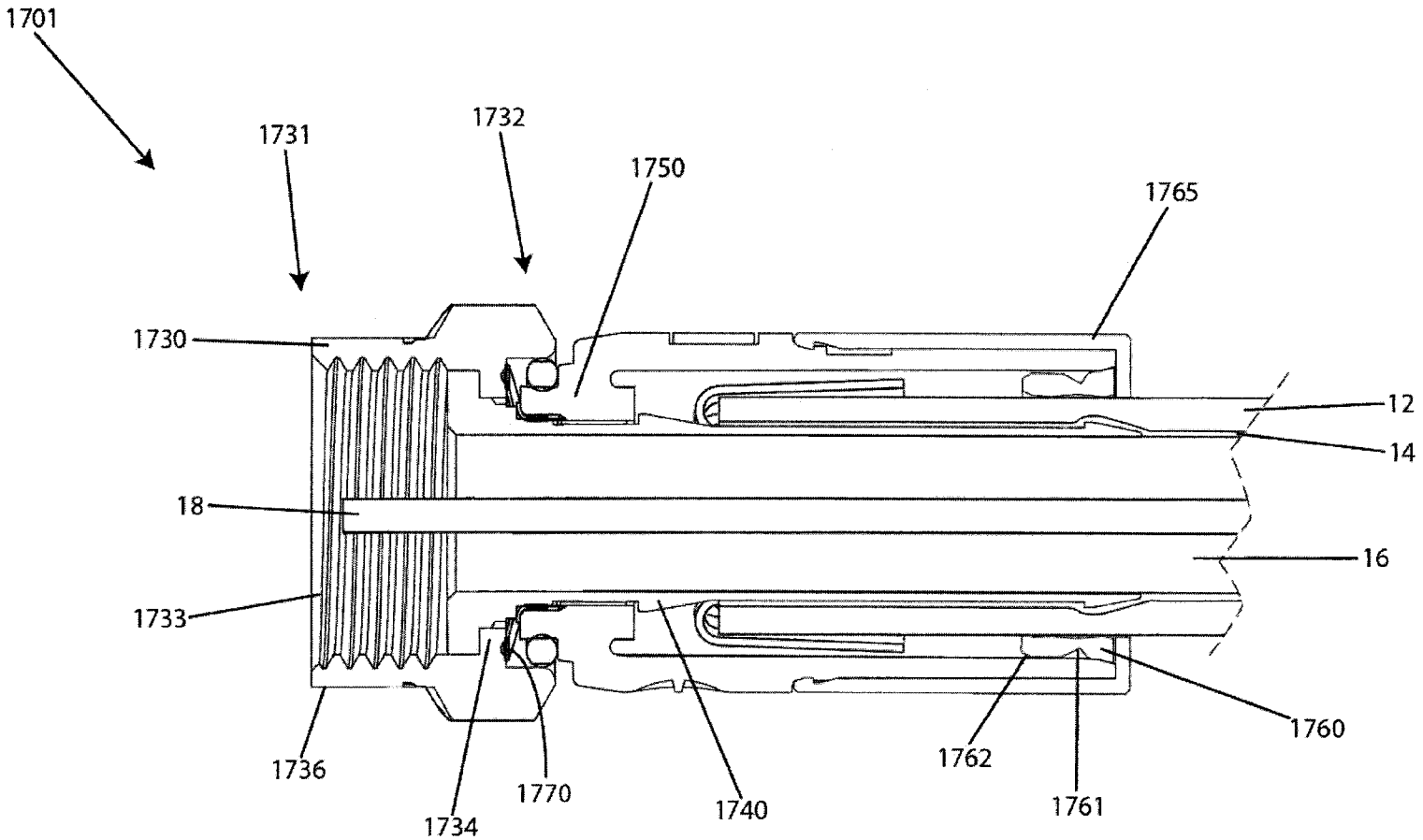
Figure 114:
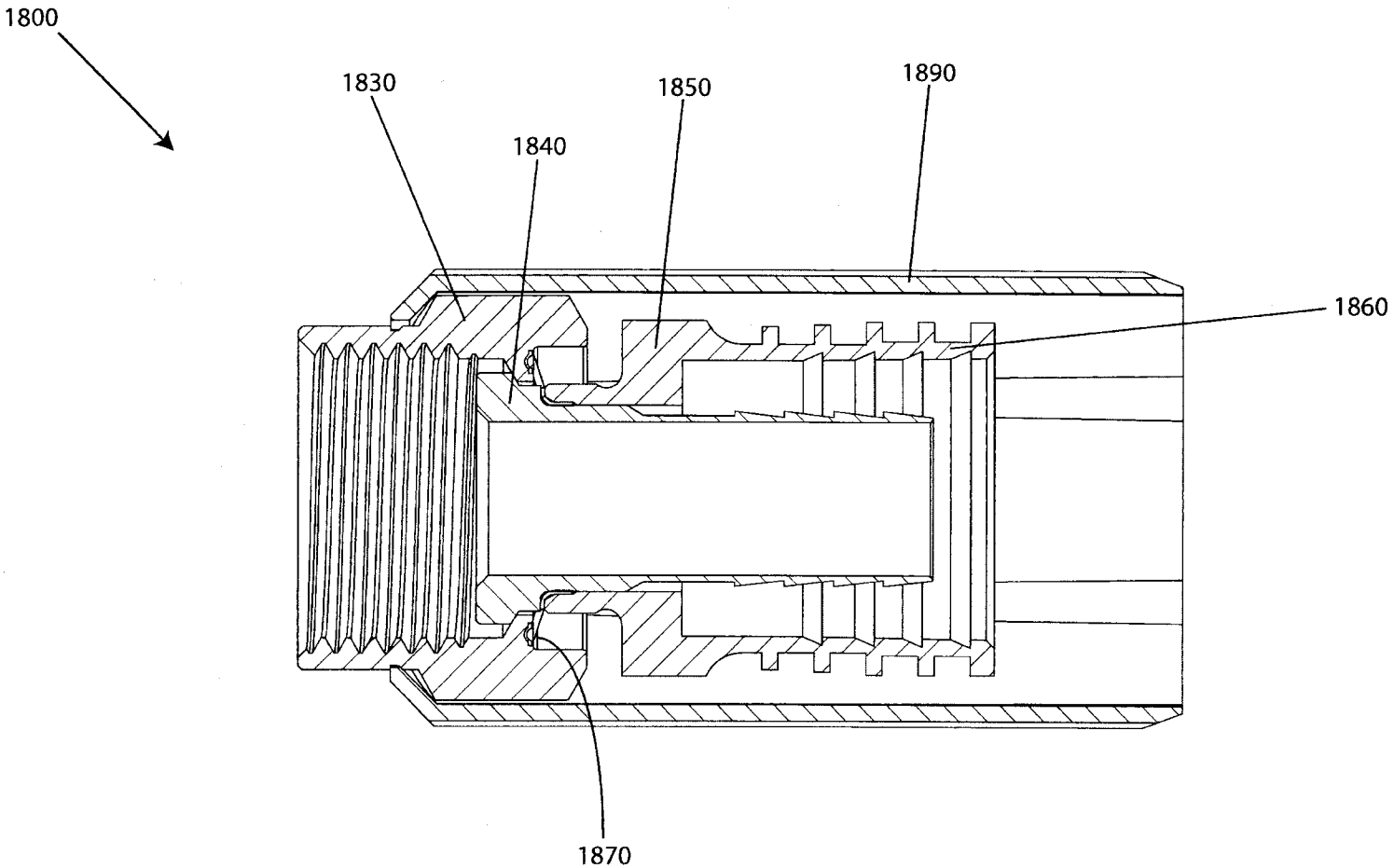
Figure 115:
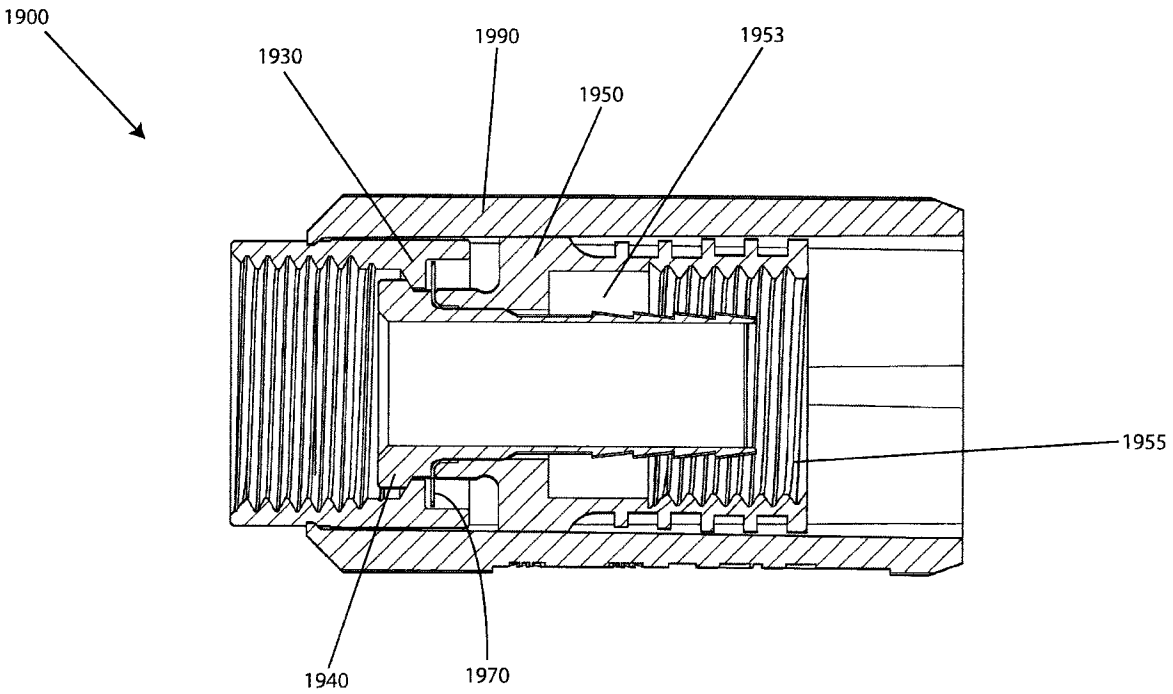

FIG. 112 depicts a cross-section view of the first embodiment of a coaxial cable connector including an embodiment of a continuity member and an embodiment of a compression portion, in a compressed position FIG. 113 depicts a cross-section view of the first embodiment of a coaxial cable connector including an embodiment of a continuity member and an embodiment of a compression portion, in a compressed position on a coaxial cable;

FIG. 114 depicts a cross-section view of a coaxial cable connector including an outer sleeve, a continuity member and an alternate embodiment of a connector body; and FIG. 115 depicts a cross-section view of a first embodiment of a coaxial cable connector including an embodiment of a continuity member, an embodiment of a compression portion, an embodiment of a connector body with internal threads, and an embodiment of a sleeve.

DETAILED DESCRIPTION

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
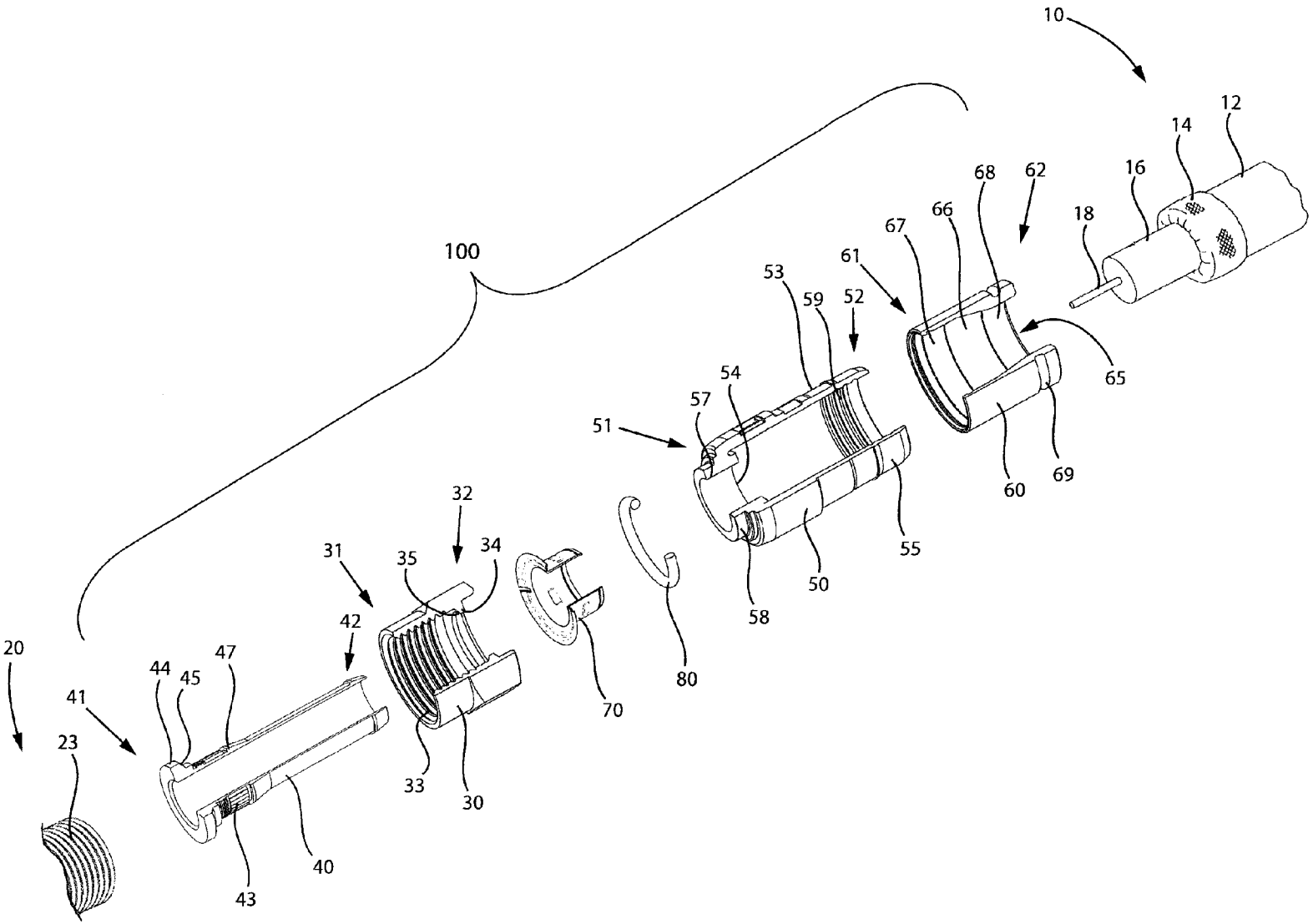
FIG. 1 depicts an exploded perspective cut-away view of an embodiment of the elements of an embodiment of a coaxial cable connector having an embodiment of an electrical continuity member.

Referring to the drawings, FIG. 1 depicts one embodiment of a coaxial cable connector 100 having an embodiment of an electrical continuity member 70. The coaxial cable connector 100 may be operably affixed, or otherwise functionally attached, to a coaxial cable 10 having a protective outer jacket 12, a conductive grounding shield 14, an interior dielectric 16 and a center conductor 18. The coaxial cable 10 may be prepared as embodied in FIG. 1 by removing the protective outer jacket 12 and drawing back the conductive grounding shield 14 to expose a portion of the interior dielectric 16. Further preparation of the embodied coaxial cable 10 may include stripping the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 may be comprised of conductive materials suitable for providing an electrical ground connection, such as cuprous braided material, aluminum foils, thin metallic elements, or other like structures. Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 may be comprised of materials suitable for electrical insulation, such as plastic foam material, paper materials, rubber-like polymers, or other functional insulating materials. It should be noted that the various materials of which all the various components of the coaxial cable 10 are comprised should have some degree of elasticity allowing the cable 10 to flex or bend in accordance with traditional broadband communication standards, installation methods and/or equipment. It should further be recognized that the radial thickness of the coaxial cable 10, protective outer jacket 12, conductive grounding shield 14, interior dielectric 16 and/or center conductor 18 may vary based upon generally recognized parameters corresponding to broadband communication standards and/or equipment.

Referring further to FIG. 1, the connector 100 may also include a coaxial cable interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the receptacle of the port 20 should be formed of a conductive material, such as a metal, like brass, copper, or aluminum. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

Referring still further to FIG. 1, an embodiment of a coaxial cable connector 100 may further comprise a threaded nut 30, a post 40, a connector body 50, a fastener member 60, a continuity member 70 formed of conductive material, and a connector body sealing member 80, such as, for example, a body O-ring configured to fit around a portion of the connector body 50.

The threaded nut 30 of embodiments of a coaxial cable connector 100 has a first forward end 31 and opposing second rearward end 32. The threaded nut 30 may comprise internal threading 33 extending axially from the edge of first forward end 31*a* distance sufficient to provide operably effective threadable contact with the external threads 23 of a standard coaxial cable interface port 20 (as shown, by way of example, in FIG. 20). The threaded nut 30 includes an internal lip 34, such as an annular protrusion, located proximate the second rearward end 32 of the nut. The internal lip 34 includes a surface 35 facing the first forward end 31 of the nut 30. The forward facing surface 35 of the lip 34 may be a tapered surface or side facing the first forward end 31 of the nut 30. The structural configuration of the nut 30 may vary according differing connector design parameters to accommodate different functionality of a coaxial cable connector 100. For instance, the first forward end 31 of the nut 30 may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 31 of a nut 30, when mated with an interface port 20. Moreover, the second rearward end 32, of the nut 30 may extend a significant axial distance to reside radially extent, or otherwise partially surround, a portion of the connector body 50, although the extended portion of the nut 30 need not contact the connector body 50. Those in the art should appreciate that the nut need not be threaded. Moreover, the nut may comprise a coupler commonly used in connecting RCA-type, or BNC-type connectors, or other common coaxial cable connectors having standard coupler interfaces. The threaded nut 30 may be formed of conductive materials, such as copper, brass, aluminum, or other metals or metal alloys, facilitating grounding through the nut 30. Accordingly, the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, combinations thereof, or other fabrication methods that may provide efficient production of the component. The forward facing surface 35 of the nut 30 faces a flange 44 the post 40 when operably assembled in a connector 100, so as to allow the nut to rotate with respect to the other component elements, such as the post 40 and the connector body 50, of the connector 100.

Referring still to FIG. 1, an embodiment of a connector 100 may include a post 40. The post 40 comprises a first forward end 41 and an opposing second rearward end 42. Furthermore, the post 40 may comprise a flange 44, such as an externally extending annular protrusion, located at the first end 41 of the post 40. The flange 44 includes a rearward facing surface 45 that faces the forward facing surface 35 of the nut 30, when operably assembled in a coaxial cable connector 100, so as to allow the nut to rotate with respect to the other component elements, such as the post 40 and the connector body 50, of the connector 100. The rearward facing surface 45 of flange 44 may be a tapered surface facing the second rearward end 42 of the post 40. Further still, an embodiment of the post 40 may include a surface feature 47 such as a lip or protrusion that may engage a portion of a connector body 50 to secure axial movement of the post 40 relative to the connector body 50. However, the post need not include such a surface feature 47, and the coaxial cable connector 100 may rely on press-fitting and friction-fitting forces and/or other component structures having features and geometries to help retain the post 40 in secure location both axially and rotationally relative to the connector body 50. The location proximate or near where the connector body is secured relative to the post 40 may include surface features 43, such as ridges, grooves, protrusions, or knurling, which may enhance the secure attachment and locating of the post 40 with respect to the connector body 50. Moreover, the portion of the post 40 that contacts embodiments of a continuity member 70 may be of a different diameter than a portion of the nut 30 that contacts the connector body 50. Such diameter variance may facilitate assembly processes. For instance, various components having larger or smaller diameters can be readily press-fit or otherwise secured into connection with each other. Additionally, the post 40 may include a mating edge 46, which may be configured to make physical and electrical contact with a corresponding mating edge 26 of an interface port 20 (as shown in exemplary fashion in FIG. 20). The post 40 should be formed such that portions of a prepared coaxial cable 10 including the dielectric 16 and center conductor 18 (examples shown in FIGS. 1 and 20) may pass axially into the second end 42 and/or through a portion of the tube-like body of the post 40. Moreover, the post 40 should be dimensioned, or otherwise sized, such that the post 40 may be inserted into an end of the prepared coaxial cable 10, around the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 should be conductive and may be formed of metals or may be formed of other conductive materials that would facilitate a rigidly formed post body. In addition, the post may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, combinations thereof, or other fabrication methods that may provide efficient production of the component.

Embodiments of a coaxial cable connector, such as connector 100, may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. The internal surface of the post mounting portion 57 may include an engagement feature 54 that facilitates the secure location of a continuity member 70 with respect to the connector body 50 and/or the post 40, by physically engaging the continuity member 70 when assembled within the connector 100. The engagement feature 54 may simply be an annular detent or ridge having a different diameter than the rest of the post mounting portion 57. However other features such as grooves, ridges, protrusions, slots, holes, keyways, bumps, nubs, dimples, crests, rims, or other like structural features may be included to facilitate or possibly assist the positional retention of embodiments of electrical continuity member 70 with respect to the connector body 50. Nevertheless, embodiments of a continuity member 70 may also reside in a secure position with respect to the connector body 50 simply through press-fitting and friction-fitting forces engendered by corresponding tolerances, when the various coaxial cable connector 100 components are operably assembled, or otherwise physically aligned and attached together. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features 59, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61 and opposing second end 62. In addition, the fastener member 60 may include an internal annular protrusion 63 (see FIG. 20) located proximate the first end 61 of the fastener member 60 and configured to mate and achieve purchase with the annular detent 53 on the outer surface 55 of connector body 50 (shown again, by way of example, in FIG. 20). Moreover, the fastener member 60 may comprise a central passageway 65 defined between the first end 61 and second end 62 and extending axially through the fastener member 60. The central passageway 65 may comprise a ramped surface 66 which may be positioned between a first opening or inner bore 67 having a first diameter positioned proximate with the first end 61 of the fastener member 60 and a second opening or inner bore 68 having a second diameter positioned proximate with the second end 62 of the fastener member 60. The ramped surface 66 may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 (such as shown, by way of example, in FIG. 20) may also be similar to the way a cable is fastened to connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50. A coupler or nut 30 at the front end of the inner post 40 serves to attach the connector 100 to an interface port. In a connector having an insertable compression sleeve, the structural configuration and functional operation of the nut 30 may be similar to the structure and functionality of similar components of a connector 100 described in FIGS. 1-20, and having reference numerals denoted similarly.

Figure 2:
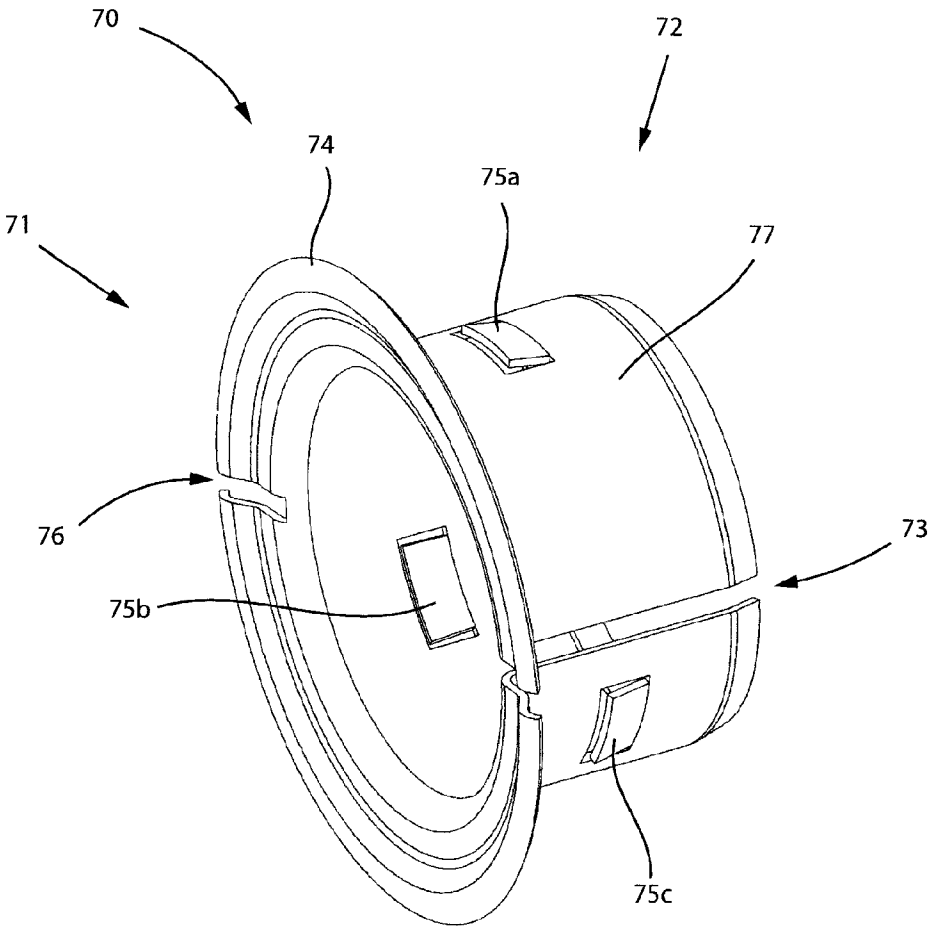
FIG. 2 depicts a perspective view of an embodiment of the electrical continuity member depicted in FIG. 1.
Figure 3:
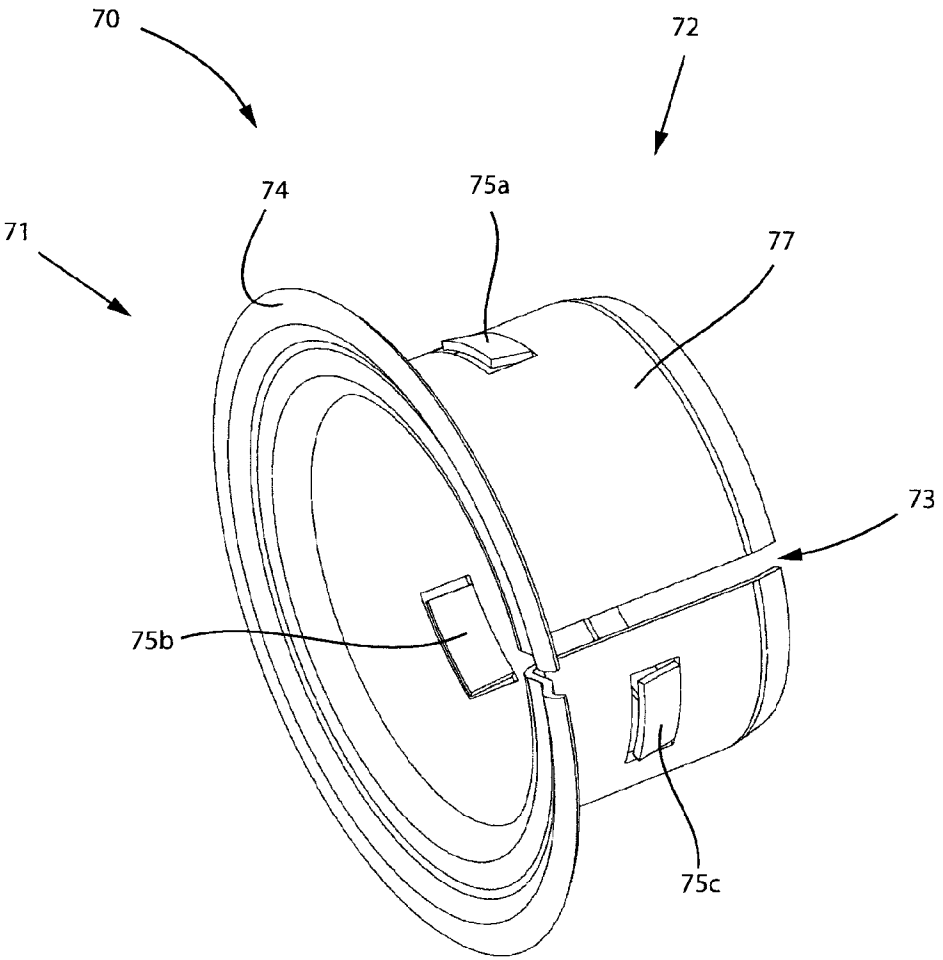
FIG. 3 depicts a perspective view of a variation of the embodiment of the electrical continuity member depicted in FIG. 1, without a flange cutout.
Figure 4:
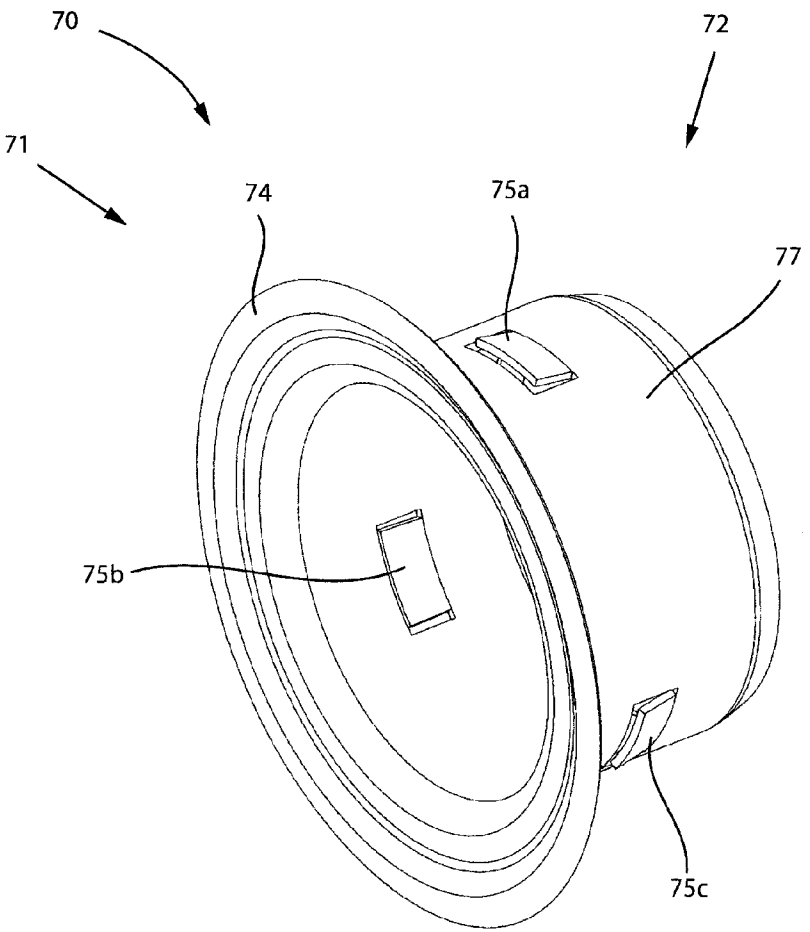
FIG. 4 depicts a perspective view of a variation of the embodiment of the electrical continuity member depicted in FIG. 1, without a flange cutout or a through-slit.

Turning now to FIGS. 2-4, variations of an embodiment of an electrical continuity member 70 are depicted. A continuity member 70 is conductive. The continuity member may have a first end 71 and an axially opposing second end 72. Embodiments of a continuity member 70 include a post contact portion 77. The post contact portion 77 makes physical and electrical contact with the post 40, when the coaxial cable connector 100 is operably assembled, and helps facilitate the extension of electrical ground continuity through the post 40. As depicted in FIGS. 2-4, the post contact portion 77 comprises a substantially cylindrical body that includes an inner dimension corresponding to an outer dimension of a portion of the post 40. A continuity member 70 may also include a securing member 75 or a plurality of securing members, such as the tabs 75*a-c*, which may help to physically secure the continuity member 70 in position with respect to the post 40 and/or the connector body 50. The securing member 75 may be resilient and, as such, may be capable of exerting spring-like force on operably adjoining coaxial cable connector 100 components, such as the post 40. Embodiments of a continuity member 70 include a nut contact portion 74. The nut contact portion 74 makes physical and electrical contact with the nut 30, when the coaxial cable connector 100 is operably assembled or otherwise put together in a manner that renders the connector 100 functional, and helps facilitate the extension of electrical ground continuity through the nut 30. The nut contact portion 74 may comprise a flange-like element that may be associated with various embodiments of a continuity member 70. In addition, as depicted in FIGS. 2-3, various embodiments of a continuity member 70 may include a through-slit 73. The through-slit 73 extends through the entire continuity member 70. Furthermore, as depicted in FIG. 2, various embodiments of a continuity member 70 may include a flange cutout 76 located on a flange-like nut contact portion 74 of the continuity member 70. A continuity member 70 is formed of conductive materials. Moreover, embodiments of a continuity member 70 may exhibit resiliency, which resiliency may be facilitated by the structural configuration of the continuity member 70 and the material make-up of the continuity member 70.

Embodiments of a continuity member 70 may be formed, shaped, fashioned, or otherwise manufactured via any operable process that will render a workable component, wherein the manufacturing processes utilized to make the continuity member may vary depending on the structural configuration of the continuity member. For example, a continuity member 70 having a through-slit 73 may be formed from a sheet of material that may be stamped and then bent into an operable shape that allows the continuity member 70 to function as it was intended. The stamping may accommodate various operable features of the continuity member 70. For instance, the securing member 75, such as tabs 75*a-c*, may be cut during the stamping process. Moreover, the flange cutout 76 may also be rendered during a stamping process. Those in the art should appreciate that various other surface features may be provided on the continuity member 70 through stamping or by other manufacturing and shaping means. Accordingly, it is contemplated that features of the continuity member 70 may be provided to mechanically interlock or interleave, or otherwise operably physically engage complimentary and corresponding features of embodiments of a nut 30, complimentary and corresponding features of embodiments of a post 40, and/or complimentary and corresponding features of embodiments of a connector body 50. The flange cutout 76 may help facilitate bending that may be necessary to form a flange-like nut contact member 74. However, as is depicted in FIG. 3, embodiments of a continuity member 70 need not have a flange cutout 76. In addition, as depicted in FIG. 4, embodiments of a continuity member 70 need also not have a through-slit 73. Such embodiments may be formed via other manufacturing methods. Those in the art should appreciate that manufacture of embodiments of a continuity member 70 may include casting, extruding, cutting, knurling, turning, coining, tapping, drilling, bending, rolling, forming, component overmolding, combinations thereof, or other fabrication methods that may provide efficient production of the component.

Figure 5:
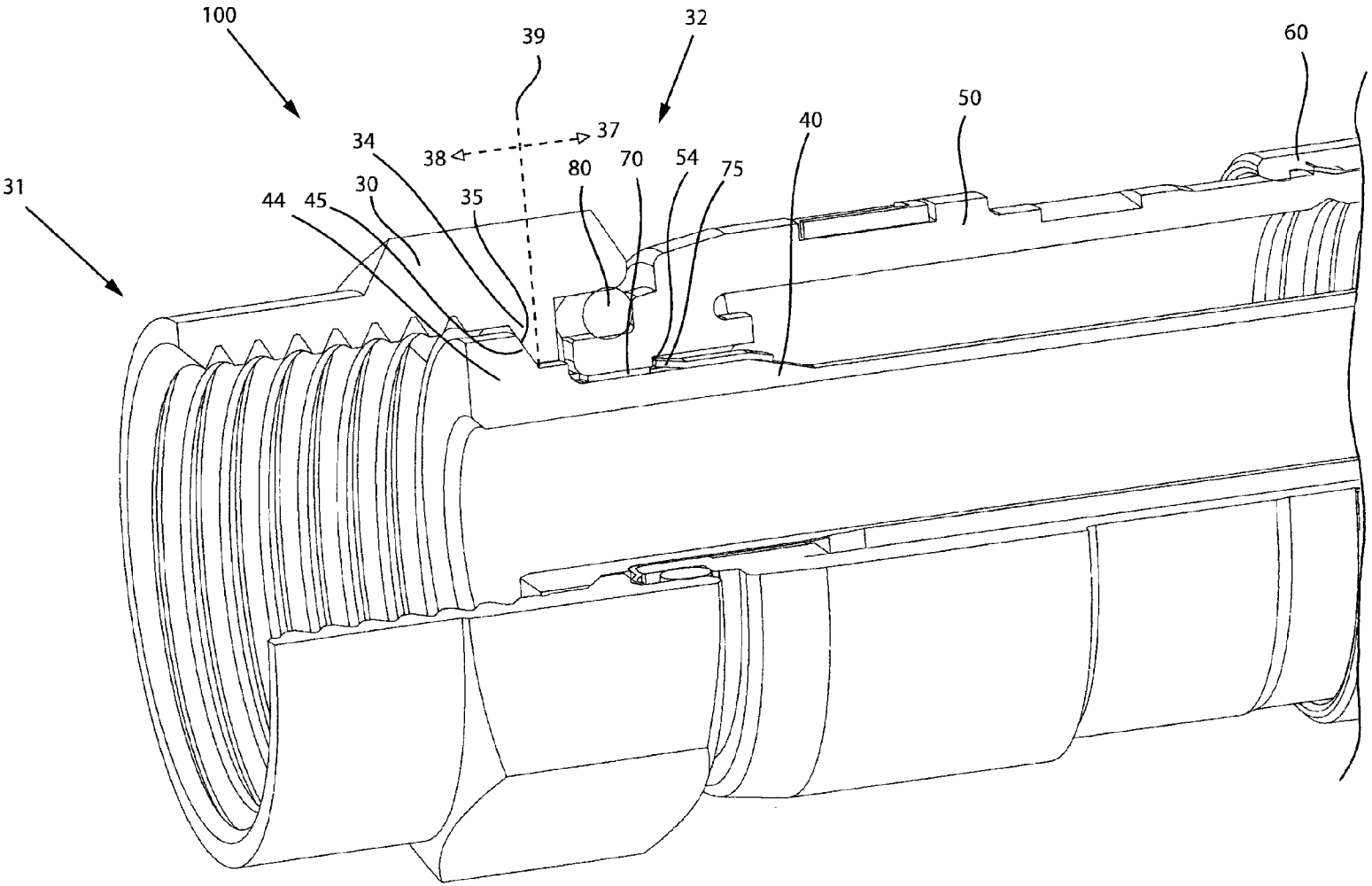
FIG. 5 depicts a perspective cut-away view of a portion of the embodiment of a coaxial cable connector having an electrical continuity member of FIG. 1, as assembled.
Figure 6:
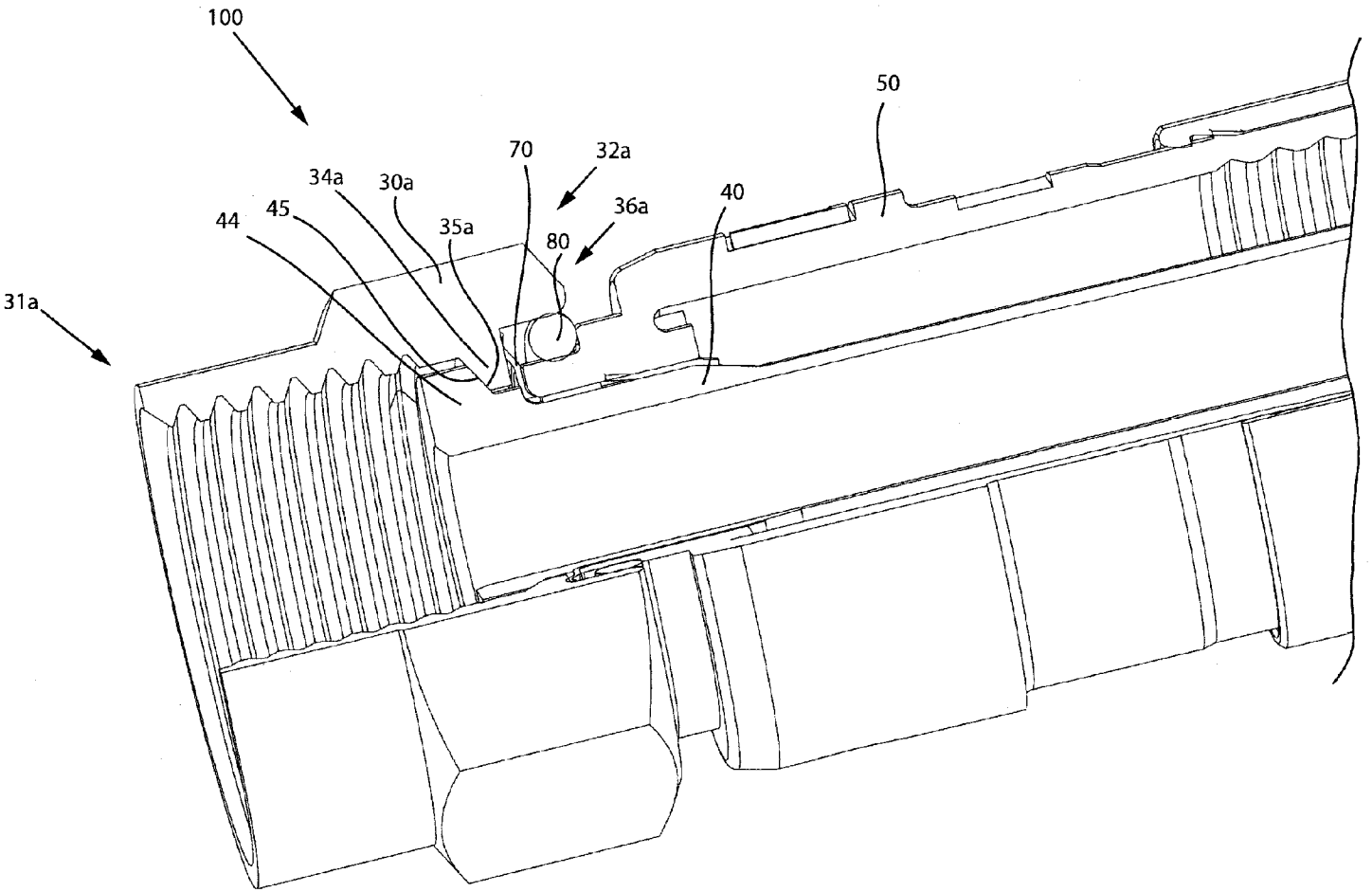
FIG. 6 depicts a perspective cut-away view of a portion of an assembled embodiment of a coaxial cable connector having an electrical continuity member and a shortened nut.
Figure 7:
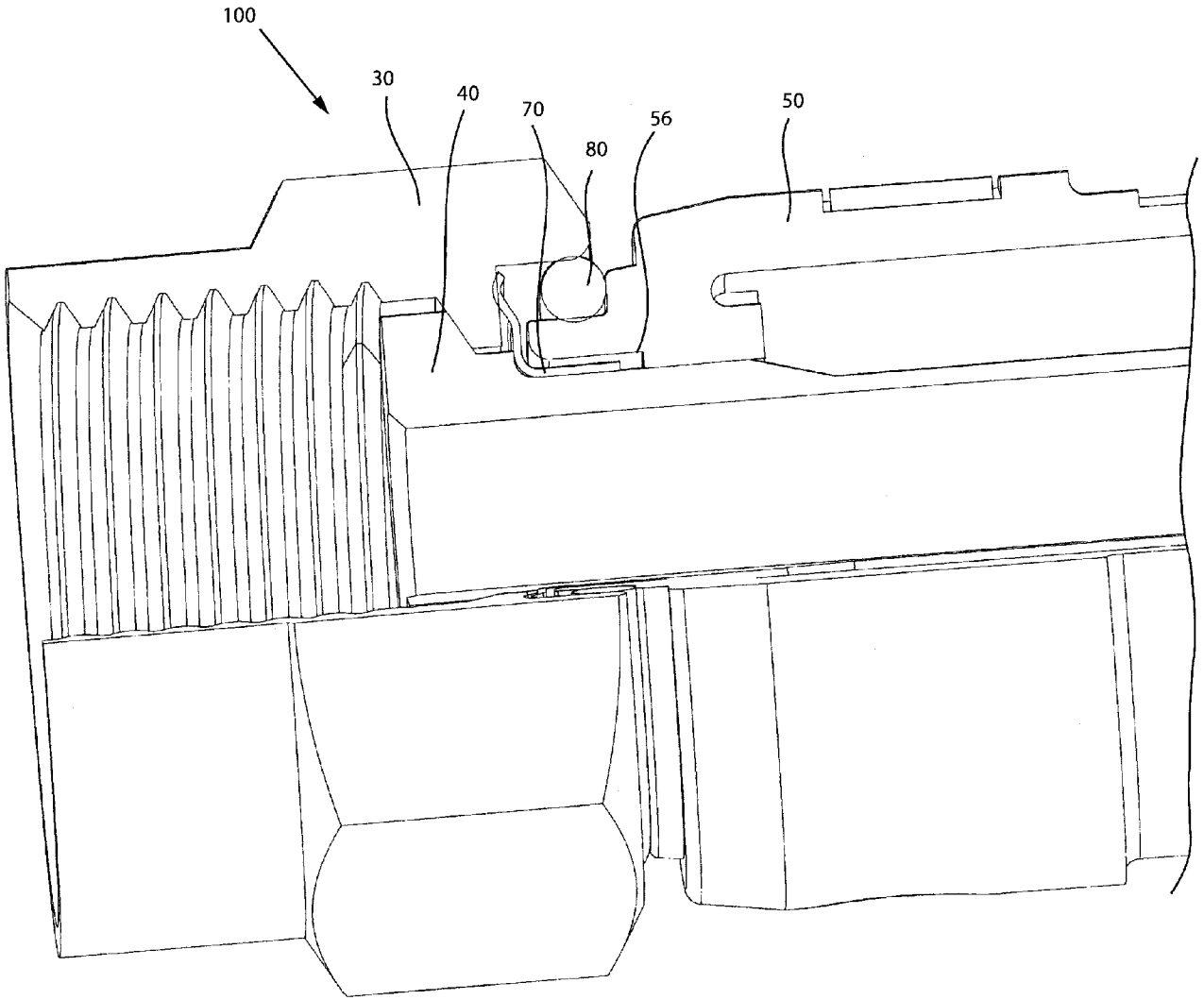
FIG. 7 depicts a perspective cut-away view of a portion of an assembled embodiment of a coaxial cable connector having an electrical continuity member that does not touch the connector body.
Figure 8:
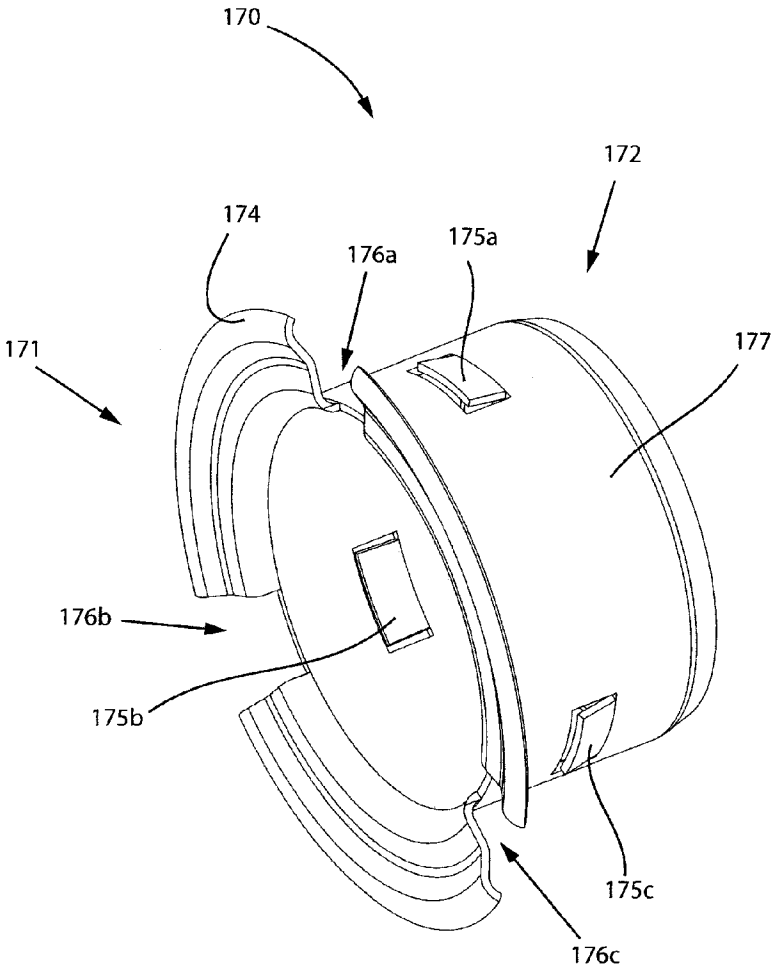
FIG. 8 depicts a perspective view of another embodiment of an electrical continuity member.
Figure 9:
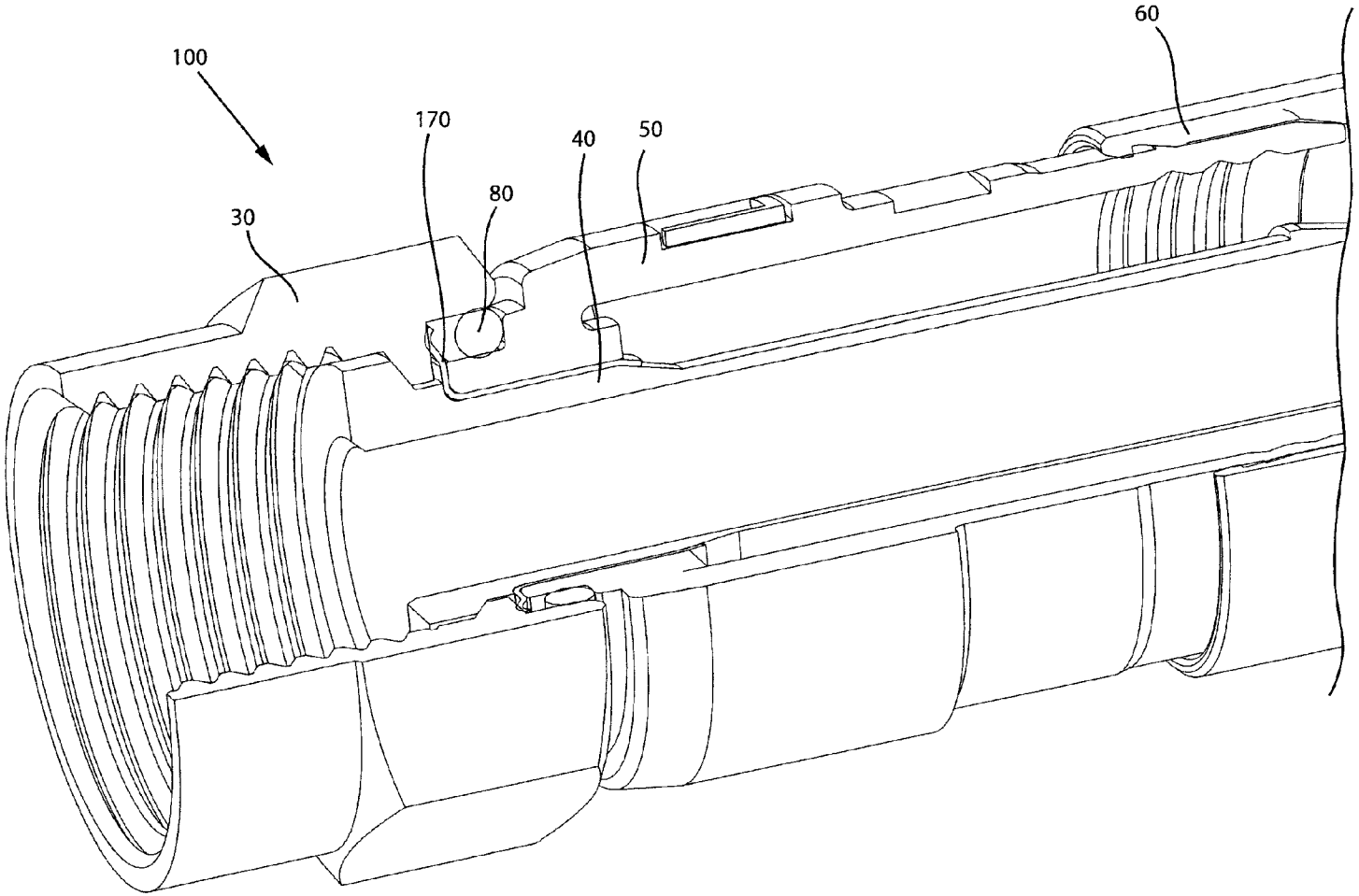
FIG. 9 depicts a perspective cut-away view of a portion of an assembled embodiment of a coaxial cable connector having the electrical continuity member of FIG. 8.
Figure 10:
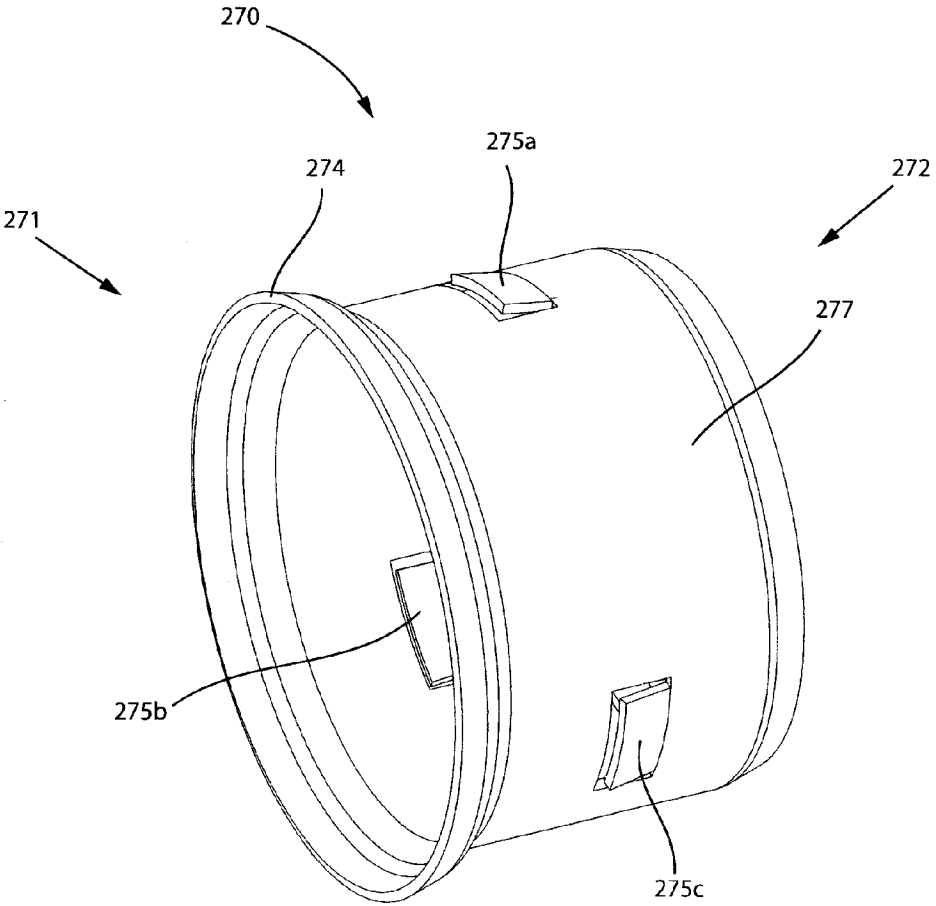
FIG. 10 depicts a perspective view of a further embodiment of an electrical continuity member.
Figure 11:
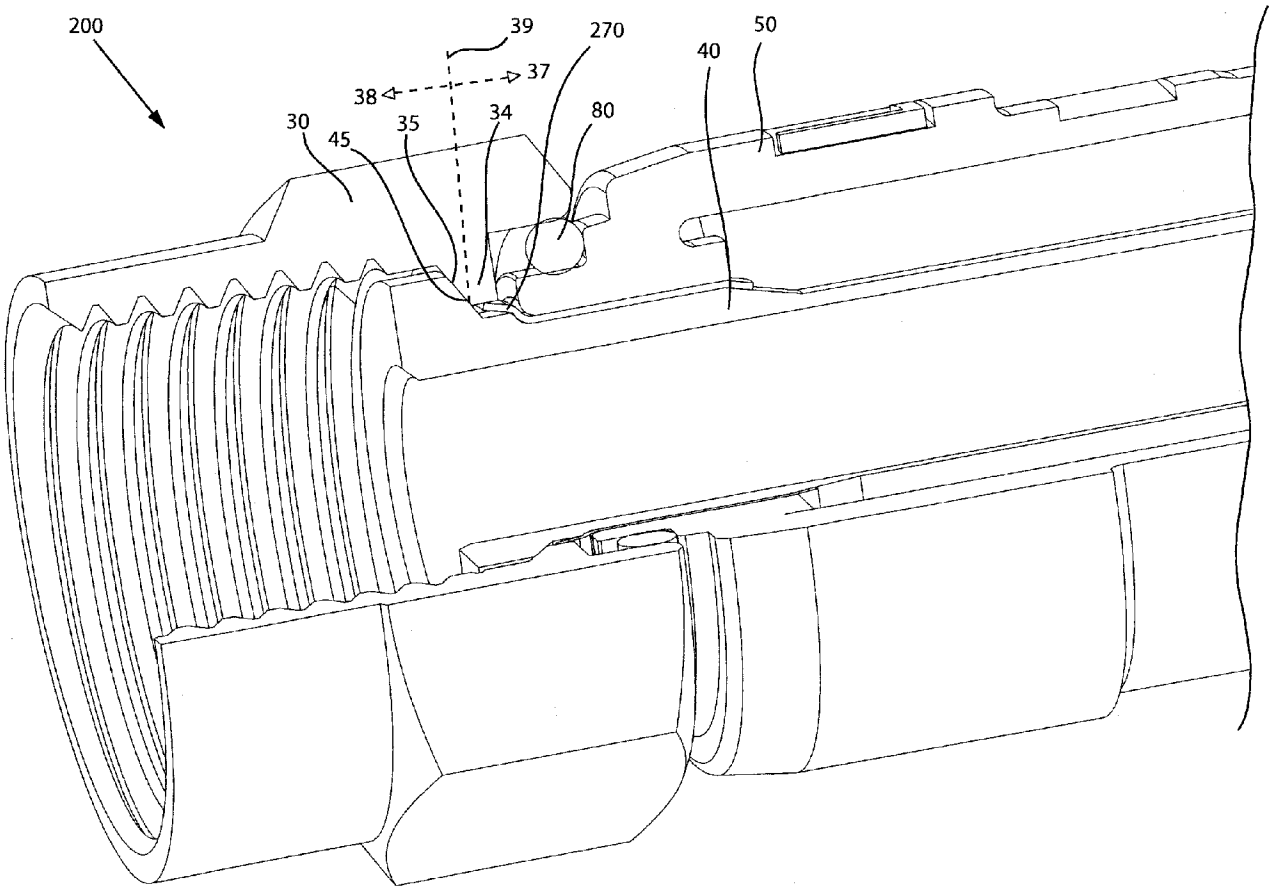
FIG. 11 depicts a perspective cut-away view of a portion of an assembled embodiment of a coaxial cable connector having the electrical continuity member of FIG. 10.
Figure 12:
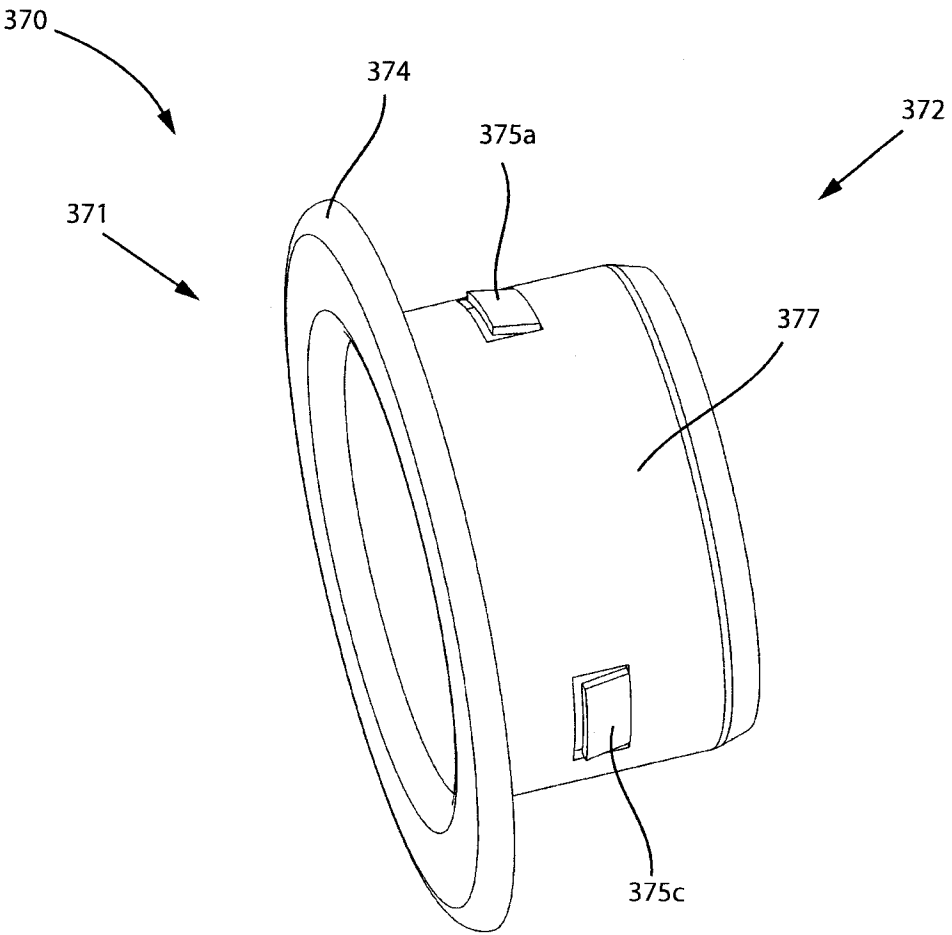
FIG. 12 depicts a perspective view of still another embodiment of an electrical continuity member.
Figure 13:
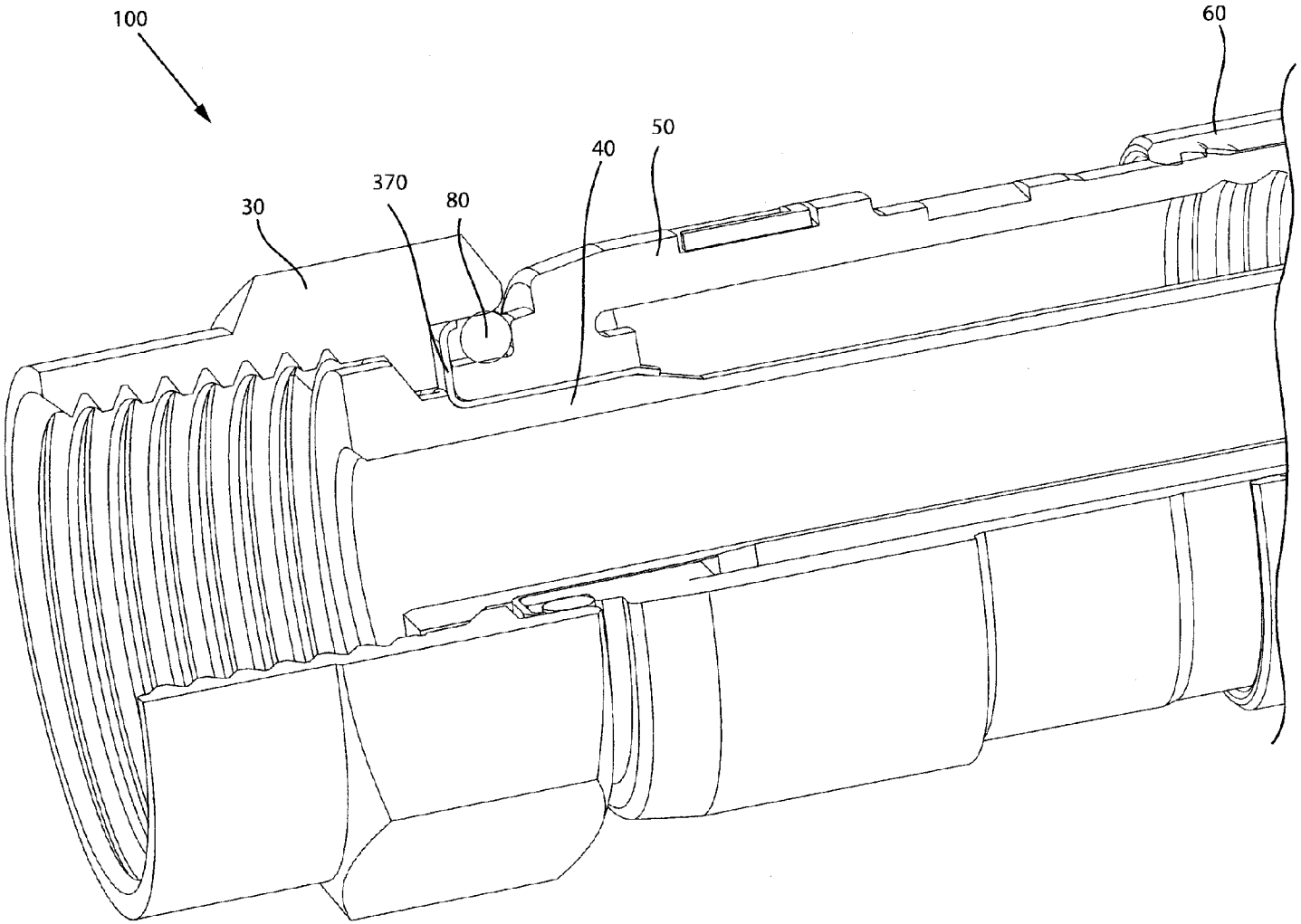
FIG. 13 depicts a perspective cut-away view of a portion of an assembled embodiment of a coaxial cable connector having the electrical continuity member of FIG. 12.
Figure 14:
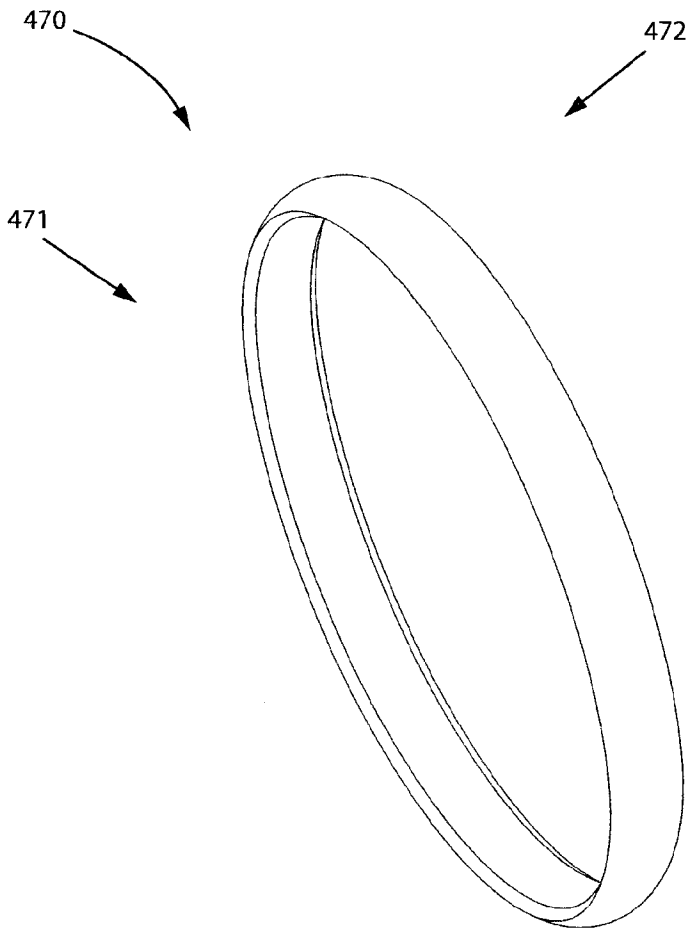
FIG. 14 depicts a perspective view of a still further embodiment of an electrical continuity member.
Figure 15:
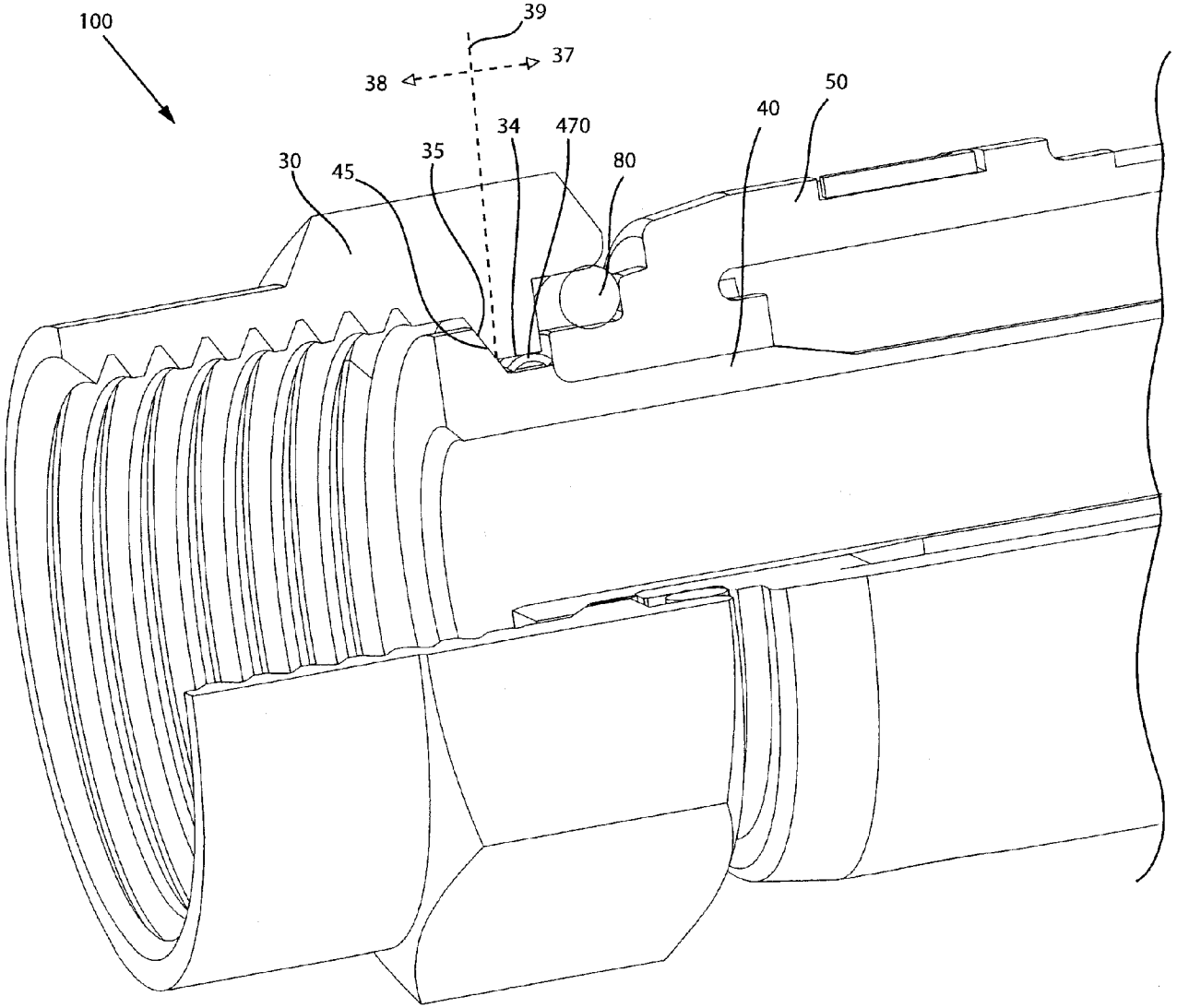
FIG. 15 depicts a perspective cut-away view of a portion of an assembled embodiment of a coaxial cable connector having the electrical continuity member of FIG. 14.
Figure 16:
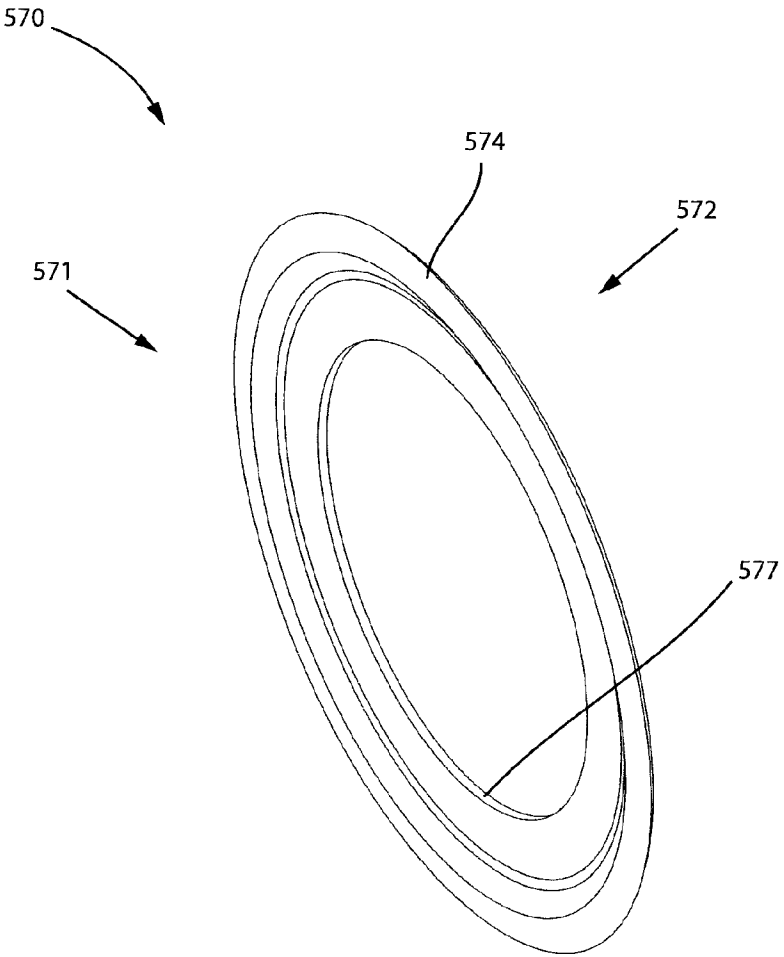
FIG. 16 depicts a perspective view of even another embodiment of an electrical continuity member.
Figure 17:
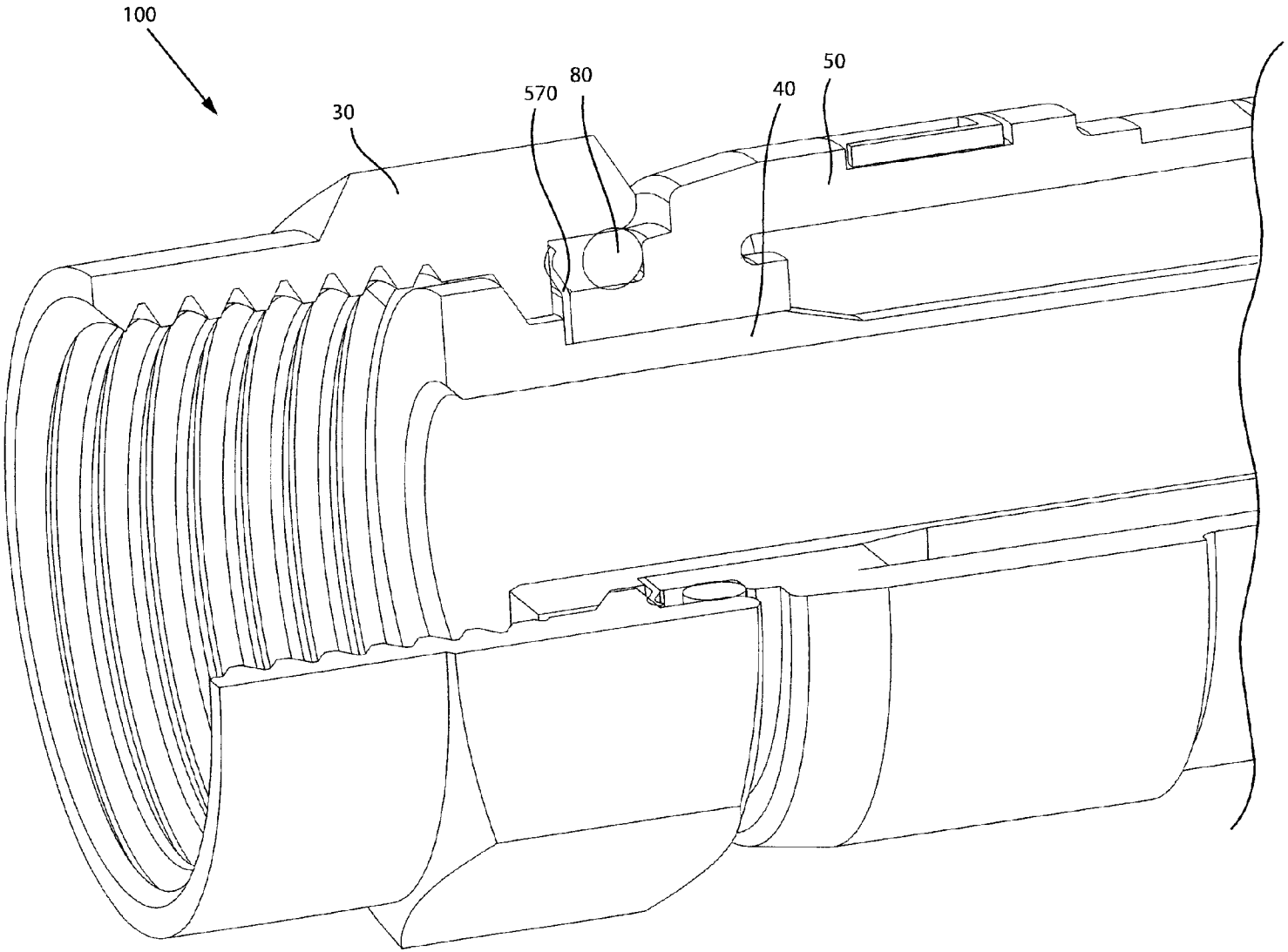
FIG. 17 depicts a perspective cut-away view of a portion of an assembled embodiment of a coaxial cable connector having the electrical continuity member of FIG. 16.
Figure 18:
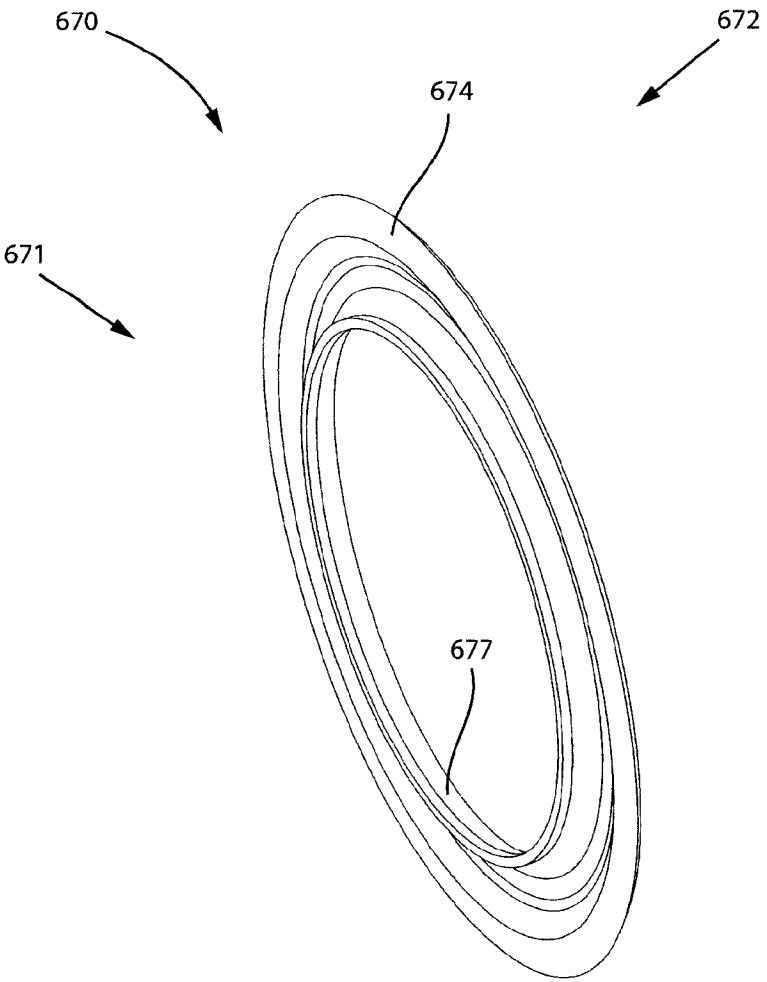
FIG. 18 depicts a perspective view of still even a further embodiment of an electrical continuity member.
Figure 19:
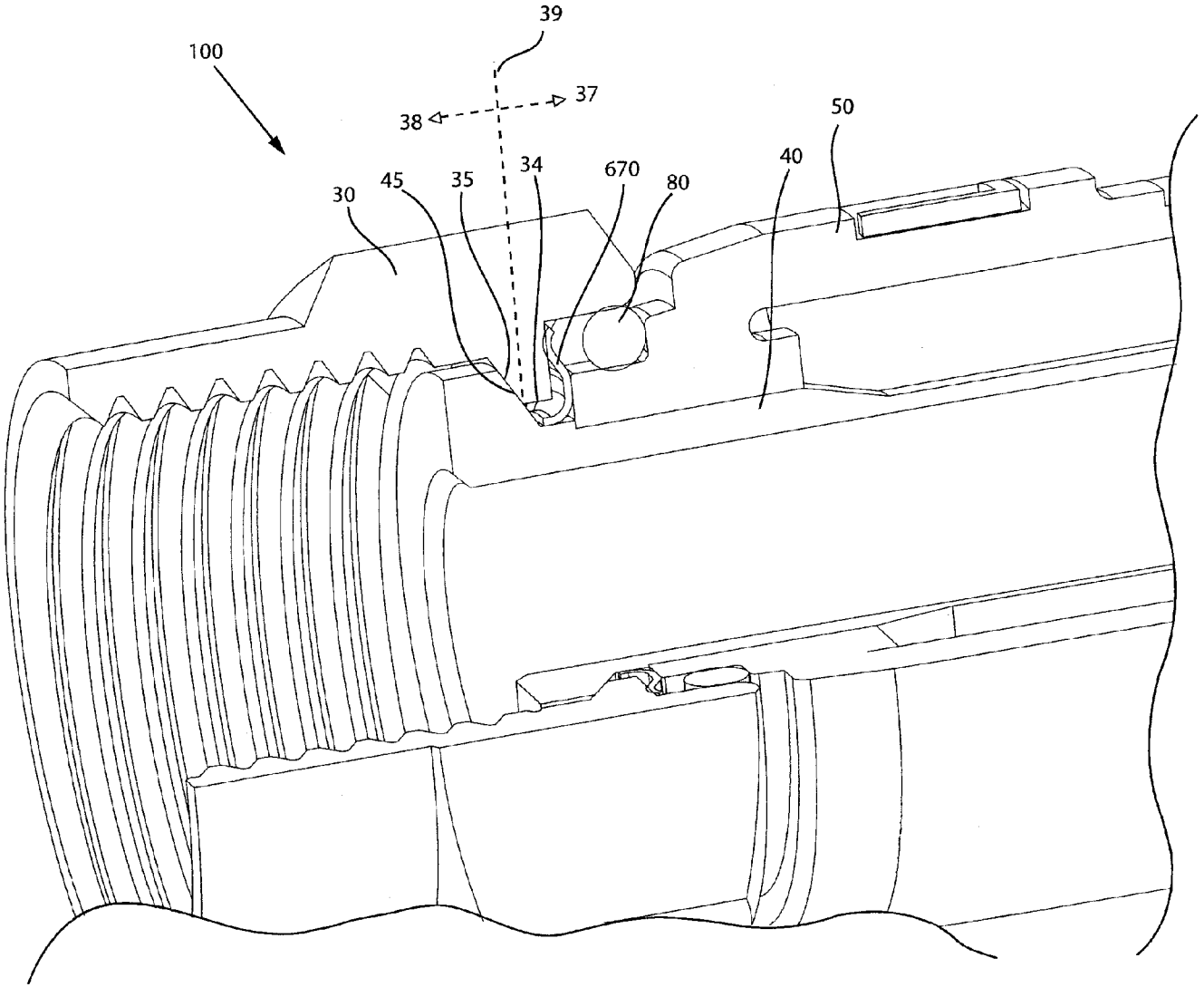
FIG. 19 depicts a perspective cut-away view of a portion of an assembled embodiment of a coaxial cable connector having the electrical continuity member of FIG. 18.

With continued reference to the drawings, FIGS. 5-7 depict perspective cut-away views of portions of embodiments of coaxial cable connectors 100 having an electrical continuity member 70, as assembled. In particular, FIG. 6 depicts a coaxial cable connector embodiment 100 having a shortened nut 30*a*, wherein the second rearward end 32*a* of the nut 30*a* does not extend as far as the second rearward end 32 of nut 30 depicted in FIG. 5. FIG. 7 depicts a coaxial cable connector embodiment 100 including an electrical continuity member 70 that does not touch the connector body 50, because the connector body 50 includes an internal detent 56 that, when assembled, ensures a physical gap between the continuity member 70 and the connector body 50. A continuity member 70 may be positioned around an external surface of the post 40 during assembly, while the post 40 is axially inserted into position with respect to the nut 30. The continuity member 70 should have an inner diameter sufficient to allow it to move up a substantial length of the post body 40 until it contacts a portion of the post 40 proximate the flange 44 at the first end 41 of the post 40.

The continuity member 70 should be configured and positioned so that, when the coaxial cable connector 100 is assembled, the continuity member 70 resides rearward a second end portion 37 of the nut 30, wherein the second end portion 37 starts at a side 35 of the lip 34 of the nut facing the first end 31 of the nut 30 and extends rearward to the second end 32 of the nut 30. The location or the continuity member 70 within a connector 100 relative to the second end portion 37 of the nut being disposed axially rearward of a surface 35 of the internal lip 34 of the nut 30 that faces the flange 44 of the post 40. The second end portion 37 of the nut 30 extends from the second rearward end 32 of the nut 30 to the axial location of the nut 30 that corresponds to the point of the forward facing side 35 of the internal lip 34 that faces the first forward end 31 of the nut 30 that is also nearest the second end 32 of the nut 30. Accordingly, the first end portion 38 of the nut 30 extends from the first end 31 of the nut 30 to that same point of the forward facing side 35 of the lip 34 that faces the first forward end 31 of the nut 30 that is nearest the second end 32 of the nut 30. For convenience, dashed line 39 shown in FIG. 5, depicts the axial point and a relative radial perpendicular plane defining the demarcation of the first end portion 38 and the second end portion 37 of embodiments of the nut 30. As such, the continuity member 70 does not reside between opposing complimentary surfaces 35 and 45 of the lip 34 of the nut 30 and the flange 44 of the post 40. Rather, the continuity member 70 contacts the nut 30 at a location rearward and other than on the side 35 of the lip 34 of the nut 30 that faces the flange 44 of the post 40, at a location only pertinent to and within the second end 37 portion of the nut 30.

With further reference to FIGS. 5-7, a body sealing member 80, such as an O-ring, may be located proximate the second end portion 37 of the nut 30 in front of the internal lip 34 of the nut 30, so that the sealing member 80 may compressibly rest or be squeezed between the nut 30 and the connector body 50. The body sealing member 80 may fit snugly over the portion of the body 50 corresponding to the annular recess 58 proximate the first end 51 of the body 50. However, those in the art should appreciate that other locations of the sealing member 80 corresponding to other structural configurations of the nut 30 and body 50 may be employed to operably provide a physical seal and barrier to ingress of environmental contaminants. For example, embodiments of a body sealing member 80 may be structured and operably assembled with a coaxial cable connector 100 to prevent contact between the nut 30 and the connector body 50.

When assembled, as in FIGS. 5-7, embodiments of a coaxial cable connector 100 may have axially secured components. For example, the body 50 may obtain a physical fit with respect to the continuity member 70 and portions of the post 40, thereby securing those components together both axially and rotationally. This fit may be engendered through press-fitting and/or friction-fitting forces, and/or the fit may be facilitated through structures which physically interfere with each other in axial and/or rotational configurations. Keyed features or interlocking structures on any of the post 40, the connector body 50, and/or the continuity member 70, may also help to retain the components with respect to each other. For instance, the connector body 50 may include an engagement feature 54, such as an internal ridge that may engage the securing member(s) 75, such as tabs 75*a-c*, to foster a configuration wherein the physical structures, once assembled, interfere with each other to prevent axial movement with respect to each other. Moreover, the same securing structure(s) 75, or other structures, may be employed to help facilitate prevention of rotational movement of the component parts with respect to each other. Additionally, the flange 44 of the post 40 and the internal lip 34 of the nut 30 work to restrict axial movement of those two components with respect to each other toward each other once the lip 34 has contact the flange 44. However, the assembled configuration should not prevent rotational movement of the nut 30 with respect to the other coaxial cable connector 100 components. In addition, when assembled, the fastener member 60 may be secured to a portion of the body 50 so that the fastener member 60 may have some slidable axial freedom with respect to the body 50, thereby permitting operable attachment of a coaxial cable 10. Notably, when embodiments of a coaxial cable connector 100 are assembled, the continuity member 70 is disposed at the second end portion 37 of the nut 30, so that the continuity member 70 physically and electrically contacts both the nut 30 and the post 40, thereby extending ground continuity between the components.

With continued reference to the drawings, FIGS. 8-19 depict various continuity member embodiments 170-670 and show how those embodiments are secured within coaxial cable connector 100 embodiments, when assembled. As depicted, continuity members may vary in shape and functionality. However, all continuity members have at least a conductive portion and all reside rearward of the forward facing surface 35 of the internal lip 34 of the nut 30 and rearward the start of the second end portion 37 of the nut 30 of each coaxial cable connector embodiment 100 into which they are assembled. For example, a continuity member embodiment 170 may have multiple flange cutouts 176*a-c*. A continuity member embodiment 270 includes a nut contact portion 274 configured to reside radially between the nut 30 and the post 40 rearward the start of the second end portion 37 of the nut 30, so as to be rearward of the forward facing surface 35 of the internal lip 34 of the nut. A continuity member embodiment 370 is shaped in a manner kind of like a top hat, wherein the nut contact portion 374 contacts a portion of the nut 30 radially between the nut 30 and the connector body 50. A continuity member embodiment 470 resides primarily radially between the innermost part of the lip 34 of nut 30 and the post 40, within the second end portion 37 of the nut 30. In particular, the nut 30 of the coaxial cable connector 100 having continuity member 470 does not touch the connector body 50 of that same coaxial cable connector 100. A continuity member embodiment 570 includes a post contact portion 577, wherein only a radially inner edge of the continuity member 570, as assembled, contacts the post 40. A continuity member embodiment 670 includes a post contact portion that resides radially between the lip 34 of the nut 30 and the post 40, rearward the start of the second end portion 37 of the nut 30.

Figure 20:
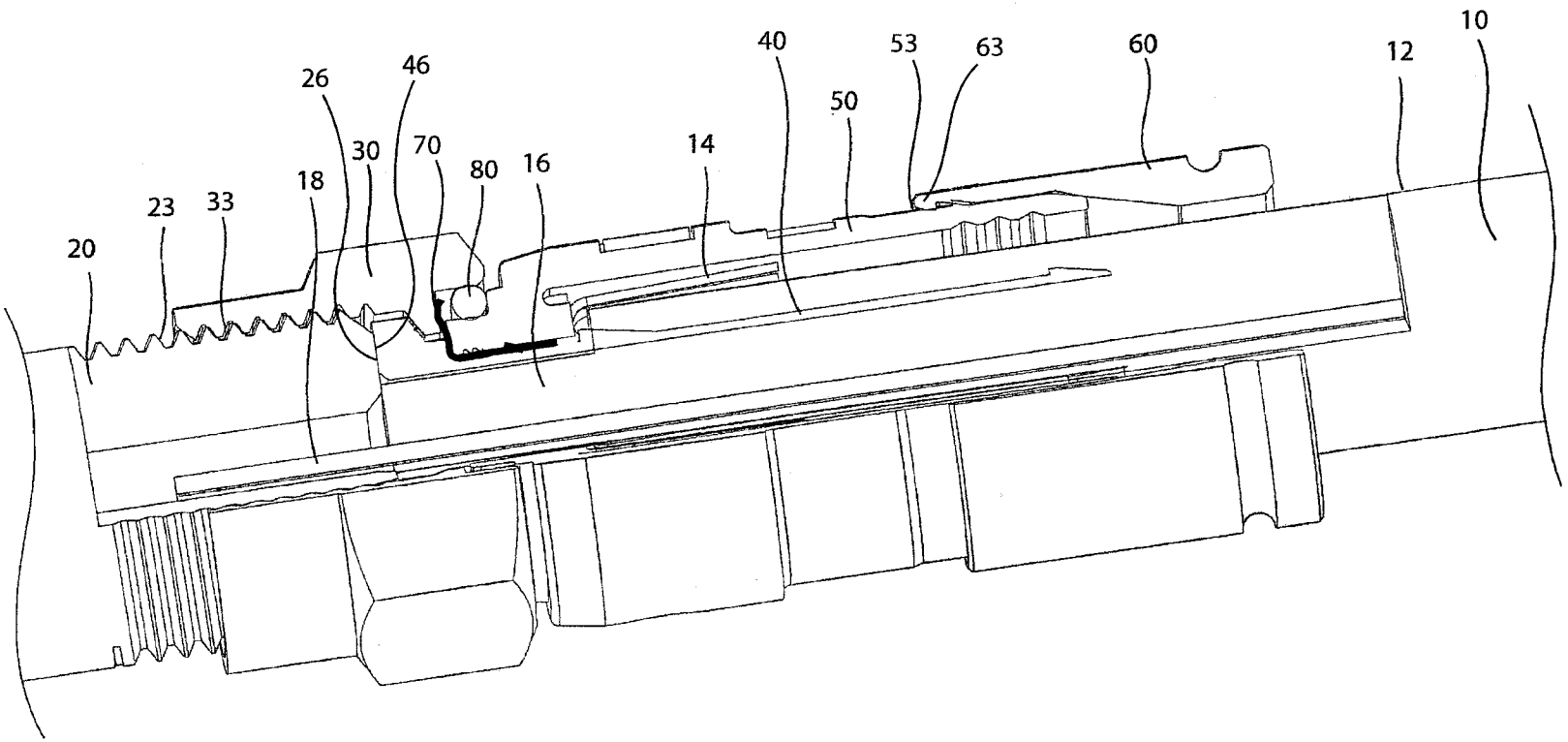
FIG. 20 depicts a perspective cut-away view of an embodiment of a coaxial cable connector including an electrical continuity member and having an attached coaxial cable, the connector mated to an interface port.

Turning now to FIG. 20, an embodiment of a coaxial cable connector 100 is depicted in a mated position on an interface port 20. As depicted, the coaxial cable connector 100 is fully tightened onto the interface port 20 so that the mating edge 26 of the interface port 20 contacts the mating edge 46 of the post 40 of the coaxial cable connector 100. Such a fully tightened configuration provides optimal grounding performance of the coaxial cable connector 100. However, even when the coaxial connector 100 is only partially installed on the interface port 20, the continuity member 70 maintains an electrical ground path between the mating port 20 and the outer conductive shield (ground 14) of cable 10. The ground path extends from the interface port 20 to the nut 30, to the continuity member 70, to the post 40, to the conductive grounding shield 14. Thus, this continuous grounding path provides operable functionality of the coaxial cable connector 100 allowing it to work as it was intended even when the connector 100 is not fully tightened.

Figure 21:
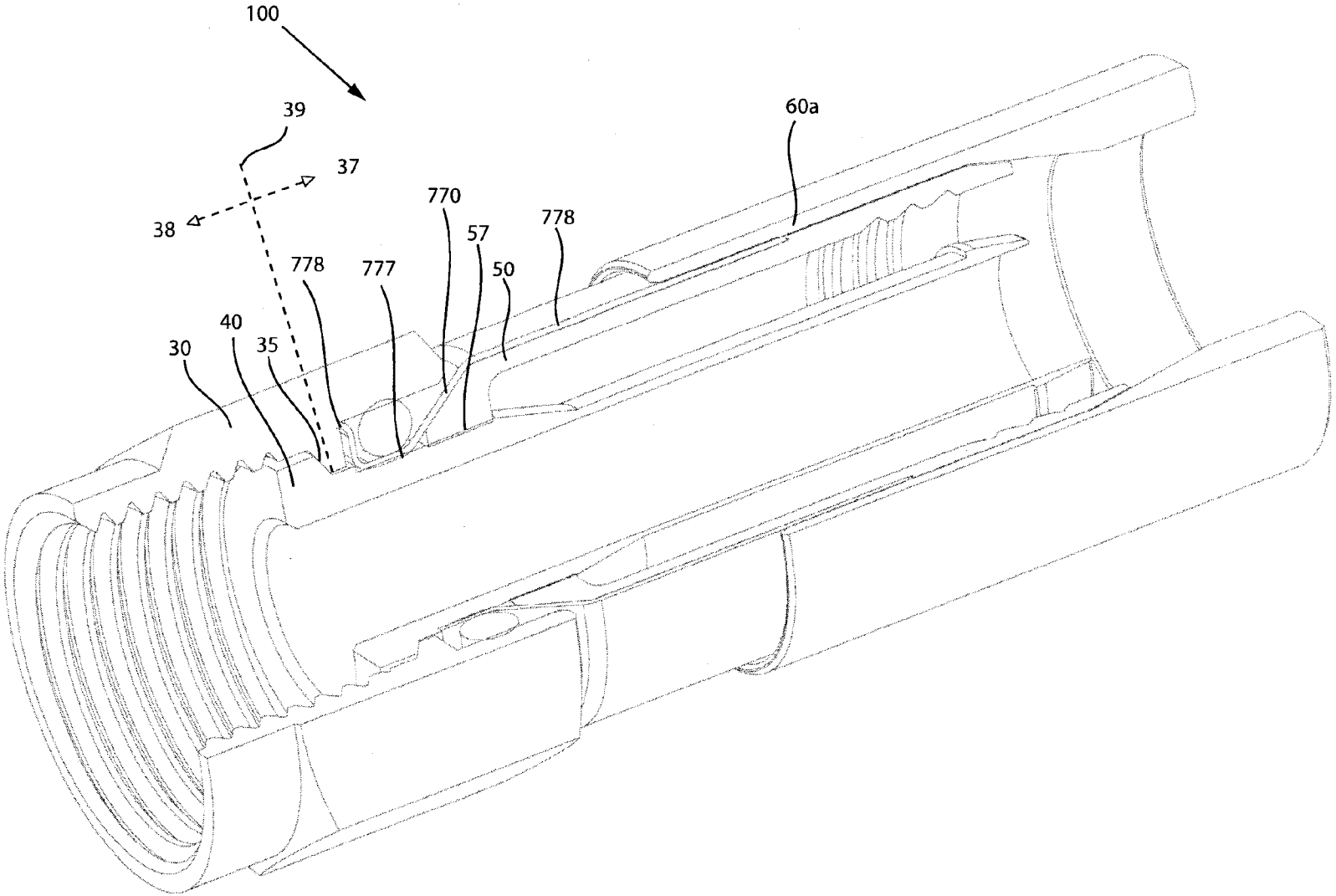
FIG. 21 depicts a perspective cut-away view of an embodiment of a coaxial cable connector having still even another embodiment of an electrical continuity member.
Figure 22:
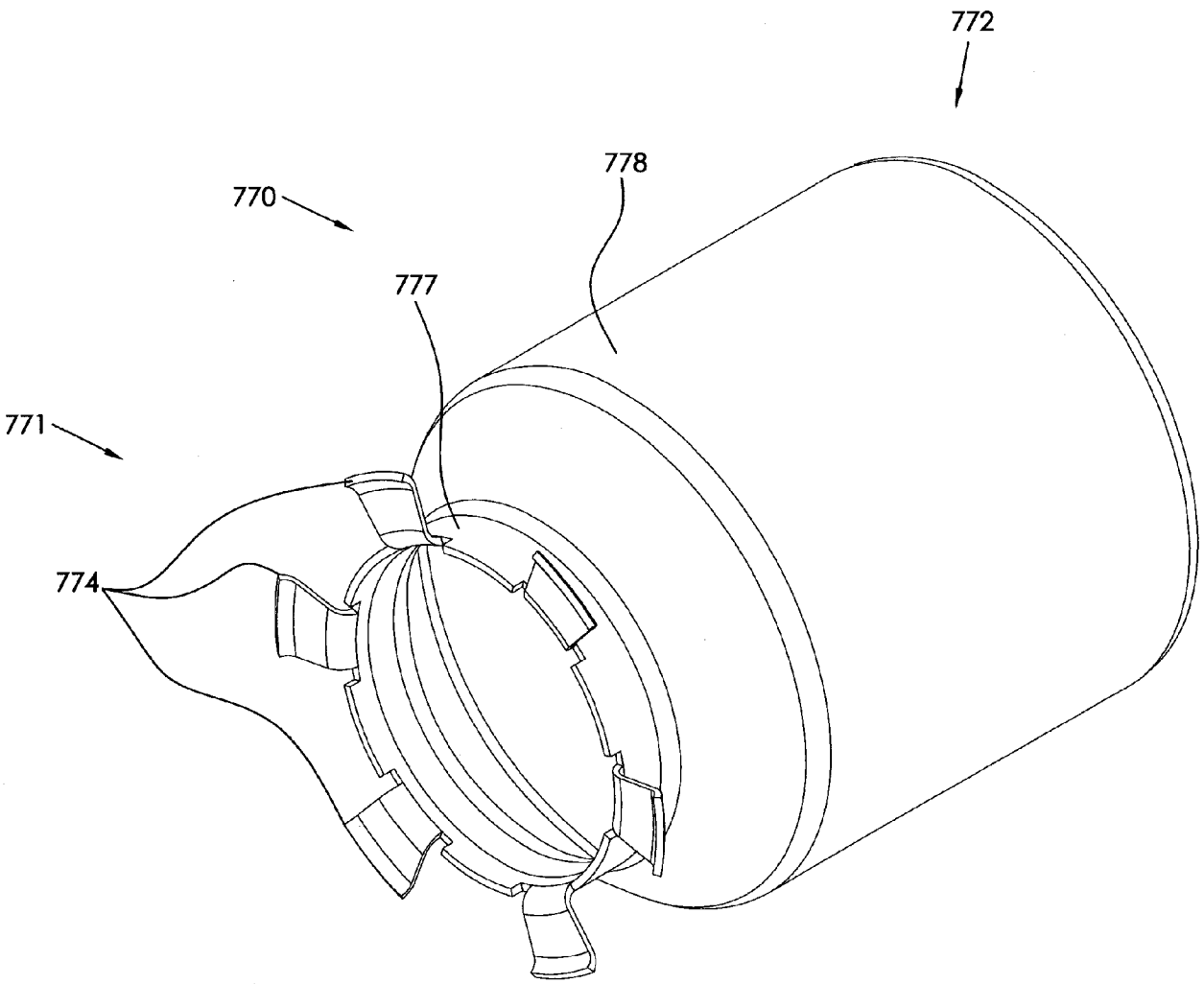
FIG. 22 depicts a perspective view of the embodiment of the electrical continuity member depicted in FIG. 21.
Figure 23:
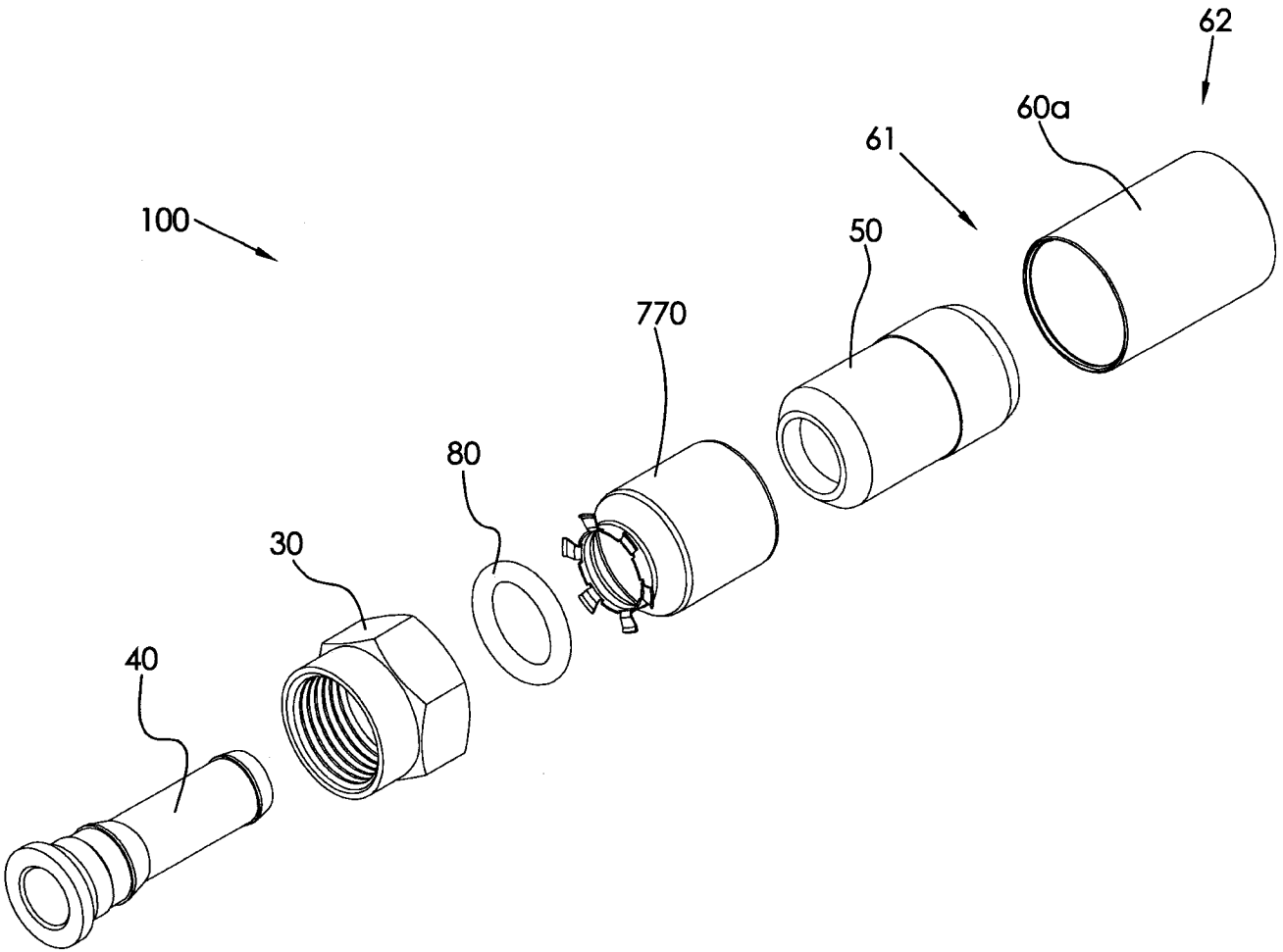
FIG. 23 an exploded perspective view of the embodiment of the coaxial cable connector of FIG. 21.

With continued reference to the drawings, FIG. 21-23 depict cut-away, exploded, perspective views of an embodiment of a coaxial cable connector 100 having still even another embodiment of an electrical continuity member 770, in accordance with the present invention. As depicted, the continuity member 770 does not reside in the first end portion 38 of the nut 30. Rather, portions of the continuity member 770 that contact the nut 30 and the post 40, such as the nut contacting portion(s) 774 and the post contacting portion 777, reside rearward the start (beginning at forward facing surface 35) of the second end portion 37 of the nut 30, like all other embodiments of continuity members. The continuity member 770, includes a larger diameter portion 778 that receives a portion of a connector body 50, when the coaxial cable connector 100 is assembled. In essence, the continuity member 770 has a sleeve-like configuration and may be press-fit onto the received portion of the connector body 50. When the coaxial cable connector 100 is assembled, the continuity member 770 resides between the nut 30 and the connector body 50, so that there is no contact between the nut 30 and the connector body 50. The fastener member 60*a* may include an axially extended first end 61. The first end 61 of the fastener member 60 may extend an axial distance so that, when the fastener member 60*a* is compressed into sealing position on the coaxial cable 100 (not shown, but readily comprehensible by those of ordinary skill in the art), the fastener member 60*a* touches or otherwise resides substantially proximate or very near the nut 30. This touching, or otherwise close contact between the nut 30 and the fastener member 60 coupled with the in-between or sandwiched location of the continuity member 770 may facilitate enhanced prevention of RF ingress and/or ingress of other environmental contaminants into the coaxial cable connector 100 at or near the second end 32 of the nut 30. As depicted, the continuity member 770 and the associated connector body 50 may be press-fit onto the post 40, so that the post contact portion 777 of the continuity member 770 and the post mounting portion 57 of the connector body 50 are axially and rotationally secured to the post 40. The nut contacting portion(s) 774 of the continuity member 770 are depicted as resilient members, such as flexible fingers, that extend to resiliently engage the nut 30. This resiliency of the nut contact portions 774 may facilitate enhanced contact with the nut 30 when the nut 30 moves during operation of the coaxial cable connector 100, because the nut contact portions 774 may flex and retain constant physical and electrical contact with the nut 30, thereby ensuring continuity of a grounding path extending through the nut 30.

Figure 24:
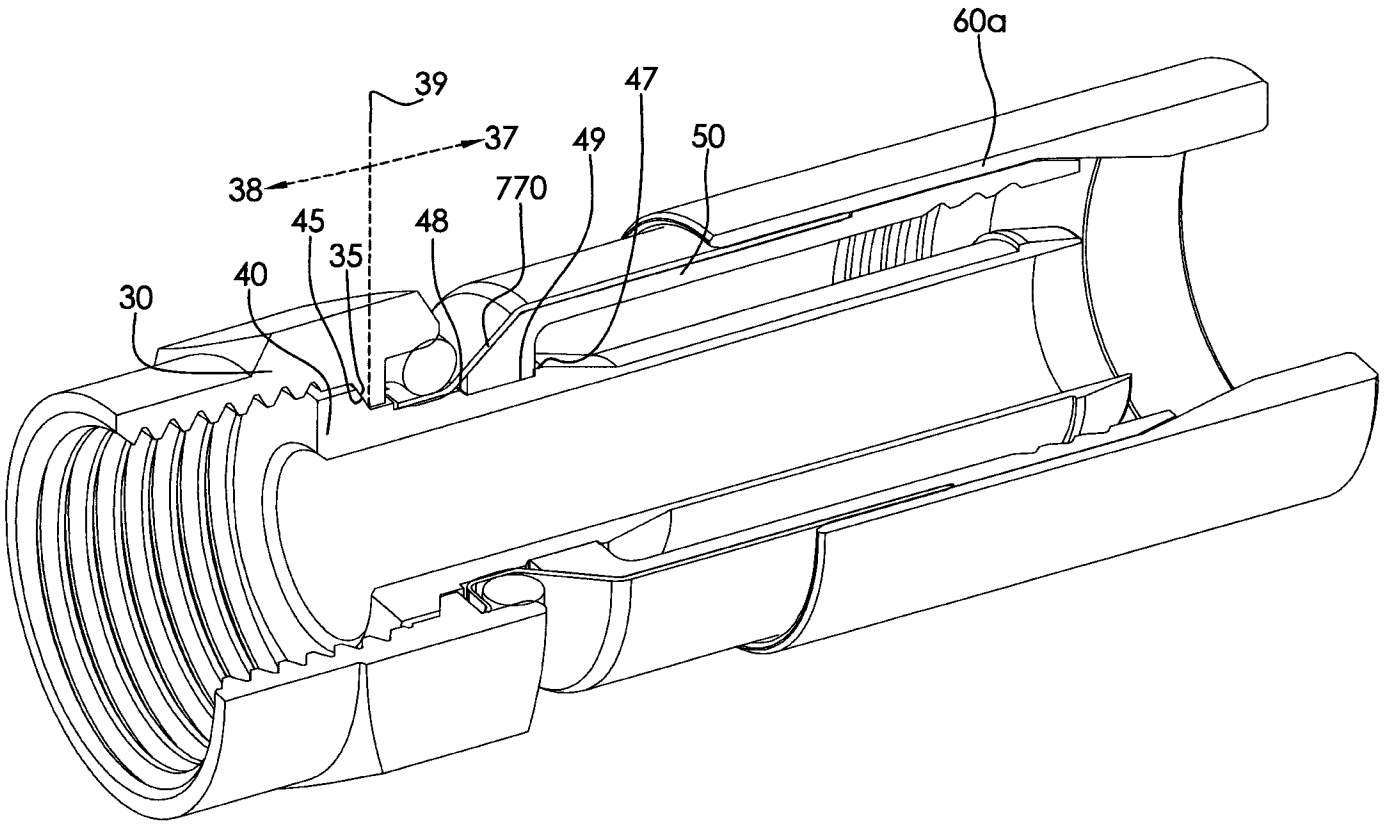
FIG. 24 depicts a perspective cut-away view of another embodiment of a coaxial cable connector having the embodiment of the electrical continuity member depicted in FIG. 22.
Figure 25:
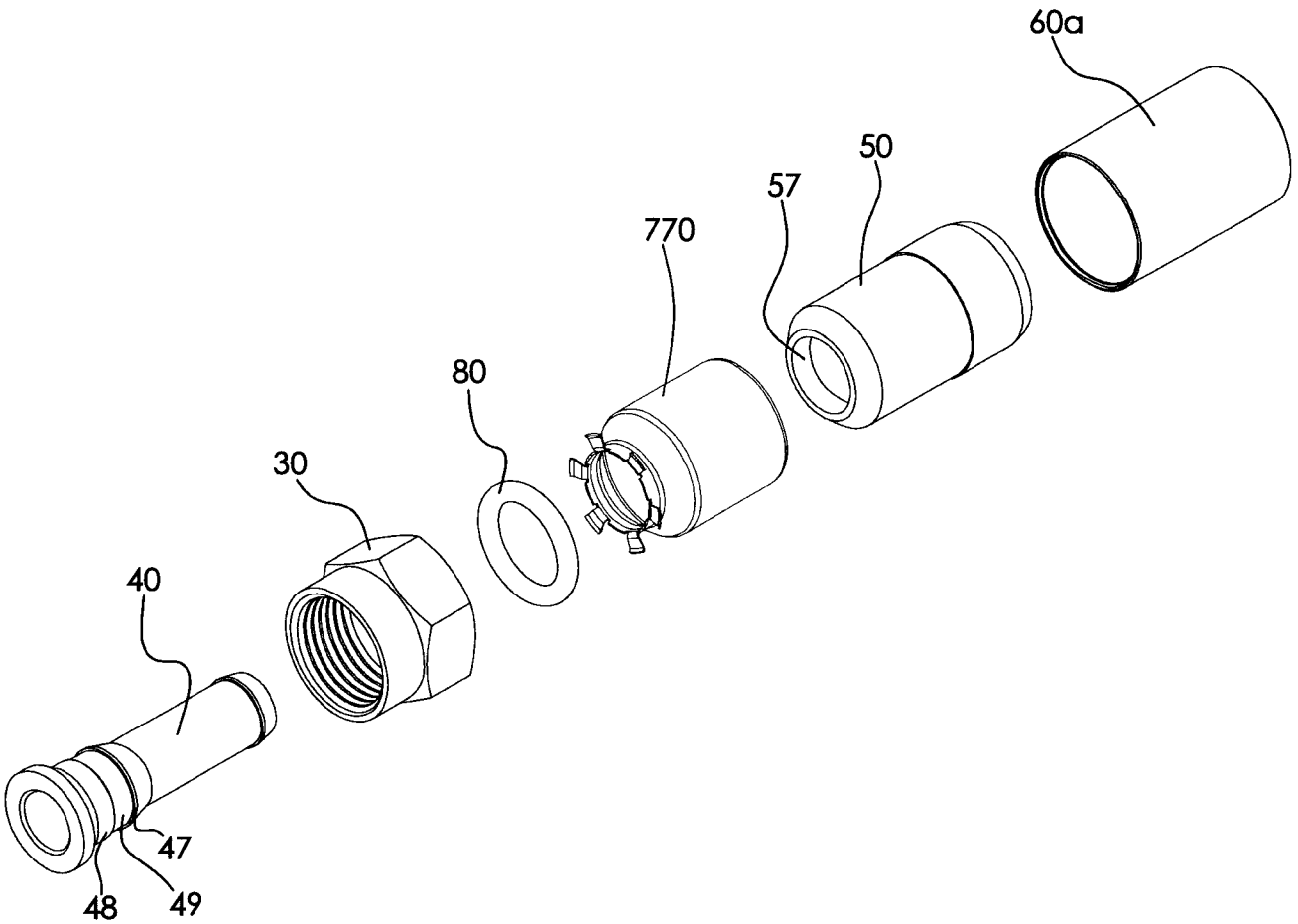
FIG. 25 depicts an exploded perspective view of the embodiment of the coaxial cable connector of FIG. 24.

Referring still further to the drawings, FIGS. 24-25 depict perspective views of another embodiment of a coaxial cable connector 100 having a continuity member 770. As depicted, the post 40 may include a surface feature 47, such as a lip extending from a connector body engagement portion 49 having a diameter that is smaller than a diameter of a continuity member engagement portion 48. The surface feature lip 47, along with the variably-diametered continuity member and connector body engagement portions 48 and 49, may facilitate efficient assembly of the connector 100 by permitting various component portions having various structural configurations and material properties to move into secure location, both radially and axially, with respect to one another.

Figure 26:
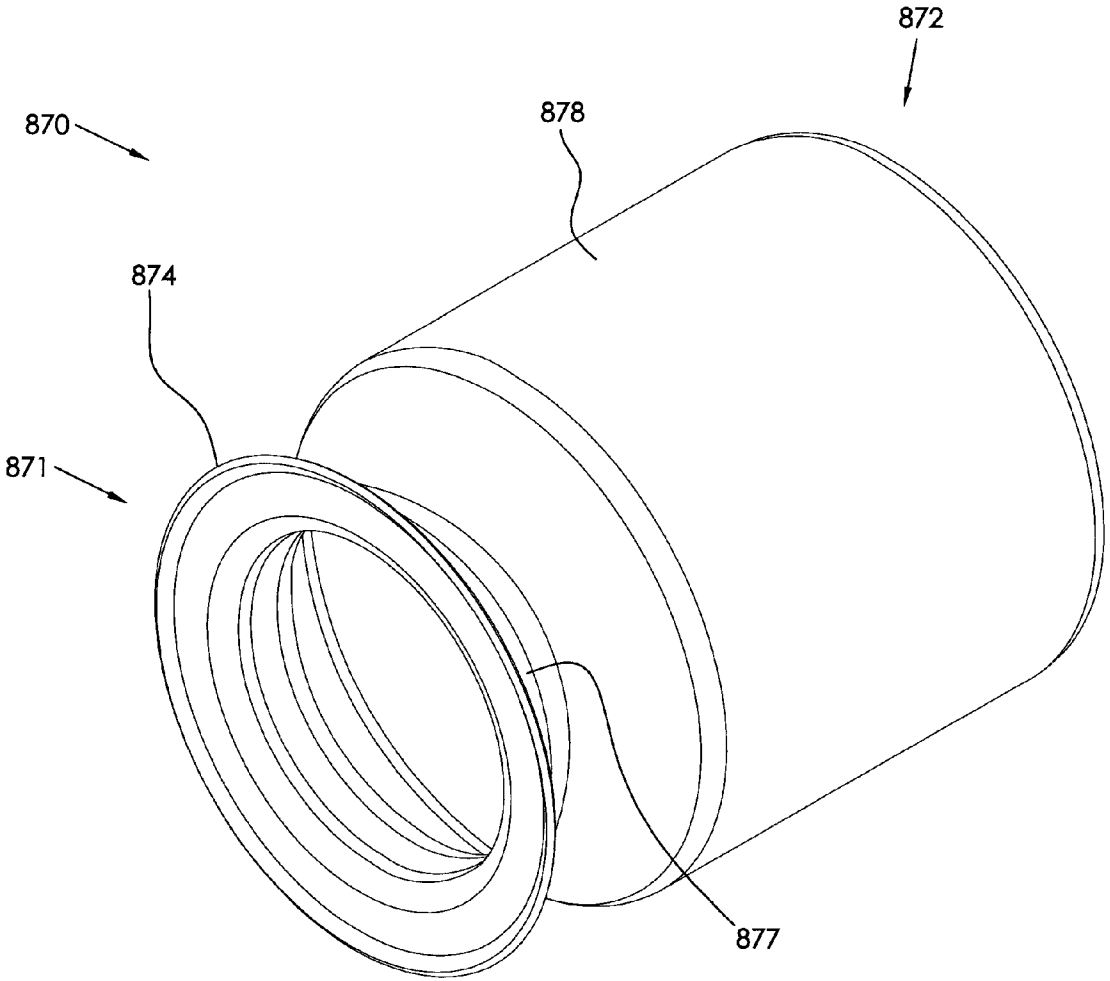
FIG. 26 depicts a perspective view of still further even another embodiment of an electrical continuity member.
Figure 27:
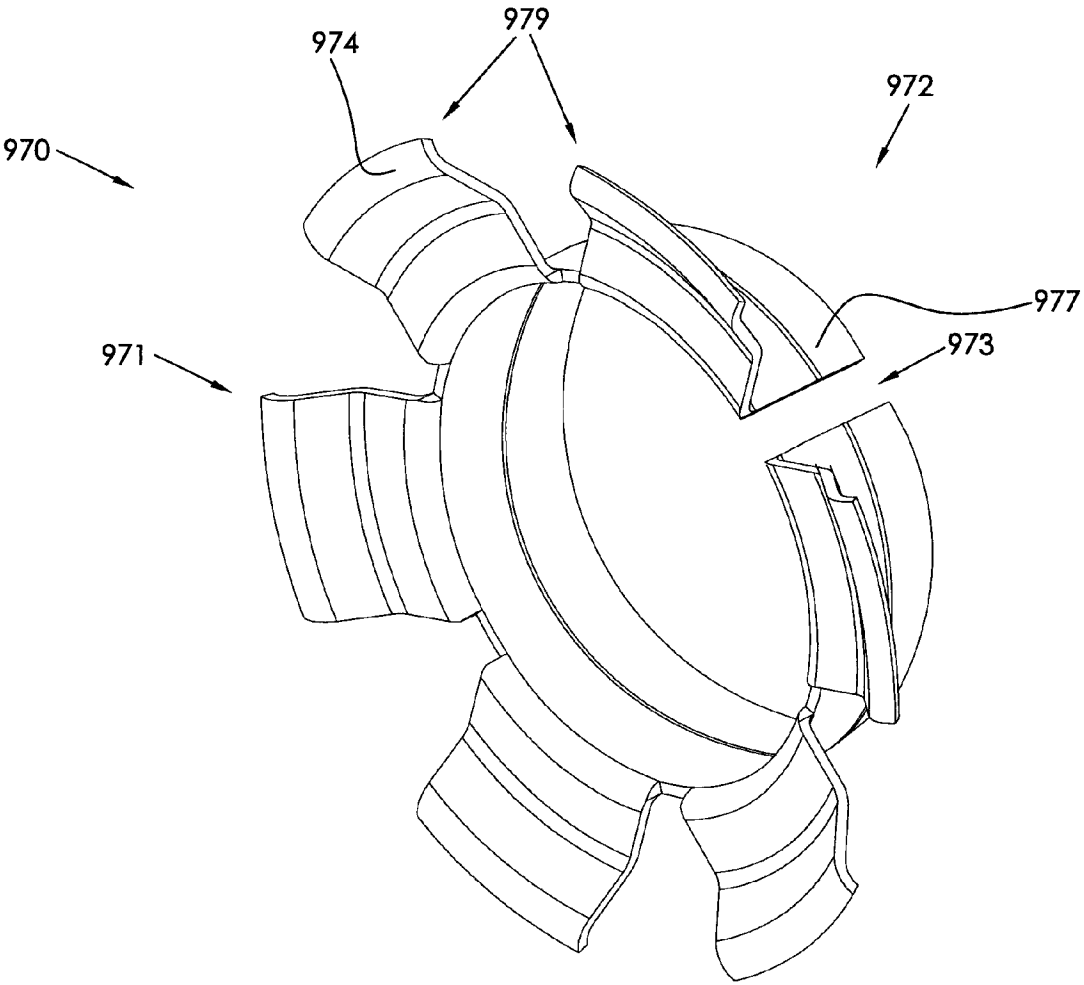
FIG. 27 depicts a perspective view of another embodiment of an electrical continuity member.
Figure 28:
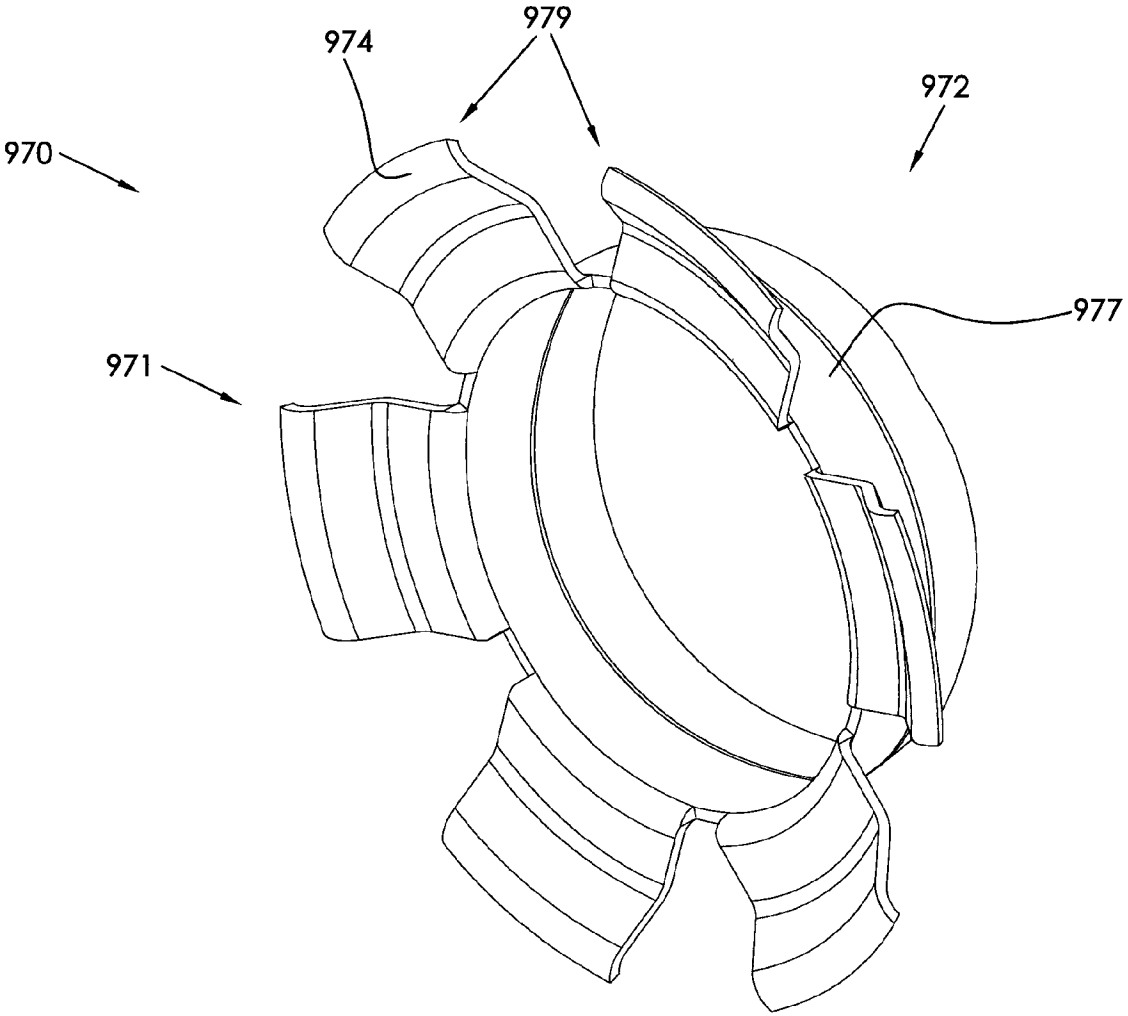
FIG. 28 depicts a perspective view of an embodiment of an electrical continuity depicted in FIG. 27, yet comprising a completely annular post contact portion with no through-slit.
Figure 29:
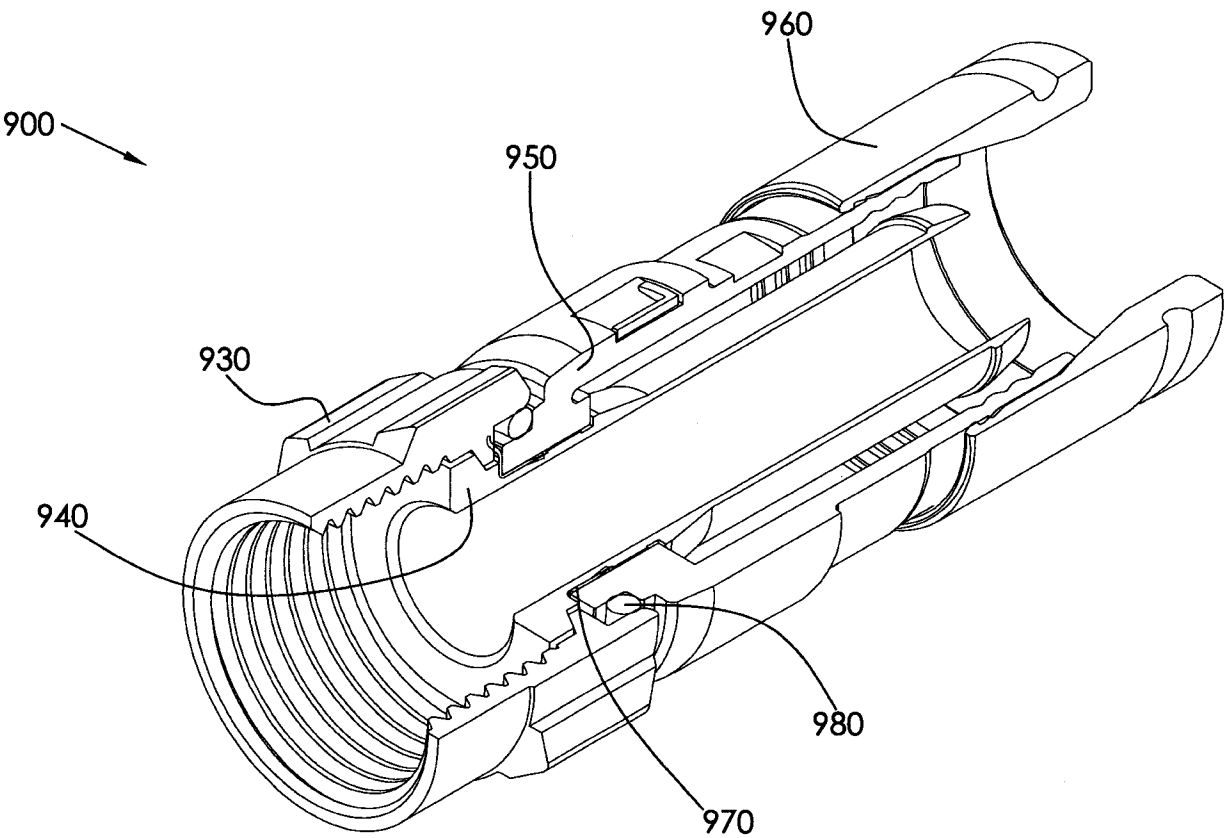
FIG. 29 depicts a perspective cut-away view of another embodiment of a coaxial cable connector operably having either of the embodiments of the electrical continuity member depicted in FIG. 27 or 28.
Figure 30:
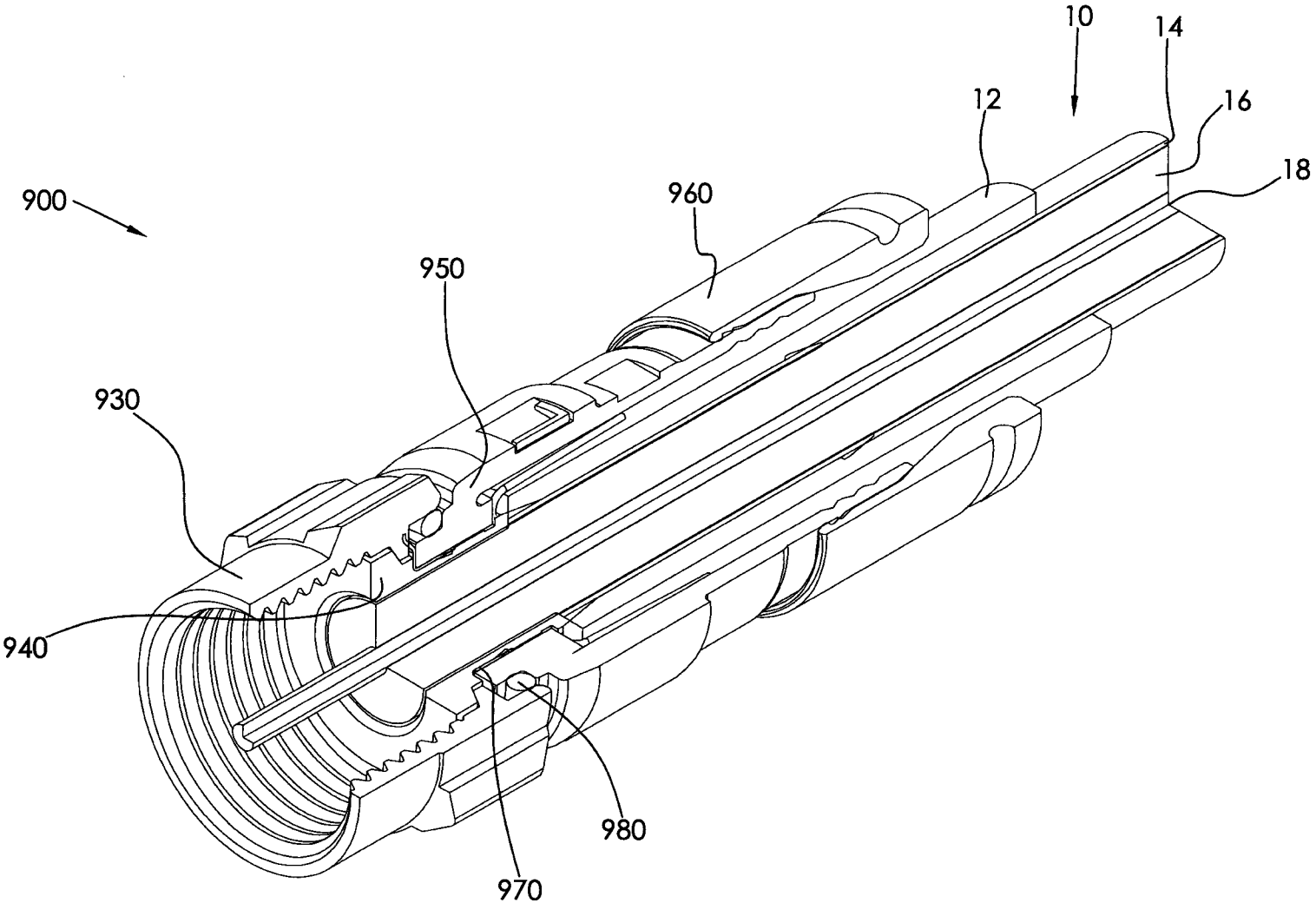
FIG. 30 depicts a perspective cut-away view of the embodiment of a coaxial cable connector of FIG. 29, wherein a cable is attached to the connector.
Figure 31:
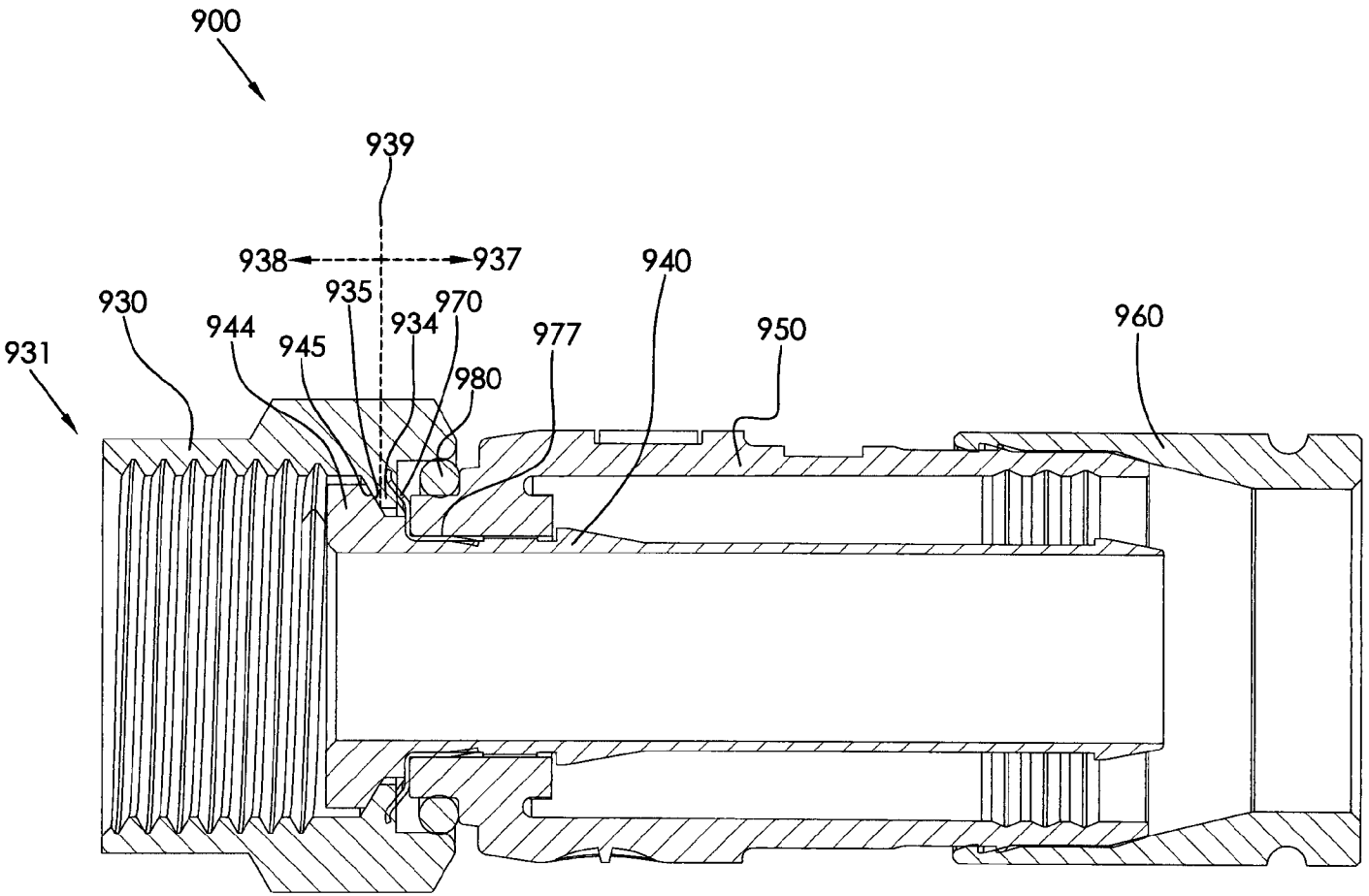
FIG. 31 depicts a side cross-section view of the embodiment of a coaxial cable connector of FIG. 29.
Figure 32:
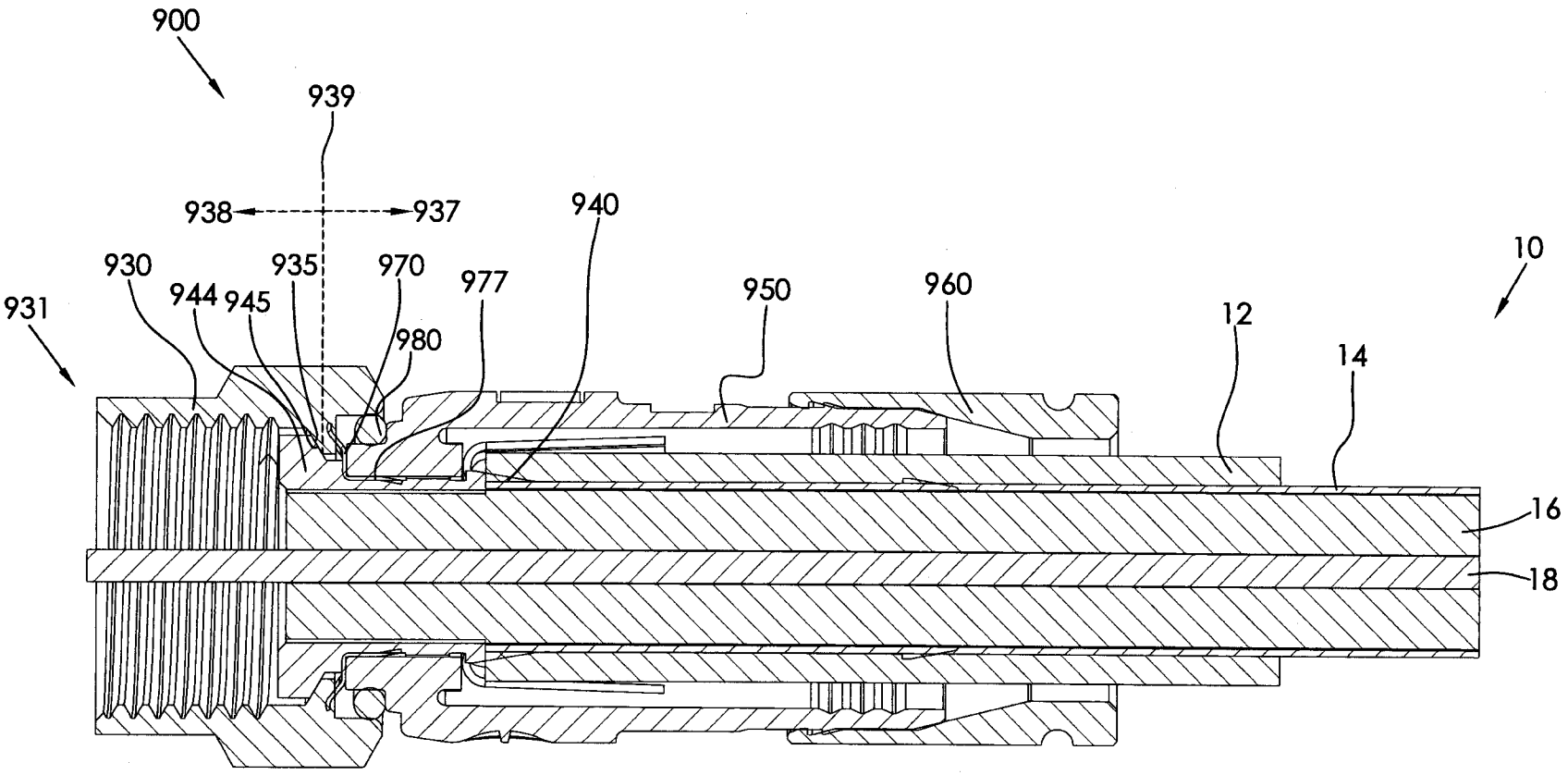
FIG. 32 depicts a perspective cut-away view of the embodiment of a coaxial cable connector of FIG. 29, wherein a cable is attached to the connector.
Figure 33:
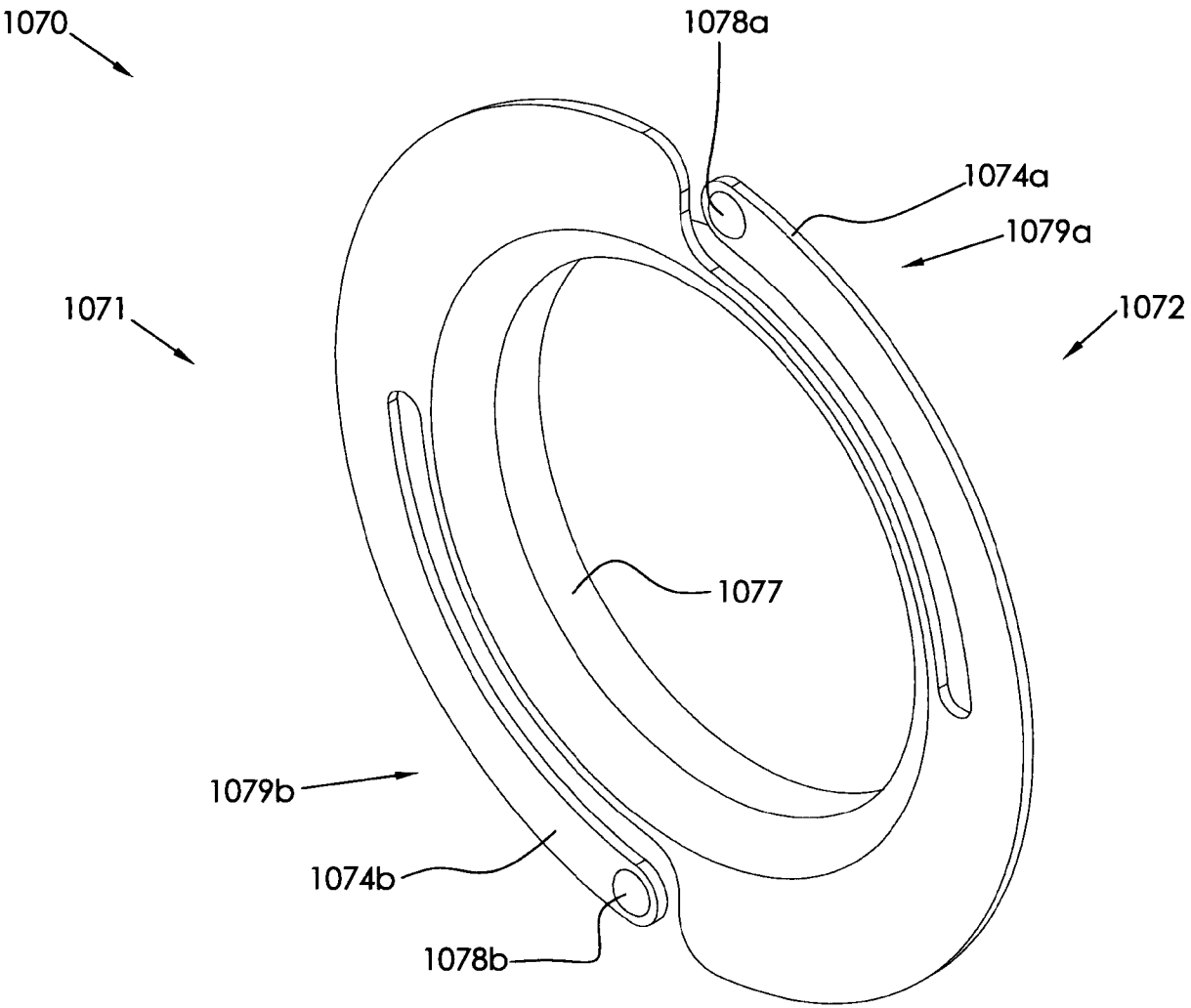
FIG. 33 depicts a perspective view of yet another embodiment of an electrical continuity member.
Figure 34:
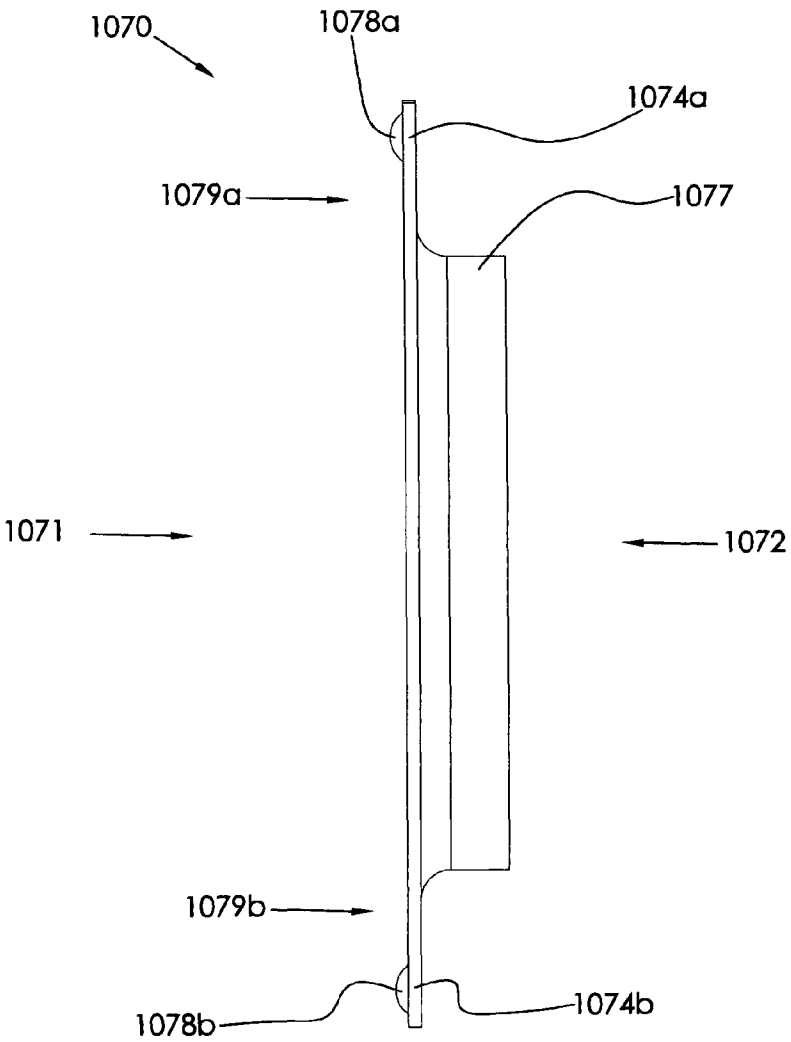
FIG. 34 depicts a side view of the embodiment of an electrical continuity member depicted in FIG. 33.

With still further reference to the drawings, FIG. 26 depicts a perspective view of still further even another embodiment of an electrical continuity member 870, in accordance with the present invention. The continuity member 870 may be similar in structure to the continuity member 770, in that it is also sleeve-like and extends about a portion of connector body 50 and resides between the nut 30 and the connector body 50 when the coaxial cable connector 100 is assembled. However, the continuity member 870 includes an unbroken flange-like nut contact portion 874 at the first end 871 of the continuity member 870. The flange-like nut contact portion 874 may be resilient and include several functional properties that are very similar to the properties of the finger-like nut contact portion(s) 774 of the continuity member 770. Accordingly, the continuity member 870 may efficiently extend electrical continuity through the nut 30.

With an eye still toward the drawings and with particular respect to FIGS. 27-32, another embodiment of an electrical continuity member 970 is depicted in several views, and is also shown as included in a further embodiment of a coaxial cable connector 900. The electrical continuity member 970 has a first end 971 and a second end 972. The first end 971 of the electrical continuity member 970 may include one or more flexible portions 979. For example, the continuity member 970 may include multiple flexible portions 979, each of the flexible portions 979 being equidistantly arranged so that in perspective view the continuity member 970 looks somewhat daisy-like. However, those knowledgeable in the art should appreciate that a continuity member 970 may only need one flexible portion 979 and associated not contact portion 974 to obtain electrical continuity for the connector 900. Each flexible portion 979 may associate with a nut contact portion 974 of the continuity member 970. The nut contact portion 974 is configured to engage a surface of the nut 930, wherein the surface of the nut 930 that is engaged by the nut contact portion 974 resides rearward the forward facing surface 935 of nut 930 and the start of the second end portion 937 of the nut 930. A post contact portion 977, may physically and electrically contact the post 940. The electrical continuity member 970 may optionally include a through-slit 973, which through-slit 973 may facilitate various processes for manufacturing the member 970, such as those described in like manner above. Moreover, a continuity member 970 with a through-slit 973 may also be associated with different assembly processes and/or operability than a corresponding electrical continuity member 970 that does not include a through-slit.

When in operation, an electrical continuity member 970 should maintain electrical contact with both the post 940 and the nut 930, as the nut 930 operably moves rotationally about an axis with respect to the rest of the coaxial cable connector 900 components, such as the post 940, the connector body 950 and the fastener member 960. Thus, when the connector 900 is fastened with a coaxial cable 10, a continuous electrical shield may extend from the outer grounding sheath 14 of the cable 10, through the post 940 and the electrical continuity member 970 to the nut or coupler 930, which coupler 930 ultimately may be fastened to an interface port (see, for example port 20 of FIG. 1), thereby completing a grounding path from the cable 10 through the port 20. A sealing member 980 may be operably positioned between the nut 930, the post 940, and the connector body 950, so as to keep environmental contaminants from entering within the connector 900, and to further retain proper component placement and prevent ingress of environmental noise into the signals being communicated through the cable 10 as attached to the connector 900. Notably, the design of various embodiments of the coaxial cable connector 900 includes elemental component configuration wherein the nut 930 does not (and even cannot) contact the body 950.

Figure 35:
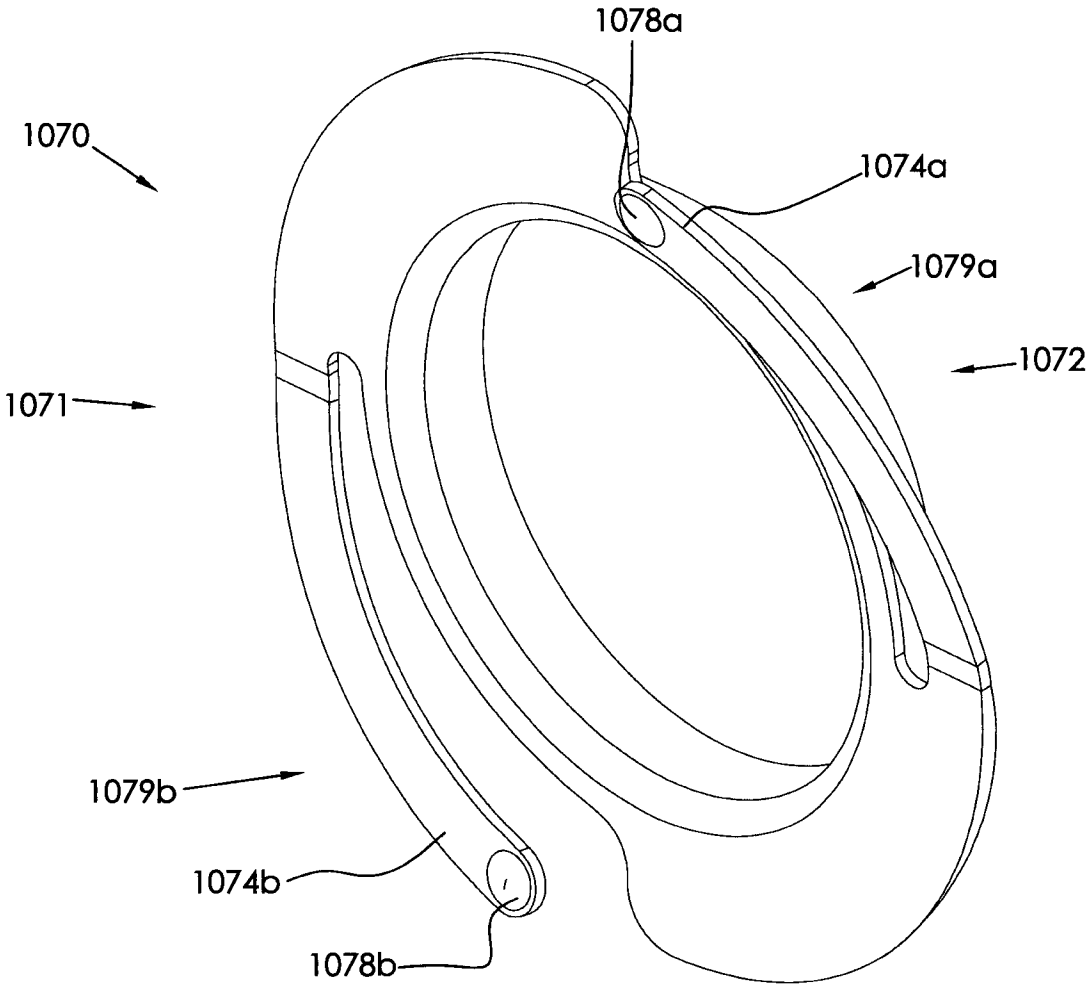
FIG. 35 depicts a perspective view of the embodiment of an electrical continuity member depicted in FIG. 33, wherein nut contact portions are bent.
Figure 36:
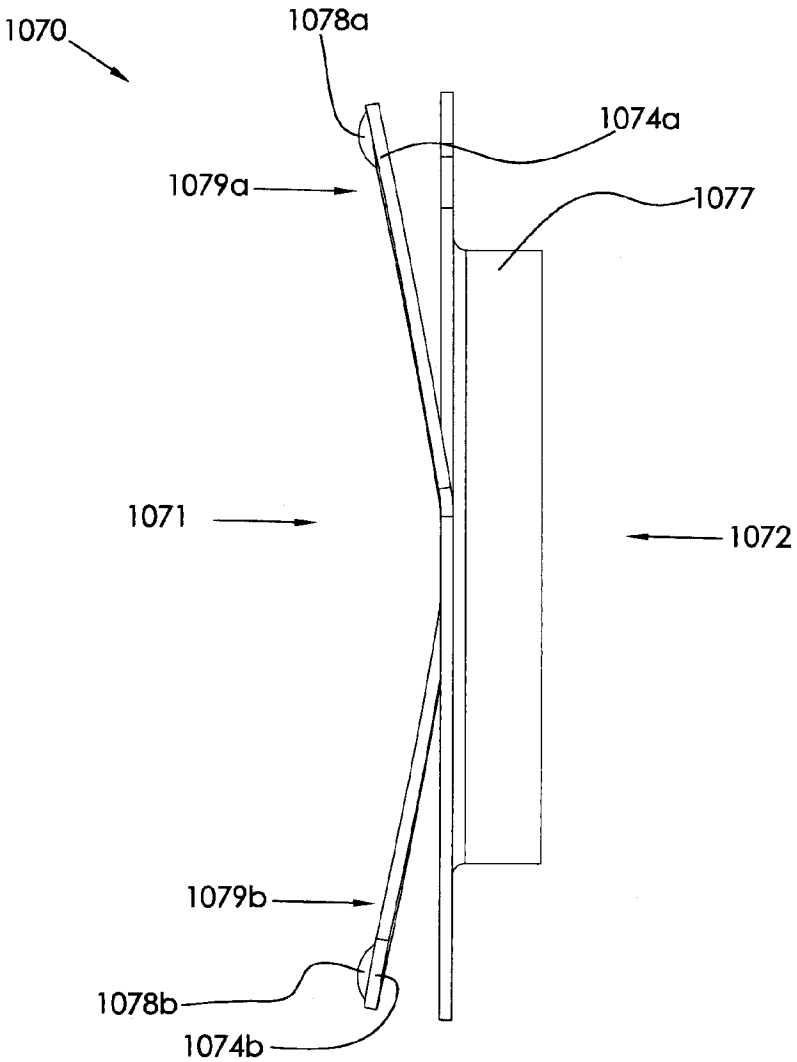
FIG. 36 depicts a side view of the embodiment of an electrical continuity member depicted in FIG. 33, wherein nut contact portions are bent.
Figure 37:
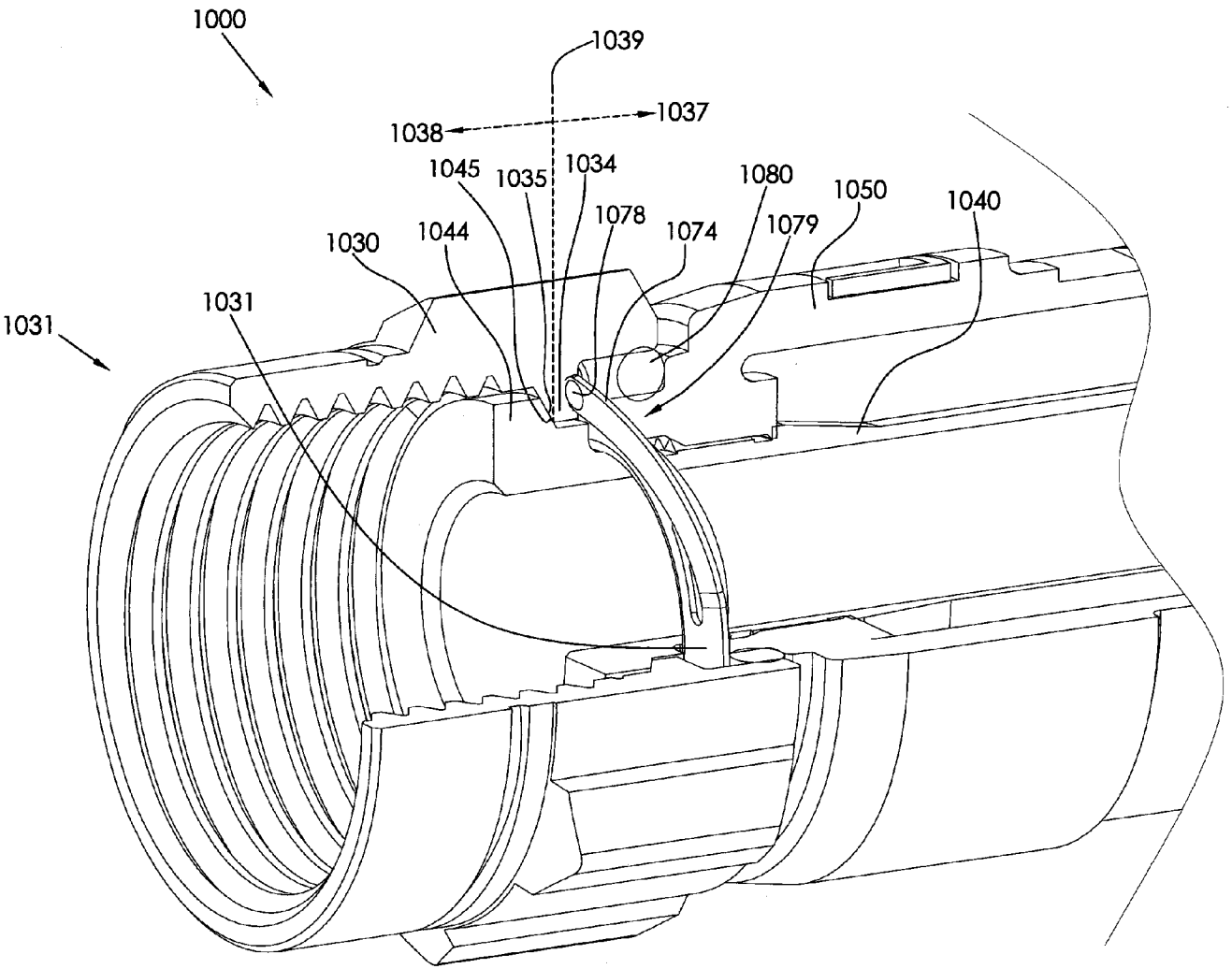
FIG. 37 depicts a perspective cut-away view of a portion of a further embodiment of a coaxial cable connector having the embodiment of the electrical continuity member depicted in FIG. 33.
Figure 38:
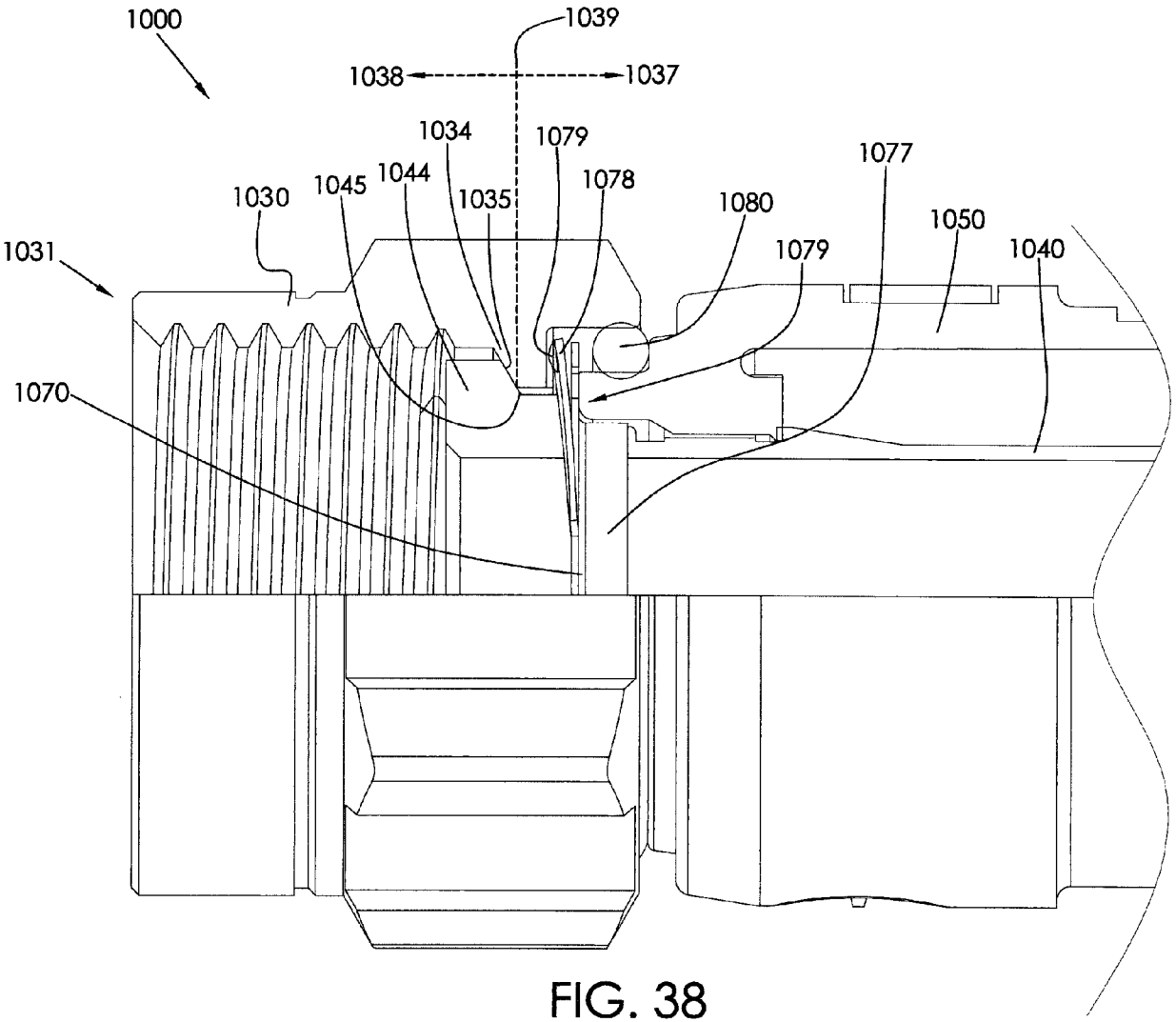
FIG. 38 depicts a cut-away side view of a portion of the further embodiment of a coaxial cable connector depicted in FIG. 37 and having the embodiment of the electrical continuity member depicted in FIG. 33.
Figure 39:
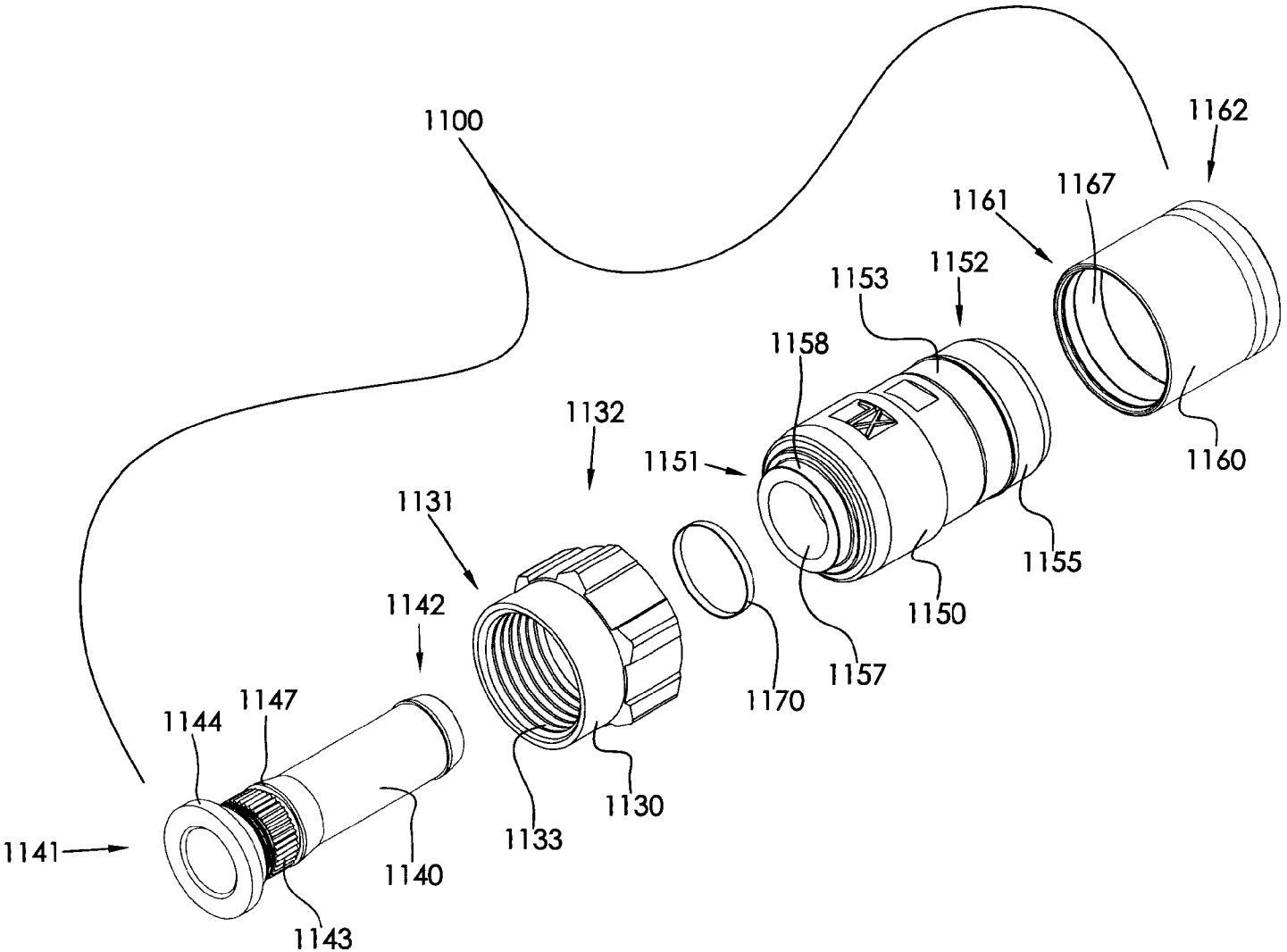
FIG. 39 depicts an exploded perspective cut-away view of another embodiment of the elements of an embodiment of a coaxial cable connector having an embodiment of an electrical continuity member.
Figure 40:
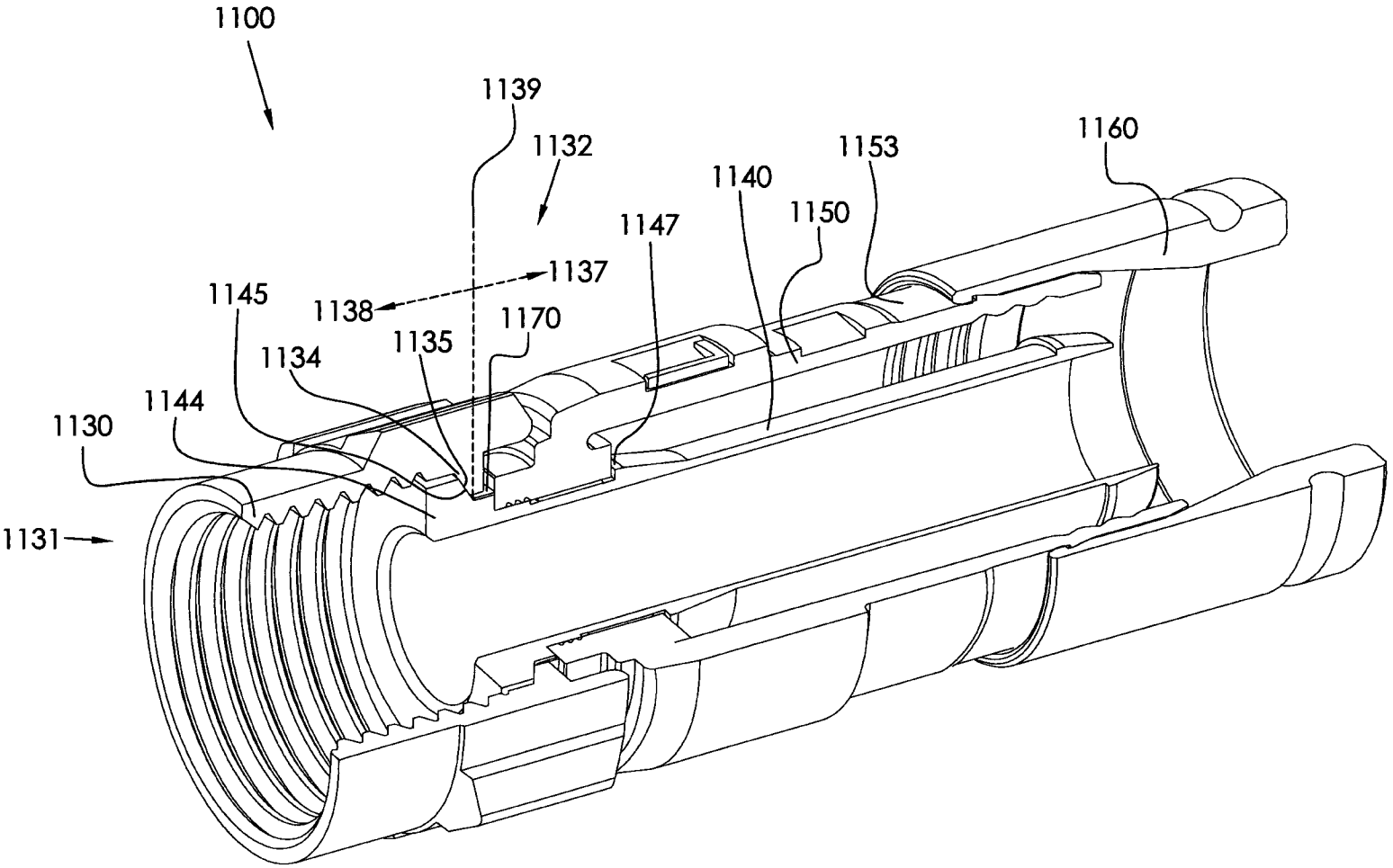
FIG. 40 depicts a side perspective cut-away view of the other embodiment of the coaxial cable connector of FIG. 39.
Figure 41:
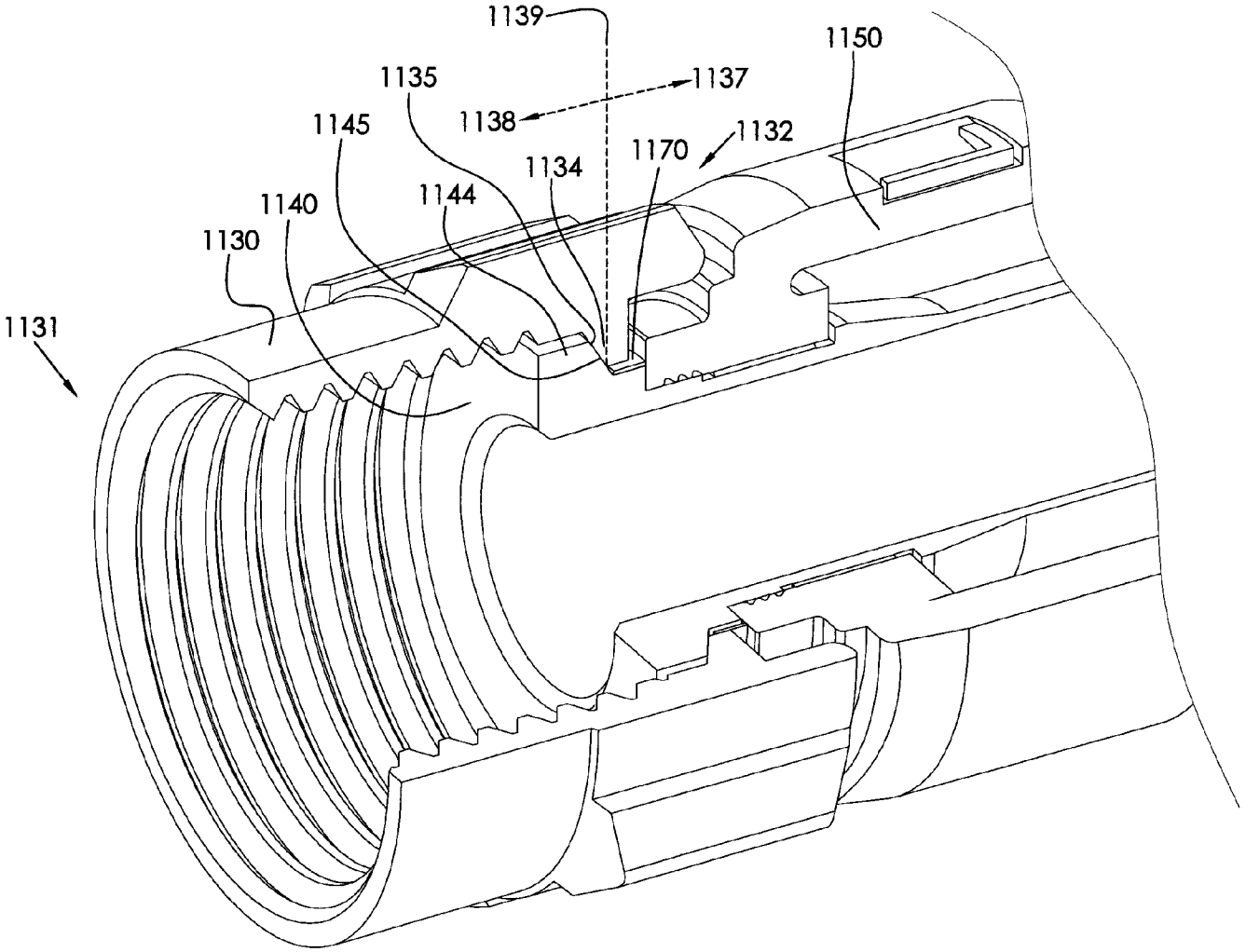
FIG. 41 depicts a blown-up side perspective cut-away view of a portion of the other embodiment of the coaxial cable connector of FIG. 39.

Turning further to the drawings, FIGS. 33-38 depict yet another embodiment of an electrical continuity member 1070. The electrical continuity member 1070 is operably included, to help facilitate electrical continuity in an embodiment of a coaxial cable connector 1000 having multiple component features, such as a coupling nut 1030, an inner post 1040, a connector body 1050, and a sealing member 1080, along with other like features, wherein such component features are, for the purposes of description herein, structured similarly to corresponding structures (referenced numerically in a similar manner) of other coaxial cable connector embodiments previously discussed herein above, in accordance with the present invention. The electrical continuity member 1070 has a first end 1071 and opposing second end 1072, and includes at least one flexible portion 1079 associated with a nut contact portion 1074. The nut contact portion 1074 may include a nut contact tab 1078. As depicted, an embodiment of an electrical continuity member 1070 may include multiple flexible portions 1079*a-b* associated with corresponding nut contact portions 1074*a-b*. The nut contact portions 1074*a-b* may include respective corresponding nut contact tabs 1078*a-b*. Each of the multiple flexible portions 1079*a-b*, nut contact portions 1074*a-b*, and nut contact tabs 1078*a-b* may be located so as to be oppositely radially symmetrical about a central axis of the electrical continuity member 1070. A post contact portion 1077 may be formed having an axial length, so as to facilitate axial lengthwise engagement with the post 1040, when assembled in a coaxial cable connector embodiment 1000. The flexible portions 1079*a-b* may be pseudo-coaxially curved arm members extending in yin/yang like fashion around the electrical continuity member 1070. Each of the flexible portions 1079*a-b* may independently bend and flex with respect to the rest of the continuity member 1070. For example, as depicted in FIGS. 35 and 36, the flexible portions 1079*a-b* of the continuity member are bent upwards in a direction towards the first end 1071 of the continuity member 1070. Those skilled in the relevant art should appreciate that a continuity member 1070 may only need one flexible portion 1079 to efficiently obtain electrical continuity for a connector 1000.

When operably assembled within an embodiment of a coaxial cable connector 1000, electrical continuity member embodiments 1070 utilize a bent configuration of the flexible portions 1079*a-b*, so that the nut contact tabs 1078*a-b* associated with the nut contact portions 1074*a-b* of the continuity member 1070 make physical and electrical contact with a surface of the nut 1030, wherein the contacted surface of the nut 1030 resides rearward of the forward facing surface 1035 of the inward lip 1034 of nut 1030, and rearward of the start (at surface 1035) of the second end portion 1037 of the nut 1030. For convenience, dashed line 1039 (similar, for example, to dashed line 39 shown in FIG. 5) depicts the axial point and a relative radial perpendicular plane defining the demarcation of the first end portion 1038 and the second end portion 1037 of embodiments of the nut 1030. As such, the continuity member 1070 does not reside between opposing complimentary surfaces of the lip 1034 of the nut 1030 and the flange 1044 of the post 1040. Rather, the electrical continuity member 1070 contacts the nut 1030 at a rearward location other than on the forward facing side of the lip 1034 of the nut 1030 that faces the flange 1044 of the post 1040, at a location only pertinent to the second end 1037 portion of the nut 1030.

Referring still to the drawings, FIGS. 39-42 depict various views of another embodiment of a coaxial cable connector 1100 having an embodiment of an electrical continuity member 1170, in accordance with the present invention. Embodiments of an electrical continuity member, such as embodiment 1170, or any of the other embodiments 70, 170, 270, 370, 470, 570, 670, 770, 870, 970, 1070, 1270 and other like embodiments, may utilize materials that may enhance conductive ability. For instance, while it is critical that continuity member embodiments be comprised of conductive material, it should be appreciated that continuity members may optionally be comprised of alloys, such as cuprous alloys formulated to have excellent resilience and conductivity. In addition, part geometries, or the dimensions of component parts of a connector 1100 and the way various component elements are assembled together in coaxial cable connector 1100 embodiments may also be designed to enhance the performance of embodiments of electrical continuity members. Such part geometries of various component elements of coaxial cable connector embodiments may be constructed to minimize stress existent on components during operation of the coaxial cable connector, but still maintain adequate contact force, while also minimizing contact friction, but still supporting a wide range of manufacturing tolerances in mating component parts of embodiments of electrical continuity coaxial cable connectors.

Figure 42:
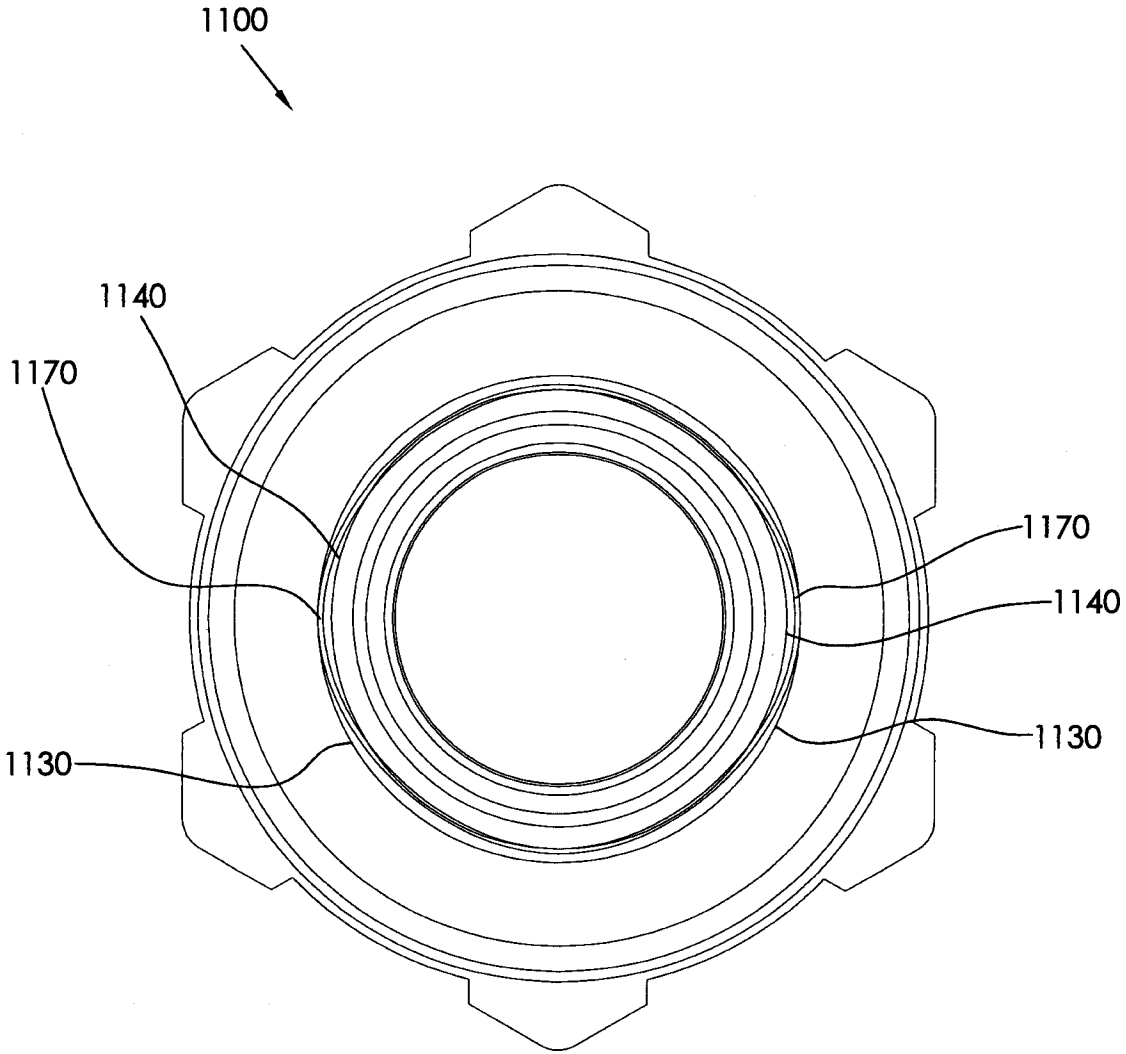
FIG. 42 depicts a front cross-section view, at the location between the first end portion of the nut and the second end portion of the nut, of the other embodiment of the coaxial cable connector of FIG. 39.
Figure 43:
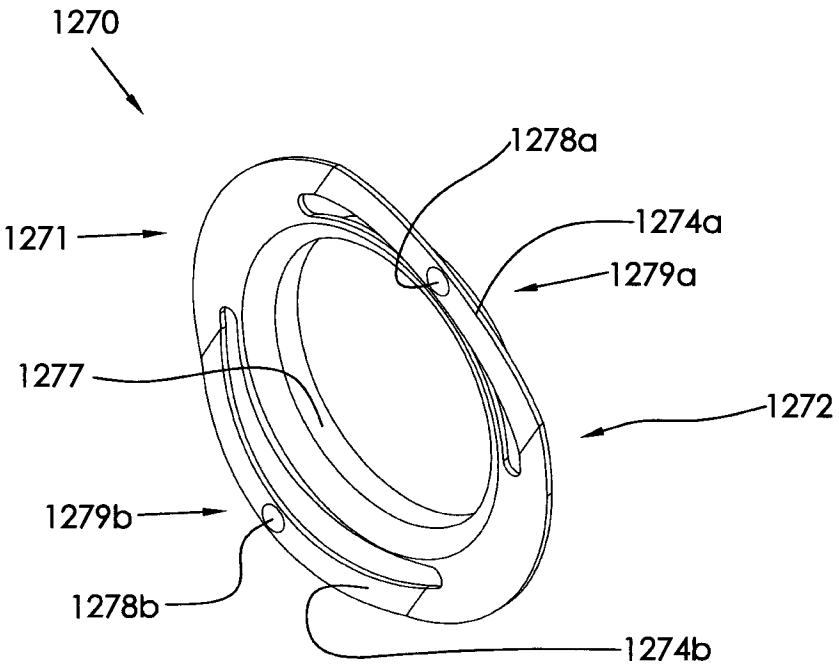
FIG. 43 depicts a front perspective view of yet still another embodiment of an electrical continuity member.
Figure 44:
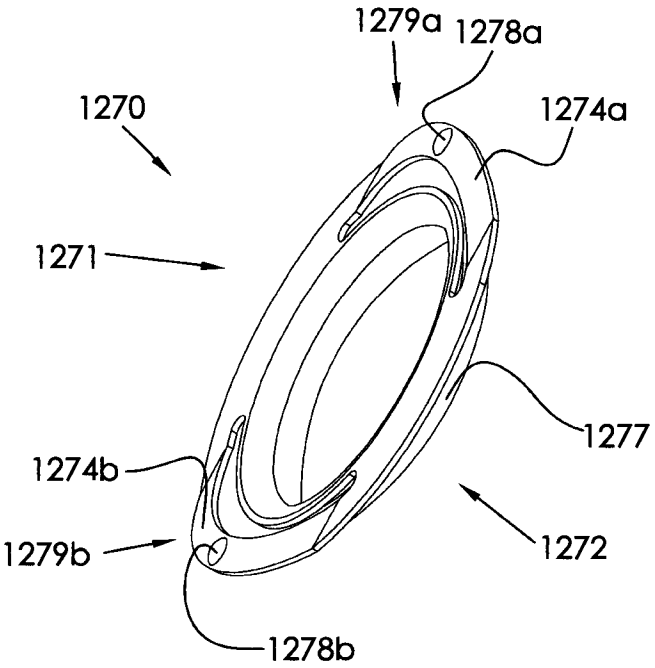
FIG. 44 depicts another front perspective view of the embodiment of the electrical continuity member depicted in FIG. 43.
Figure 45:
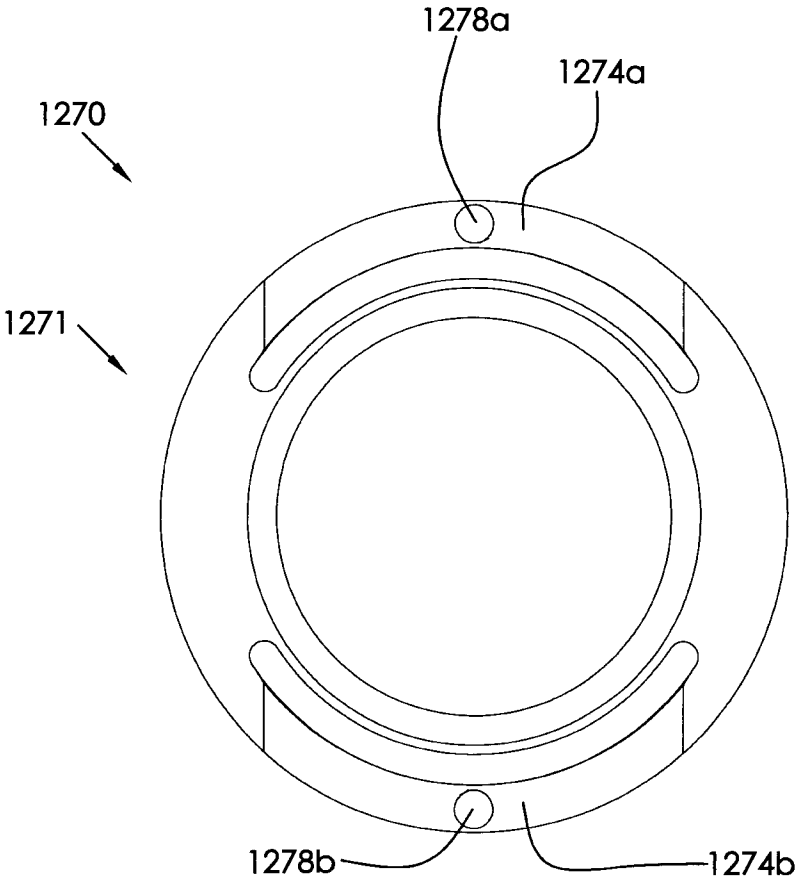
FIG. 45 depicts a front view of the embodiment of the electrical continuity member depicted in FIG. 43.
Figure 46:
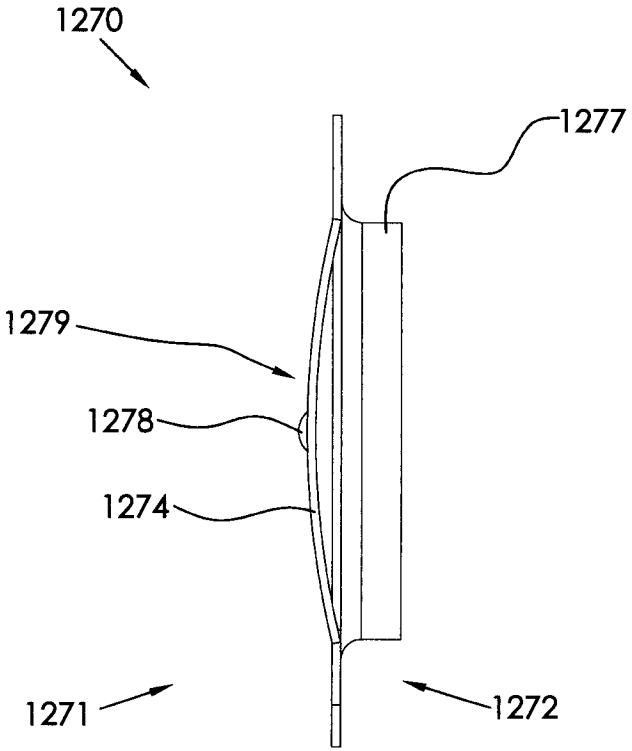
FIG. 46 depicts a side view of the embodiment of the electrical continuity member depicted in FIG. 43.
Figure 47:
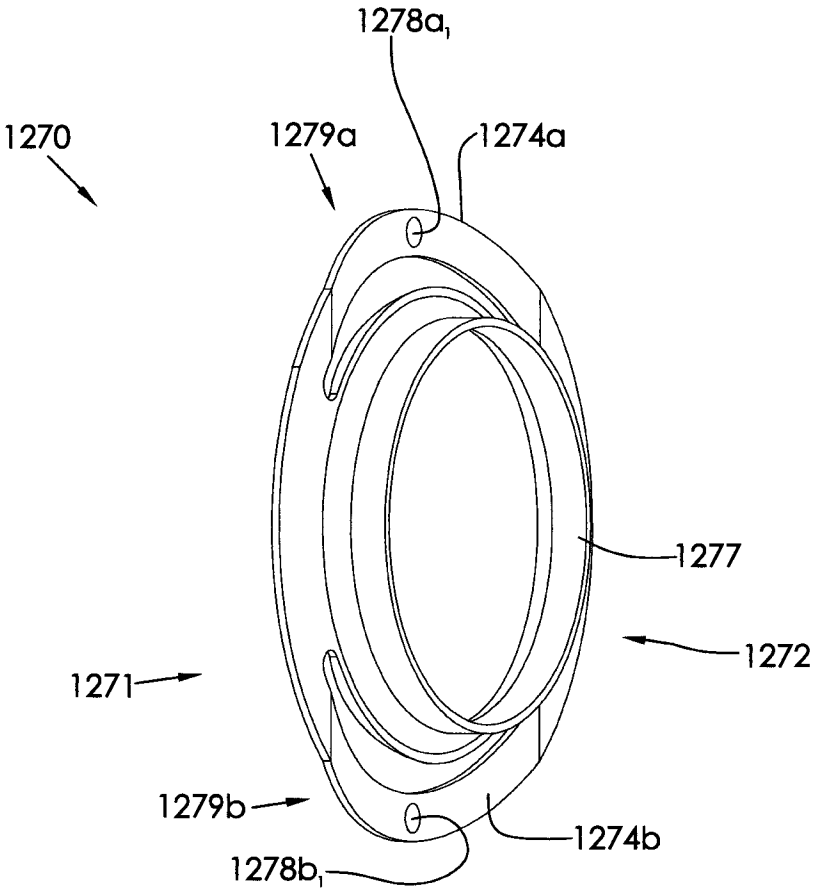
FIG. 47 depicts a rear perspective view of the embodiment of the electrical continuity member depicted in FIG. 43.
Figure 48:
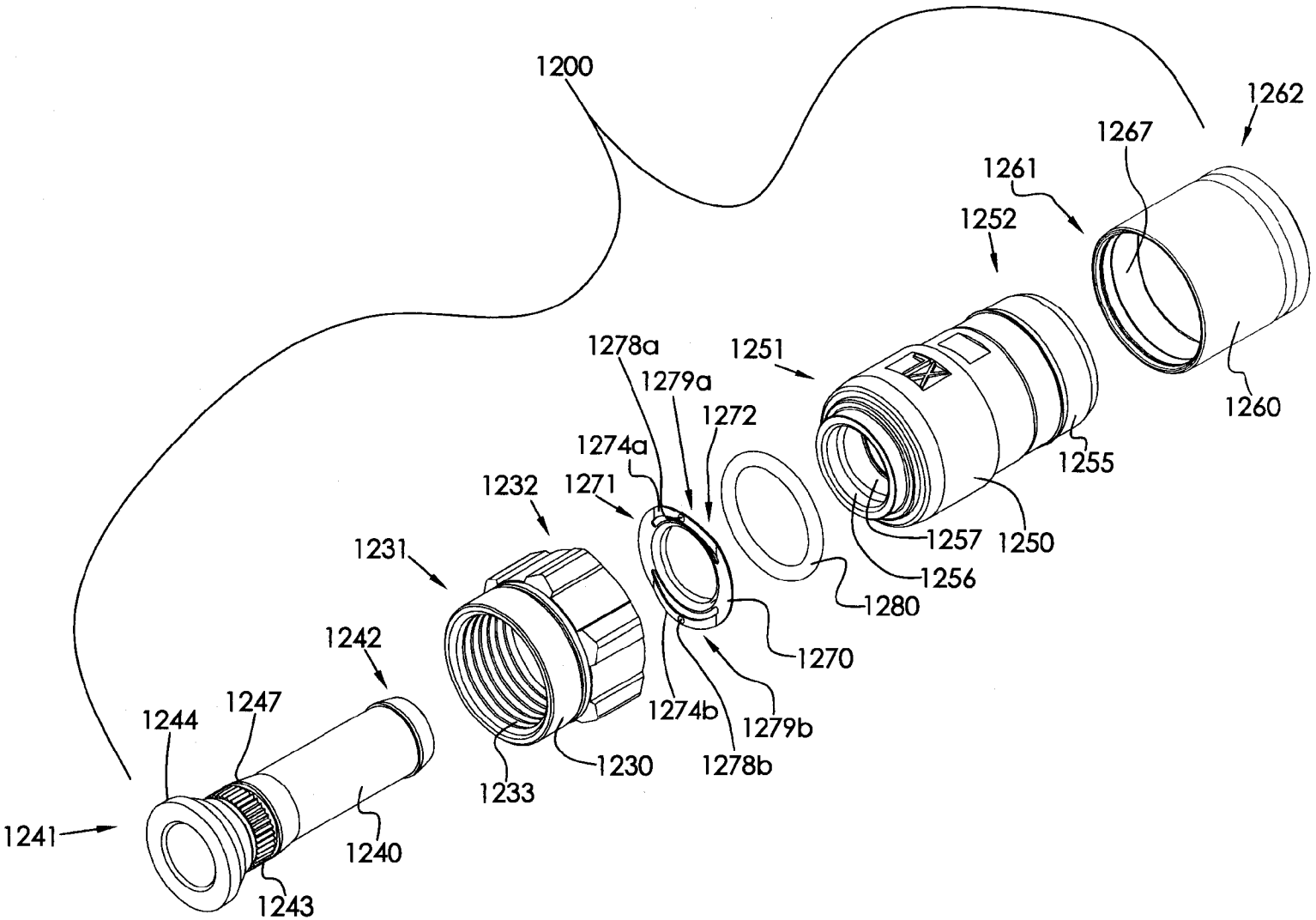
FIG. 48 depicts an exploded perspective cut-away view of a yet still other embodiment of the coaxial cable connector having the embodiment of the yet still other electrical continuity member depicted in FIG. 43.
Figure 49:
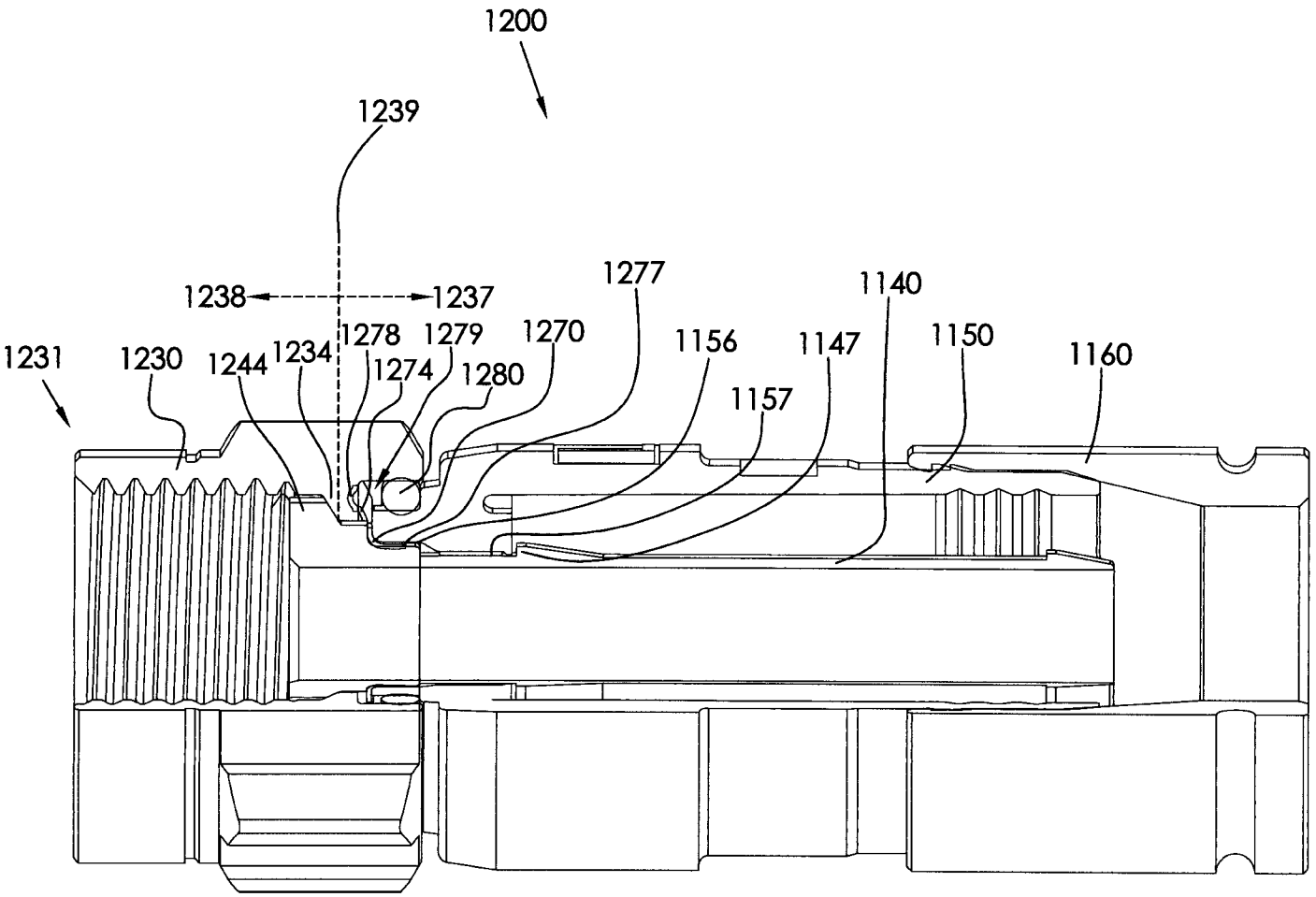
FIG. 49 depicts a perspective cut-away view of a the yet still other embodiment of a coaxial cable connector depicted in FIG. 48 and having the embodiment of the yet still other electrical continuity member depicted in FIG. 43.
Figure 50:
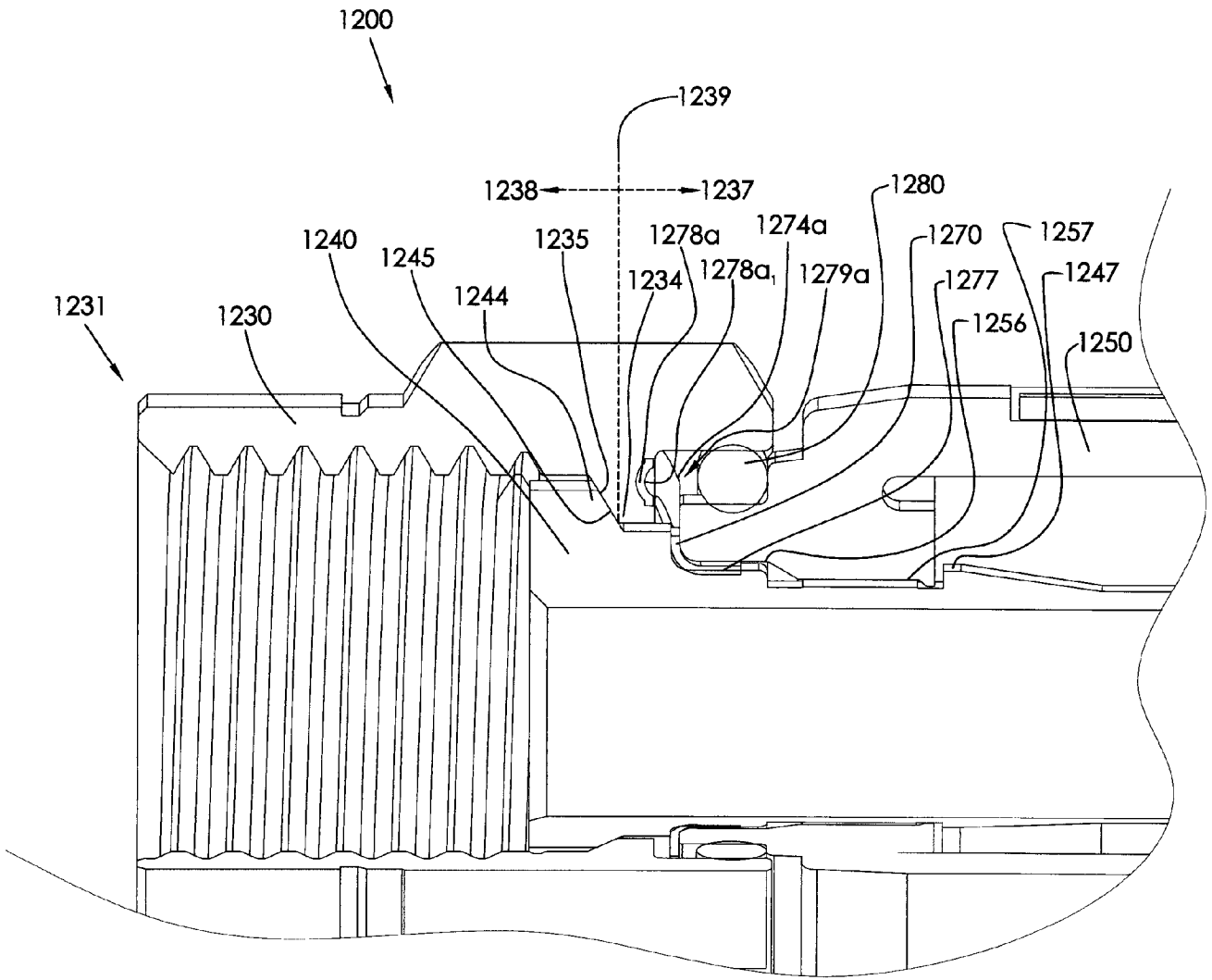
FIG. 50 depicts a blown-up perspective cut-away view of a portion of the yet still other embodiment of a coaxial cable connector depicted in FIG. 48 and having the embodiment of the yet still other electrical continuity member depicted in FIG. 43.
Figure 51:
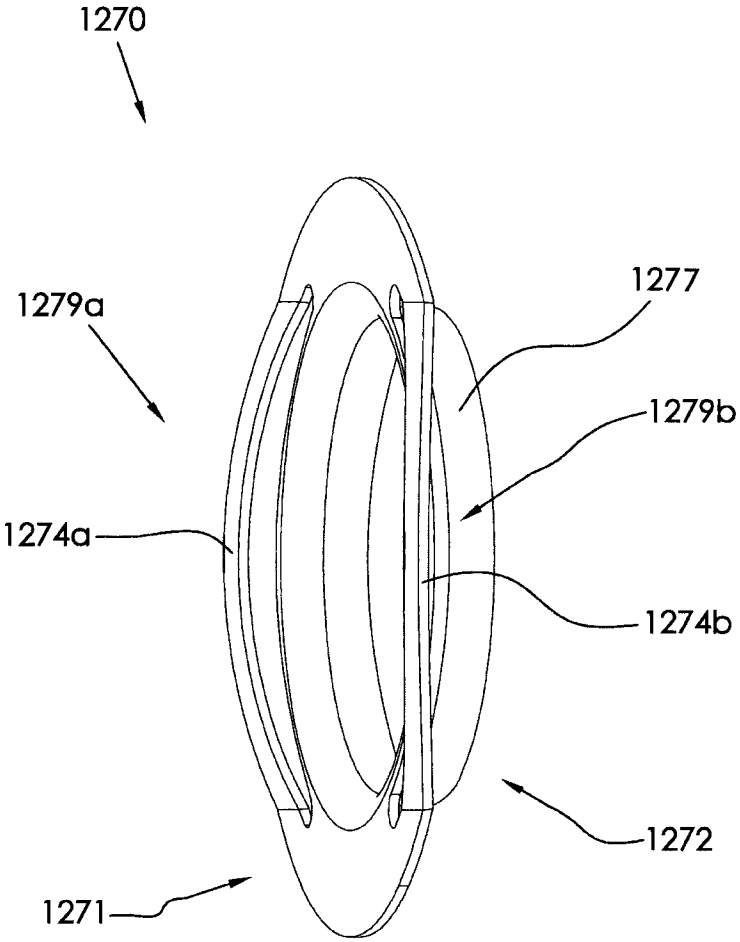
FIG. 51 depicts a perspective view of the embodiment of an electrical continuity member depicted in FIG. 43, yet without nut contact tabs.
Figure 52:
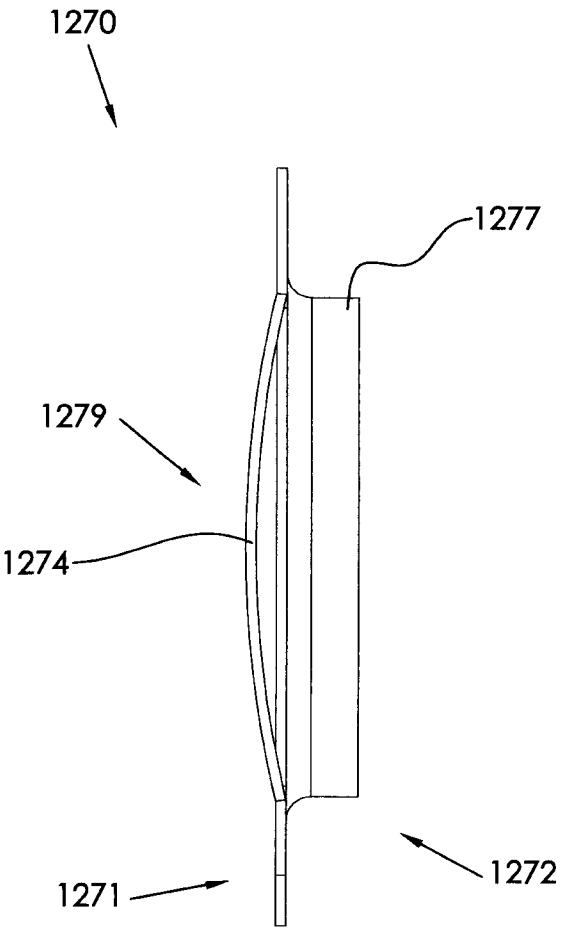
FIG. 52 depicts a side view of the embodiment of the electrical continuity member depicted in FIG. 51.

An embodiment of an electrical continuity member 1170 may comprise a simple continuous band, which, when assembled within embodiments of a coaxial cable connector 1100, encircles a portion of the post 1140, and is in turn surrounded by the second end portion 1137 of the nut 1130. The band-like continuity member 1170 resides rearward a second end portion 1137 of the nut that starts at a side 1135 of the lip 1134 of the nut 1130 facing the first end 1131 of the nut 1130 and extends rearward to the second end 1132 of the nut. The simple band-like embodiment of an electrical continuity member 1170 is thin enough that it occupies an annular space between the second end portion 1137 of the nut 1130 and the post 1140, without causing the post 1140 and nut 1130 to bind when rotationally moved with respect to one another. The nut 1130 is free to rotate, and has some freedom for slidable axial movement, with respect to the connector body 1150. The band-like embodiment of an electrical continuity member 1170 can make contact with both the nut 1130 and the post 1140, because it is not perfectly circular (see, for example, FIG. 42 depicted the slightly oblong shape of the continuity member 1170). This non-circular configuration may maximize the beam length between contact points, significantly reducing stress in the contact between the nut 1130, the post 1140 and the electrical continuity member 1170. Friction may also be significantly reduced because normal force is kept low based on the structural relationship of the components; and there are no edges or other friction enhancing surfaces that could scrape on the nut 1130 or post 1140. Rather, the electrical continuity member 1170 comprises just a smooth tangential-like contact between the component elements of the nut 1130 and the post 1140. Moreover, if permanent deformation of the oblong band-like continuity member 1170 does occur, it will not significantly reduce the efficacy of the electrical contact, because if, during assembly or during operation, continuity member 1170 is pushed out of the way on one side, then it will only make more substantial contact on the opposite side of the connector 1100 and corresponding connector 1100 components. Likewise, if perchance the two relevant component surfaces of the nut 1130 and the post 1140 that the band-like continuity member 1170 interacts with have varying diameters (a diameter of a radially inward surface of the nut 1130 and a diameter of a radially outward surface of the post 1140) vary in size between provided tolerances, or if the thickness of the band-like continuity member 1170 itself varies, then the band-like continuity member 1170 can simply assume a more or less circular shape to accommodate the variation and still make contact with the nut 1130 and the post 1140. The various advantages obtained through the utilization of a band-like continuity member 1170 may also be obtained, where structurally and functionally feasible, by other embodiments of electrical continuity members described herein, in accordance with the objectives and provisions of the present invention.

Referencing the drawings still further, it is noted that FIGS. 43-53 depict different views of another coaxial cable connector 1200, the connector 1200 including various embodiments of an electrical continuity member 1270. The electrical continuity member 1270, in a broad sense, has some physical likeness to a disc having a central circular opening and at least one section being flexibly raised above the plane of the disc; for instance, at least one raised flexible portion 1279 of the continuity member 1270 is prominently distinguishable in the side views of both FIG. 46 and FIG. 52, as being arched above the general plane of the disc, in a direction toward the first end 1271 of the continuity member 1270. The electrical continuity member 1270 may include two symmetrically radially opposite flexibly raised portions 1279*a-b* physically and/or functionally associated with nut contact portions 1274*a-b*, wherein nut contact portions 1274*a-b* may each respectively include a nut contact tab 1278*a-b*. As the flexibly raised portions 1279*a-b* arch away from the more generally disc-like portion of the electrical continuity member 1270, the flexibly raised portions (being also associated with nut contact portions 1274*a-b*) make resilient and consistent physical and electrical contact with a conductive surface of the nut 1230, when operably assembled to obtain electrical continuity in the coaxial cable connector 1200. The surface of the nut 1230 that is contacted by the nut contact portion 1274 resides within the second end portion 1237 of the nut 1230.

The electrical continuity member 1270 may optionally have nut contact tabs 1278*a-b*, which tabs 1278*a-b* may enhance the member's 1270 ability to make consistent operable contact with a surface of the nut 1230. As depicted, the tabs 1278*a-b* comprise a simple bulbous round protrusion extending from the nut contact portion. However, other shapes and geometric design may be utilized to accomplish the advantages obtained through the inclusion of nut contact tabs 1278*a-b*. The opposite side of the tabs 1278*a-b* may correspond to circular detents or dimples 1278$a_1$-$b_1$. These oppositely structured features 1278$a_1$-$b_1$ may be a result of common manufacturing processes, such as the natural bending of metallic material during a stamping or pressing process possibly utilized to create a nut contact tab 1278.

As depicted, embodiments of an electrical continuity member 1270 include a cylindrical section extending axially in a lengthwise direction toward the second end 1272 of the continuity member 1270, the cylindrical section comprising a post contact portion 1277, the post contact portions 1277 configured so as to make axially lengthwise contact with the post 1240. Those skilled in the art should appreciated that other geometric configurations may be utilized for the post contact portion 1277, as long as the electrical continuity member 1270 is provided so as to make consistent physical and electrical contact with the post 1240 when assembled in a coaxial cable connector 1200.

The continuity member 1270 should be configured and positioned so that, when the coaxial cable connector 1200 is assembled, the continuity member 1270 resides rearward the start of a second end portion 1237 of the nut 1230, wherein the second end portion 1237 begins at a side 1235 of the lip 1234 of the nut 1230 facing the first end 1231 of the nut 1230 and extends rearward to the second end 1232 of the nut 1230. The continuity member 1270 contacts the nut 1230 in a location relative to a second end portion 1237 of the nut 1230. The second end portion 1237 of the nut 1230 extends from the second end 1232 of the nut 1230 to the axial location of the nut 1230 that corresponds to the point of the forward facing side 1235 of the internal lip 1234 that faces the first forward end 1231 of the nut 1230 that is also nearest the second rearward end 1232 of the nut 1230. Accordingly, the first end portion 1238 of the nut 1230 extends from the first end 1231 of the nut 1230 to that same point of the side of the lip 1234 that faces the first end 1231 of the nut 1230 that is nearest the second end 1232 of the nut 1230. For convenience, dashed line 1239 (see FIGS. 49-50, and 53), depicts the axial point and a relative radial perpendicular plane defining the demarcation of the first end portion 1238 and the second end portion 1237 of embodiments of the nut 1230. As such, the continuity member 1270 does not reside between opposing complimentary surfaces 1235 and 1245 of the lip 1234 of the nut 1230 and the flange 1244 of the post 40. Rather, the continuity member 1270 contacts the nut 1230 at a location other than on the side of the lip 1234 of the nut 1230 that faces the flange 1244 of the post 1240, at a rearward location only pertinent to the second end 1237 portion of the nut 1230.

Various other component features of a coaxial cable connector 1200 may be included with a connector 1200. For example, the connector body 1250 may include an internal detent 1256 positioned to help accommodate the operable location of the electrical continuity member 1270 as located between the post 1240, the body 1250, and the nut 1230. Moreover, the connector body 1250 may include a post mounting portion 1257 proximate the first end 1251 of the body 1250, the post mounting portion 1257 configured to securely locate the body 1250 relative to a portion 1247 of the outer surface of post 1240, so that the connector body 1250 is axially secured with respect to the post 1240. Notably, the nut 1230, as located with respect to the electrical continuity member 1270 and the post 1240, does not touch the body. A body sealing member 1280 may be positioned proximate the second end portion of the nut 1230 and snugly around the connector body 1250, so as to form a seal in the space therebetween.

Figure 53:
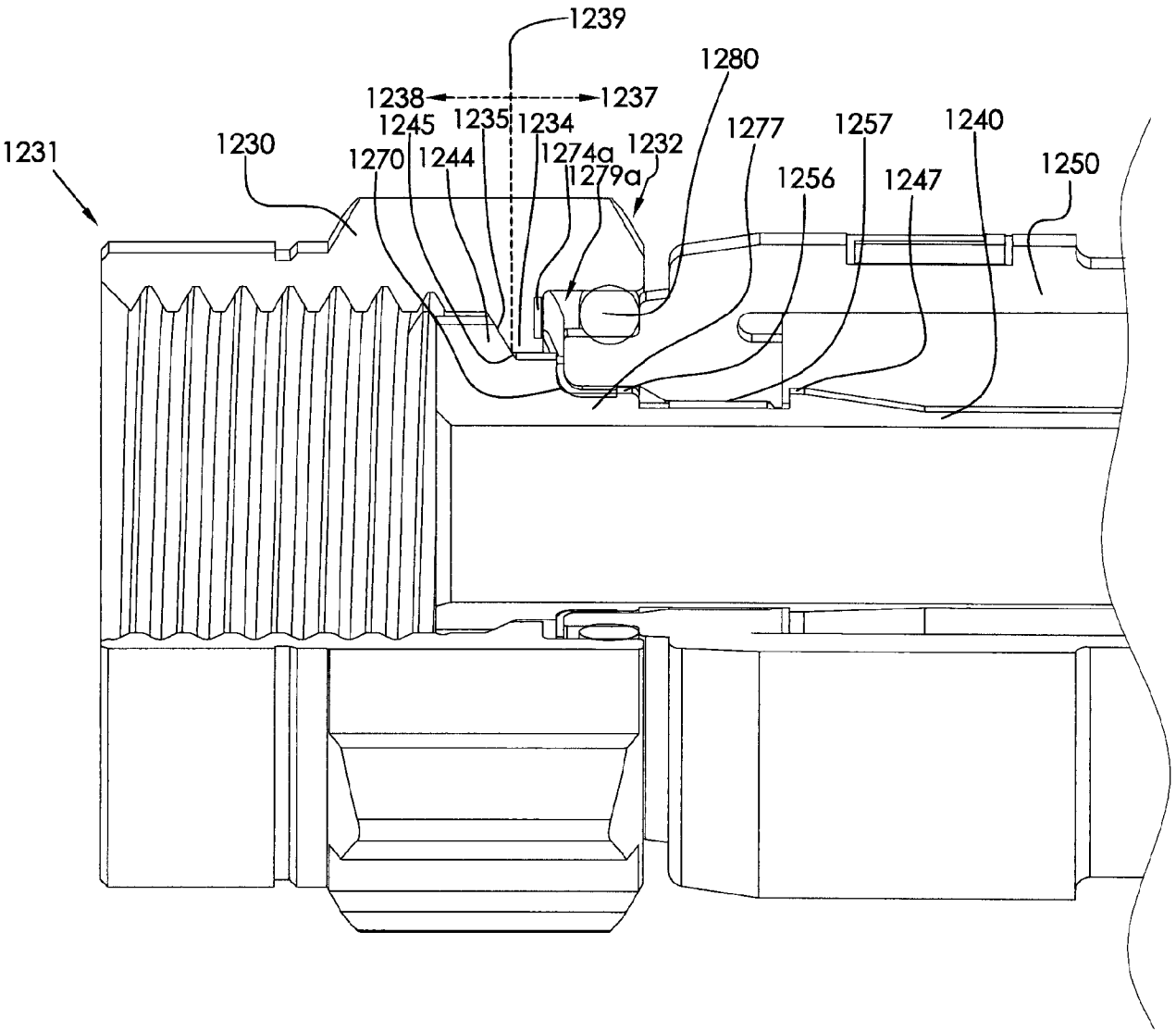
FIG. 53 depicts a perspective cut-away view of a portion of an embodiment of a coaxial cable connector having the embodiment of the electrical continuity member depicted in FIG. 51.

With respect to FIGS. 1-53, a method of obtaining electrical continuity for a coaxial cable connection is described. A first step includes providing a coaxial cable connector 100/900/1000/1100/1200 operable to obtain electrical continuity. The provided coaxial cable connector 100/900/1000/1100/1200 includes a connector body 50/950/1050/1150/1250 and a post 40/940/1040/1140/1240 operably attached to the connector body 50/950/1050/1150/1250, the post 40/940/1040/1140/1240 having a flange 44/944/1044/1144/1244. The coaxial cable connector 100/900/1000/1100/1200 also includes a nut 30/930/1030/1130/1230 axially rotatable with respect to the post 40/940/1040/1140/1240 and the connector body 50/950/1050/1150/1250, the nut 30/930/1030/1130/1230 including an inward lip 34/934/1034/1134/1234. In addition, the provided coaxial cable connector includes an electrical continuity member 70/170/270/370/470/570/670/770/870/970/1070/1170/1270 disposed axially rearward of a surface 35/935/1035/1135/1235 of the internal lip 34/934/1034/1134/1234 of the nut 30/930/1030/1130/1230 that faces the flange 44/944/1044/1144/1244 of the post 40/940/1040/1140/1240. A further method step includes securely attaching a coaxial cable 10 to the connector 100/900/1000/1100/1200 so that the grounding sheath or shield 14 of the cable electrically contacts the post 40/940/1040/1140/1240. Moreover, the methodology includes extending electrical continuity from the post 40/940/1040/1140/1240 through the continuity member 70/170/270/370/470/570/670/770/870/970/1070/1170/1270 to the nut 30/930/1030/1130/1230. A final method step includes fastening the nut 30/930/1030/1130/1230 to a conductive interface port 20 to complete the ground path and obtain electrical continuity in the cable connection, even when the nut 30/930/1030/1130/1230 is not fully tightened onto the port 20, because only a few threads of the nut onto the port are needed to extend electrical continuity through the nut 30/930/1030/1130/1230 and to the cable shielding 14 via the electrical interface of the continuity member 70/170/270/370/470/570/670/770/870/970/1070/1170/1270 and the post 40/940/1040/1140/1240.

Referring now to FIGS. 54A-77, embodiments of connector 1300-1323 may include a coupling member 1330, a post 1340, a connector body 1350, a continuity member 1370, a sleeve 1390, a compression portion 1360, and a radial restriction member 1365. Embodiments of coupling member 1330 may be coupling member 1330*a*, 1330*b*, or 1330*c* described in further detail infra. Embodiments of sleeve 1390 may be sleeve 1390*a*, 1390*b*, 1390*c*, 1390*d*, 1390*e*, 1390*f*, 1390*g*, or 1390*h*, described in further detail infra. Similarly, embodiments of compression portion 1360 may be 1360*a*, described in further detail infra. Embodiments of radial restriction member 1365 may be 1365*a*, 1365*b*, or 1365*c*, described in further detail infra. Furthermore, embodiments of post 1340 and connector body 1350 may share the same or substantially the same structural and functional aspects of the embodiments of post 40/940/1040/1140/1240 and connector body 50/950/1050/1150/1250 described supra. Embodiments of continuity member 1370 may be disposed in the same or substantially the same location in a connector 100/900/1000/1100/1200/1300-1323 and may share the same structural and functional aspects of continuity member 70/170/270/370/470/570/670/970/1070/1170/1270, as described supra. However, continuity member 1370 may share the same structural and functional aspects of continuity member 770/870 if a connector body, such as connector body 1350, is appropriately modified to accommodate the continuity member, such as continuity member 770/870. Connectors 1300-1323 may come in a preassembled configuration or may require additional operable attachment of the sleeve 1390 to connector 1300-1323 during installation.

Figure 54A:
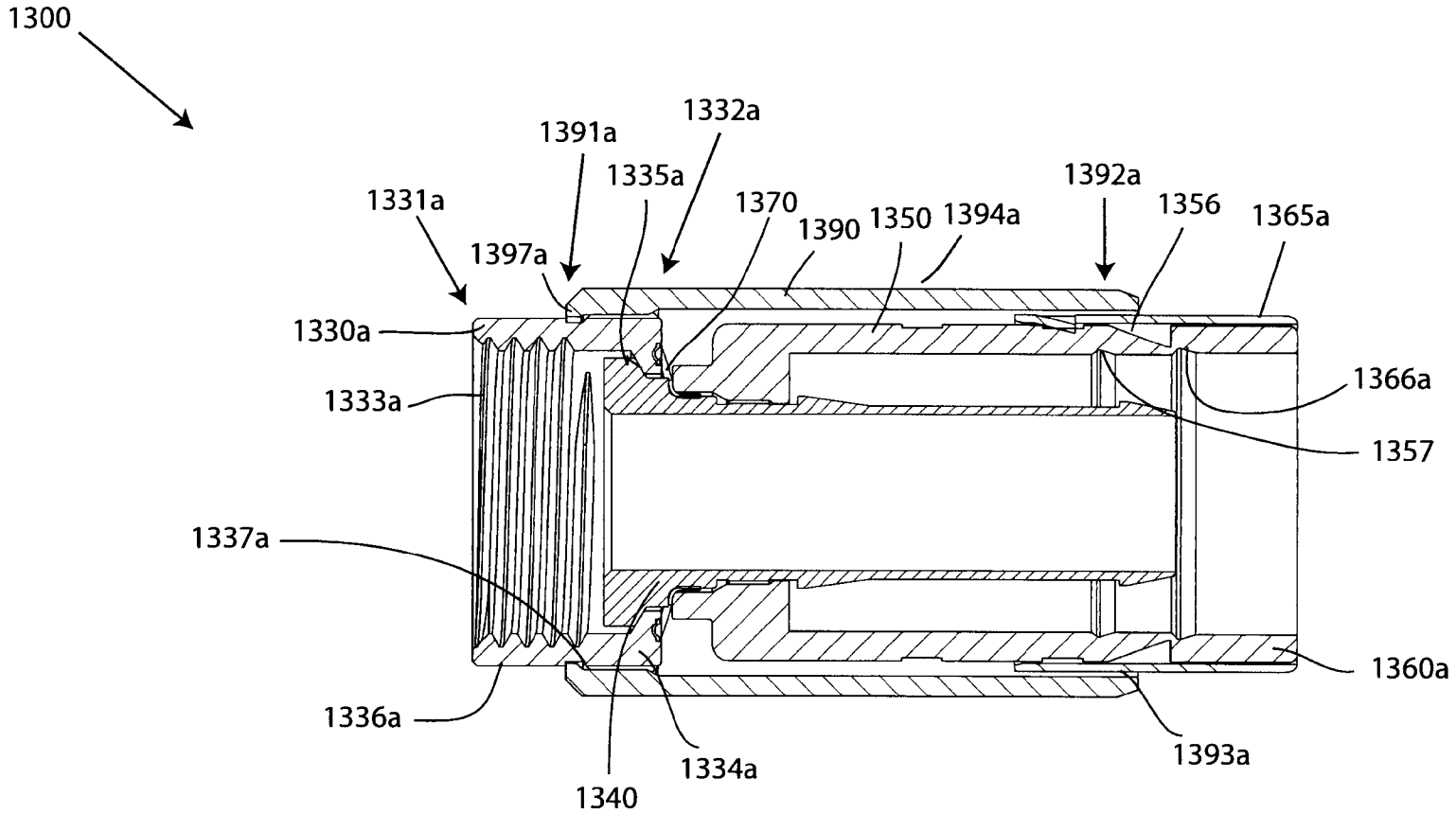
FIG. 54A depicts a cross-section view of a first embodiment of a coaxial cable connector including an embodiment of a continuity member, an embodiment of a sleeve, an embodiment of a compression portion, and an embodiment of a radial restriction member.

With reference to FIG. 54A, embodiments of connector 1300 may include a coupling member 1330*a*, a post 1340, a connector body 1350, a continuity member 1370, an outer sleeve 1390*a*, a compression portion 1360*a*, and a radial restriction member 1365*a*.

Embodiments of connector 1300 may include a coupling member 1330*a*. Coupling member 1330*a* may share some of the structural and functional aspects of nut 30/930/1030/1130/1230, such as being mated, threaded or otherwise, to a corresponding interface port 20. Further, the coupling member 1330*a* may include a first end 1331*a*, a second end 1332*a*, an inner surface 1333*a*, an outer surface 1336*a*, an internal lip 1334*a*, such as an annular protrusion, located proximate the second rearward end 1332*a* of the coupling member 1330*a*, wherein the internal lip 1334*a* includes a surface 1335*a* facing the first forward end 1331*a* of the coupling member 1330*a*. However, the internal lip 1334*a* of coupling member 1330*a* may define the second end 1332*a* of the coupling member 1330*a*, eliminating excess material from the coupling member 1330*a*. Located somewhere on the outer surface 1336*a* of the coupling member 1330*a* may be a retaining structure 1337*a*. The retaining structure 1337*a* of the coupling member 1330*a* may be an annular groove or recess that extends completely or partially around the outer surface 1336*a* of the coupling member 1330*a* to retain, accommodate, receive, or mate with an engagement member 1397 of the sleeve 1390. Alternatively, the retaining structure 1337*a* may be an annular protrusion that extends completely or partially around the outer surface 1336*a* of the coupling member 1330*a* to retain or mate with the engagement member 1397 of the sleeve 1390. The retaining structure 1337*a* may be placed at various axial positions from the first end 1331*a* to the 1332*a*, depending on the configuration of the sleeve 1390 and other design requirements of connector 1300.

Moreover, embodiments of coupling member 1330*a* may include an outer surface feature 1338*a* proximate or otherwise near the second end 1332*a* to improve mechanical interference or friction between the coupling member 1330*a* and the sleeve 1390. For instance, the outer surface feature 1338*a* may extend completely or partially around the outer surface 1336*a* proximate the second 1332*a* of the coupling member 1330*a* to increase a retention force between an inner surface 1393 of the sleeve 1390 and the outer surface 1336*a* of the coupling member 1330*a*. The outer surface feature 1338*a* may include a knurled surface, a slotted surface, a plurality of bumps, ridges, grooves, or any surface feature that may facilitate contact between the sleeve 1390 and the coupling member 1330*a*. In one embodiment, the coupling member 1330 may be referred to as a press-fit nut. Embodiments of the coupling member 1330*a* may be formed of conductive materials, such as copper, brass, aluminum, or other metals or metal alloys, facilitating grounding through the coupling member 1330*a*. Accordingly, the coupling member 1330*a* may be configured to extend an electromagnetic buffer by electrically contacting conductive surfaces of an interface port 20 when connector 1300 is advanced onto the port 20.

Embodiments of connector 1300 may also include an outer sleeve 1390*a*. The sleeve 1390*a* may be engageable with the coupling member 1330*a*. The sleeve 1390*a* may include a first end 1391*a*, a second 1391*a*, an inner surface 1393*a*, and an outer surface 1394*a*. The sleeve 1390*a* may be a generally annular member having a generally axial opening therethrough. The sleeve 1390*a* may be radially disposed over the coupling member 1330*a*, or a portion thereof, the connector body 1350, or a portion thereof, and the compression portion 1360 and radial restriction member 1365, or a portion thereof, while operably assembled and/or in a compressed position. Proximate or otherwise near the first end 1391*a*, the sleeve 1390*a* may include an engagement member 1397*a* configured to mate or engage with the retaining structure 1337 of the coupling member 1330. The engagement member 1397*a* may be an annular lip or protrusion that may enter or reside within the retaining structure 1337 of the coupling member 1330. For example, in embodiments where the retaining structure 1337 is an annular groove, the engagement member 1397*a* may be a protrusion or lip that may snap into the groove located on the coupling member 1330 to retain the sleeve 1390*a* in a single axial position. In other words, the cooperating surfaces of the groove-like retaining structure 1337 and the lip or protruding engagement member 1397*a* may prevent axial movement of the sleeve 1390*a* once the connector 1300 is in an assembled configuration. Alternatively, the engagement member 1397*a* may be an annular groove or recess that may receive or engage with the retaining structure 1337 of the coupling member 1330. For example, in embodiments where the retaining structure 1337 of the coupling member 1330 is an annular protrusion, the engagement member 1397*a* may be a groove or recess that may allow the annular protruding retaining structure 1337 of the coupling member 1330 to snap into to retain the sleeve 1390*a* in a single axial position. In other words, the cooperating surfaces of the protruding retaining structure 1337 and the groove-like engagement member 1397*a* may prevent axial movement of the sleeve 1390*a* once the connector 1300 is in an assembled configuration. Those having skill in the art should understand that various surface features effectuating cooperating surfaces between the coupling member 1330 and the sleeve 1390*a* may be implemented to retain the sleeve 1390*a* with respect to the rest of the connector 1300 in an axial direction. Furthermore, the engagement member 1397*a* of the sleeve 1390*a* may be segmented such that one or more gaps may separate portions of the engagement member 1397*a*, while still providing sufficient structural engagement with the retaining structure 1337.

Figure 54B:
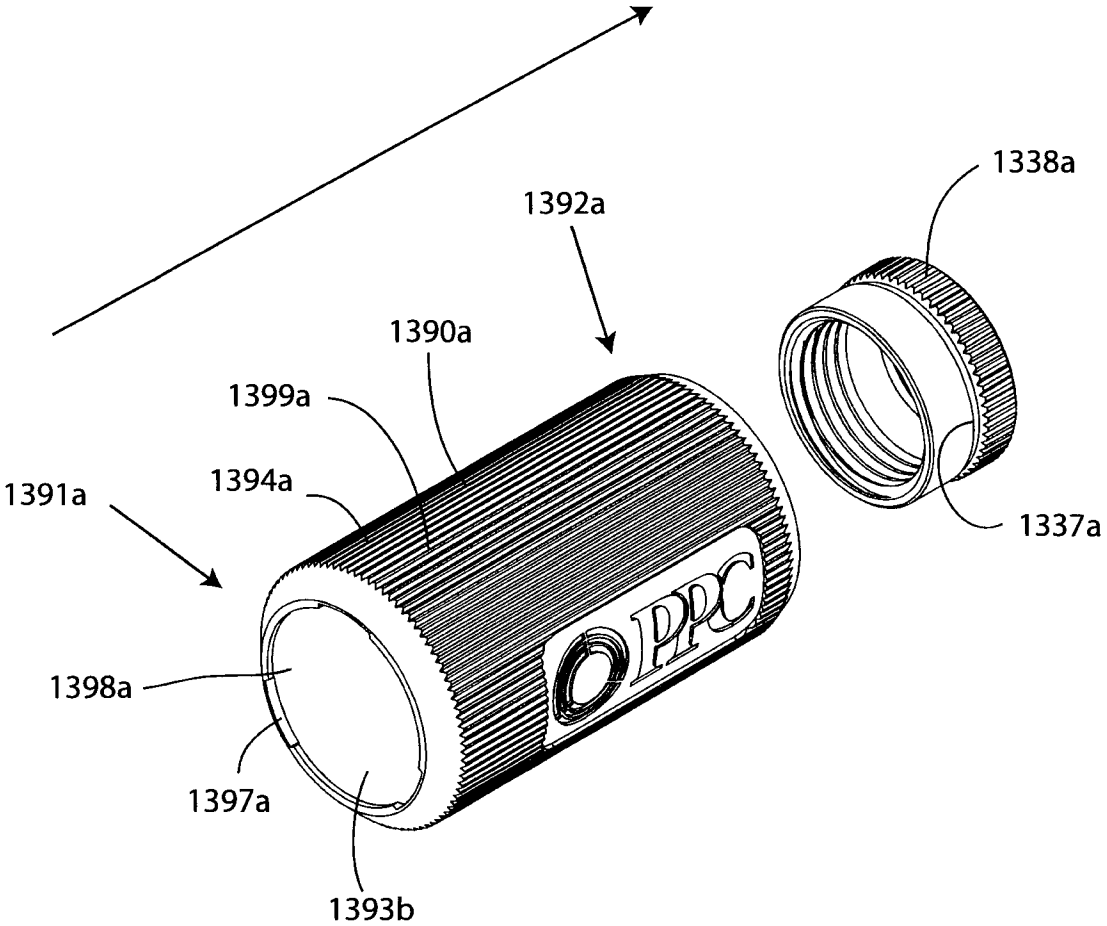
FIG. 54B depicts a perspective view of an embodiment of a sleeve and an embodiment of a coupling member.

An embodiment of an assembled configuration of connector 1300 with respect to the sleeve 1390*a* may involve sliding the sleeve 1390*a* over the coupling member 1330 in an axial direction starting from the first end 1331 and continuing toward the second end 1332 of the coupling member 1330 until sufficient mating and/or engagement occurs between the engagement member 1397*a* of the sleeve 1390*a* and the retaining structure 1337 of the coupling member 1330, as shown in FIG. 54B. Once in the assembled configuration, rotation of the sleeve 1390*a* may in turn cause the coupling member 1330 to simultaneously rotate in the same direction as the sleeve 1390*a* due to mechanical interference between the inner surface 1393*a* of the sleeve 1390*a* and the outer surface 1336 of the coupling member 1330. In some embodiments, the interference between the sleeve 1390*a* and the coupling member 1330 relies simply on a friction fit or interference fit between the components. Other embodiments include a coupling member 1330 with an outer surface feature 1338, as described supra, to improve the mechanical interference between the components. Further embodiments include a sleeve 1390*a* with internal surface features 1398*a* positioned on the inner surface 1393*a* to improve the contact between the components. Even further embodiments of connector 1300 may include a sleeve 1390*a* and a coupling member 1330*a* both having surface features 1398*a*, 1338*a*, respectively. Embodiments of the inner surface features 1398*a* of the sleeve 1390*a* may include a knurled surface, a slotted surface, a plurality of bumps, ridges, grooves, or any surface feature that may facilitate contact between the sleeve 1390*a* and the coupling member 1330. In many embodiments, the inner surface features 1398*a* of the sleeve 1390*a* and the inner surface features 1338 of the coupling member may structurally correspond with each other. For example, the inner geometry of the sleeve 1390*a* may reflect and/or structurally correspond with the outer geometric shape of the coupling member 1330. Due to the engagement between the sleeve 1390*a* and the coupling member 1330, a user may simply grip and rotate/twist the sleeve 1390*a* to thread the coupling element 1330 onto an interface port, such as interface port 20. Further still, embodiments of the sleeve 1390*a* may include outer surface features 1399*a*, such as annular serrations or slots, configured to enhance gripping of the sleeve 1390*a* while connecting the connector 1300 onto an interface port. The sleeve 1390*a* may be formed of materials such as plastics, polymers, bendable metals or composite materials that facilitate a rigid body. Further, the sleeve 1390*a* may be formed of conductive or non-conductive materials or a combination thereof. Manufacture of the sleeve 1390*a* may include casting, extruding, cutting, turning, drilling, knurling, injection molding, spraying, blow molding, component overmolding, combinations thereof, or other fabrication methods that may provide efficient production of the component.

Figure 54C:
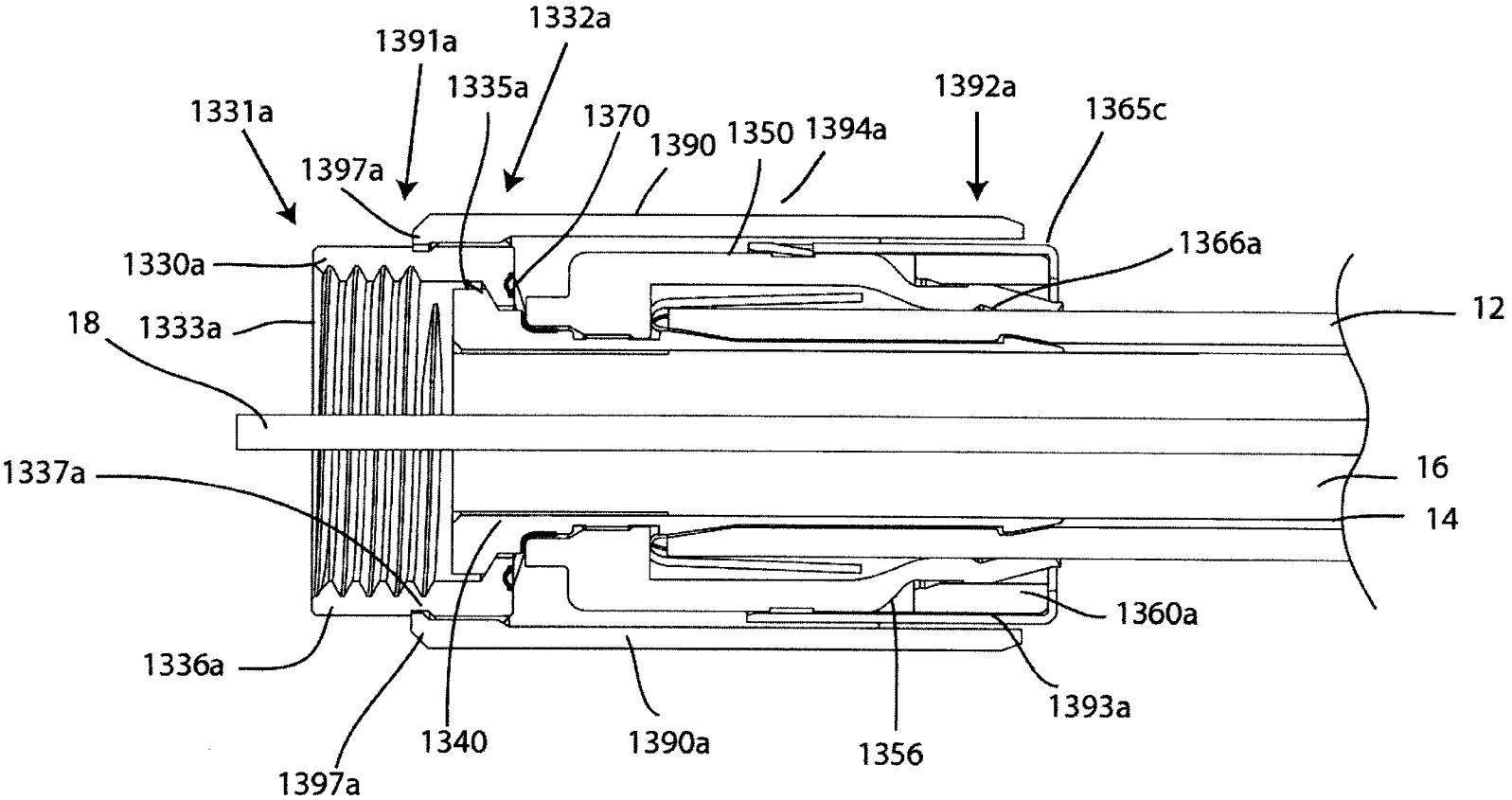
FIG. 54C depicts a cross-section view of an embodiment of a compression portion in a compressed position.

Referring still to FIG. 54A, embodiments of connector 1300 may include a compression portion 1360*a*. Compression portion 1360*a* may be operably attached to the connector body 1350. For instance, the compression portion 1360*a* may be structurally integral with the connector body 1350, wherein the compression portion 1360*a* separates from the connector body 1350 upon an axial force which in turn radially compresses the second end of the connector body 1350 onto the coaxial cable 10, as shown in FIG. 54C. In other words, the compression portion 1360*a* may have a frangible connection with the connector body 1350. The structural connection between the connector body 1350 and the compression portion 1360*a* may be thin or otherwise breakable when compressive, axial force is applied (e.g. by an axial compression tool). Moreover, the structural connection or configuration between the connector body 1350 and the compression portion 1360*a* may be defined by an internal annular notch 1366*a* or groove of the compression portion 1360*a* and an outer ramped surface 1356 of the connector body 1350. The connector body 1350 may further include an internal annular notch 1357 or groove to structurally facilitate the deformation of the connector body 1350 proximate a rearward second end. The compression portion 1360*a* may be formed of the same material as connector body 1350 because they may be structurally integral with each other. For example, the compression portion 1360*a* may be comprised of materials such as plastics, polymers, bendable metals or composite materials that facilitate a rigid body. Further, the compression portion 1360*a* may be formed of conductive or non-conductive materials or a combination thereof. Manufacture of the compression member 1360*a* may include casting, extruding, cutting, turning, drilling, knurling, injection molding, spraying, blow molding, component overmolding, combinations thereof, or other fabrication methods that may provide efficient production of the component.

Furthermore, embodiments of connector 1300 may include a radial restriction member 1365*a*. The radial restriction member 1365*a* may be a bushing or similar annular tubular member disposed proximate the rearward second end of the connector body 1350. For instance, the radial restriction member 1365*a* may surround the compression portion 1360*a* and a portion of the connector body 1350 proximate the rearward second end. The radial restriction member 1365*a* may be a generally annular, hollow cylindrically-shaped sleeve-like member comprised of stainless steel or other substantially rigid materials which may structurally assist the crack and seal process of compression portion 1360*a*. For instance, when the compression portion 1360*a* is axially compressed in a direction towards the coupling member 1330, the radial restriction member 1365*a* may axially displace along with the compression portion 1360*a* and may prevent the compression portion 1360*a* from splintering or otherwise displacing in a direction other than substantially axial towards the coupling member 1330.

Figure 54D:
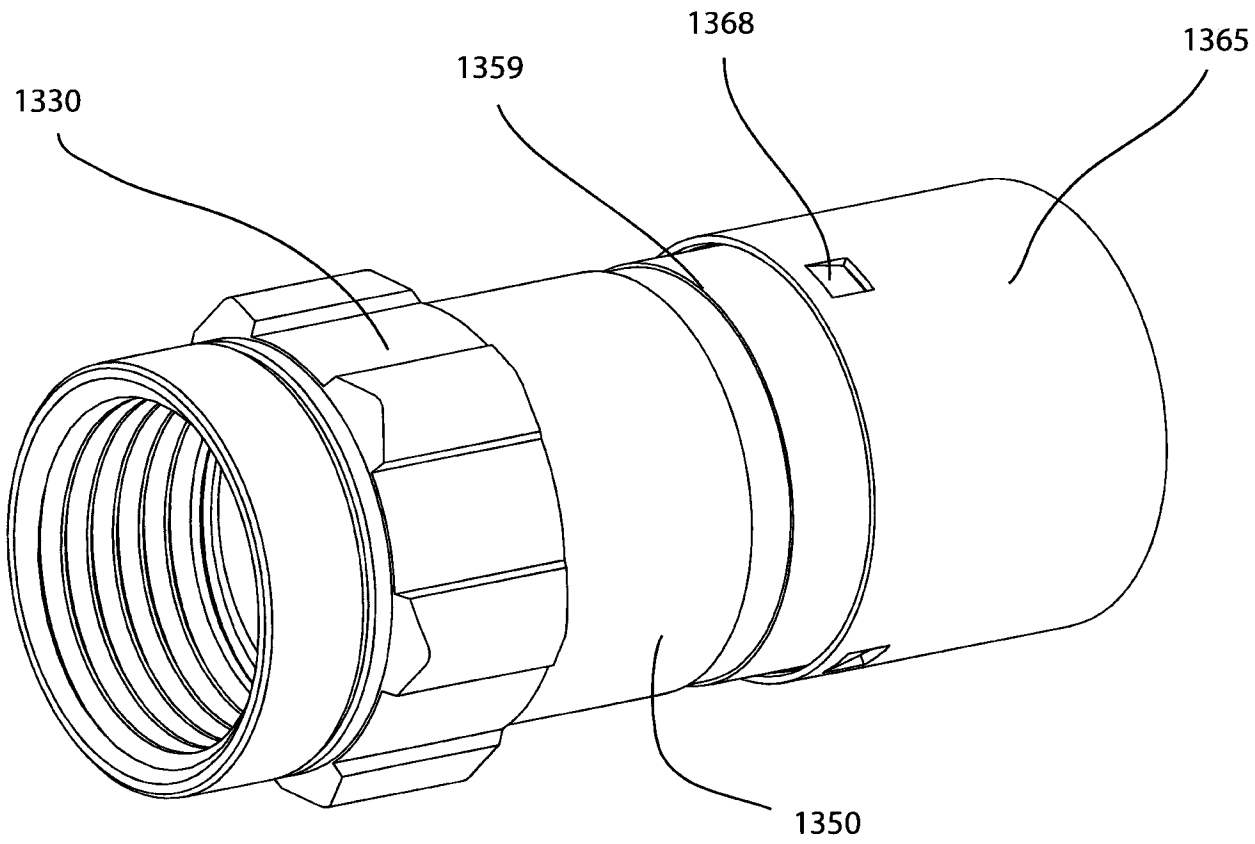
FIG. 54D depicts a perspective view of an embodiment of a coaxial cable connector having an embodiment of a radial restriction member with an embodiment of one or more gripping features.

Moreover, the radial restriction member 1365*a* may include one or more gripping features 1368 for engagement with the connector body 1350, as shown in FIG. 54D. The gripping features 1368 may be inward protrusions configured to engage with a lip 1359 on the outer surface of the connector body 1350. For instance, the lip 1359 of the connector body 1350 may outwardly protrude a radial distance away from the outer surface of the connector body 1350, while the gripping feature 1368 of the radial restriction member 1365*a* may inwardly protrude from an inner surface of the radial restriction member 1365*a*. When the connector, such as connector 1300, is axially compressed in a direction towards the coupling member 1330, the radial restriction member 1365*a* may be axially displaced towards the coupling member 1330. After axially displacing a certain distance towards the coupling member 1330 upon application of an axially compressive force, the gripping features 1368 may pass the lip of the connector body 1350, and then securably engage the lip of the connector body 1350 to prevent axial displacement of the radial restriction member 1365*a* in a direction opposite the coupling member 1330. In some embodiments, the gripping features 1368 may be an inwardly extending ramped surface to alleviate restrictive mechanical interference between the gripping feature 1368 of the radial restriction member 1365*a* and the outer surface of the connector body 1350 as the connector is axially compressed, and may increase the retention force created by the securable engagement between the lip of the connector body 1350 and the radial restriction member 1365*a*. The gripping feature 1368, as described in association with radial restriction member 1365*a*, may also be present in embodiments of radial restriction member 1365*c*, described supra.

Embodiments of the compression portion 1360*a* may create an environmental seal around the coaxial cable 10 when in the fully compressed position. Specifically, when the compression portion 1360 (and potentially the radial restriction member 1365*a*) is axially slid towards the coupling member 1330, the structural connection between the compression portion 1360*a* and the connector body 1350 is severed and the compression portion 1360*a* comes into contact with the outer ramped surface 1356 of the connector body 1350. The severing of the structural connection between the connector body 1350 and the compression portion 1360*a* essentially turns the internal notch 1366*a* into a cooperative ramped surface with the outer ramped surface 1356 of the connector body 1350. Due to the cooperative ramped surfaces, the axial compression (displacement) of the compression portion 1360*a* evenly compresses the second end of the connector body 1350 onto the outer jacket 12 of the coaxial cable and deforms the outer ramped surface 1356, as shown in FIG. 54C. Accordingly, the compression portion 1360*a* and potentially the radial restriction member 1365*a* may be referred to as a crack and seal compression means with a radial restriction member 1365*a*. Those skilled in the requisite art should appreciate that the seal may be created by the compression portion 1360*a* without the radial restriction member 1365*a*. However, the radial restriction member 1365*a* significantly enhances the structural integrity and functional operability of the compression portion, for example, when it is compressed and sealed against an attached coaxial cable 10.

Figure 55:
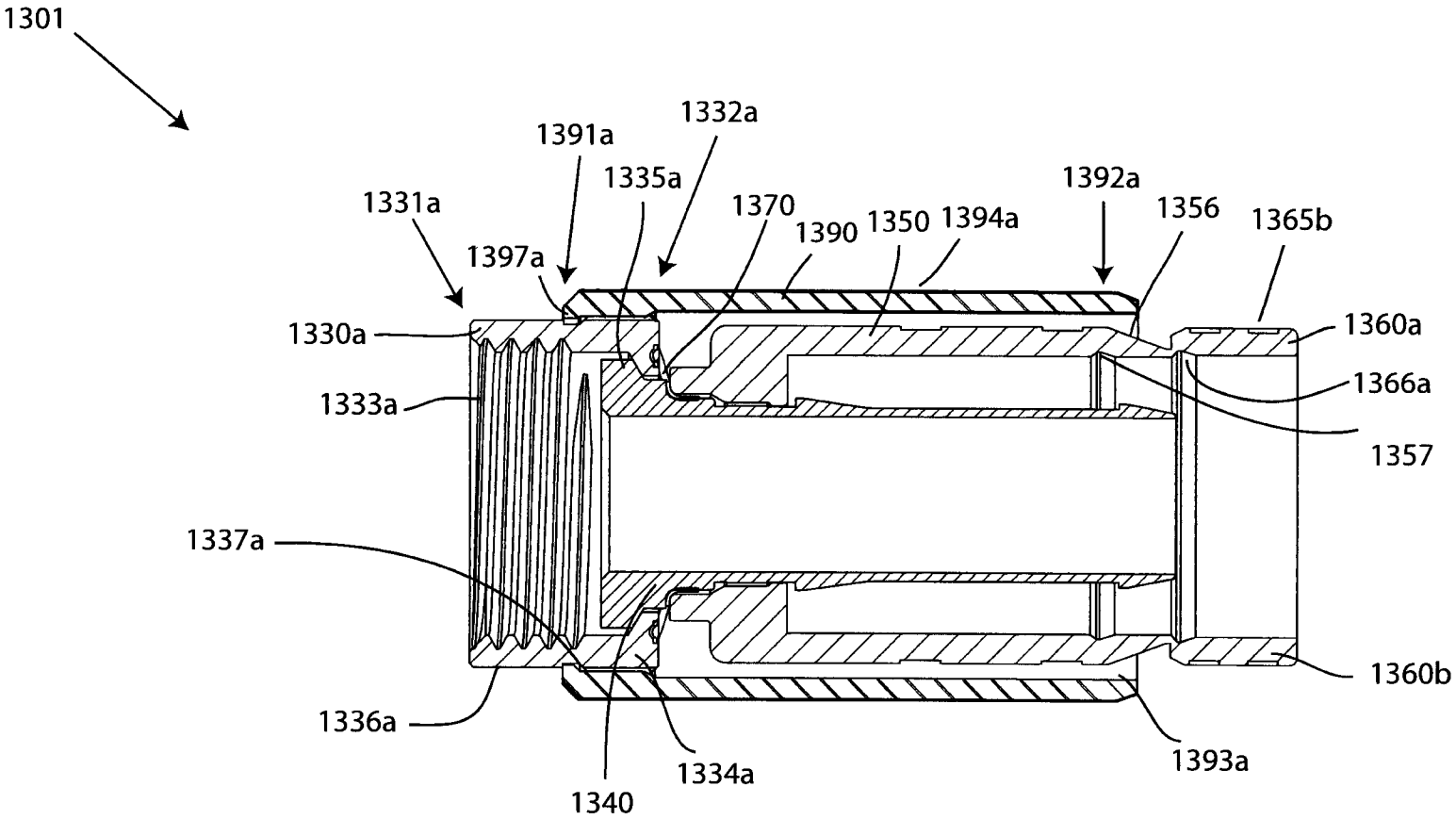
FIG. 55 depicts a cross-section view of a second embodiment of a coaxial cable connector including an embodiment of a continuity member, an embodiment of a sleeve, an embodiment of a compression portion, and an embodiment of a radial restriction member.

Referring now to FIG. 55, embodiments of connector 1301 may include a coupling member 1330*a*, a post 1340, a connector body 1350, a continuity member 1370, a sleeve 1390*a*, a compression portion 1360*a*, and a radial restriction member 1365*b*. Radial restriction member 1365*b* may share the same or substantially the same function as radial restriction member 1365*a*. However, radial restriction member 1365 may be one or more straps or bands that extend annularly around or partially around the compression portion 1360*a*. The radial restriction member 1365*b* may be structurally attached to the compression portion 1360*a* in a variety of methods, such as press-fit, adhesion, cohesion, fastened, etc. For instance, the radial restriction member 1365*b* may reside within annular notches or grooves in the compression portion 1360*a*. The notches or grooves may have various depths to allow the radial restriction member 1365*b* to be flush with the outer surface of the compression portion 1360*a*, to protrude from the outer surface of the compression portion 1360*a*, or to reside completely beneath the outer surface of the compression portion 1360*a*. Moreover, the radial restriction member 1365*b* may be comprised of stainless steel or other substantially rigid materials which may structurally assist the crack and seal process of compression portion 1360*a*. For instance, when the compression portion 1360*a* is axially compressed in a direction towards the coupling member 1330, the radial restriction member 1365*b* may prevent the compression portion 1360*a* from splintering or otherwise displacing in a direction other than substantially axial towards the coupling member 1330.

Figure 56A:
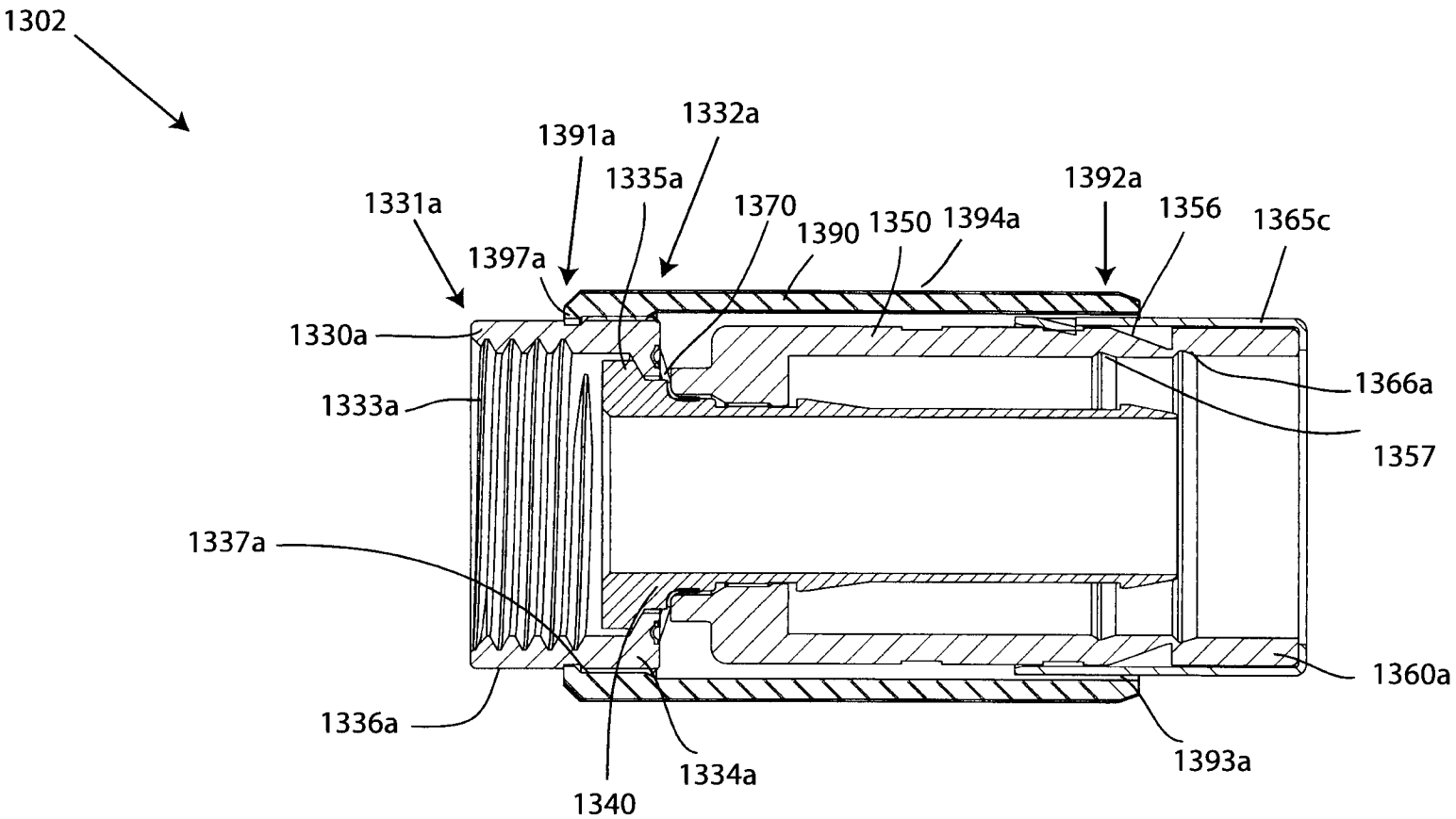
FIG. 56A depicts a cross-section view of a third embodiment of a coaxial cable connector including an embodiment of a continuity member, an embodiment of a sleeve, an embodiment of a compression portion, and an embodiment of a radial restriction member.
Figure 56B:
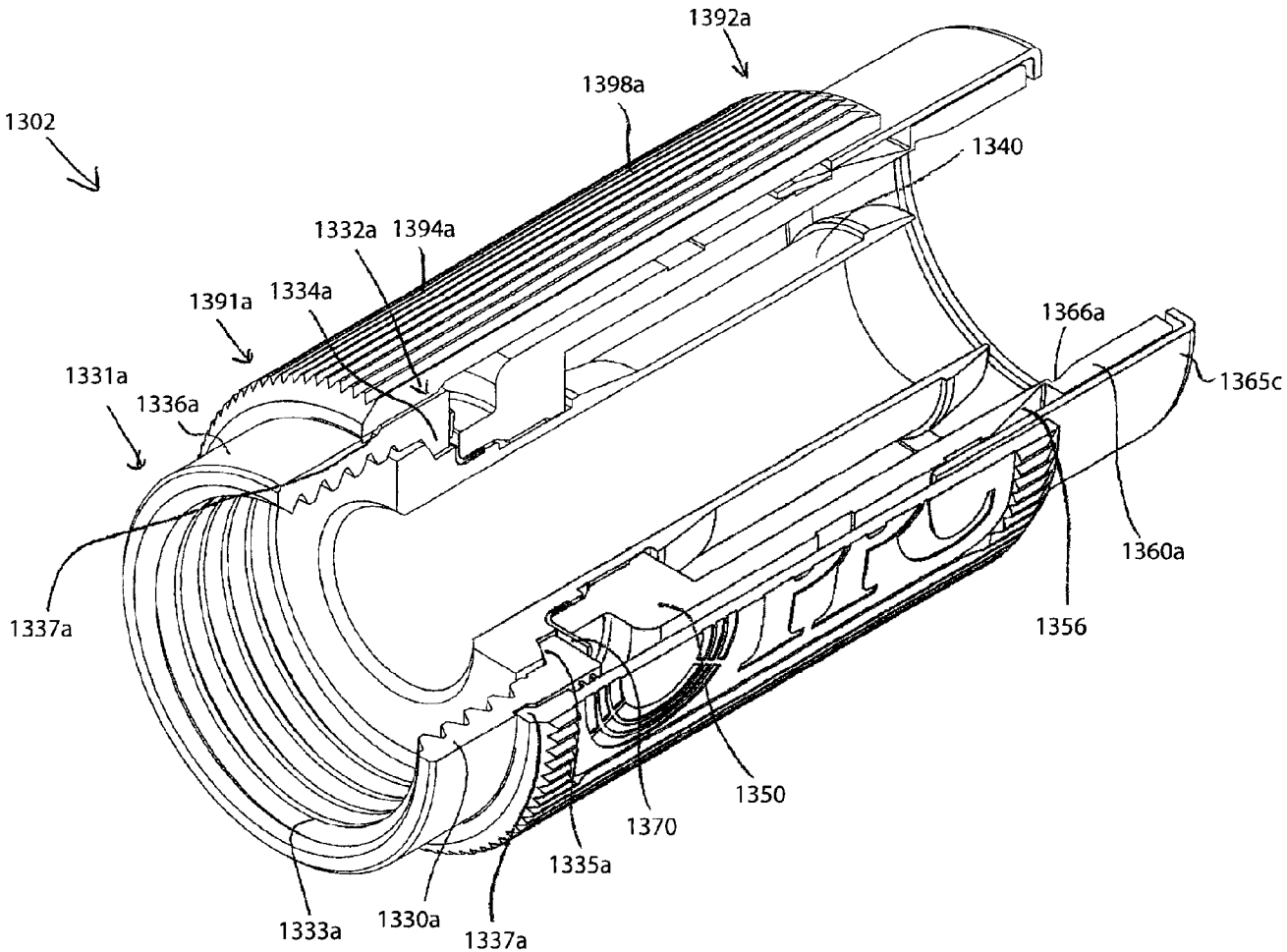
FIG. 56B depicts a perspective view of the third embodiment of the coaxial cable connector, as depicted in FIG. 56.

Referring now to FIGS. 56A and 56B, embodiments of connector 1302 may include a coupling member 1330*a*, a post 1340, a connector body 1350, a continuity member 1370, an outer sleeve 1390*a*, a compression portion 1360*a*, and a radial restriction member 1365*c*. Radial restriction member 1365*c* may share the same or substantially the same function as radial restriction member 1365*a*. However, radial restriction member 1365*c* may be a cap member, or similar generally annular, tubular member having an engagement surface for operable engagement with a compression tool. For instance, embodiments of the radial restriction member 1365*c* may include an internal annular lip or inwardly extending flange proximate a rearward end of the radial restriction member 1365*c*. The radial restriction member 1365*c* may surround or partially surround the compression portion 1360*a* and a portion of the connector body 1350 proximate the rearward second end, wherein the internal annular lip of the radial restriction member 1365*c* may be configured to contact the compression portion 1360*a* prior to or upon axial compression of the connector 1302. The radial restriction member 1365*c* may be comprised of stainless steel or other substantially rigid materials which may structurally assist the crack and seal process of compression portion 1360*a*. For instance, when the compression portion 1360*a* is axially compressed in a direction towards the coupling member 1330, the radial restriction member 1365*c* may axially displace along with the compression portion 1360*a* and may prevent the compression portion 1360*a* from splintering or otherwise displacing in a direction other than substantially axial towards the coupling member 1330. Additionally, the internal lip proximate the rearward end of the radial restriction member 1365*c* may provide an engagement surface for operable engagement with a compression tool, or other device/means that provides the necessary compression to compress seal connector 1302.

Figure 57A:
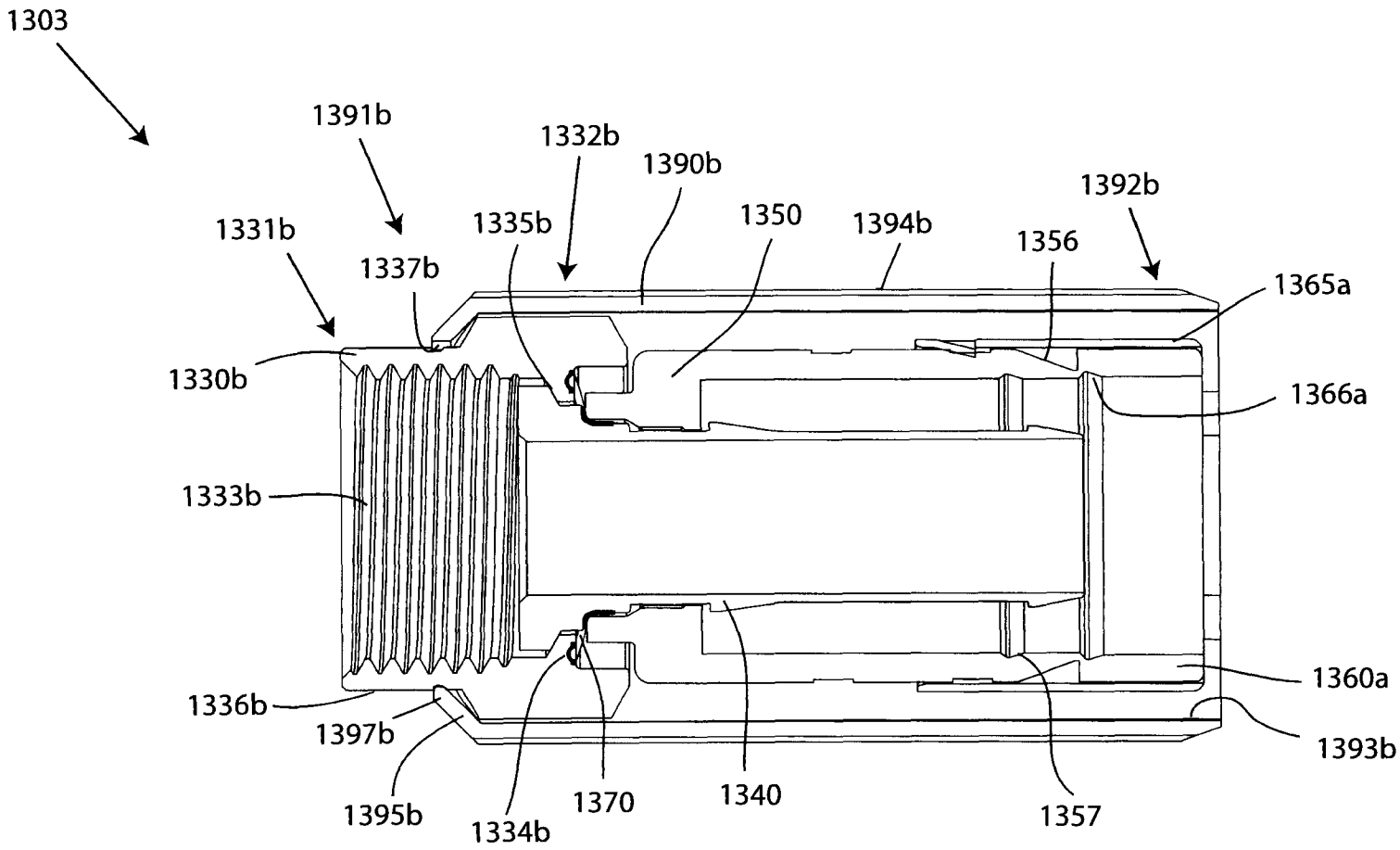
FIG. 57A depicts a cross-section view of a fourth embodiment of a coaxial cable connector including an embodiment of a continuity member, an embodiment of a sleeve, an embodiment of a compression portion, and an embodiment of a radial restriction member

FIG. 57A depicts an embodiment of connector 1303, which includes a coupling member 1330*b*, a post 1340, a connector body 1350, a continuity member 1370, a sleeve 1390*b*, a compression portion 1360*a*, and a radial restriction member 1365*a*.

Embodiments of connector 1303 may include a coupling member 1330*b*. Coupling member 1330*b* may share the same or substantially the same structural and functional aspects of the embodiments of nut 30/930/1030/1130/1230, such as being mated, threaded or otherwise, to a corresponding interface port 20. Accordingly, coupling member 1330*b* may include a first end 1331*b*, a second end 1332*b*, an inner surface 1333*b*, an outer surface 1336*b*, an internal lip 1334*b*, such as an annular protrusion, located proximate the second rearward end 1332*b* of the coupling member 1330*b*, wherein the internal lip 1334*b* includes a surface 1335*b* facing the first forward end 1331*b* of the coupling member 1330*b*. Additionally, coupling member 1330*b* may include a retaining structure 1337*b* on the outer surface 1336*b* of the coupling member 1330*b*. The retaining structure 1337*b* of the coupling member 1330*b* may be an annular groove or recession that extends completely or partially around the outer surface 1336*b* of the coupling member 1330*b* to retain, accommodate, receive, or mate with an engagement member 1397 of the sleeve 1390. Alternatively, the retaining structure 1337*b* may be an annular protrusion that extends completely or partially around the outer surface 1336*b* of the coupling member 1330*b* to retain or mate with the engagement member 1397 of the sleeve 1390. The retaining structure 1337*b* may be placed at various axial positions from the first end 1331*b* to the 1332*b*, depending on the configuration of the sleeve 1390 and other design requirements of the connector.

Moreover, embodiments of coupling member 1330*b* may include an outer surface feature(s) 1338*b* proximate or otherwise near the second end 1332*a* to improve mechanical interference or friction between the coupling member 1330*b* and the sleeve 1390. For instance, the outer surface feature(s) 1338*a* may extend completely or partially around the outer surface 1336*b* proximate the second 1332*b* of the coupling member 1330*b* to increase a retention force between an inner surface 1393 of the sleeve 1390*b* and the outer surface 1336*b* of the coupling member 1330*b*. The outer surface feature 1338*b* may include a plurality of planar surfaces that may facilitate contact between the sleeve 1390 and the coupling member 1330*b*. Embodiments of the coupling member 1330*b* may be formed of conductive materials, such as copper, brass, aluminum, or other metals or metal alloys, facilitating grounding through the coupling member 1330*b*. Accordingly, the coupling member 1330*b* may be configured to extend an electromagnetic buffer by electrically contacting conductive surfaces of an interface port 20 when the coaxial cable connector is advanced onto the port 20.

Figure 57B:
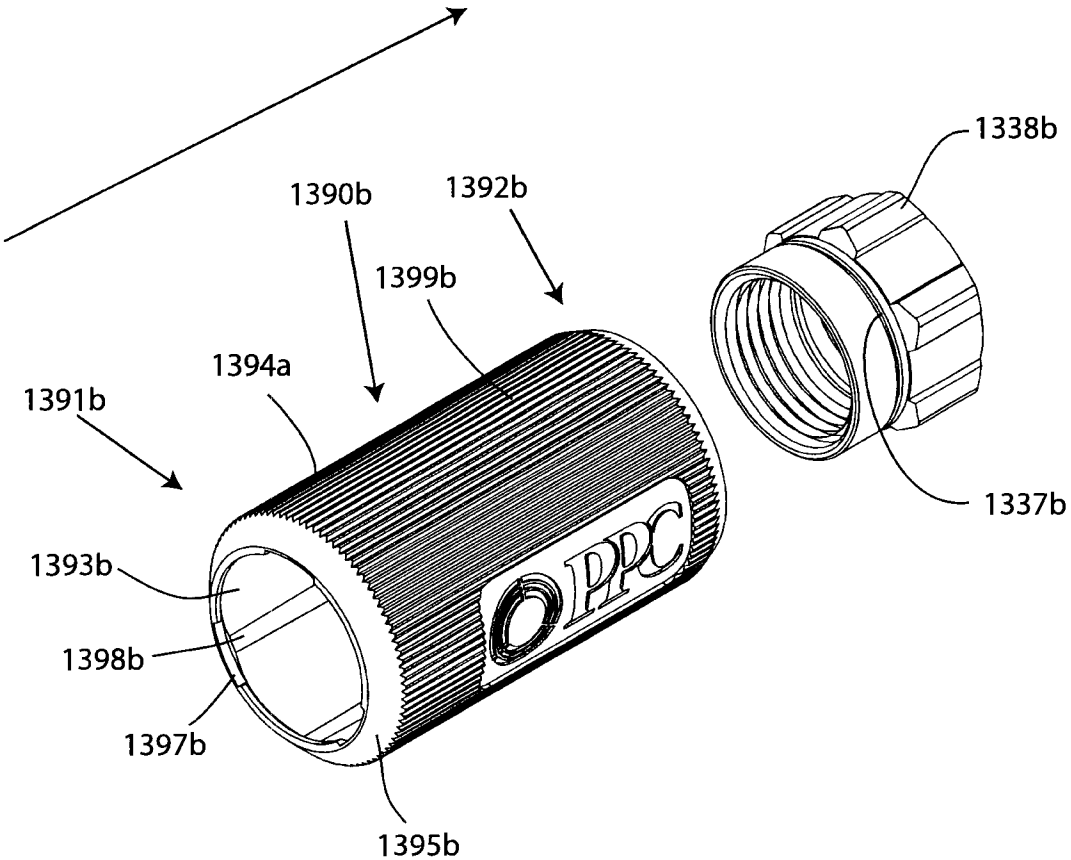
FIG. 57B depicts a perspective view of an embodiment of a sleeve and an embodiment of a coupling member.

Embodiments of connector 1303 may also include a sleeve 1390*b*. Sleeve 1390*b* may share the same structural and functional aspects of sleeve 1390*a* described in association with, for example, connector 1300. Accordingly, sleeve 1390*b* may include an engagement member 1397*b* that is configured to mate or engage with a retaining structure 1337*b* of the coupling member 1330*b*. For example, the sleeve 1390*b* may include a first end 1391*b*, a second end 1392*b*, an inner surface 1393*b*, and an outer surface 1394*b*, and may be a generally annular member having a generally axial opening therethrough. However, the sleeve 1390*b* may be radially disposed over the coupling member 1330*b*, or a portion thereof, the connector body 1350, or a portion thereof, the compression portion 1360, or a portion thereof, and the radial restriction member 1365 while operably assembled and/or in a compressed position. Additionally, the sleeve 1390*b* may include an annular ramped surface 1395*b* or chamfer proximate or otherwise near the first end 1391*b* to accommodate an increased diameter or general size of the coupling member 1330*b* proximate a second, rearward end 1332*b* of the coupling member 1330*b*. Embodiments of the ramped surface 1395*b* may be structurally integral with the engagement member 1397*b* and the body of the sleeve 1390*b*. Furthermore, embodiments of an assembled configuration of connector 1303 with respect to the sleeve 1390*b* may involve sliding the sleeve 1390*b* over the coupling member 1330*b* in an axial direction starting from the first end 1331*b* and continuing toward the second end 1332*b* of the coupling member 1330 until sufficient mating and/or engagement occurs between the engagement member 1397*b* of the sleeve 1390*b* and the retaining structure 1337 of the coupling member 1330, as shown in FIG. 57B. Sleeve 1390*b* may also include outer surface feature(s) 1399*b*, such as annular serrations or slots, configured to enhance gripping of the sleeve 1690 while connecting the coaxial cable connector onto an interface port.

Figure 58:
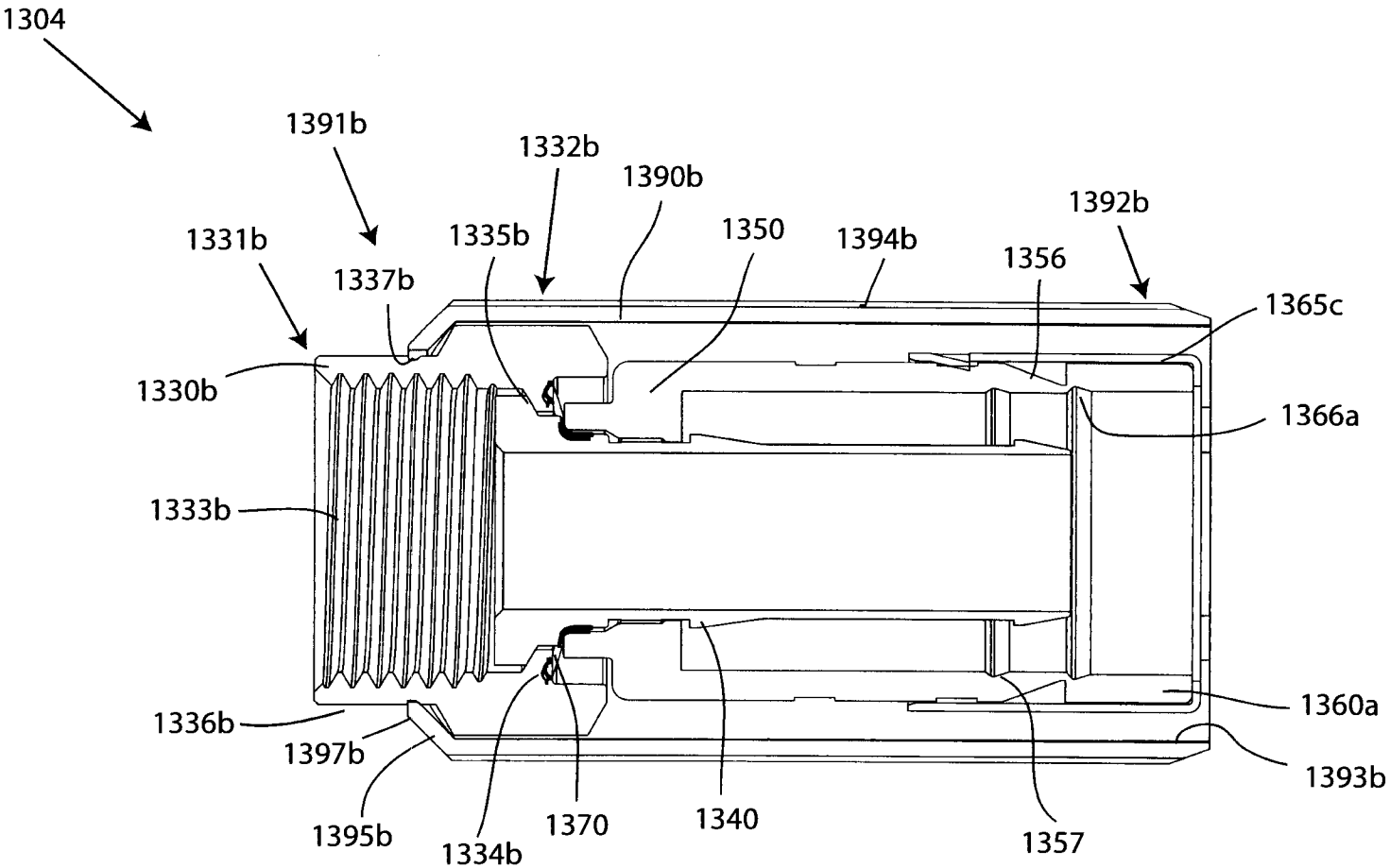
FIG. 58 depicts a cross-section view of a fifth embodiment of a coaxial cable connector including an embodiment of a continuity member, an embodiment of a sleeve, an embodiment of a compression portion, and an embodiment of a radial restriction member.

FIG. 58 depicts an embodiment of connector 1304. Embodiments of connector 1304 may include a coupling member 1330*b*, a post 1340, a connector body 1350, a continuity member 1370, an outer sleeve 1390*b*, a compression portion 1360*a*, and a radial restriction member 1365*c*.

Figure 59:
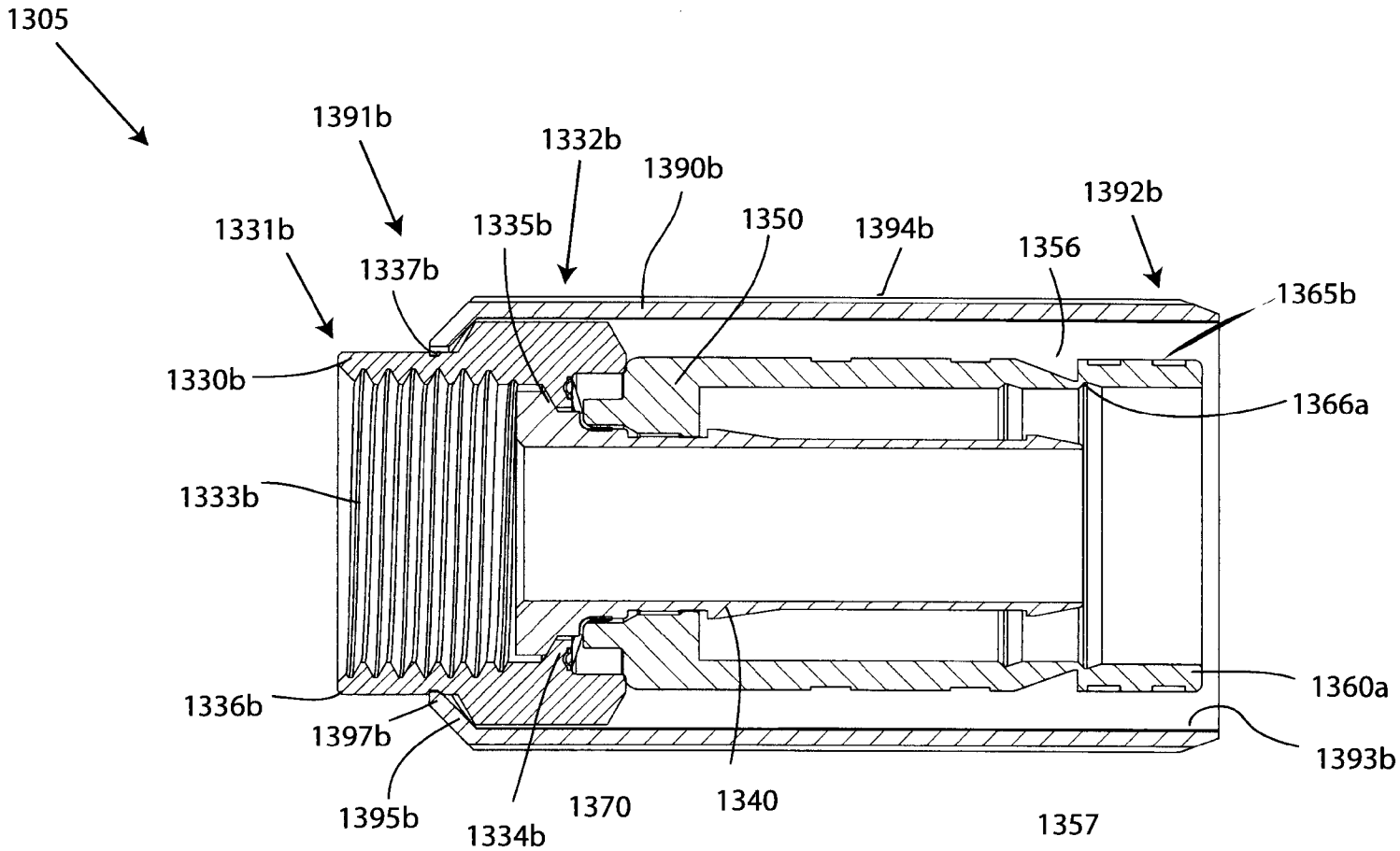
FIG. 59 depicts a cross-section view of a sixth embodiment of a coaxial cable connector including an embodiment of a continuity member, an embodiment of a sleeve, an embodiment of a compression portion, and an embodiment of a radial restriction member.

FIG. 59 depicts an embodiment of connector 1305. Embodiments of connector 1305 may include a coupling member 1330*b*, a post 1340, a connector body 1350, a continuity member 1370, a sleeve 1390*b*, a compression portion 1360*a*, and a radial restriction member 1365*b*.

Figure 60:
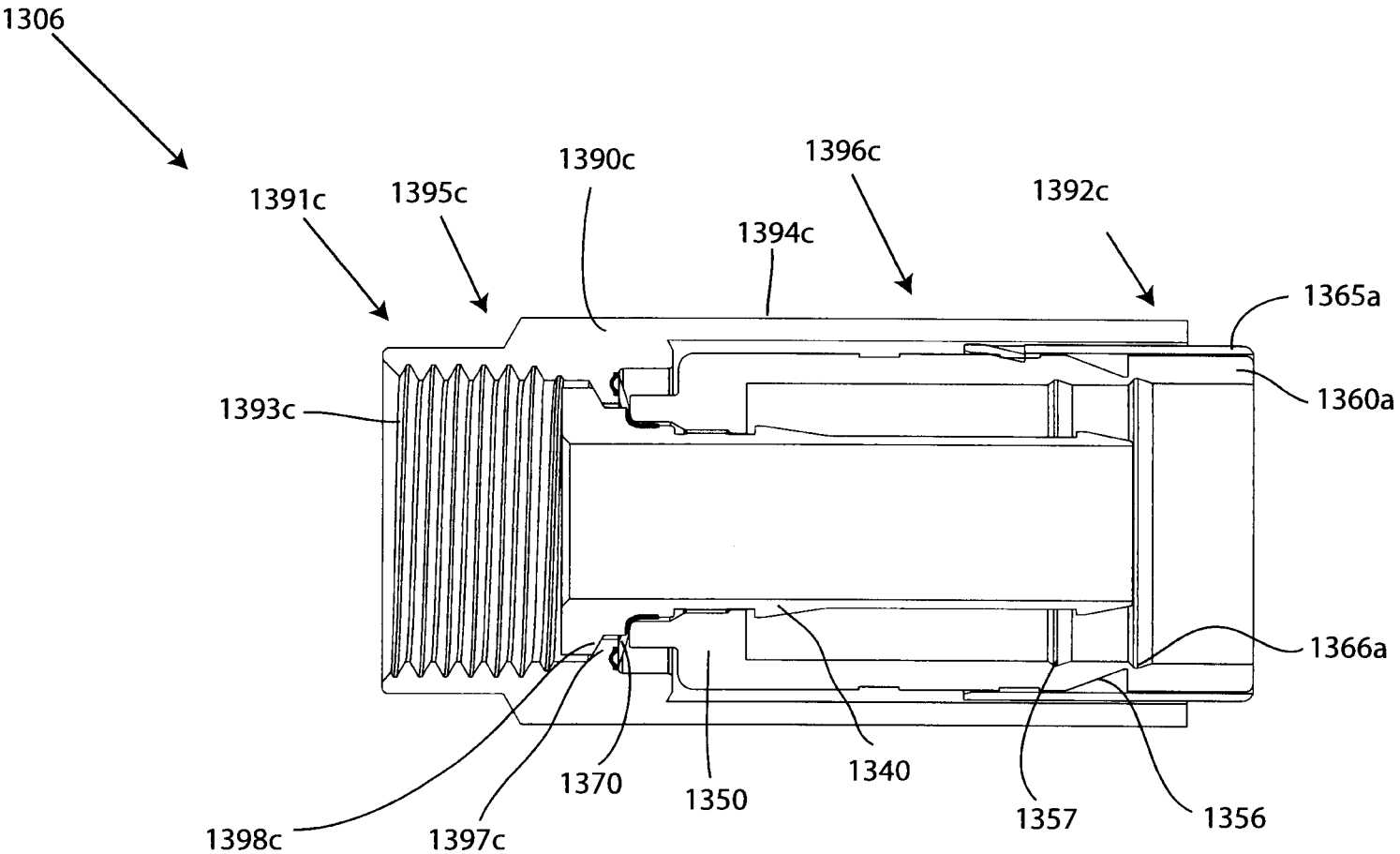
FIG. 60 depicts a cross-section view of a seventh embodiment of a coaxial cable connector including an embodiment of a continuity member, an embodiment of a sleeve, an embodiment of a compression portion, and an embodiment of a radial restriction member.

Referring still to the drawings, FIG. 60 depicts an embodiment of connector 1306. Embodiments of connector 1306 may include an integral sleeve 1390*c*, a post 1340, a connector body 1350, a continuity member 1370, a compression portion 1360*a*, and a radial restriction member 1365*a*.

Embodiments of connector 1306 may include an integral sleeve 1390*c*. An integral sleeve 1390*c* may be a generally annular member having a generally axial opening therethrough. The integral sleeve 1390*c* may include a first end 1391*c*, a second end 1392*c*, an outer surface 1393*c*, and an outer surface 1394*c*. Furthermore, the integral sleeve 1390*c* may include a coupling portion 1395*c* proximate the first end 1391*c* and a body portion 1396*c* structurally integral with the coupling portion 1395*c*. The coupling portion 1395*c* may include internal threads for operable engagement with an interface port, such as interface port 20. For instance, the internal threads of the coupling portion 1395*c* of the integral sleeve 1390*c* may correspond to threads on the outer surface of an interface port. The coupling portion 1395*c* may also include an internal lip 1397*c*, such as an annular protrusion. The internal lip 1397*c* includes a surface 1398*c* facing the first forward end 1391*c* of the integral sleeve 1390*c*. The forward facing surface 1398*c* of the lip 1397*c* may be a tapered surface that corresponds to a tapered surface of the post 1340. The forward facing surface 1398*c* of the coupling portion 1395*c* faces the flange of the post 1340 when operably assembled in a connector 1306, so as to allow the integral sleeve 1390*c* to rotate with respect to the other component elements, such as the post 1340 and the connector body 1350. The structural configuration of the coupling portion 1395*c* of integral sleeve 1390*c* may vary according to differing connector design parameters to accommodate different functionality of a coaxial cable connector. For instance, the first forward end 1391*c* of the integral sleeve 1390*c* may include internal and/or external structures such as ridges, grooves, curves, detents, slots, openings, chamfers, or other structural features, etc., which may facilitate the operable joining of an environmental sealing member, such a water-tight seal or other attachable component element, that may help prevent ingress of environmental contaminants, such as moisture, oils, and dirt, at the first forward end 1391*c* of the integral sleeve 1390*c*, when mated with an interface port 20. Those in the art should appreciate that the coupling portion 1395*c* need not be threaded.

Moreover, the integral sleeve 1390*c* includes a body portion 1396*c* that may be structurally integral with the coupling portion 1395*c* to form an outer sleeve that may surround the continuity member 1370, the post 1340, the connector body 1350, the compression portion 1360, or a portion thereof, and the radial restriction member 1365, or a portion thereof when in an assembled and/or compressed position. Because the body portion 1396*c* may be structurally integral with the coupling portion 1395*c*, rotation or twisting of the body portion 1396*c* can cause rotation or twisting of the coupling portion 1395*c* to operably mate a coaxial cable connector, such as connector 1306 onto an interface port. Thus, the integral sleeve 1390*c* includes a larger surface area to grip and twist the integral sleeve 1390*c* to thread the coupling portion 1395*c* fully onto the interface port, such as interface port 20. Embodiments of the body portion 1396*c* of the integral sleeve 1390*c* may include outer surface features, such as annular serrations or slots, configured to enhance gripping of the integral sleeve 1390*c* while connecting the coaxial cable connector onto an interface port. The body portion 1396*c* of the sleeve 1390*c* may be formed of materials such as plastics, polymers, bendable metals or composite materials that facilitate a rigid body, while the coupling portion 1395*c* may be formed of conductive materials, such as copper, brass, aluminum, or other metals or metal alloys, facilitating grounding through the connector 1306. In other words, the integral sleeve 1390*c* may be formed of both conductive and non-conductive materials. For example, the external surface of the coupling portion 1395*c* of the integral sleeve 1390*c* may be formed of a polymer, while the remainder of the coupling portion 1395*c* may be comprised of a metal or other conductive material. Alternatively, the coupling portion 1395*c* and the body portion 1396*c* of the integral sleeve 1390*c* may be formed of conductive materials such as metals or metal alloys, or may both be formed of polymers or other materials that would facilitate a rigidly formed component. Manufacture of the integral sleeve 1390*c* may include casting, extruding, cutting, knurling, turning, tapping, drilling, injection molding, blow molding, combinations thereof, or other fabrication methods that may provide efficient production of the component.

Figure 61:
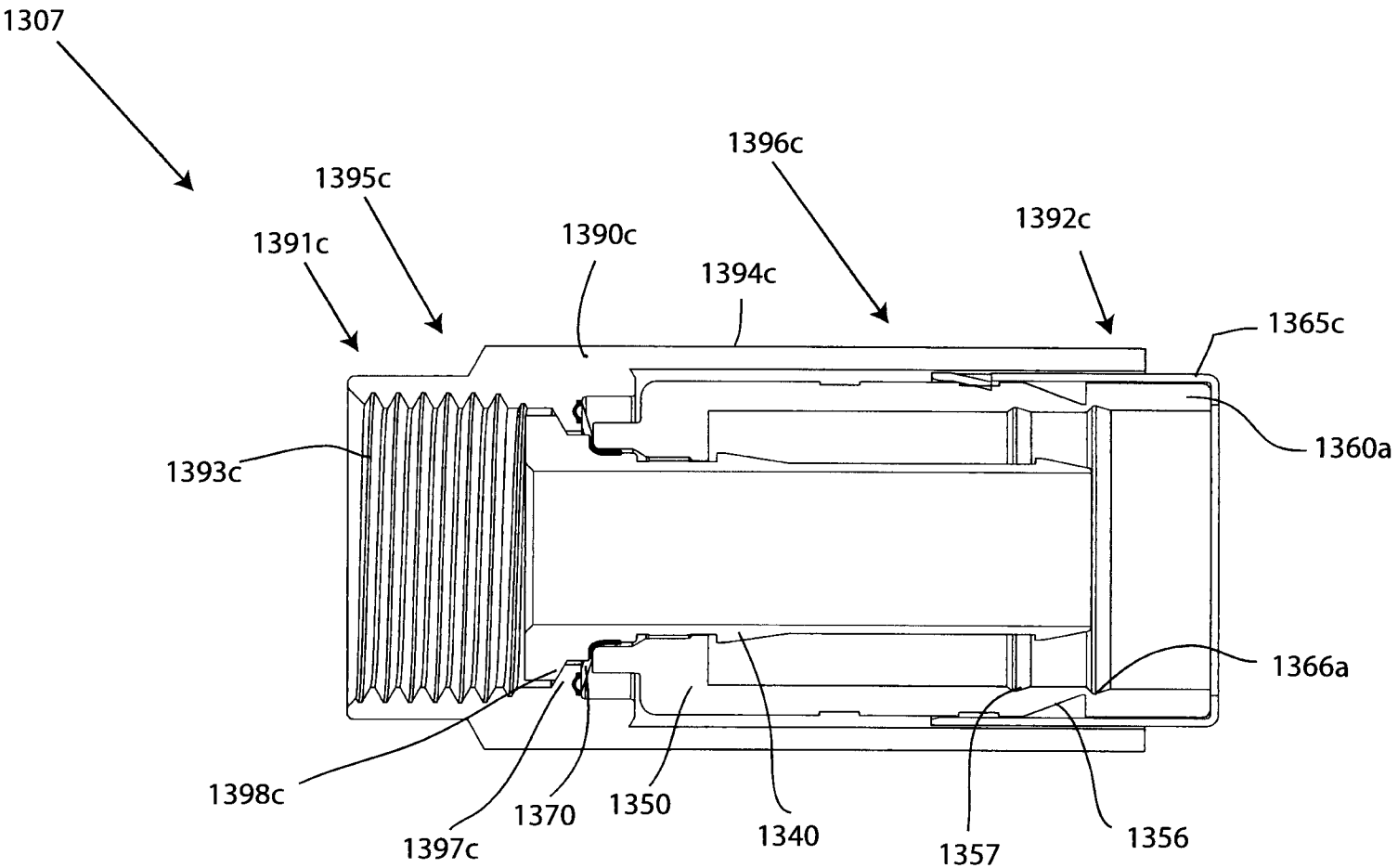
FIG. 61 depicts a cross-section view of a eighth embodiment of a coaxial cable connector including an embodiment of a continuity member, an embodiment of a sleeve, an embodiment of a compression portion, and an embodiment of a radial restriction member.

Referring now to FIG. 61, an embodiment of connector 1307 is shown. Embodiments of connector 1307 may include an integral sleeve 1390*c*, a post 1340, a connector body 1350, a continuity member 1370, a compression portion 1360*a*, and a radial restriction member 1365*c*.

Figure 62:
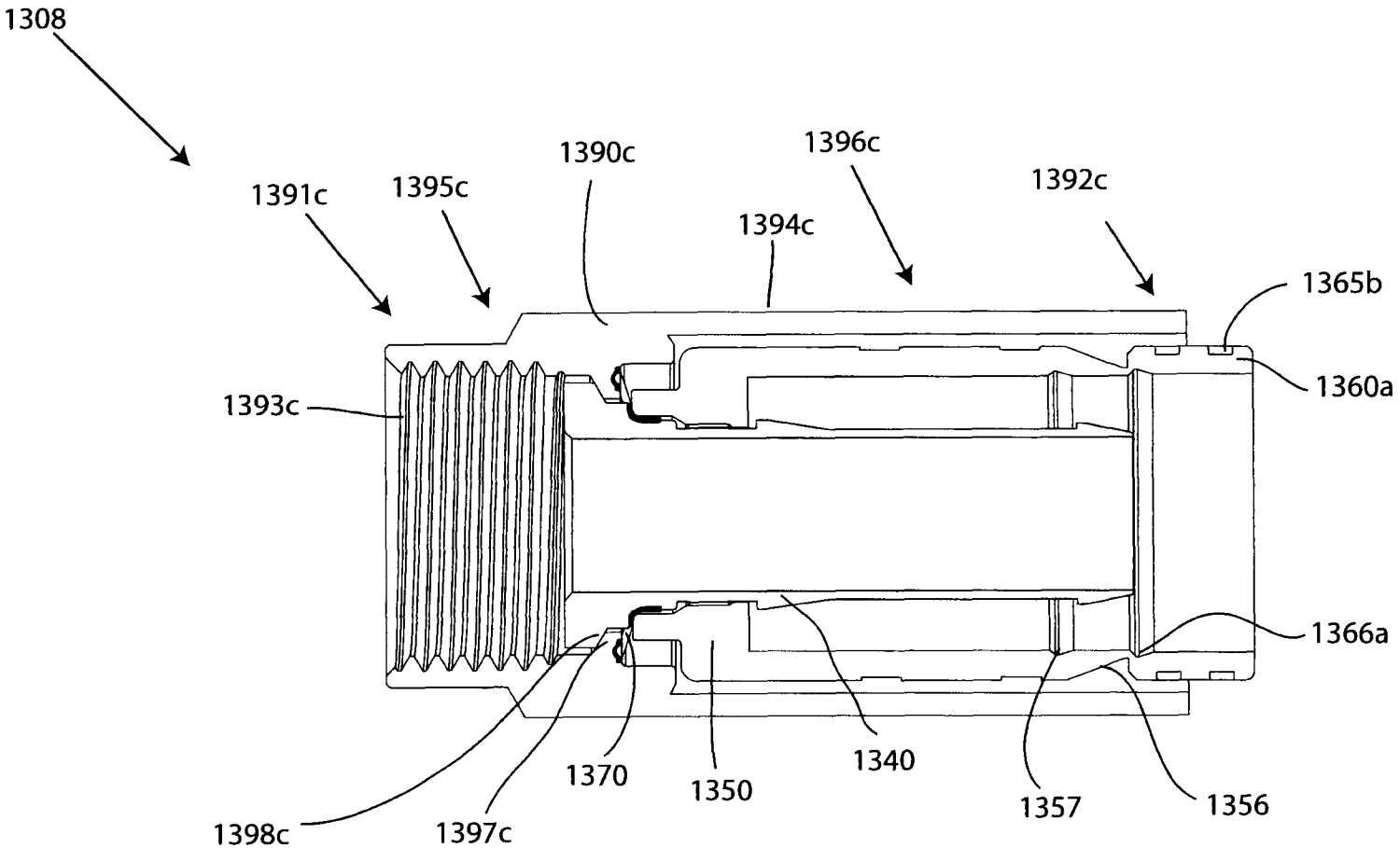
FIG. 62 depicts a cross-section view of a ninth embodiment of a coaxial cable connector including an embodiment of a continuity member, an embodiment of a sleeve, an embodiment of a compression portion, and an embodiment of a radial restriction member.

FIG. 62 depicts an embodiment of connector 1308. Embodiments of connector 1308 may include an integral sleeve 1390*c*, a post 1340, a continuity member 1370, a connector body 1350, a compression portion 1360*a*, and a radial restriction member 1360*b*.

Figure 63:
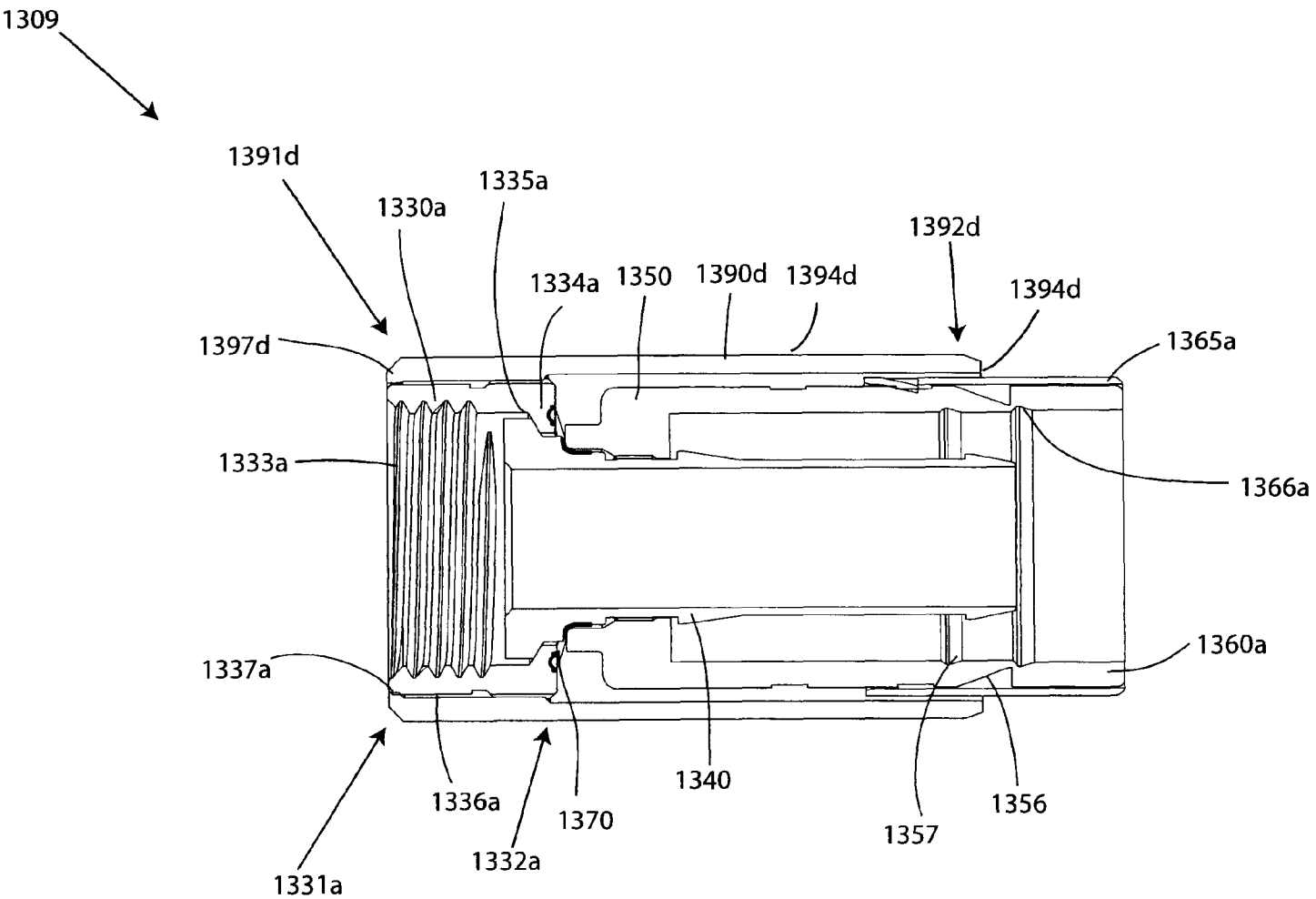
FIG. 63 depicts a cross-section view of a tenth embodiment of a coaxial cable connector including an embodiment of a continuity member, an embodiment of a sleeve, an embodiment of a compression portion, and an embodiment of a radial restriction member.

With reference now to FIG. 63, embodiments of connector 1309 may include a coupling member 1330*a*, a post 1340, a continuity member 1370, a connector body 1350, an outer sleeve 1390*d*, a compression portion 1360*a*, and a radial restriction member 1365*a*.

Embodiments of connector 1309 may include a sleeve 1390*d*. The sleeve 1390*d* may be engageable with the coupling member 1330*a*. Sleeve 1390*d* may share the same or substantially the same structural and functional aspects of sleeve 1390*a*. Accordingly, sleeve 1390*d* may include an engagement member 1397*d* that is configured to mate or engage with a retaining structure 1337 of the coupling member 1330*a*. Additionally, the sleeve 1390*d* may include a first end 1391*d*, a second end 1392*d*, an inner surface 1393*d*, and an outer surface 1394*d*, and may be a generally annular member having a generally axial opening therethrough. Additionally, sleeve 1390*d* may surround the coupling member 1330*a*, the post 1340, the connector body 1350, or a portion thereof, the compression portion 1360, and a radial restriction member 65, or a portion thereof when in an assembled and/or compressed position. However, the sleeve 1390*d* may extend towards the first end 1331*a* of coupling member 1330*a*. In one embodiment, the first end 1391*d* of the sleeve 1390*d* may be flush or substantially flush with an edge of the coupling member 1330*a* proximate or otherwise near the first end 1331*a* of the coupling member 1330*a*. Moreover, the engagement member 1397*d* may be located proximate or otherwise near the edge of the first end 1391*d* of the sleeve 1390*d*. The engagement member 1397*d* may be configured to mate or engage a retaining structure 1337*a* of the coupling member 1330*a* that is correspondingly located proximate or otherwise near the first end 1331*a* of the coupling member 1330*a*.

Figure 64:
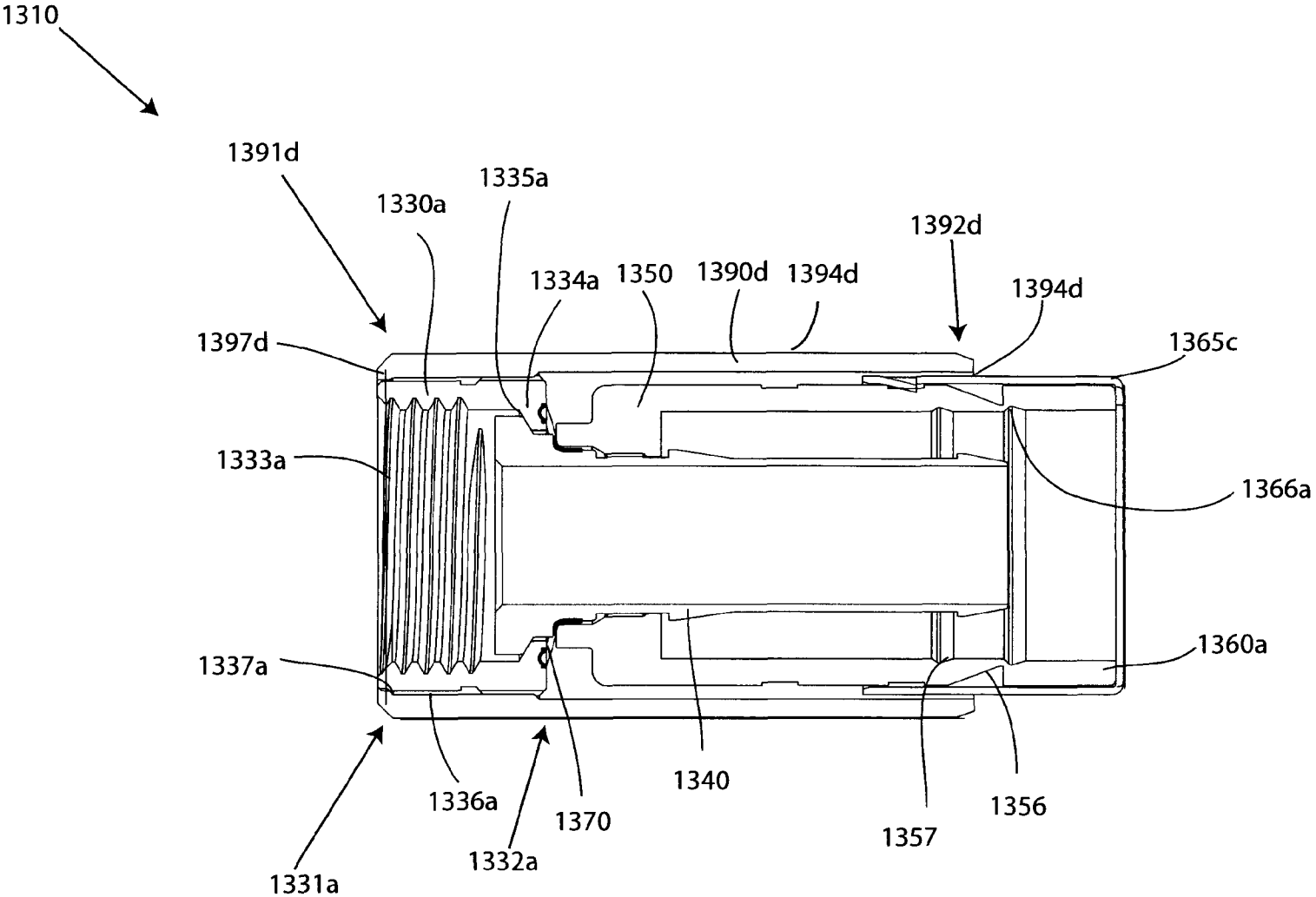
FIG. 64 depicts a cross-section view of a eleventh embodiment of a coaxial cable connector including an embodiment of a continuity member, an embodiment of a sleeve, an embodiment of a compression portion, and an embodiment of a radial restriction member.

FIG. 64 depicts an embodiment of connector 1310. Embodiments of connector 1310 may include a coupling member 1330*a*, a post 1340, a connector body 1350, a continuity member 1370, a sleeve 1390*d*, a compression portion 1360*a*, and a radial restriction member 1365*c*.

Figure 65:
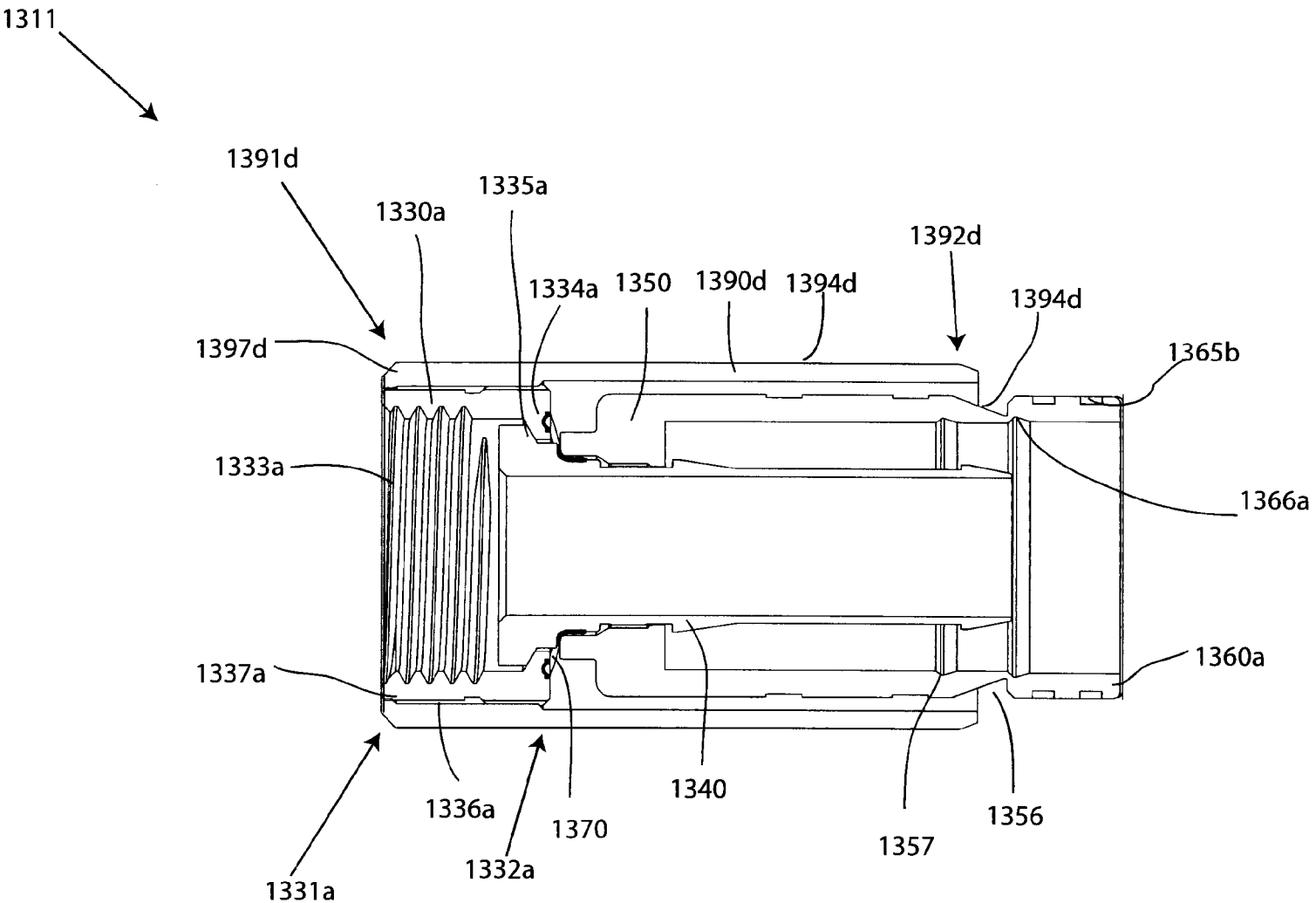
FIG. 65 depicts a cross-section view of a twelfth embodiment of a coaxial cable connector including an embodiment of a continuity member, an embodiment of a sleeve, an embodiment of a compression portion, and an embodiment of a radial restriction member.

FIG. 65 depicts an embodiment of connector 1311. Embodiments of connector 1311 may include a coupling member 1330*a*, a post 1340, a connector body 1350, a continuity member 1370, a sleeve 1390*d*, a compression portion 1360*a*, and a radial restriction member 1365*b*.

Figure 66:
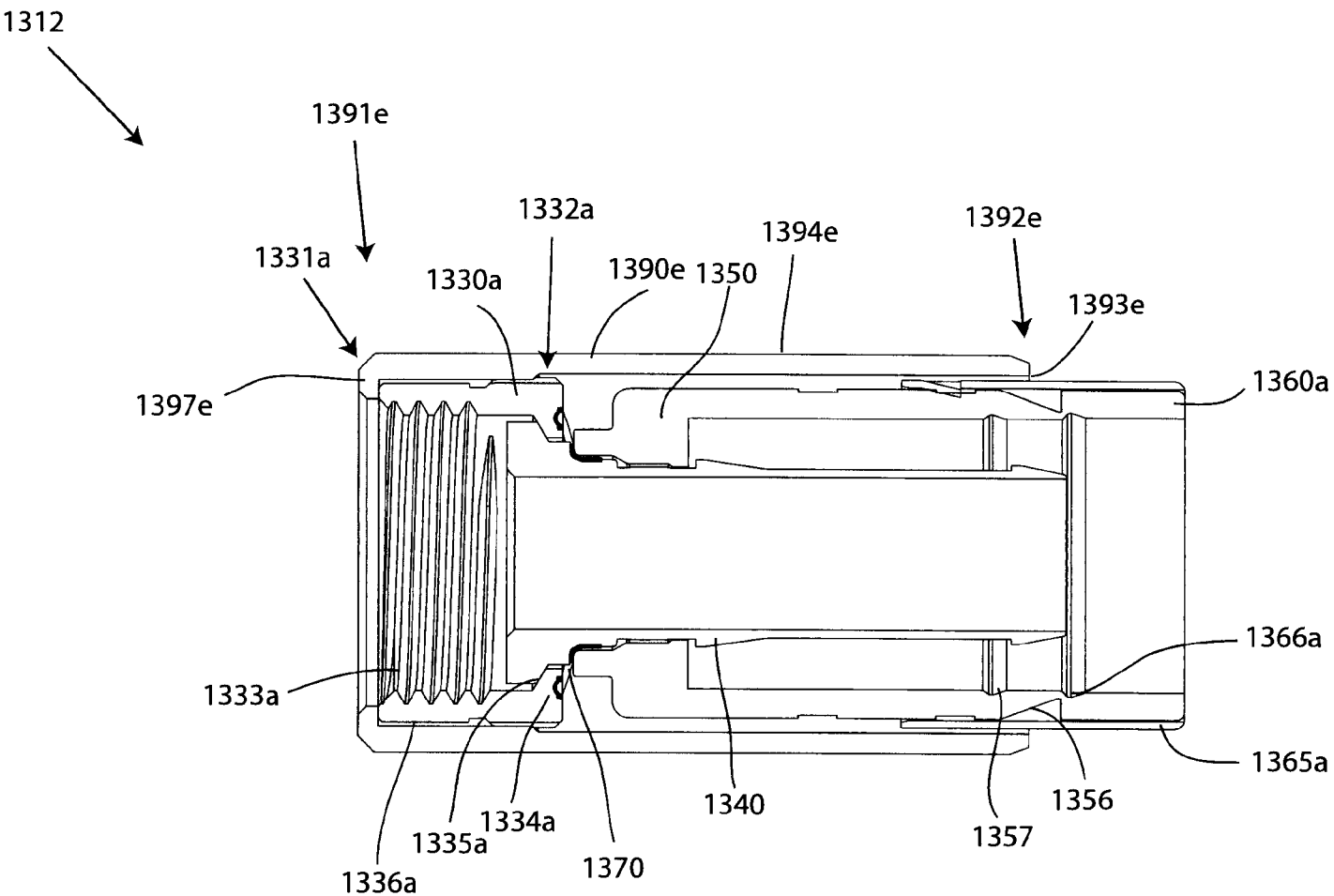
FIG. 66 depicts a cross-section view of a thirteenth embodiment of a coaxial cable connector including an embodiment of a continuity member, an embodiment of a sleeve, an embodiment of a compression portion, and an embodiment of a radial restriction member.

Referring now to FIG. 66, embodiments of connector 1312 may include a coupling member 1330*a*, a post 1340, a connector body 1350, a continuity member 1370, a sleeve 1390*e*, a compression portion 1360*a*, and a radial restriction member 1365*a*.

Embodiments of connector 1312 may include a sleeve 1390*e*. The outer sleeve 1390*e* may be engageable with the coupling member 1330*a*. Sleeve 1390*e* may share the same or substantially the same function as sleeve 1390*a* and sleeve 1390*d*. Accordingly, the sleeve 1390*e* may include a first end 1391*e*, a second end 1392*e*, an inner surface 1393*e*, and an outer surface 1394*e*, and may be a generally annular member having a generally axial opening therethrough. Sleeve 1390*e* may surround the coupling member 1330*a*, the post 1340, the connector body 1350, or a portion thereof, the compression portion 1360, and a radial restriction member 1365, or a portion thereof when in an assembled and/or compressed position. Moreover, the sleeve 1390*e* may extend towards the first end 1331*a* of coupling member 1330*a*. However, sleeve 1390*e* may include an inwardly extending lip 1397*e* proximate or otherwise near the first end 1391*e* of the sleeve 1390*e*, which can help guide the coupling member 1330*a* onto a corresponding interface port. The lip 1397*e* may share the same functional aspects of the engagement member 1397*a*, 1397*d* of sleeve 1390*a*, 1390*d*, respectively. For instance, the lip 1397*e* may radially inwardly extend a distance sufficient to prevent axial movement of the sleeve 1390*e* in a direction towards the second end 1332*a* of the coupling member 1330*a* when operably assembled and/or in a compressed position. An embodiment of an assembled configuration of connector 1312 with respect to the sleeve 1390*e* may involve sliding the sleeve 1390*e* over the coupling member 1330*a* in an axial direction starting from the first end 1331*a* and continuing toward the second end 1332*a* of the coupling member 1330*a* until sufficient mechanical interference and/or engagement occurs between the lip 1397*e* of the sleeve 1390*e* and frontal edge or mating surface of the coupling member 1330*a*. The simultaneous rotation/twisting of the sleeve 1390*e* and the coupling member 1330*a* may be effectuated in the same or similar manner as described between the sleeve 1390*a* and the coupling member 1330*a*.

Figure 67:
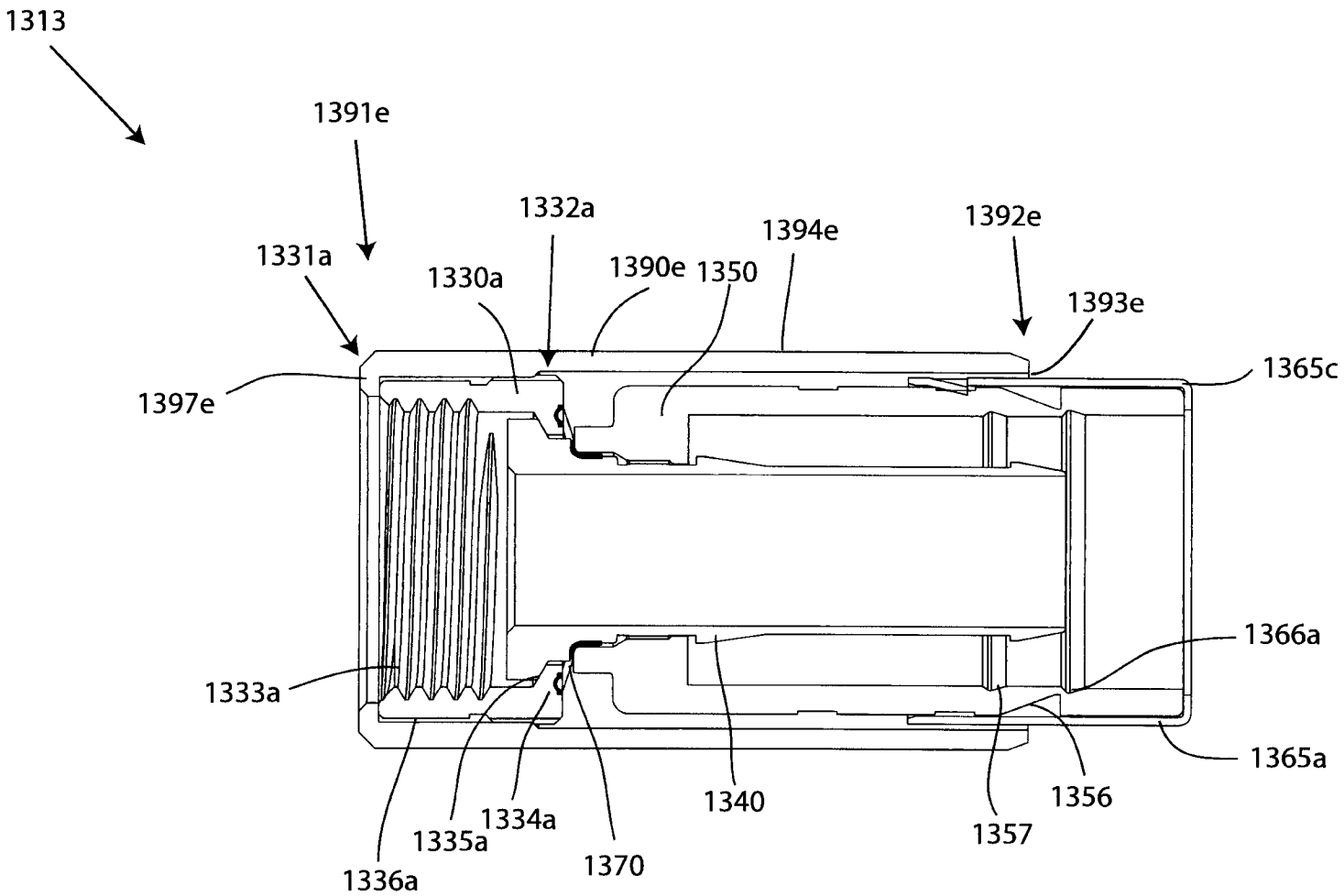
FIG. 67 depicts a cross-section view of a fourteenth embodiment of a coaxial cable connector including an embodiment of a continuity member, an embodiment of a sleeve, an embodiment of a compression portion, and an embodiment of a radial restriction member.

FIG. 67 depicts an embodiment of connector 1313. Embodiments of connector 1313 may include a coupling member 1330*a*, a post 1340, a connector body 1350, a continuity member 1370, a sleeve 1390*e*, a compression portion 1360*a*, and a radial restriction member 1365*c*.

Figure 68:
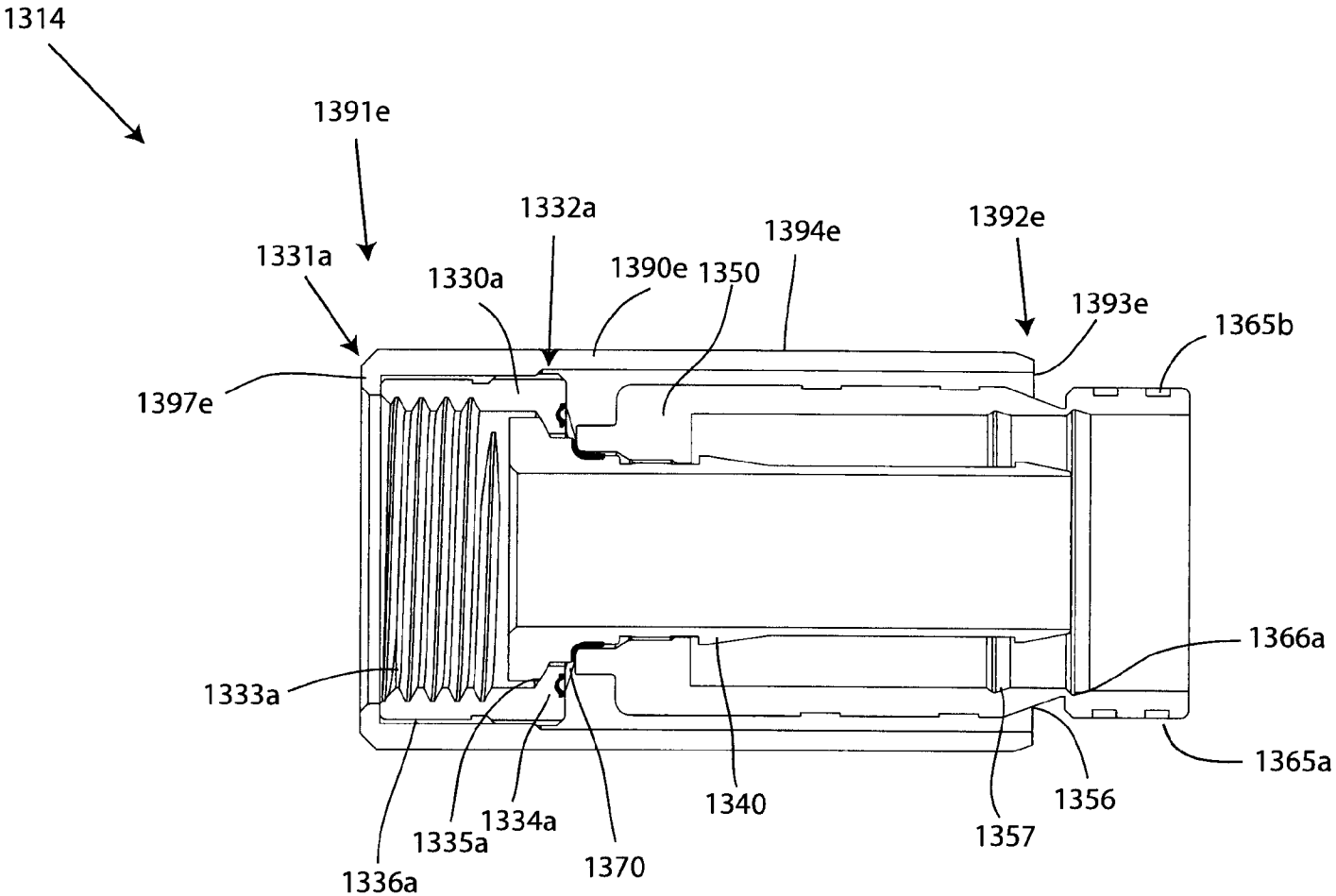
FIG. 68 depicts a cross-section view of a fifteenth embodiment of a coaxial cable connector including an embodiment of a continuity member, an embodiment of a sleeve, an embodiment of a compression portion, and an embodiment of a radial restriction member.

FIG. 68 depicts an embodiment of connector 1314. Embodiments of connector 1314 may include a coupling member 1330*a*, a post 1340, a connector body 1350, a continuity member 1370, a sleeve 1390*e*, a compression portion 1360*a*, and a radial restriction member 1365*b*.

Figure 69:
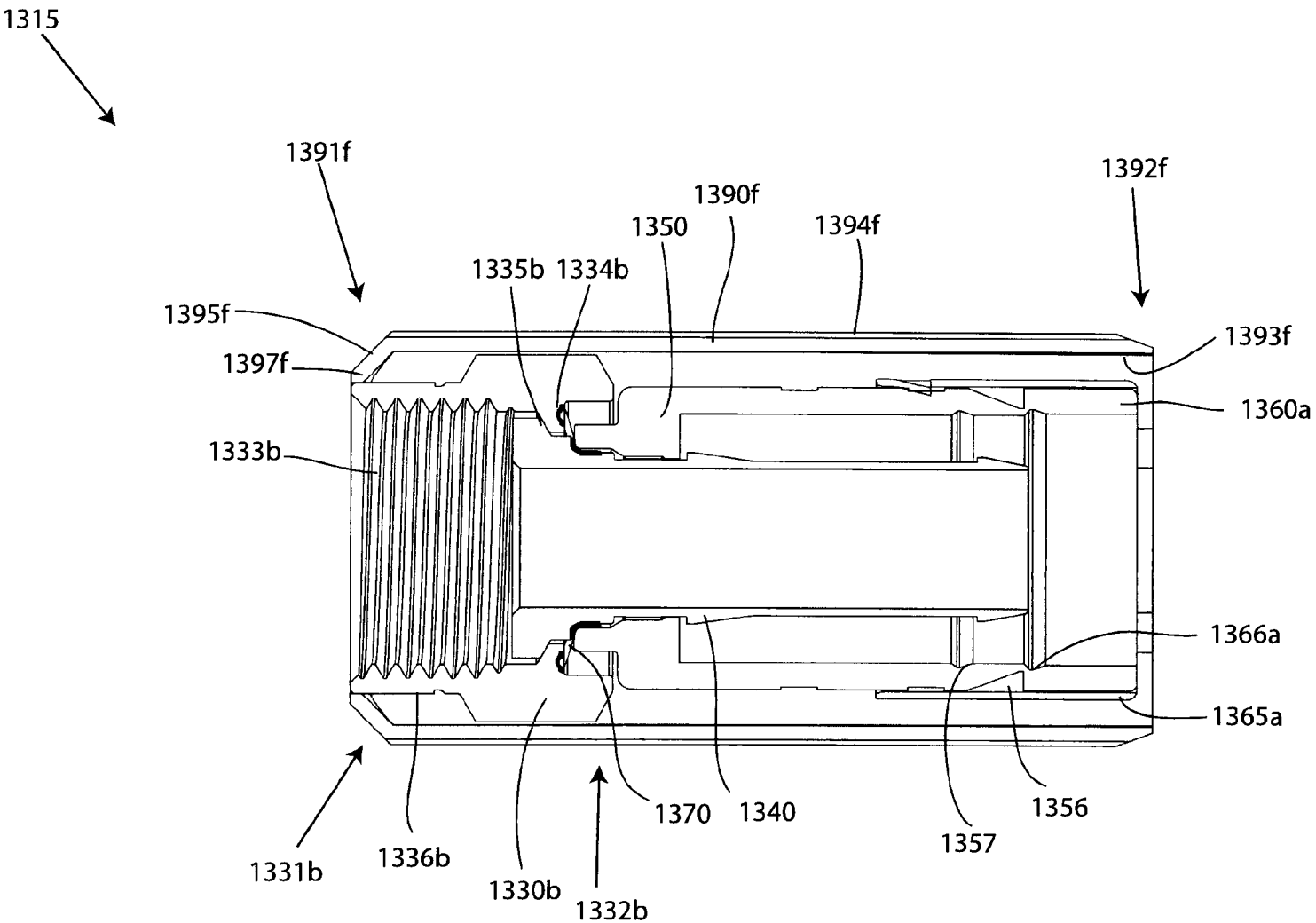
FIG. 69 depicts a cross-section view of a sixteenth embodiment of a coaxial cable connector including an embodiment of a continuity member, an embodiment of a sleeve, an embodiment of a compression portion, and an embodiment of a radial restriction member.

With reference now to FIG. 69, embodiments of connector 1315 may include a coupling member 1330*b*, a post 1340, a connector body 1350, a continuity member 1370, a sleeve 1390*f*, a compression portion 1360*a*, and a radial restriction member 1365*a*.

Embodiments of connector 1315 may include sleeve 1390*f*. Sleeve 1390*f* may share the same or substantially the same structural and functional aspects of sleeve 1390*b*. Accordingly, sleeve 1390*f* may include an engagement member 1397*f* that is configured to mate or engage with a retaining structure 1337*b* of the coupling member 1330*b*. For example, the sleeve 1390*f* may include a first end 1391*f*, a second end 1392*f*, an inner surface 1393*f*, and an outer surface 1394*f*, and may be a generally annular member having a generally axial opening therethrough. Additionally, sleeve 1390*f* may surround the coupling member 1330*b*, the post 1340, the connector body 1350, or a portion thereof, the compression portion 1360, and a radial restriction member 1365, or a portion thereof when in an assembled and/or compressed position. However, the sleeve 1390*f* may extend towards the first end 1331*b* of coupling member 1330*b*. In one embodiment, the first end 1391*f* of the sleeve 1390*f* may be flush or substantially flush with an edge of the coupling member 1330*b* proximate or otherwise near the first end 1331*b* of the coupling member 1330*b*. Moreover, the engagement member 1397*f* may be located proximate or otherwise near the edge of the first end 1391*f* of the sleeve 1390*f*. The engagement member 1397*f* may be configured to mate or engage a retaining structure 1337*b* of the coupling member 1330*b* that is correspondingly located proximate or otherwise near the first end 1331*b* of the coupling member 1330*b*.

Figure 70:
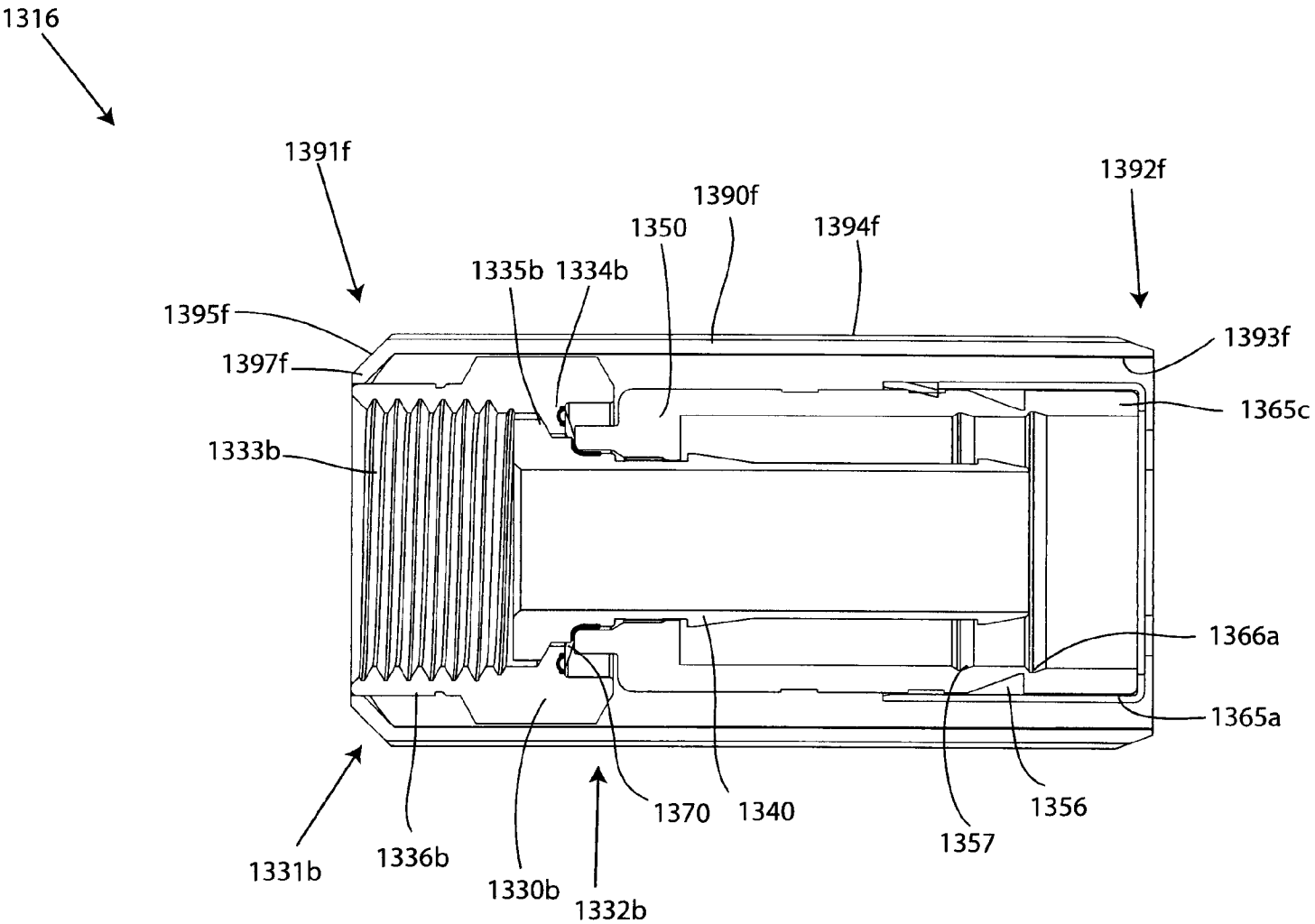
FIG. 70 depicts a cross-section view of a seventeenth embodiment of a coaxial cable connector including an embodiment of a continuity member, an embodiment of a sleeve, an embodiment of a compression portion, and an embodiment of a radial restriction member.

FIG. 70 depicts an embodiment of connector 1316. Embodiments of connector 1316 may include a coupling member 1330*b*, a post 1340, a connector body 1350, a continuity member 1370, a sleeve 1390*f*, a compression portion 1360*a*, and a radial restriction member 1365*c*.

Figure 71:
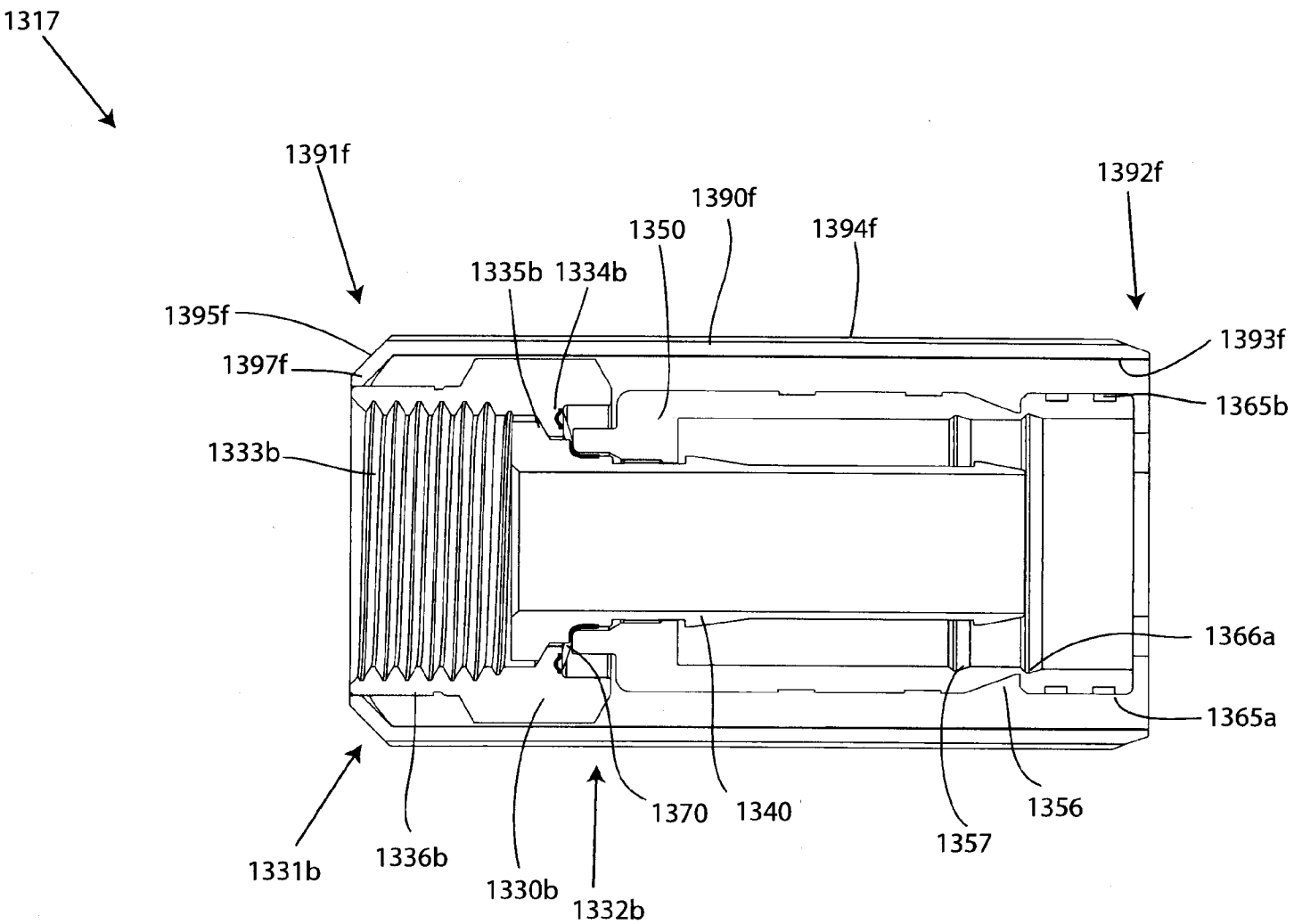
FIG. 71 depicts a cross-section view of a eighteenth embodiment of a coaxial cable connector including an embodiment of a continuity member, an embodiment of a sleeve, an embodiment of a compression portion, and an embodiment of a radial restriction member.

FIG. 71 depicts an embodiment of connector 1317. Embodiments of connector 1317 may include a coupling member 1330*b*, a post 1340, a connector body 1350, a continuity member 1370, a sleeve 1390*f*, a compression portion 1360*a*, and a radial restriction member 1365*b*.

Figure 72:
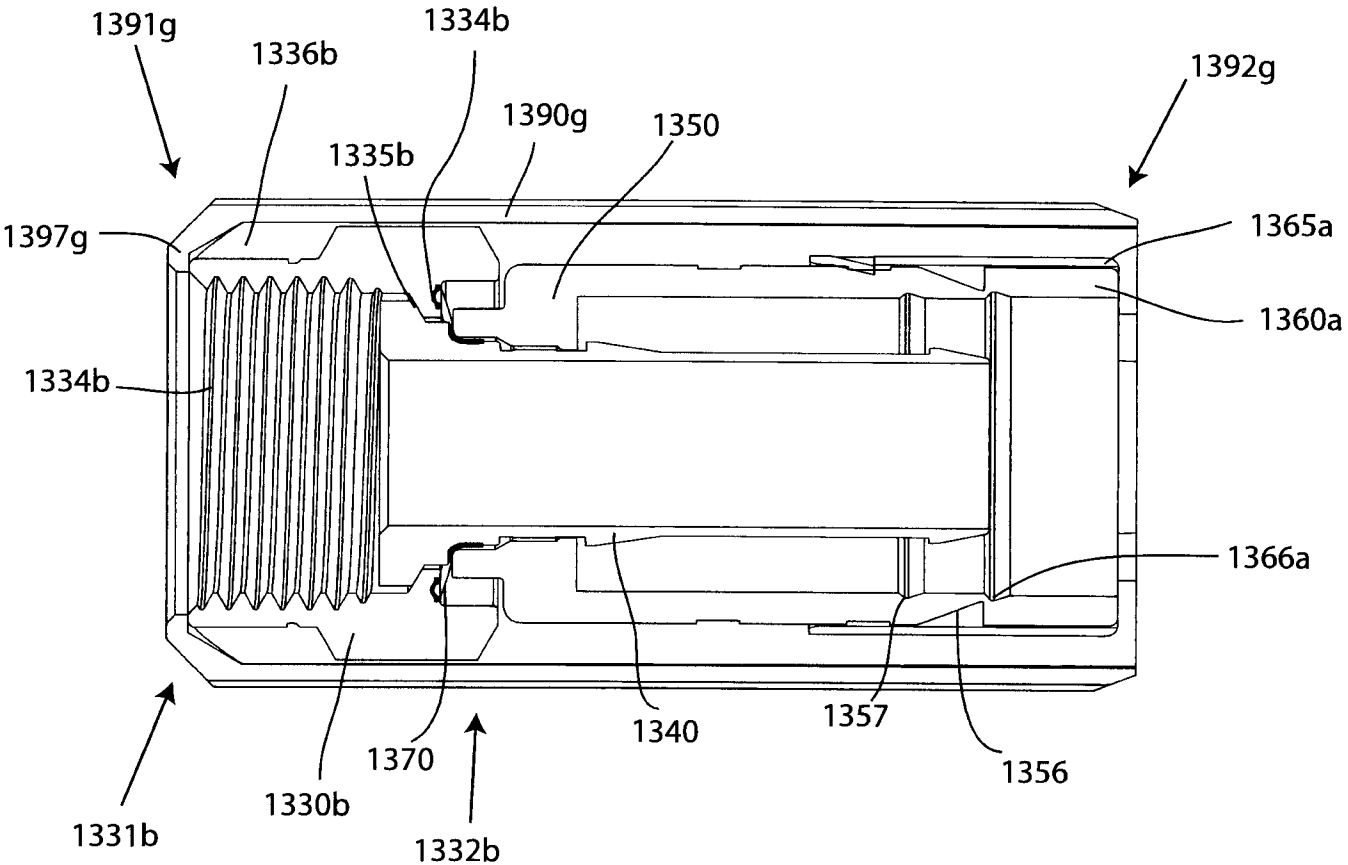
FIG. 72 depicts a cross-section view of a nineteenth embodiment of a coaxial cable connector including an embodiment of a continuity member, an embodiment of a sleeve, an embodiment of a compression portion, and an embodiment of a radial restriction member.

With reference to FIG. 72, embodiments of connector 1318 may include a coupling member 1330*b*, a post 1340, a connector body 1350, a continuity member 1370, a sleeve 1390*g*, a compression portion 1360*a*, and a radial restriction member 1365*a*.

Embodiments of connector 1318 may include a sleeve 1390*g*. The sleeve 1390*b* may be engageable with the coupling member 1330*b*. Sleeve 1390*g* may share the same or substantially the same function as sleeve 1390*b* and sleeve 1390*f*. Accordingly, the sleeve 1390*g* may include a first end 1391*g*, a second end 1392*g*, an inner surface 1393*g*, and an outer surface 1394*g*, and may be a generally annular member having a generally axial opening therethrough. Sleeve 1390*g* may surround the coupling member 1330*b*, the post 1340, the connector body 1350, or a portion thereof, the compression portion 1360, and a radial restriction member 1365, or a portion thereof, when in an assembled and/or compressed position. Moreover, the sleeve 1390*g* may extend towards the first end 1331*b* of coupling member 1330*b*. However, sleeve 1390*g* may include an inwardly extending lip 1397*g* proximate or otherwise near the first end 1391*g* of the sleeve 1390*g*, which can help guide the coupling member 1330*b* onto a corresponding interface port. The lip 1397*g* may share the same structural and functional aspects of the engagement member 1397*b*, 1397*f* of sleeve 1390*b*, 1390*f*, respectively. For instance, the lip 1397*g* may radially inwardly extend a distance sufficient to prevent axial movement of the sleeve 1390*g* in a direction towards the second end 1332*b* of the coupling member 1330*b* when operably assembled and/or in a compressed position. An embodiment of an assembled configuration of connector 1318 with respect to the sleeve 1390*g* may involve sliding the sleeve 1390*g* over the coupling member 1330*b* in an axial direction starting from the first end 1331*b* and continuing toward the second end 1332*b* of the coupling member 1330*b* until sufficient mechanical interference and/or engagement occurs between the lip 1397*g* of the sleeve 1390*g* and frontal edge or mating surface of the coupling member 1330*b*. The simultaneous rotation/twisting of the sleeve 1390*g* and the coupling member 1330*b* may be effectuated in the same or similar manner as described between the sleeve 1390*b* and the coupling member 1330*b*.

Figure 73:
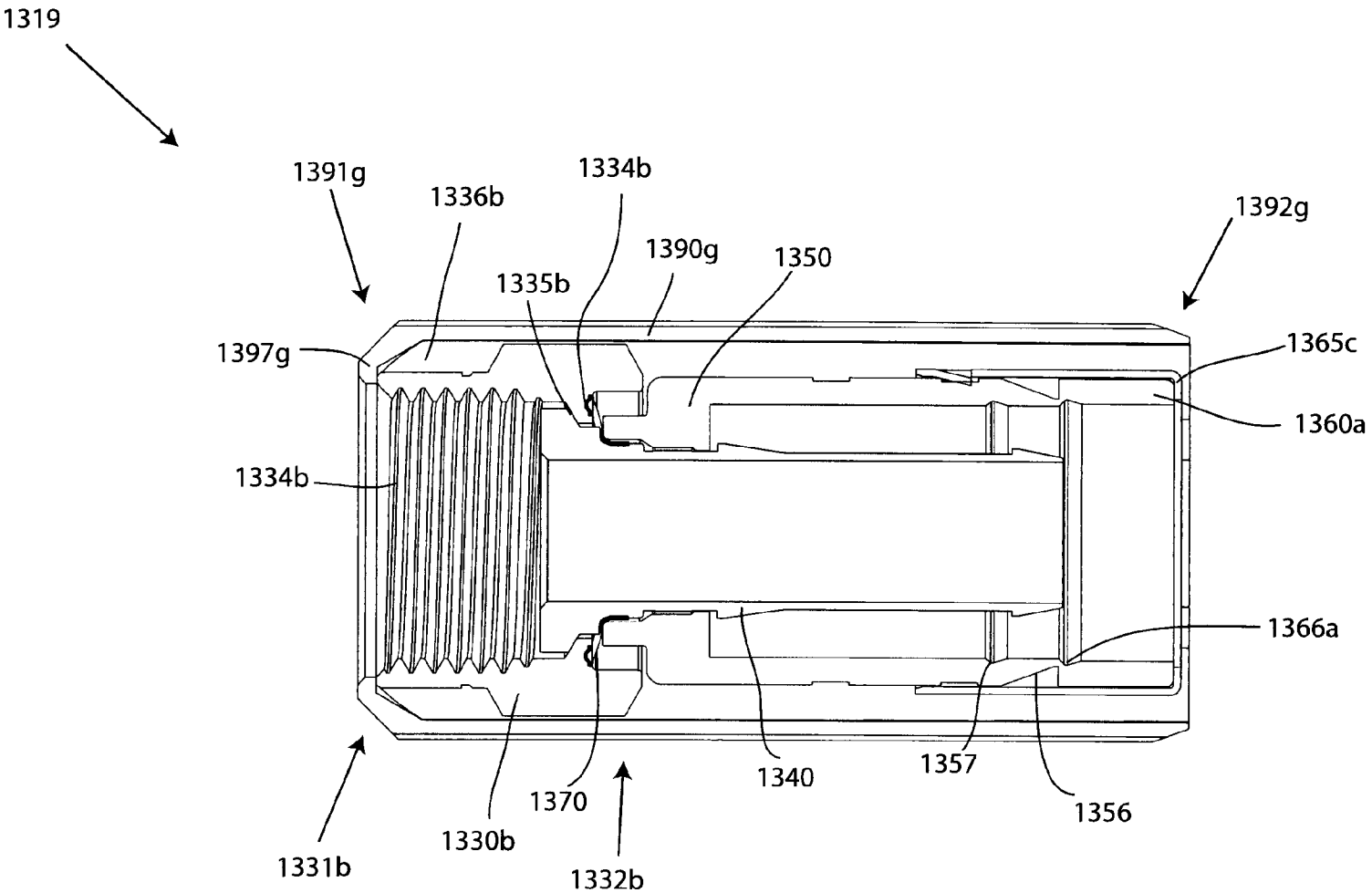
FIG. 73 depicts a cross-section view of a twentieth embodiment of a coaxial cable connector including an embodiment of a continuity member, an embodiment of a sleeve, an embodiment of a compression portion, and an embodiment of a radial restriction member.

FIG. 73 depicts an embodiment of connector 1319. Embodiments of connector 1319 may include a coupling member 1330*b*, a post 1340, a connector body 1350, a continuity member 1370, a sleeve 1390*g*, a compression portion 1365*a*, and a radial restriction member 1365*c*.

Figure 74:
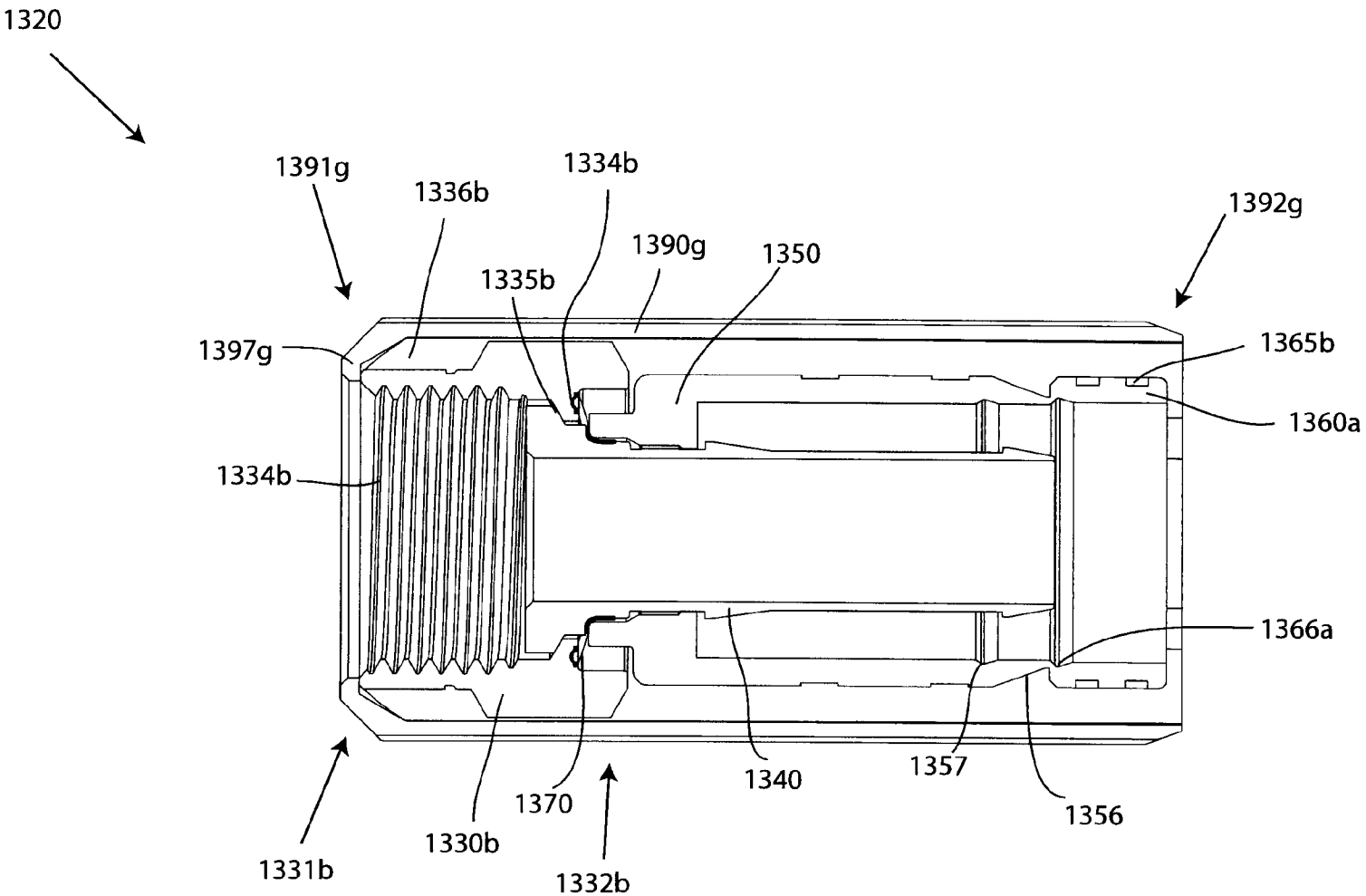
FIG. 74 depicts a cross-section view of a twenty-first embodiment of a coaxial cable connector including an embodiment of a continuity member, an embodiment of a sleeve, an embodiment of a compression portion, and an embodiment of a radial restriction member.

FIG. 74 depicts an embodiment of connector 1320. Embodiments of connector 1320 may include a coupling member 1330*b*, a post 1340, a connector body 1350, a continuity member 1370, a sleeve 1390*g*, a compression portion 1365*a*, and a radial restriction member 1365*b*.

Figure 75:
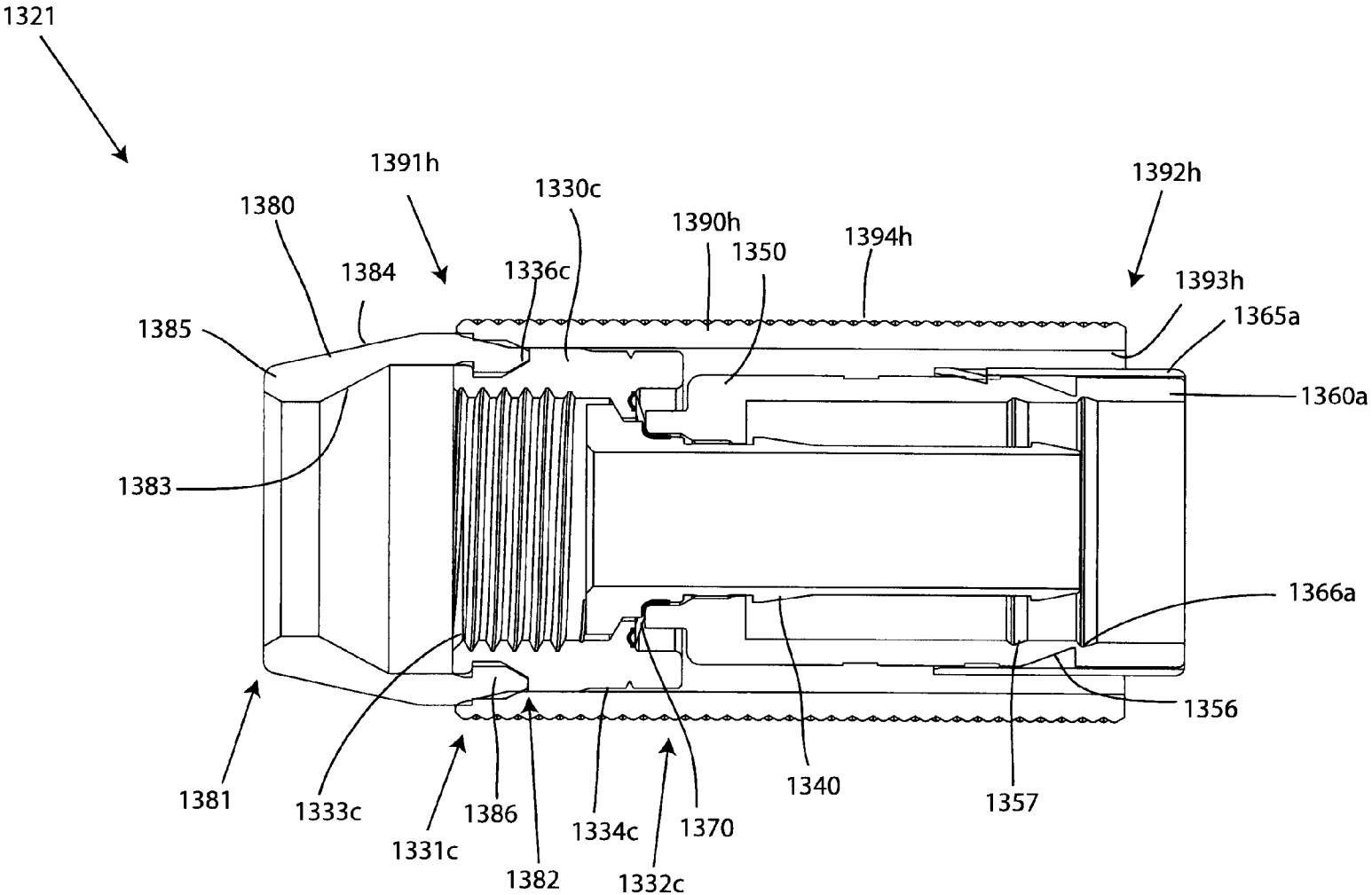
FIG. 75 depicts a cross-section view of a twenty-second embodiment of a coaxial cable connector including an embodiment of a continuity member, an embodiment of a sleeve, an embodiment of a compression portion, and an embodiment of a radial restriction member.

With reference now to FIG. 75, embodiments of connector 1321 may include a coupling member 1330*c*, a sealing member 1380, a post 1340, a connector body 1350, a continuity member 1370, a sleeve 1390*h*, a compression portion 1360*a*, and a radial restriction member 1365*a*.

Embodiments of connector 1321 may include a coupling member 1330*c*. Coupling member 1330*c* may share some of the structural and functional aspects of embodiments of nut 30/930/1030/1130/1230, such as being mated, threaded or otherwise, to a corresponding interface port 20. Coupling member 1330*c* may include a first end 1331*c*, a second end 1332*c*, an inner surface 1333*c*, at least a portion of which is threaded, a connector-grasping portion 1339*c*, and an outer surface 1334*c*, including a seal-grasping surface portion 1336*c*. The seal-grasping surface portion 1336*c* may be a flat, smooth surface or a flat, roughened surface suitable to frictionally and/or adhesively engage an interior sealing surface 1383 of the sealing member 1380. Embodiments of the seal-grasping surface portion 1336*c* may also contain a ridge that together with the seal grasping surface portion 1336*c* forms a groove or shoulder that is suitably sized and shaped to correspondingly engage an internal shoulder 1387 of the sealing member 1380 adjacent the interior sealing surface 1383 in a locking-type interference fit between the coupling member 1330*c* and the sealing member 1380.

Moreover, the coupling member 1330*c* may further include a coupling member-turning surface portion on an outer surface 1384 of the sealing member 1380. The coupling member-turning surface portion may have at least two flat surface regions that allow engagement with the surfaces of a tool such as a wrench. In one embodiment, the coupling member-turning surface is hexagonal. Alternatively, the coupling member-turning surface may be a knurled surface to facilitate hand-turning of the nut component. Furthermore, upon engagement of the sealing member 1380 with the coupling member 1330*c*, a rear sealing surface 1386 of the sealing member 1380 abuts a side/edge surface of the coupling member 1330*c* to form a sealing relationship in that region. In one embodiment, the connector-grasping portion 1336*c* of the coupling member 1330*c* is an internally-projecting shoulder that engages a flange of the post 1340 in such a manner that the coupling member 1330*c* can be freely rotated as it is held in place as part of the connector.

With continued reference to FIG. 75, connector 1321 may include a sealing member 1380. The sealing member may include a first end 1381, a second end 1382, an inner surface 1383, and an outer surface 1384. The sealing member 1380 may have a generally tubular body that is elastically deformable by nature of its material characteristics and design. In most embodiments, the seal member 1380 is a one-piece element made of a compression molded, elastomer material having suitable chemical resistance and material stability (i.e., elasticity) over a temperature range between about −40° C. to +40° C. For example, the sealing member 1380 may be made of silicone rubber. Alternatively, the material may be propylene, a typical O-ring material. Other materials known in the art may also be suitable. Furthermore, the first end 1381 of sealing member 1380 may be a free end for ultimate engagement with a port, while the second end 1382 may be for ultimate connection to the coupling member 1330*c*. The seal may have a forward sealing surface 1385, a rear sealing portion 1386 including an interior sealing surface 1383 that integrally engages the coupling member 1330*c*, and an integral joint-section 1837 intermediate the first and second end 1381, 1382 of the tubular body of the sealing member 1380. The forward sealing surface 1385 at the first end 1381 of the sealing member 1380 may include annular facets to assist in forming a seal with the port, such as interface port 20. Alternatively, forward sealing surface 1385 may be a continuous rounded annular surface that forms effective seals through the elastic deformation of the inner surface 1383 and end of the sealing member 1380 compressed against the port. The integral joint-section includes a portion of the length of the sealing member 1380 which is relatively thinner in radial cross-section to encourage an outward expansion or bowing of the seal upon its axial compression. In an exemplary embodiment, the coupling member grasping surface includes an interior sealing surface which forms an annular surface on the inside of the tubular body, and an internal shoulder 1387 of the tubular body adjacent the second end 1382. Accordingly, compressive axial force may be applied against one or both ends of the seal depending upon the length of the port intended to be sealed. The force will act to axially compress the seal whereupon it will expand radially in the vicinity of the integral joint-section. In one embodiment, the integral joint-section is located axially asymmetrically intermediate the first end 1381 and the second end 1382 of the tubular body, and adjacent an anterior end of the interior sealing surface 1383. Embodiments of the sealing member 1380 may have an interior diameter at the integral joint-section equal to about 0.44 inches in an uncompressed state; the tubular body of the sealing member 1380 may have a length from the first end 1381 to the second end 1382 of about 0.36 inches in an uncompressed state. However, it is contemplated that the joint-section can be designed to be inserted anywhere between she sealing surface and the first end 1381. The sealing member 1380 may prevent the ingress of corrosive elements when the seal is used for its intended function.

Referring still to FIG. 75, embodiments of connector 1321 may include a sleeve 1390*h*. The outer sleeve 1390*h* may be engageable with coupling member 1330*c*. Sleeve 1390 *h* may share the same or substantially the same structural and functional aspects of sleeve 1390*a*, 1390*d*, 1390*f*. Accordingly, the sleeve 1390*h* may include a first end 1391*h*, a second end 1392*h*, an inner surface 1393*h*, and an outer surface 1394*h*. However, the sleeve 1390*h* need not include an engagement member, such as an embodiment of engagement member 1397*a*. The mechanical interference to effectuate simultaneous rotation/twisting of the sleeve 1390*h* and the coupling member 1330*c* between coupling member 1330*c* and sleeve 1390*h* may rely on a press-fit or interference fit between the components. Alternatively, the sleeve 1390*h* may and coupling member 1330*c* may include corresponding internal (sleeve 1390*h*) and external (coupling member 1330*c*) surface features to facilitate mechanical interference between the components. Internal and external surface features of sleeve 1390*h* and coupling member 1330*c* may share the structural and functional aspects as surface features 1398*a* and 1338*a*, as described in association with, for example, connector 1300.

Figure 76:
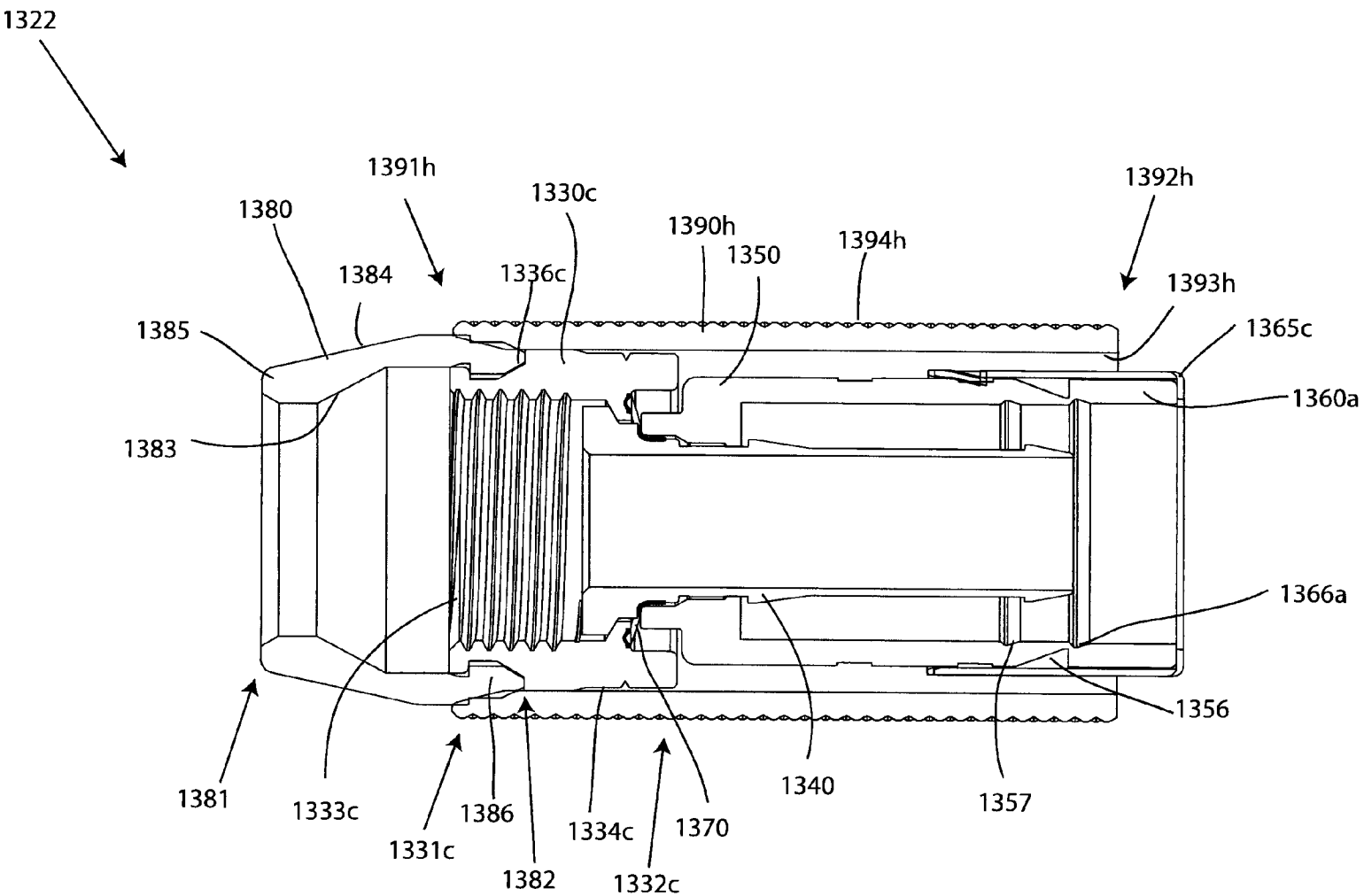
FIG. 76 depicts a cross-section view of a twenty third embodiment of a coaxial cable connector including an embodiment of a continuity member, an embodiment of a sleeve, an embodiment of a compression portion, and an embodiment of a radial restriction member.

FIG. 76 depicts an embodiment of connector 1322. Embodiments of connector 1322 may include a coupling member 1330*c*, a sealing member 1380, a post 1340, a connector body 1350, a continuity member 1370, a sleeve 1390*h*, a compression portion 1360*a*, and a radial restriction member 1365*c*.

Figure 77:
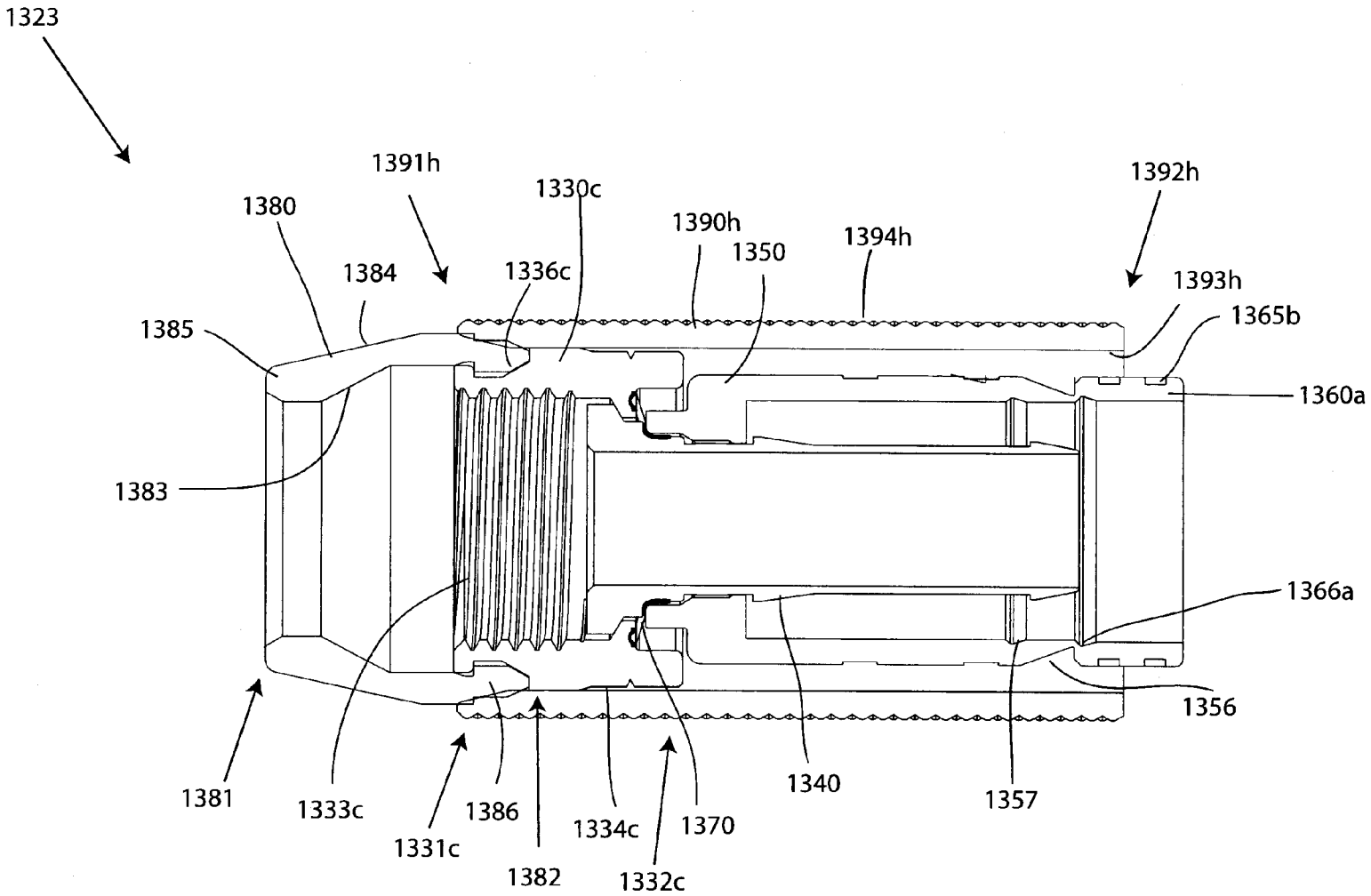
FIG. 77 depicts a cross-section view of a twenty-fourth embodiment of a coaxial cable connector including an embodiment of a continuity member, an embodiment of a sleeve, an embodiment of a compression portion, and an embodiment of a radial restriction member.

FIG. 77 depicts an embodiment of connector 1323. Embodiments of connector 1323 may include a coupling member 1330*c*, a sealing member 1380, a post 1340, a connector body 1350, a continuity member 1370, a sleeve 1390*h*, a compression portion 1360*a*, and a radial restriction member 1365*b*.

Referring now to FIGS. 78-93, embodiments of connector 1400-1415 may include a coupling member 1430, a post 1440, a connector body 1450, a continuity member 1470, a sleeve 1490, and a compression portion 1460. Embodiments of coupling member 1430 may be coupling member 1430*a*, 1430*b*, or 1430*c*, described in further detail infra. Embodiments of sleeve 1490 may be sleeve 1490*a*, 1490*b*, 1490*c*, 1490*d*, 1490*e*, 1490*f*, 1490*g*, or 1490*h*, described in further detail infra. Similarly, embodiments of compression portion 1460 may be 1460*b* or 1460*c*, described in further detail infra. Furthermore, embodiments of post 1440 and connector body 1450 may share the same or substantially the same structural and functional aspects of the embodiments of post 40/940/1040/1140/1240/1340 and connector body 50/950/1050/1150/1250/1350 described supra. Embodiments of continuity member 1470 may be disposed in the same or substantially the same location in a connector 100/900/1000/1100/1200/1300-1323/1400-1415 and may share the same structural and functional aspects of continuity member 70/170/270/370/470/570/670/970/1070/1170/1270/1370, as described supra. However, continuity member 1470 may share the same structural and functional aspects of continuity member 770/870 if a connector body, such as connector body 1450, is appropriately modified to accommodate the continuity member, such as continuity member 770/870. Connectors 1400-1415 may come in a preassembled configuration or may require additional operable attachment of the sleeve 1490 to connector 1400-1415 during installation.

Figure 78:
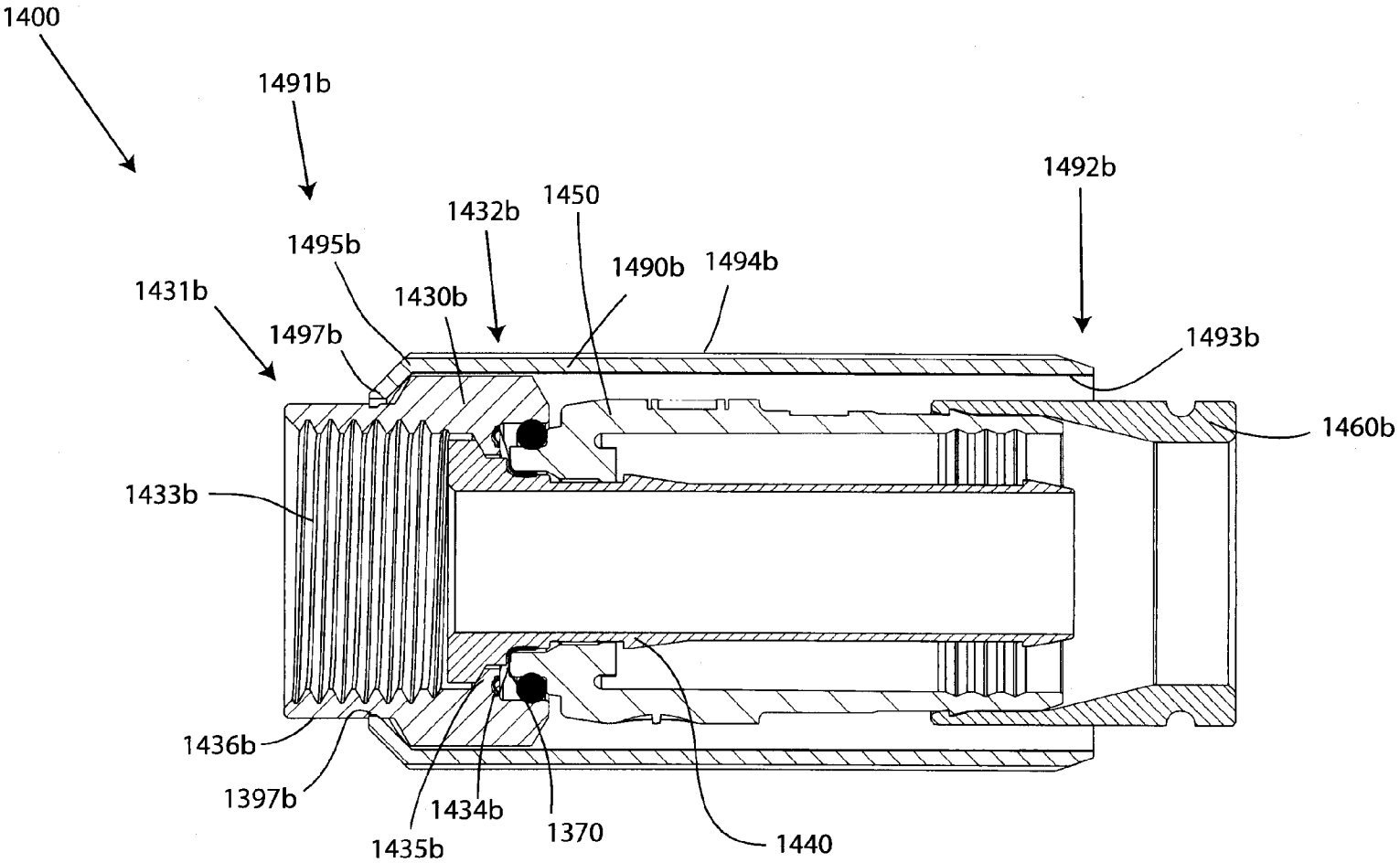
FIG. 78 depicts a cross-section view of a first embodiment of a coaxial cable connector including an embodiment of a continuity member and an embodiment of a sleeve.

Referring to FIG. 78, an embodiment of connector 1400 may include a coupling member 1430*b*, a post 1440, a connector body 1450, a continuity member 1470, a sleeve 1490*b*, and a compression portion 1360.

Embodiments of connector 1400 may include a coupling member 1430*b*. Coupling member 1430*b* may share the same or substantially the same structural and functional aspects of the embodiments of nut 30/930/1030/1130/1230/1330*b*, such as being mated, threaded or otherwise, to a corresponding interface port 20. Accordingly, coupling member 1430*b* may include a first end 1431*b*, a second end 1432*b*, an inner surface 1433*b*, an outer surface 1436*b*, an internal lip 1434*b*, such as an annular protrusion, located proximate the second rearward end 1432*b* of the coupling member 1430*b*, wherein the internal lip 1434*b* includes a surface 1435*b* facing the first forward end 1431*b* of the coupling member 1430*b*. Additionally, coupling member 1430*b* may include a retaining structure 1437*b* on the outer surface 1436*b* of the coupling member 1430*b*. The retaining structure 1437*b* of the coupling member 1430*b* may be an annular groove or recession that extends completely or partially around the outer surface 1436*b* of the coupling member 1430*b* to retain, accommodate, receive, or mate with an engagement member 1497 of the sleeve 1490. Alternatively, the retaining structure 1437*b* may be an annular protrusion that extends completely or partially around the outer surface 1436*b* of the coupling member 1430*b* to retain or mate with the engagement member 1497 of the sleeve 1490. The retaining structure 1437*b* may be placed at various axial positions from the first end 1431*b* to the 1432*b*, depending on the configuration of the sleeve 1490 and other design requirements of a coaxial cable connector.

Moreover, embodiments of coupling member 1430*b* may include an outer surface feature(s) 1438*b* proximate or otherwise near the second end 1432*a* to improve mechanical interference or friction between the coupling member 1430*b* and the sleeve 1490. For instance, the outer surface feature(s) 1438*a* may extend completely or partially around the outer surface 1436*b* proximate the second 1432*b* of the coupling member 1430*b* to increase a retention force between an inner surface of the sleeve 1490 and the outer surface 1436*b* of the coupling member 4330*b*. The outer surface feature 1438*b* may include a plurality of planar surfaces that may facilitate contact between the sleeve 1490 and the coupling member 1430*b*.

Embodiments of connector 1400 may also include a sleeve 1490*b*. Sleeve 1490*b* may share the same structural and functional aspects of sleeve 1390*b* described in association with, for example, connector 1303. Accordingly, sleeve 1490*b* may include an engagement member 1497*b* that is configured to mate or engage with a retaining structure 1437*b* of the coupling member 1430*b*. For example, the sleeve 1490*b* may include a first end 1491*b*, a second end 1492*b*, an inner surface 1493*b*, and an outer surface 1494*b*, and may be a generally annular member having a generally axial opening therethrough. However, the sleeve 1490*b* may be radially disposed over the coupling member 1430*b*, or a portion thereof, the post 1440, the connector body 1450, or a portion thereof, and the compression portion 1460, or a portion thereof, while operably assembled and/or in a compressed position. Additionally, the sleeve 1490*b* may include an annular ramped surface 1495*b* or chamfer proximate or otherwise near the first end 1491*b* to accommodate an increased diameter or general size of the coupling member 1430*b* proximate a second, rearward end 1432*b* of the coupling member 1430*b*. Embodiments of the ramped surface 1495*b* may be structurally integral with the engagement member 1497*b* and the body of the sleeve 1490*b*.

Referring still to FIG. 78, embodiments of connector 1400 may include a compression portion 1460*b*. Compression portion 1460*b* may share the same or substantially the same structural and functional aspects of fastener member 60, as described supra. Accordingly, compression portion 1460*b* may have a first end 1461*b* and opposing second end 1462*b*, and a ramped surface 1466*b* which may be positioned between a first opening or inner bore having a first diameter positioned proximate with the first end 1461*b* of the compression portion 1460*b* and a second opening or inner bore having a second diameter positioned proximate with the second end 1462*b* of the compression portion 1460*b* to deformably compress the outer surface of a connector body 1450 when the compression portion 1460*b* is operated to secure a coaxial cable 10. Furthermore, the compression portion 1460*b* may be manufactured via casting, extruding, cutting, turning, drilling, knurling, injection molding, spraying, blow molding, component overmolding, combinations thereof, or other fabrication methods that may provide efficient production of the component.

Figure 79A:
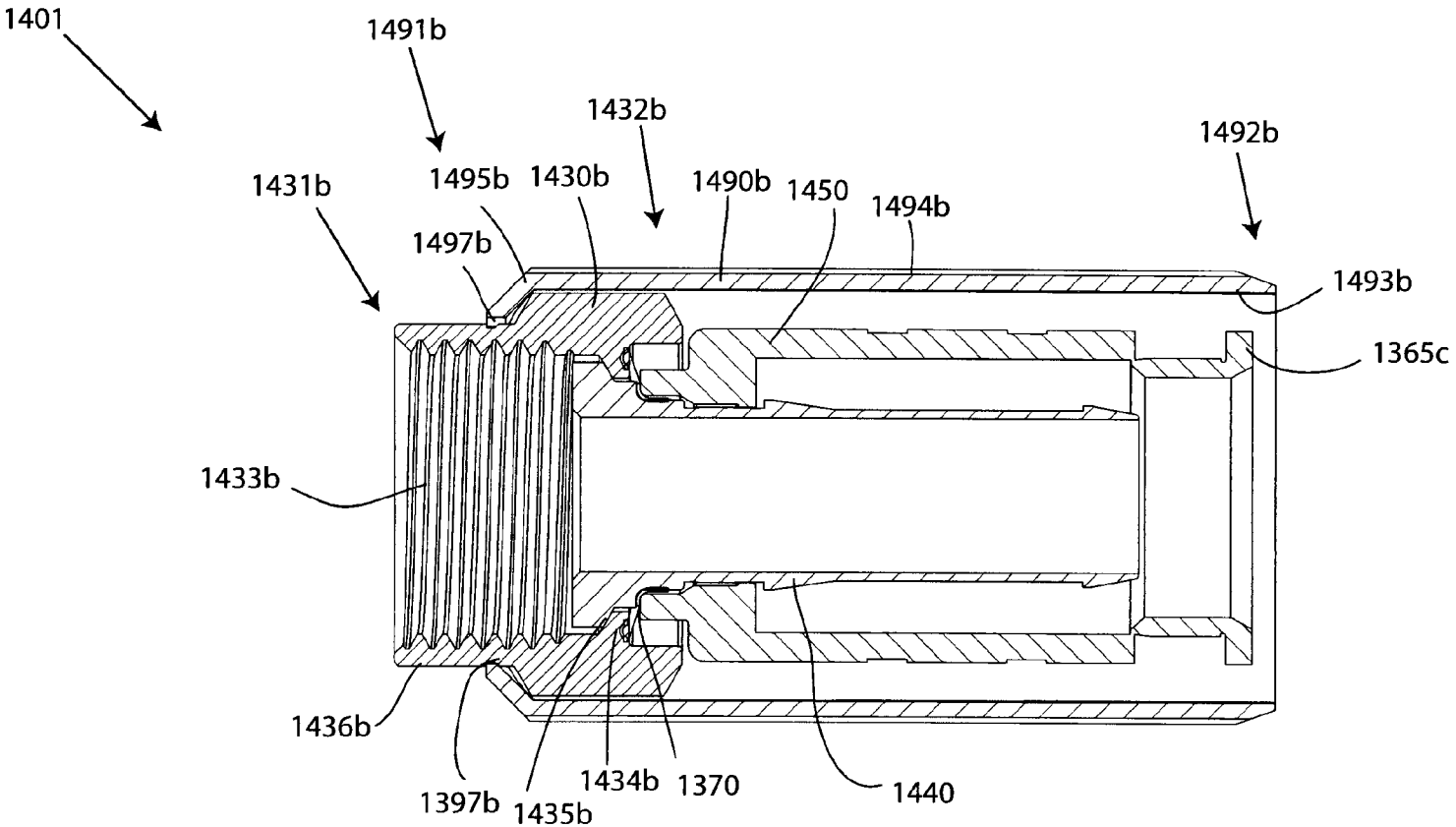
FIG. 79A depicts a cross-section view of a second embodiment of a coaxial cable connector including an embodiment of a continuity member, an embodiment of a sleeve, and a first embodiment of a compression sleeve.
Figure 79B:
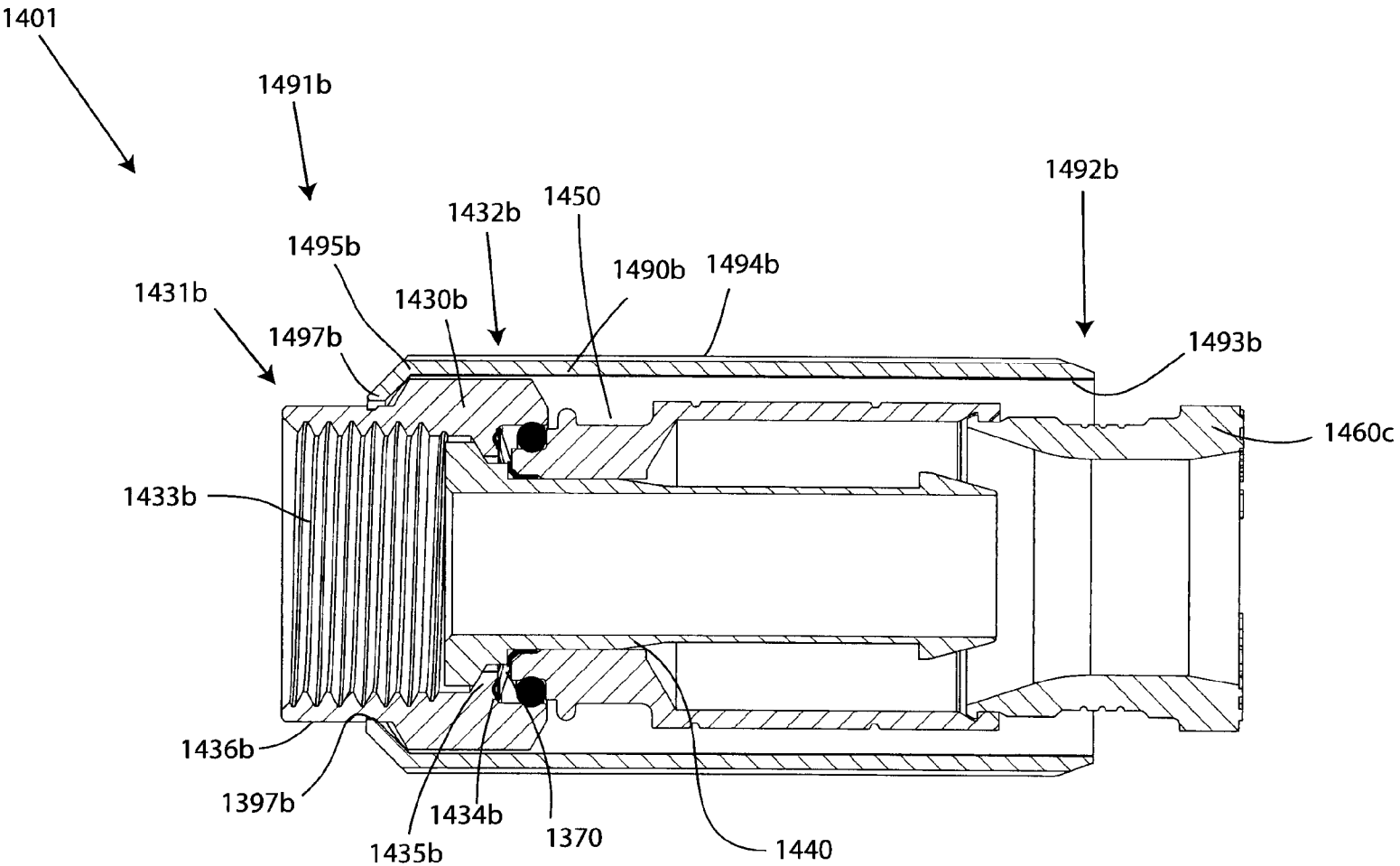
FIG. 79B depicts a cross-section view of a second embodiment of a coaxial cable connector including an embodiment of a continuity member, an embodiment of a sleeve, and a second embodiment of a compression sleeve.

With reference now to FIGS. 79A and 79B, embodiments of connector 1401 may include a coupling member 1430*b*, a post 1440, a connector body 1450, a continuity member 1470, a sleeve 1490*b*, and a compression portion 1460*c*.

Embodiments of connector 1401 may include a compression portion 1460*c*. Compression portion 1460*c* may be an insertable compression sleeve or tubular locking compression member that resides internally with respect to the connector body 1450 in the compressed position, as described in further detail supra. The compression portion 1460*c* may include a first end 1461*c*, a second end 1462*c*, an inner surface 1463, and an outer surface 1464*c*. The compression portion 1460*c* may be pushed into the connector body 1450 to squeeze against and secure the cable 10. For instance, the compression portion 1460*c* may protrude axially into an annular chamber through the rear opening, and may be slidably coupled or otherwise movably affixed to the connector body 1450 to compress into the connector body 1450 and retain the cable 10. The compression portion 1460*c* may be displaceable or movable axially or in the general direction of the axis of the connector between a first open position (accommodating insertion of the tubular inner post 1440 into a prepared cable 10 end to contact the grounding shield 14), and a second clamped position compressibly fixing the cable 10 within the chamber of the connector because the compression portion 1460*c* is squeezed into retraining contact with the cable 10 within the connector body 1450. An alternative embodiment of compression portion 1460*c* may be shown in FIG. 79A, which includes an internal annular groove in the connector body 1450 and a lip 1465*c* proximate the first end 1461*c* of the compression position 1460*c*, wherein the internal groove of the connector body 1450 mates with the lip 1465*c* of the compression portion 1460*c*.

Figure 80:
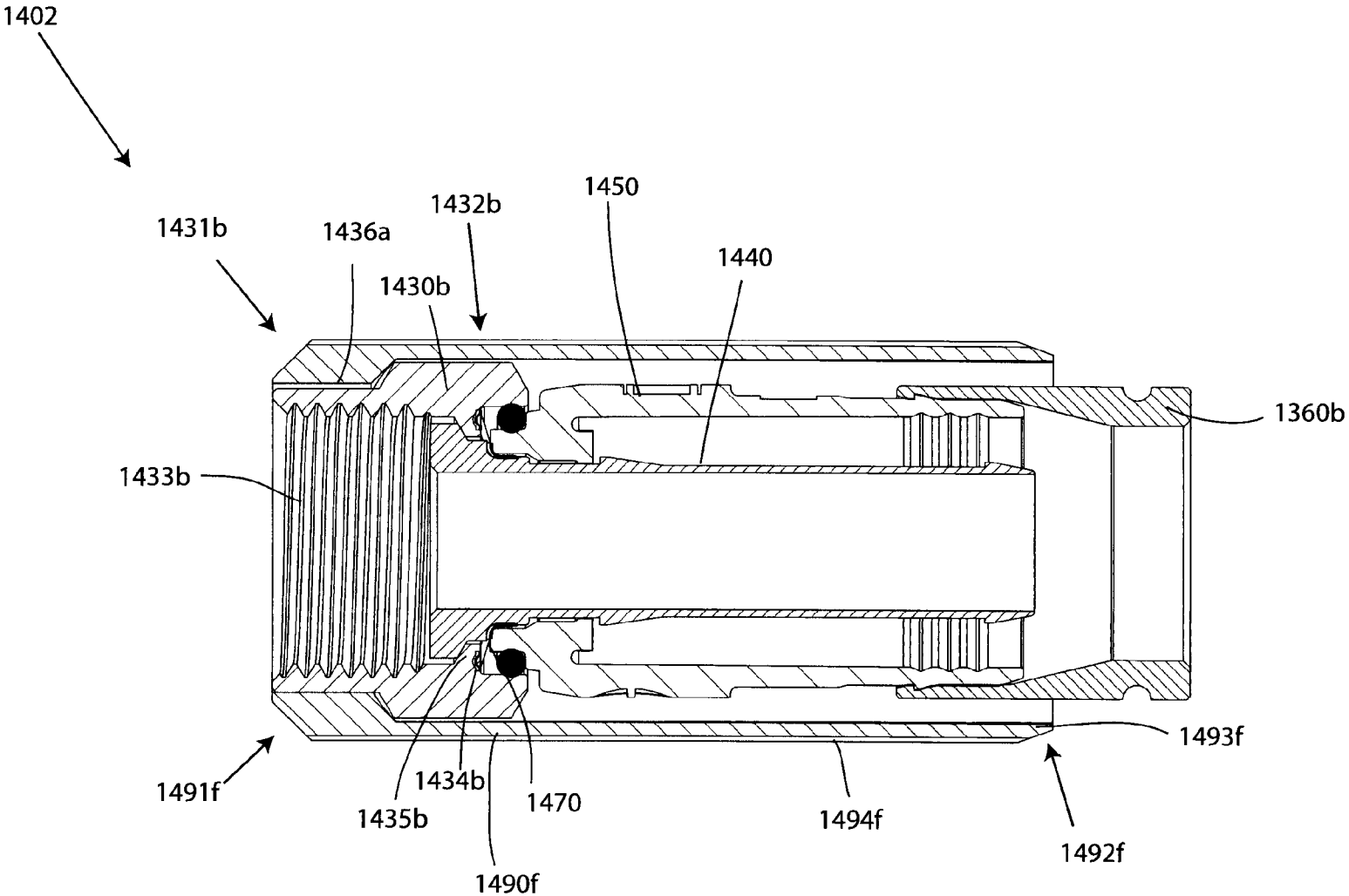
FIG. 80 depicts a cross-section view of a third embodiment of a coaxial cable connector including an embodiment of a continuity member and an embodiment of a sleeve.

With reference now to FIG. 80, embodiments of connector 1402 may include a coupling member 1440*b*, a post 1440, a connector body 1450, a continuity member 1470, a sleeve 1490*f*, and a compression portion 1460*b*.

Embodiments of connector 1402 may include a sleeve 1490*f*. Sleeve 1490*f* may share the same or substantially the same structural and functional aspects of sleeve 1390*f*. Accordingly, sleeve 1490*f* may include an engagement member 1497*f* that is configured to mate or engage with a retaining structure 1437*b* of the coupling member 1430*b*. For example, the sleeve 1490*f* may include a first end 1491*f*, a second end 1492*f*, an inner surface 1493*f*, and an outer surface 1494*f*, and may be a generally annular member having a generally axial opening therethrough. Additionally, sleeve 1490*f* may surround the coupling member 1430*b*, the post 1440, the connector body 1450, or a portion thereof, and the compression portion 1460 when in an assembled and/or compressed position. However, the sleeve 1490*f* may extend towards the first end 1431*b* of coupling member 1430*b*. In one embodiment, the first end 1491*f* of the sleeve 1490*f* may be flush or substantially flush with an edge of the coupling member 1430*b* proximate or otherwise near the first end 1431*b* of the coupling member 1430*b*.

Figure 81:
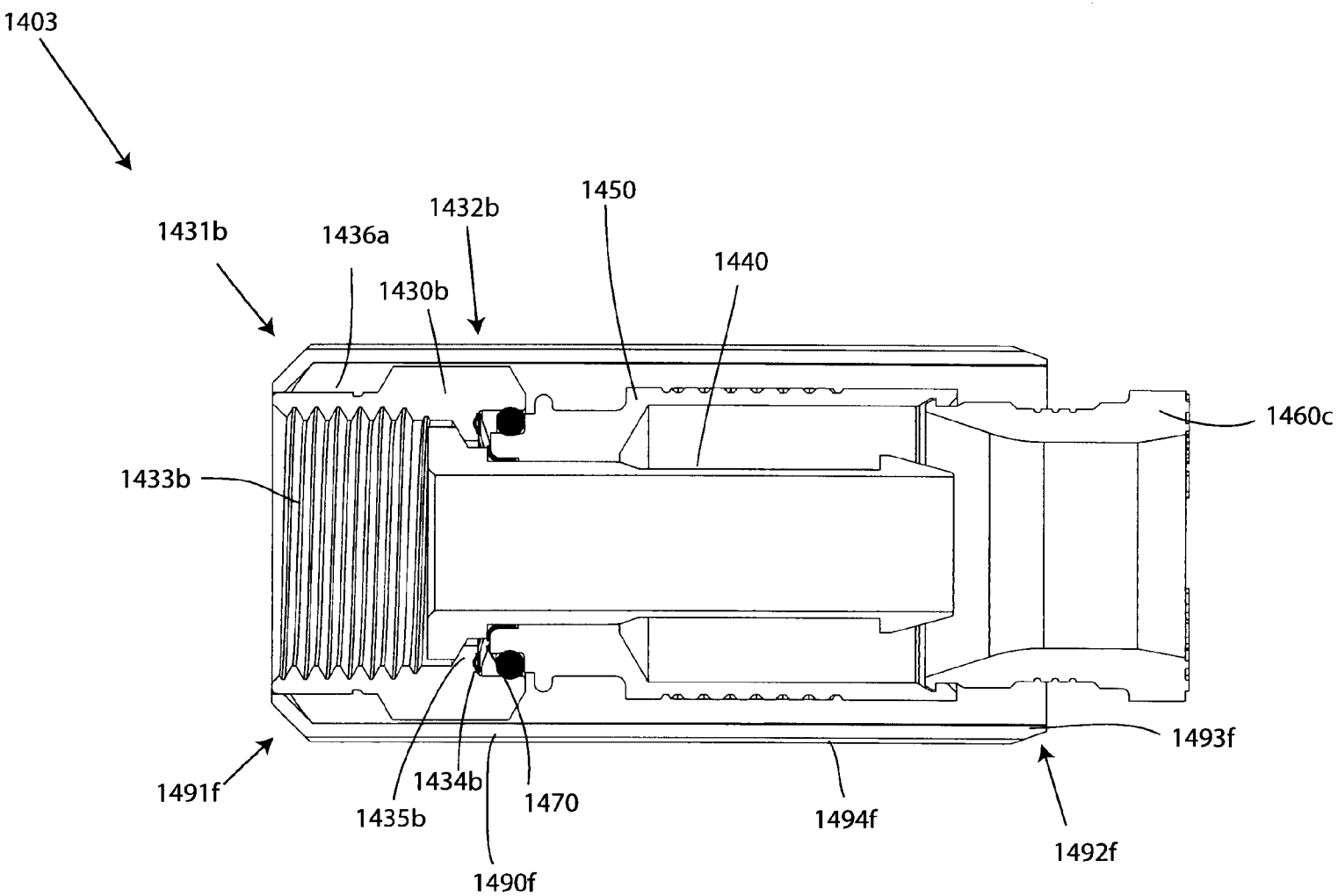
FIG. 81 depicts a cross-section view of a fourth embodiment of a coaxial cable connector including an embodiment of a continuity member and an embodiment of a sleeve.

FIG. 81 depicts an embodiment of connector 1403. Embodiments of connector 1403 may include a coupling member 1430*b*, a post 1440, a connector body 1450, a continuity member 1470, a sleeve 1490*f*, and a compression portion 1460*c*.

Figure 82:
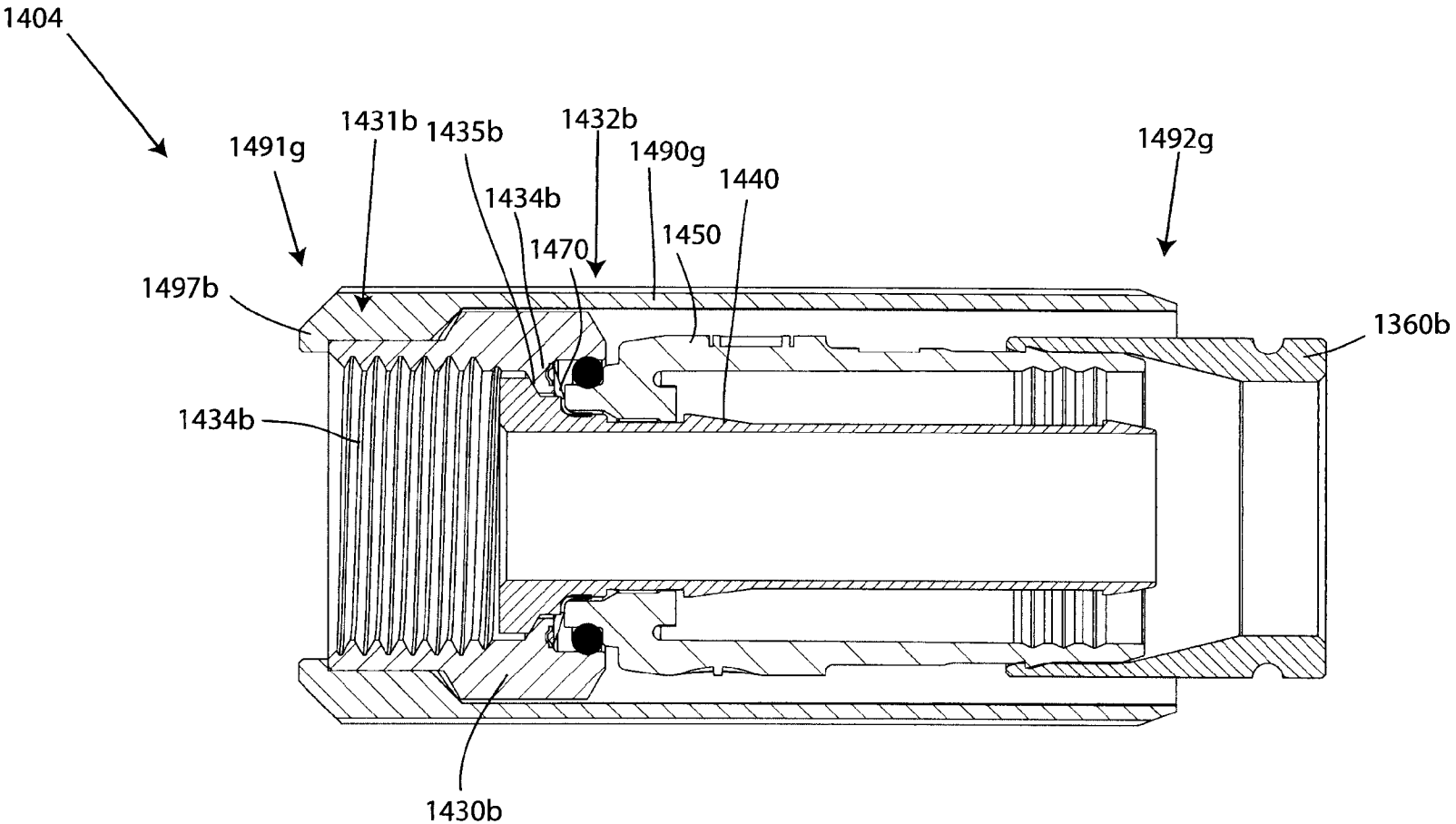
FIG. 82 depicts a cross-section view of a fifth embodiment of a coaxial cable connector including an embodiment of a continuity member and an embodiment of a sleeve.

With reference now to FIG. 82, embodiments of connector 1404 may include a coupling member 1440*b*, a post 1440, a connector body 1450, a continuity member 1470, a sleeve 1490*g*, and a compression portion 1460*b*.

Embodiments of connector 1404 may include a sleeve 1490*g*. Sleeve 1490*g* may share the same or substantially the same function as sleeve 1390*g*. Accordingly, the sleeve 1490*g* may include a first end 1491*g*, a second end 1492*g*, an inner surface 1493*g*, and an outer surface 1494*g*, and may be a generally annular member having a generally axial opening therethrough. Sleeve 1490*g* may surround the coupling member 1430*b*, the post 1440, the connector body 1450, or a portion thereof, and the compression portion 1360 when in an assembled and/or compressed position. Moreover, the sleeve 1490*g* may extend towards the first end 1431*b* of coupling member 1430*b*. However, sleeve 1490*g* may include an inwardly extending lip 1497*g* proximate or otherwise near the first end 1491*g* of the sleeve 1490*g*, which can help guide the coupling member 1430*b* onto a corresponding interface port. The lip 1497*g* may share the same functional aspects of the engagement member 1397*f* of sleeve 1390*f*.

Figure 83:
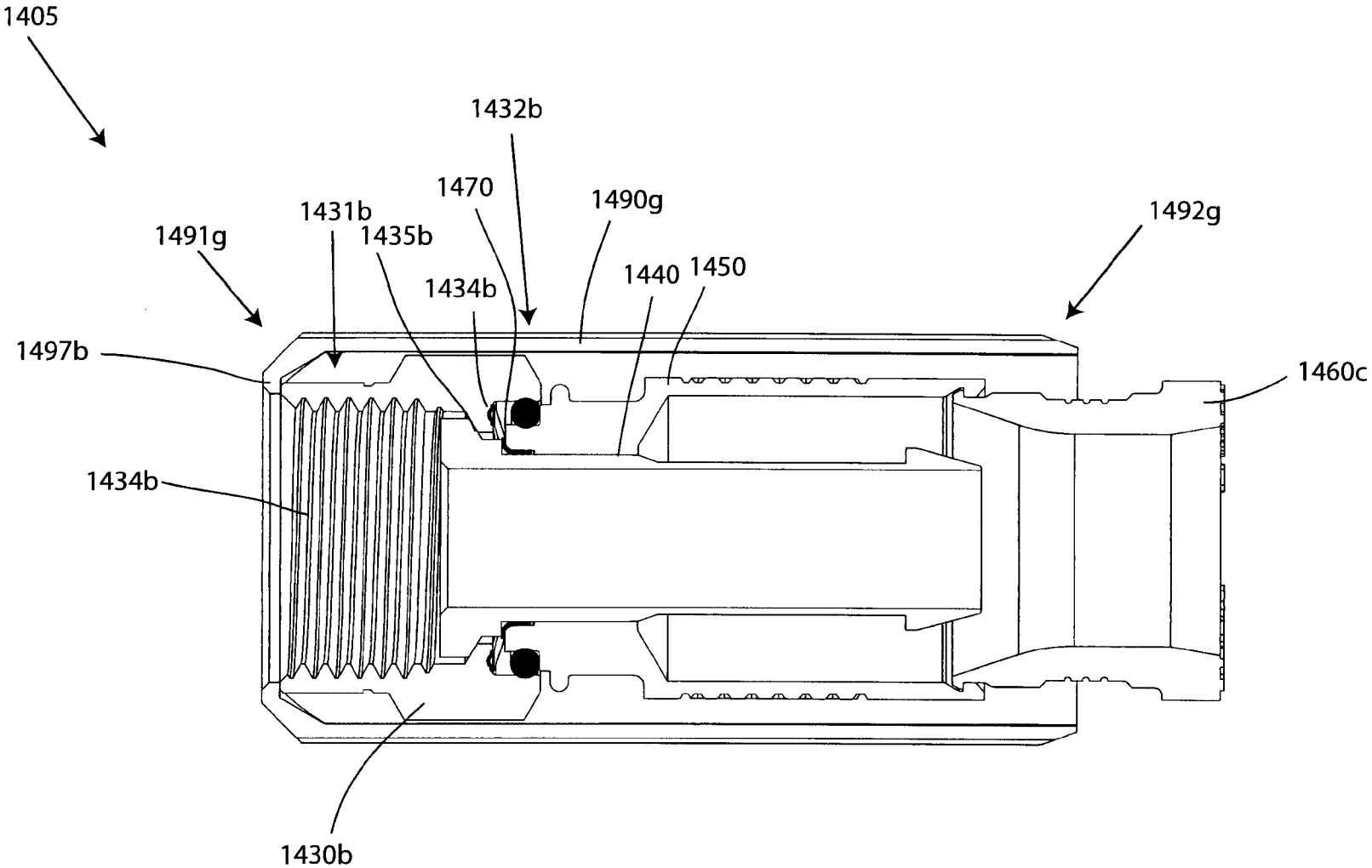
FIG. 83 depicts a cross-section view of a sixth embodiment of a coaxial cable connector including an embodiment of a continuity member and an embodiment of a sleeve.

FIG. 83 depicts an embodiment of connector 1405. Embodiments of connector 1405 may include a coupling member 1440*b*, a post 1440*b*, a connector body 1450, a continuity member 1470, a sleeve 1490*f*, and a compression portion 1460*c*.

Figure 84:
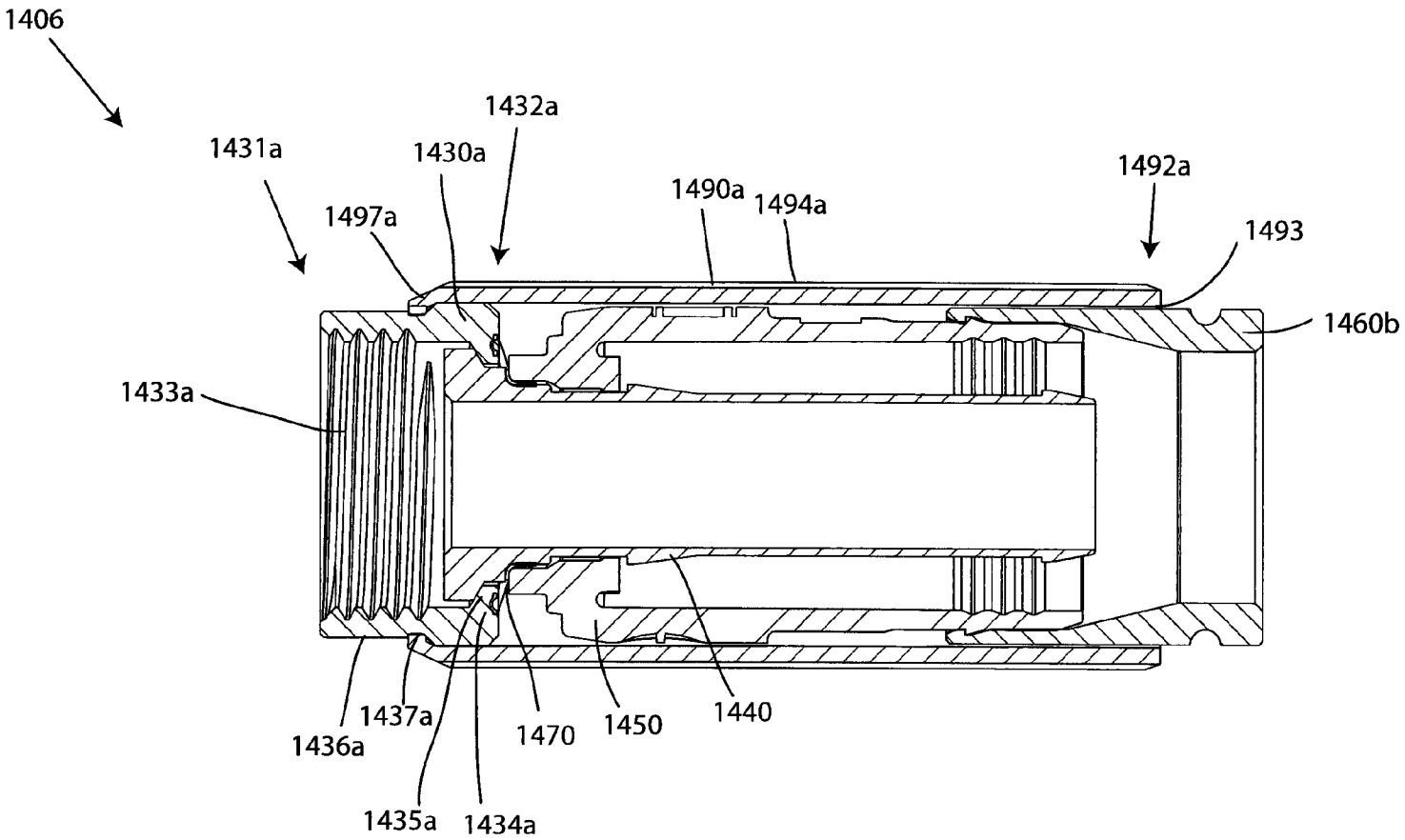
FIG. 84 depicts a cross-section view of a seventh embodiment of a coaxial cable connector including an embodiment of a continuity member and an embodiment of a sleeve.

Referring to FIG. 84, an embodiment of connector 1406 may include a coupling member 1430*a*, a post 1440, a connector body 1450, a continuity member 1470, a sleeve 1490*a*, and a compression portion 1460.

Embodiments of connector 1406 may include a coupling member 1430*a*. Coupling member 1430*a* may share the same or substantially the same structural and functional aspects of coupling member 1330*a*. Accordingly, coupling member 1430*a* may include a first end 1431*a*, a second end 1432*a*, an inner surface 1433*a*, an outer surface 1436*a*, an internal lip 1434*a*, such as an annular protrusion, located proximate the second rearward end 1432*a* of the coupling member 1430*a*, wherein the internal lip 1434*a* includes a surface 1435*a* facing the first forward end 1431*a* of the coupling member 1430*a*. Moreover, coupling member 1430*a* may include an engagement member 1497*a* configured to retain, accommodate, receive, or mate with an engagement member 1497*a* of the sleeve 1490*a*, and an outer surface feature 1438*a* proximate or otherwise near the second end 1432*a* to improve mechanical interference or friction between the coupling member 1330*a* and the sleeve 1390.

Embodiments of connector 1406 may also include a sleeve 1490*a*. Sleeve 1490*a* may share the same or substantially the same structural and functional aspects of sleeve 1390*a* described supra. Accordingly, the sleeve 1490*a* may include a first end 1491*a*, a second 1491*a*, an inner surface 1493*a*, and an outer surface 1494*a*, and may be a generally annular member having a generally axial opening therethrough. Moreover, the sleeve 1390*a* may also include an engagement member 1497*a* configured to mate or engage with the retaining structure 1337 of the coupling member 1330*a*, and internal surface features 1498*a* to improve the contact between the coupling member 1430*a* and sleeve 1490*a*.

Figure 85:
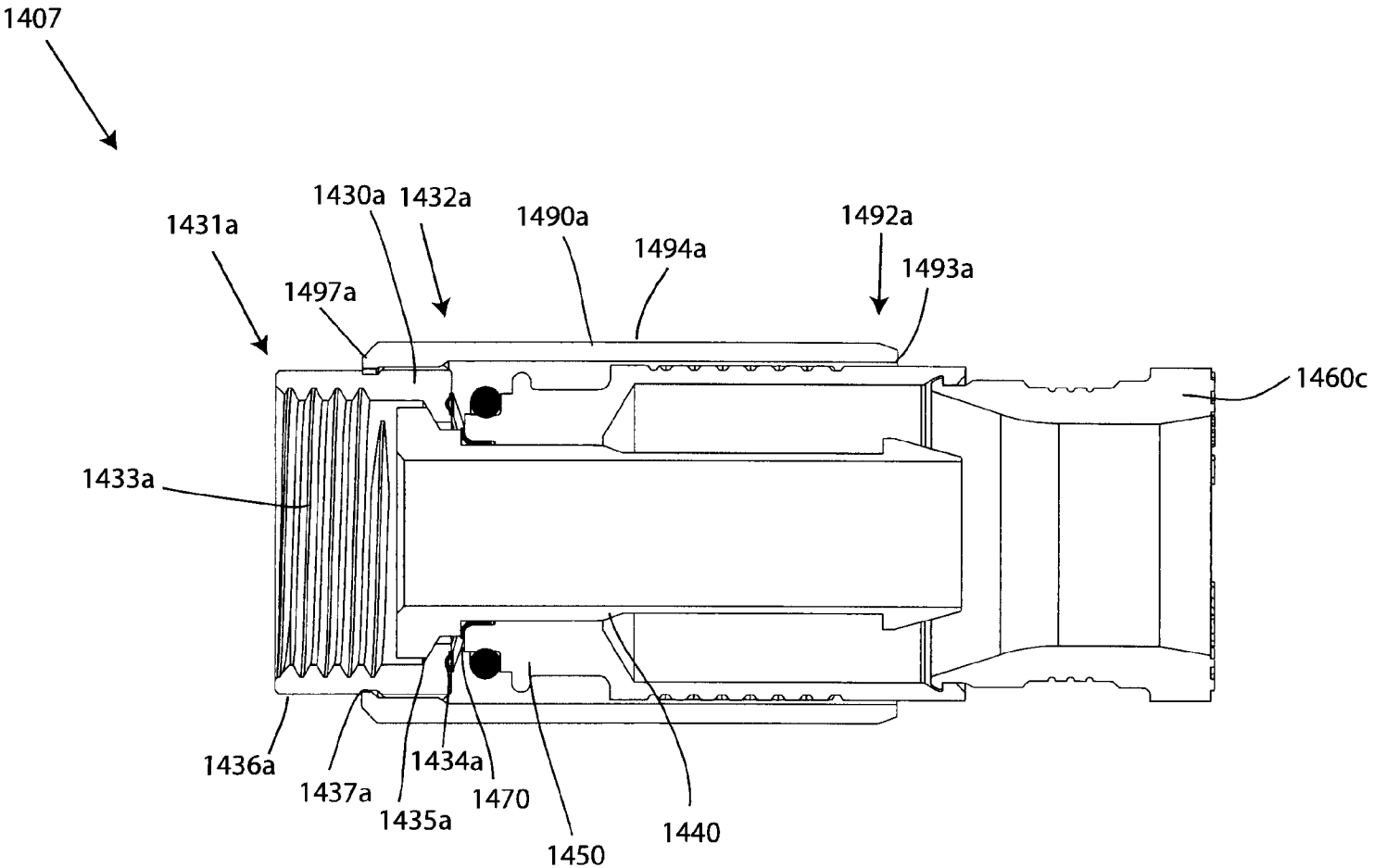
FIG. 85 depicts a cross-section view of a eighth embodiment of a coaxial cable connector including an embodiment of a continuity member and an embodiment of a sleeve.

FIG. 85 depicts an embodiment of connector 1407. Embodiments of connector 1407 may include a coupling member 1430*a*, a post 1440, a connector body 1450, a continuity member 1470, a sleeve 1490*a*, and a compression portion 1360*c*.

Figure 86:
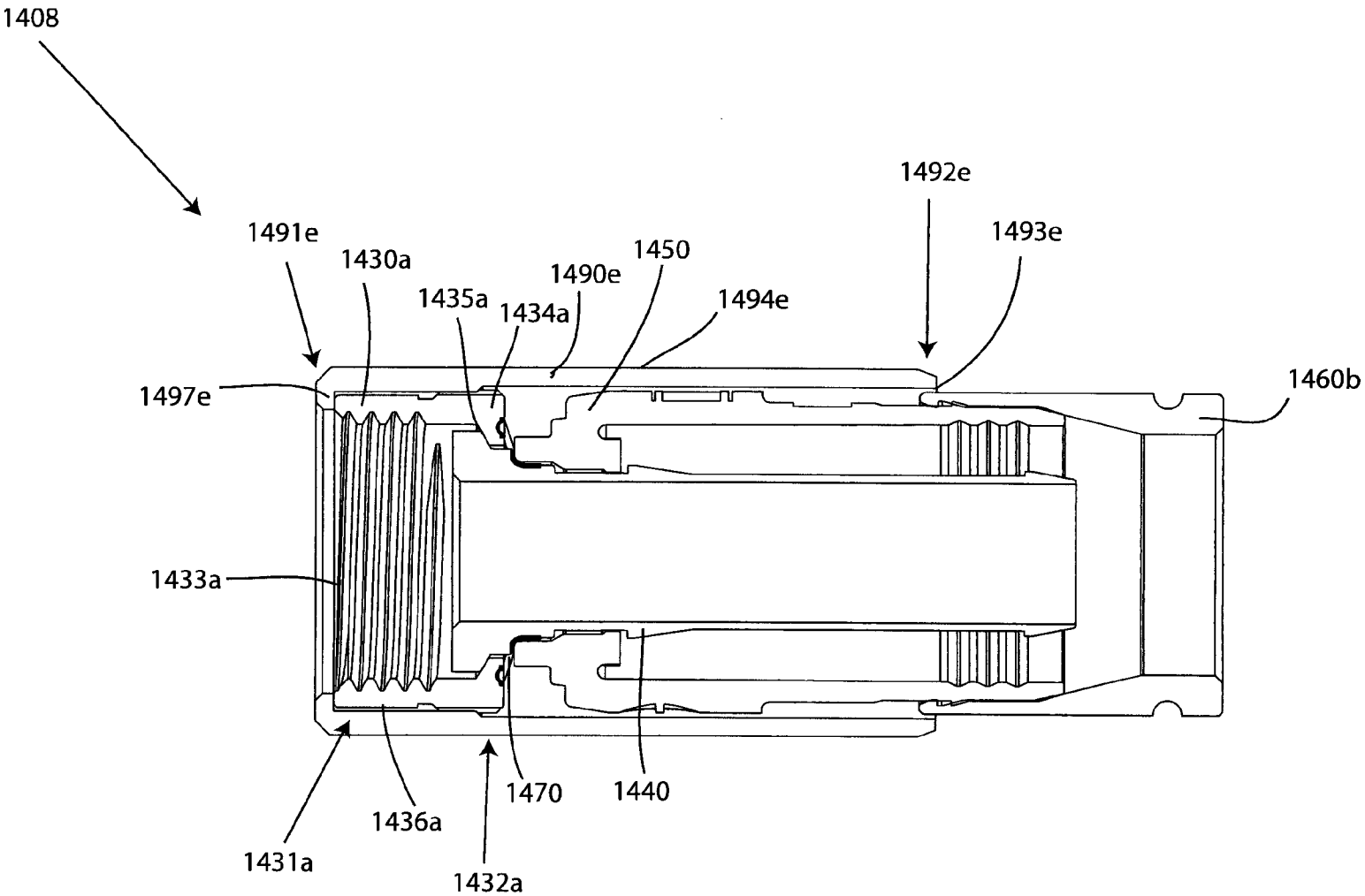
FIG. 86 depicts a cross-section view of a ninth embodiment of a coaxial cable connector including an embodiment of a continuity member and an embodiment of a sleeve.

Referring now to FIG. 86, embodiments of connector 1408 may include a coupling member 1430*a*, a post 1440, a connector body 1450, a continuity member 1470, a sleeve 1490*e*, and a compression portion 1360*b*.

Embodiments of connector 1408 may include a sleeve 1490*e*. Sleeve 1490*e* may share the same or substantially the same function as sleeve 1390*e*. Accordingly, the sleeve 1490*e* may include a first end 1491*e*, a second end 1492*e*, an inner surface 1493*e*, and an outer surface 1494*e*, and may be a generally annular member having a generally axial opening therethrough. Sleeve 1490*e* may surround the coupling member 1430*a*, the post 1440, the connector body 1450, or a portion thereof, and the compression portion 1360 when in an assembled and/or compressed position. Moreover, the sleeve 1490*e* may extend towards the first end 1431*a* of coupling member 1430*a*. Sleeve 1490*e* may further include an inwardly extending lip 1497*e* proximate or otherwise near the first end 1491*e* of the sleeve 1490*e*, which can help guide the coupling member 1430*a* onto a corresponding interface port. The lip 1497*e* may share the same functional aspects of the engagement member 1397*e* of sleeve 1390*e*.

Figure 87:
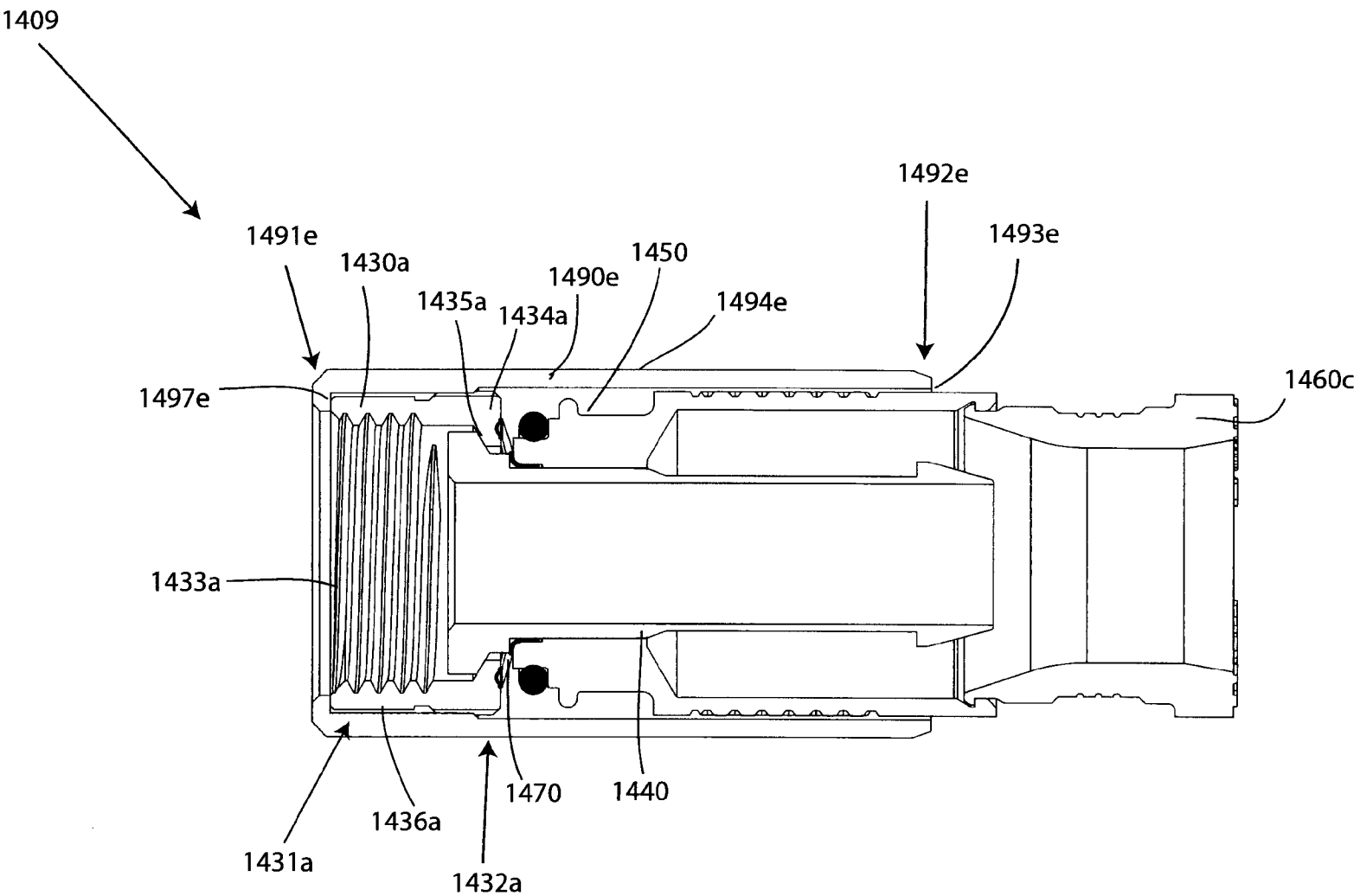
FIG. 87 depicts a cross-section view of a tenth embodiment of a coaxial cable connector including an embodiment of a continuity member and an embodiment of a sleeve.

FIG. 87 depicts an embodiment of connector 1409. Embodiments of connector 1409 may include a coupling member 1430*a*, a post 1440, a connector body 1450, a continuity member 1470, an outer sleeve 1490*e*, and compression portion 1460*c*.

Figure 88:
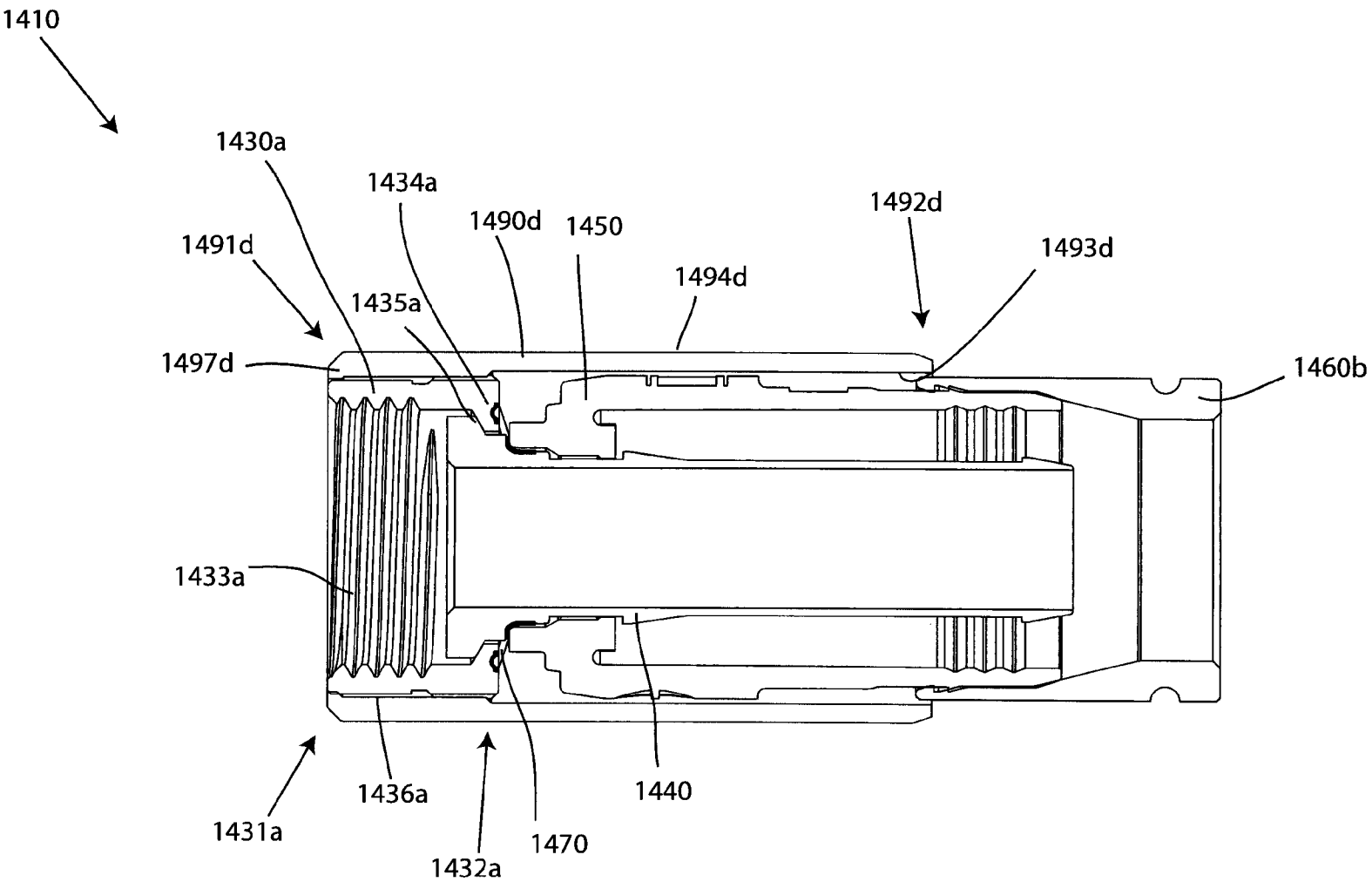
FIG. 88 depicts a cross-section view of an eleventh embodiment of a coaxial cable connector including an embodiment of a continuity member and an embodiment of a sleeve.

With reference now to FIG. 88, embodiments of connector 1410 may include a coupling member 1430*a*, a post 1440, a connector body 1450, a continuity member 1470, a sleeve 1490*d*, and a compression portion 1460*b*.

Embodiments of connector 1410 may include a sleeve 1410. Sleeve 1410 may share the same or substantially the same structural and functional aspects of sleeve 1390*d*. Accordingly, the sleeve 1490*d* may include a first end 1491*d*, a second end 1492*d*, an inner surface 1493*d*, and an outer surface 1494*d*, and may be a generally annular member having a generally axial opening therethrough. Additionally, sleeve 1490*d* may extend towards the first end 1431*a* of coupling member 1430*a*. The sleeve 1490*d* may include an engagement member 1497*d* that may share the same or substantially the same structural or functional aspects as engagement member 1397*d*. For instance, the engagement member 1497*d* may be configured to mate or engage with a correspondingly located retaining structure 1337 of the coupling member 1330*a*.

Figure 89:
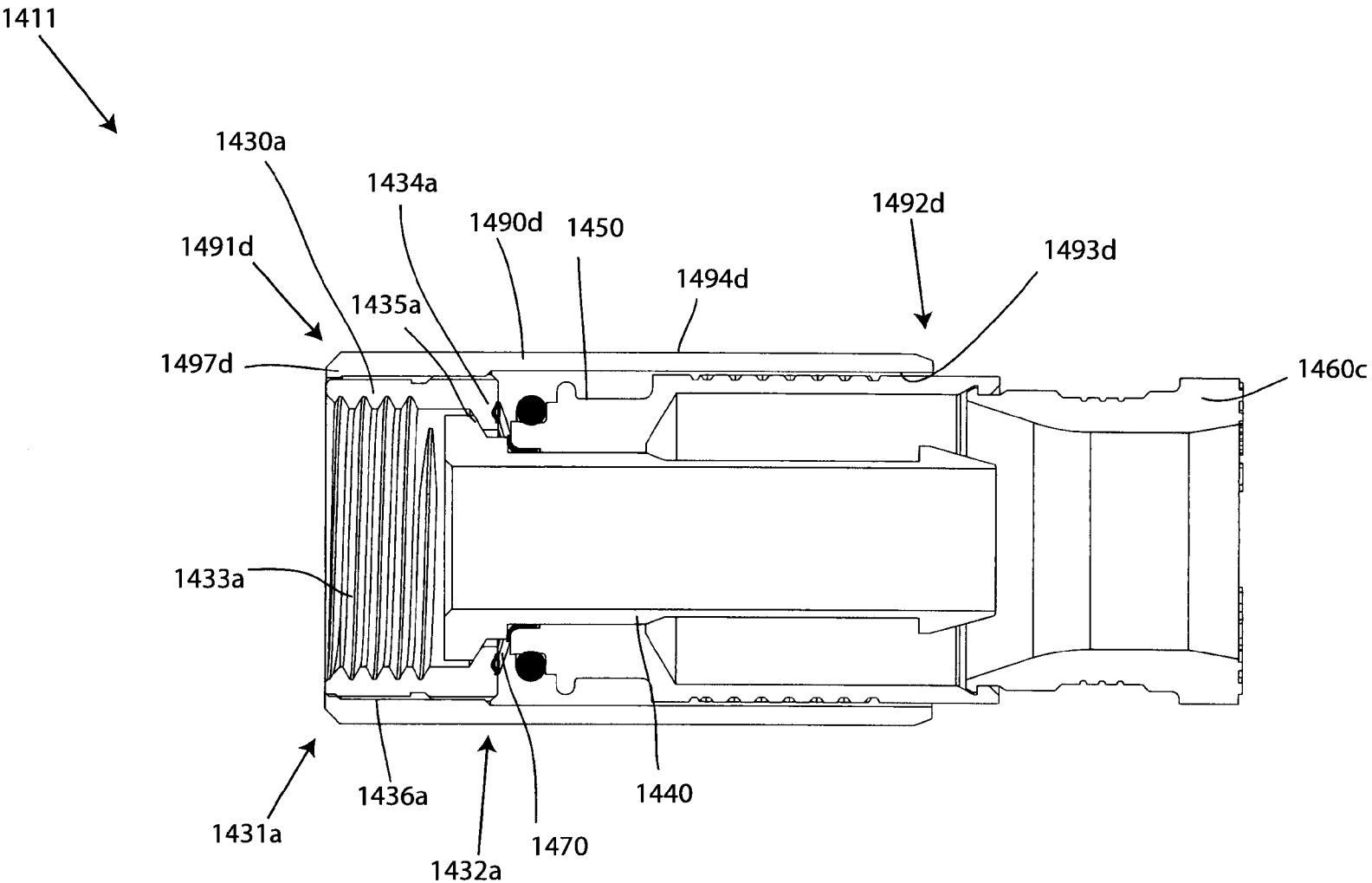
FIG. 89 depicts a cross-section view of a twelfth embodiment of a coaxial cable connector including an embodiment of a continuity member and an embodiment of a sleeve.

FIG. 89 depicts an embodiment of connector 1411. Embodiments of connector 1411 may include a coupling member 1430*a*, a post 1440, a connector body 1450, a continuity member 1470, a sleeve 1490*d*, and a compression portion 1360*c*.

Figure 90:
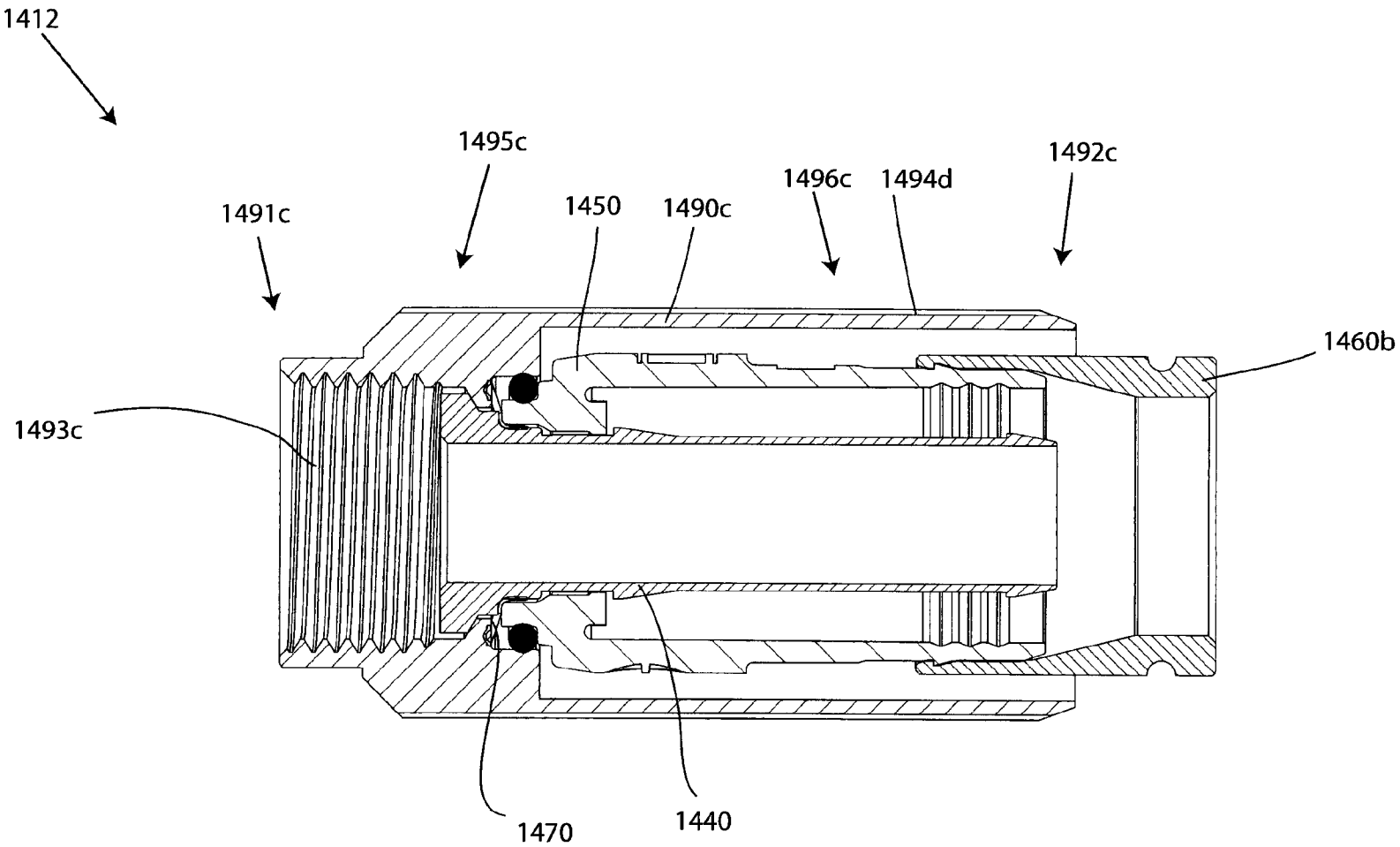
FIG. 90 depicts a cross-section view of a thirteenth embodiment of a coaxial cable connector including an embodiment of a continuity member and an embodiment of a sleeve.

With reference now to FIG. 90, embodiments of connector 1412 may include an integral sleeve 1490*c*, a post 1440, a connector body 1450, a continuity member 1370, and a compression portion 1360*b*.

Embodiments of connector 1412 may include an integral sleeve 1490*c*. Integral sleeve 1490*c* may share the same structural and functional aspects of integral sleeve 1390*c*. Accordingly, integral sleeve 1390*c* may include a first end 1491*c*, a second end 1492*c*, an outer surface 1493*c*, and an outer surface 1494*c*, and may be a generally annular member having a generally axial opening therethrough. Moreover, the integral sleeve 1490*c* may include a coupling portion 1495*c* proximate the first end 1491*c* and a body portion 1496*c* structurally integral with the coupling portion 1495*c*.

Figure 91:
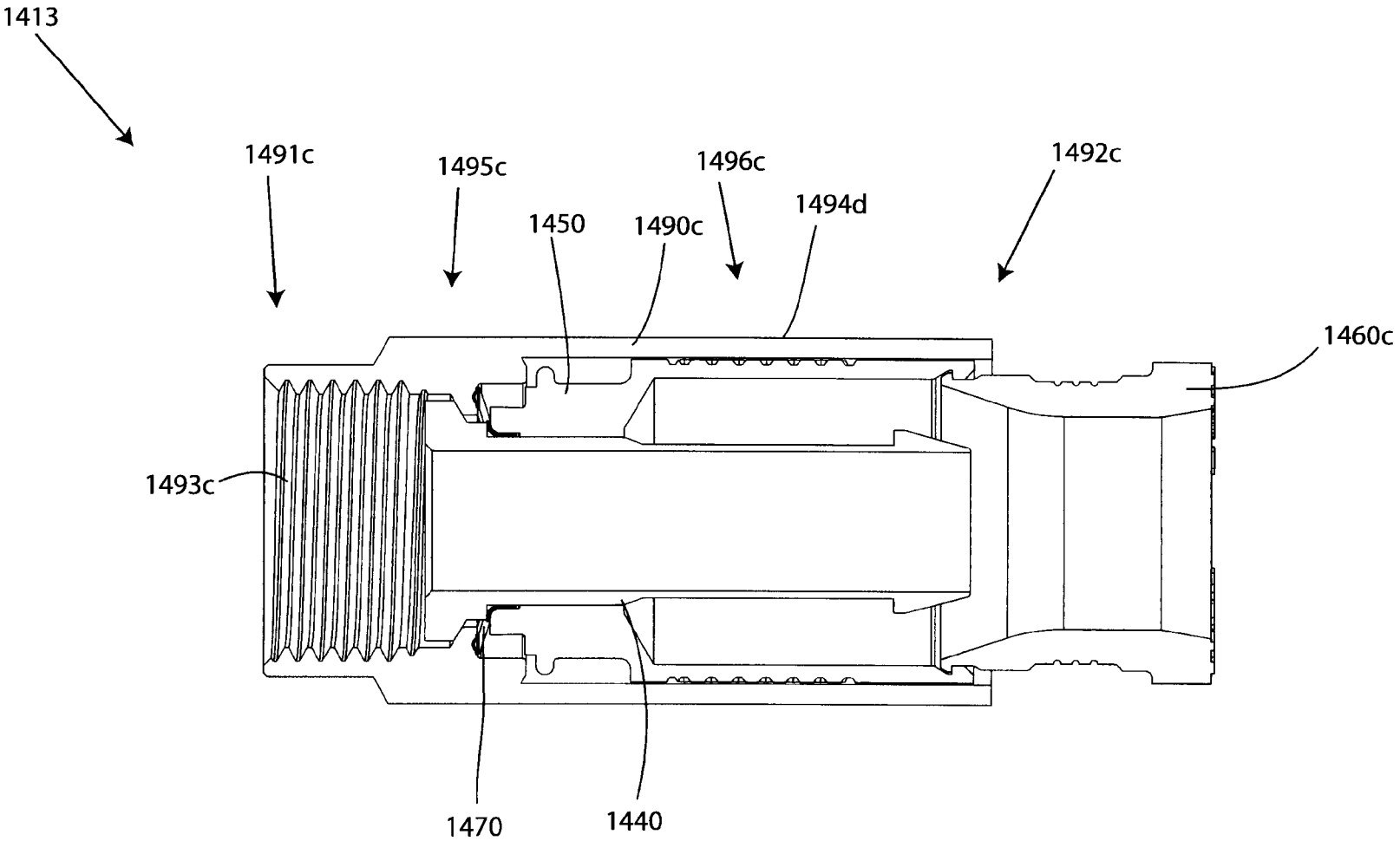
FIG. 91 depicts a cross-section view of a fourteenth embodiment of a coaxial cable connector including an embodiment of a continuity member and an embodiment of a sleeve.

FIG. 91 depicts and embodiment of connector 1413. Embodiments of connector 1413 may include an integral sleeve 1490*c*, a post 1440, a connector body 1450, a continuity member 1470, and a compression portion 1460*c*.

Figure 92:
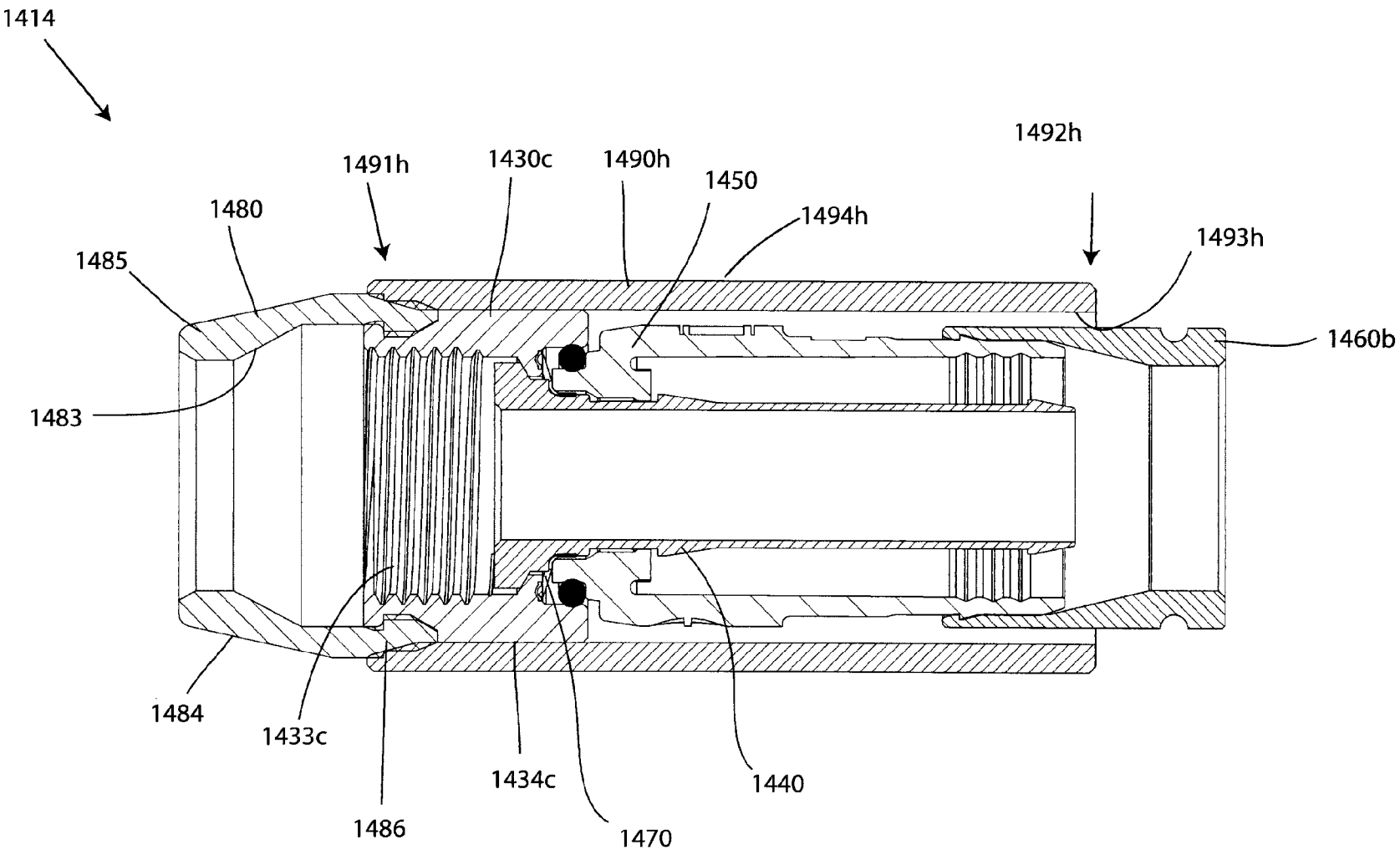
FIG. 92 depicts a cross-section view of a fifteenth embodiment of a coaxial cable connector including an embodiment of a continuity member and an embodiment of a sleeve.

Referring now to FIG. 92, embodiments of connector 1414 may include a coupling member 1430*c*, a sealing member 1480, a post 1440, a connector body 1450, a continuity member 1470, a sleeve 1490*h*, and a compression portion 1360*b*. Embodiments of coupling member 1430*c* may share the same or substantially the same structural and functional aspects as coupling member 1330*c*, described supra. Embodiments of sleeve 1490*h* may share the same or substantially the same structural and functional aspects of sleeve 1390*h*, described supra. Similarly, embodiments of sealing member 1480 may share the same or substantially the same structural and functional aspects as sealing member 1380, described supra.

Figure 93:
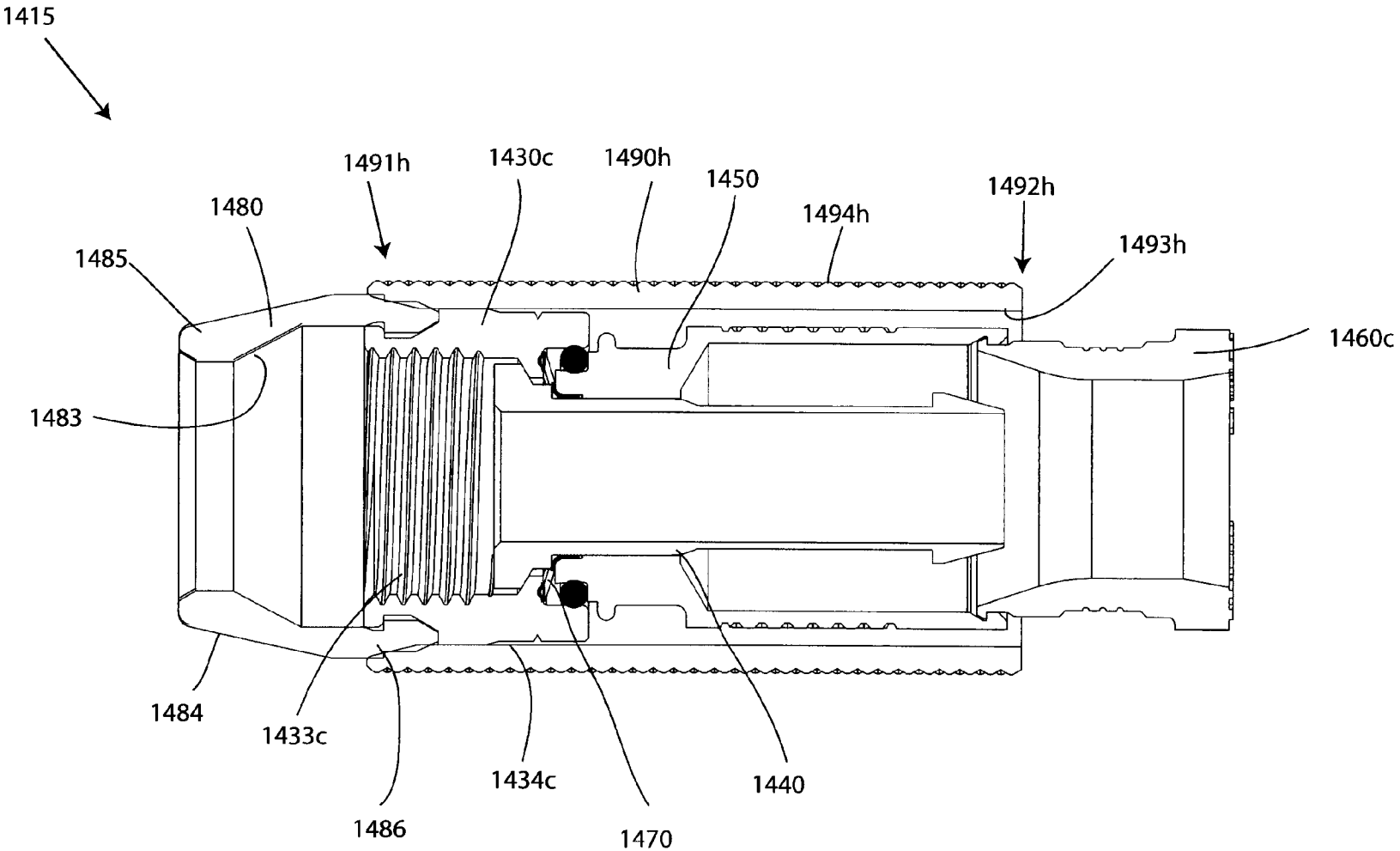
FIG. 93 depicts a cross-section view of a sixteenth embodiment of a coaxial cable connector including an embodiment of a continuity member and an embodiment of a sleeve.

FIG. 93 depicts an embodiment of connector 1415. Embodiments of connector 1415 may include a coupling member 1430*c*, a sealing member 1480, a post 1440, a connector body 1450, a continuity member 1470, a sleeve 1490*h*, and a compression portion 1460*c*.

With continued reference to the drawings, FIGS. 94-102, embodiments of connector 1500-1508 may include a coupling member 1530, a post 1540, a connector body 1550, a continuity member 1570, a compression portion 1560*a*, and a radial restriction member 1565. Embodiments of coupling member 1530 may be coupling member 1530*a* or 1530*b*, described in further detail infra. Similarly, embodiments of radial restriction member 1565 may be 1565*a*, 1565*b* or 1565*c*, described in further detail infra. Furthermore, embodiments of post 1540 and connector body 1550 may share the same or substantially the same structural and functional aspects of the embodiments of post 40/940/1040/1140/1240/1340/1440 and connector body 50/950/1050/1150/1250/1350/1450 described supra. Embodiments of continuity element 1570 may be disposed in the same or substantially the same location in connector 1500-1508 and may share the same structural and functional aspects as continuity member 70/170/270/370/470/570/670/970/1070/1170/1270/1370/1470, as described supra. However, continuity member 1570 may share the same structural and functional aspects of continuity member 770/870 if connector body 1550 is appropriately modified to accommodate continuity member 770/870. Connectors 1500-1508 may come in a preassembled configuration or may require additional operable attachment of connector components during installation.

Figure 94:
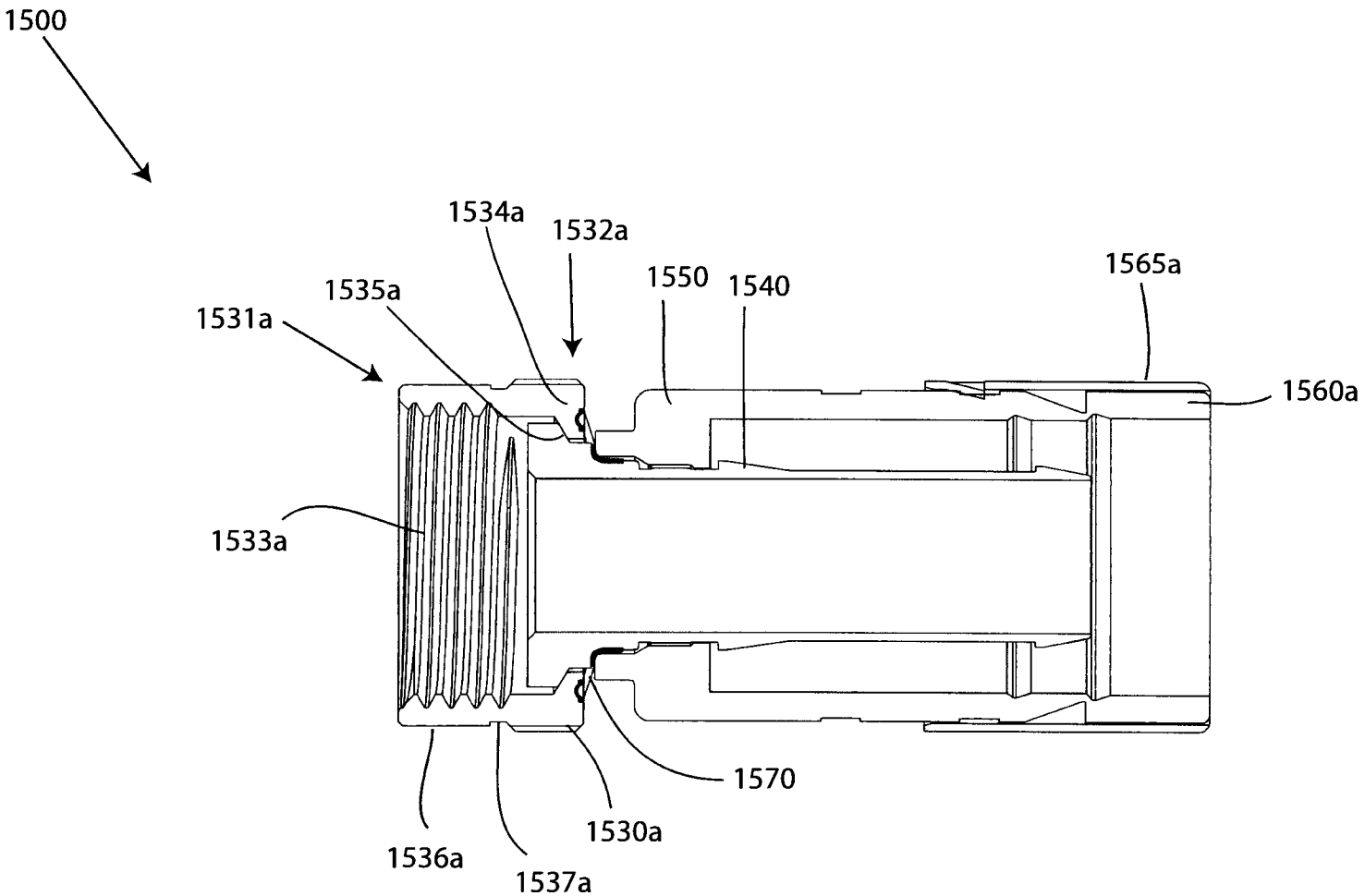
FIG. 94 depicts a cross-section view of a first embodiment of a coaxial cable connector including an embodiment of a continuity member, an embodiment of a compression portion, and an embodiment of a radial restriction member.

Referring to FIG. 94, embodiments of connector 1500 may include a coupling member 1530*a*, a post 1540, a connector body 1550, a continuity member 1570, compression portion 1560*a*, and a radial restriction member 1565*a*.

Embodiments of connector 1500 may include a coupling member 1530*a*. Coupling member 1530*a* may share the same or substantially the same structural and functional aspects of coupling member 1330*a*/1430*a*. Accordingly, coupling member 1530*a* may include a first end 1531*a*, a second end 1532*a*, an inner surface 1533*a*, an outer surface 1536*a*, an internal lip 1534*a*, such as an annular protrusion, located proximate the second rearward end 1532*a* of the coupling member 1530*a*, wherein the internal lip 1534*a* includes a surface 1535*a* facing the first forward end 1531*a* of the coupling member 1530*a*. However, coupling member 1530*a* need not include an engagement member 1597*a*, as described in association with coupling member 1330*a*/1430*a*.

Embodiments of connector 1500 may also include a compression portion 1560*a*. Compression portion 1560*a* may share the same or substantially the same structural and functional aspects of compression portion 1360*a*. Accordingly, compression portion 1560*a* may be operably attached to the connector body 1550. For instance, the compression portion 1560*a* may be structurally integral with the connector body 1550, wherein the compression portion 1560*a* separates from the connector body 1550 upon an axial force which in turn radially compresses the second end of the connector body 1550 onto the coaxial cable 10. Moreover, the structural connection or configuration between the connector body 1550 and the compression portion 1560*a* may be defined by an internal annular notch 1566*a* or groove of the compression portion 1565*a* and an outer ramped surface 1556 of the connector body 1550.

Furthermore, embodiments of connector 1500 may include a radial restriction member 1565*a*. Radial restriction member 1565*a* may share the same structural and functional aspects of radial restriction member 1365*a*. Accordingly, the radial restriction member 1565*a* may be a bushing or similar annular tubular member disposed proximate the rearward second end of the connector body 1550 that may prevent the compression portion 1560*a* from splintering or otherwise displacing in a direction other than substantially axial towards the coupling member 1530. Embodiments of the compression portion 1560*a* may create an environmental seal around the coaxial cable 10 when in the fully compressed position. Those skilled in the requisite art should appreciate that the seal may be created by the compression portion 1560*a* without the radial restriction member 1565*a*. However, the radial restriction member 1565*a* significantly enhances the structural integrity and functional operability of the compression portion, for example, when it is compressed and sealed against an attached coaxial cable 10.

Figure 95:
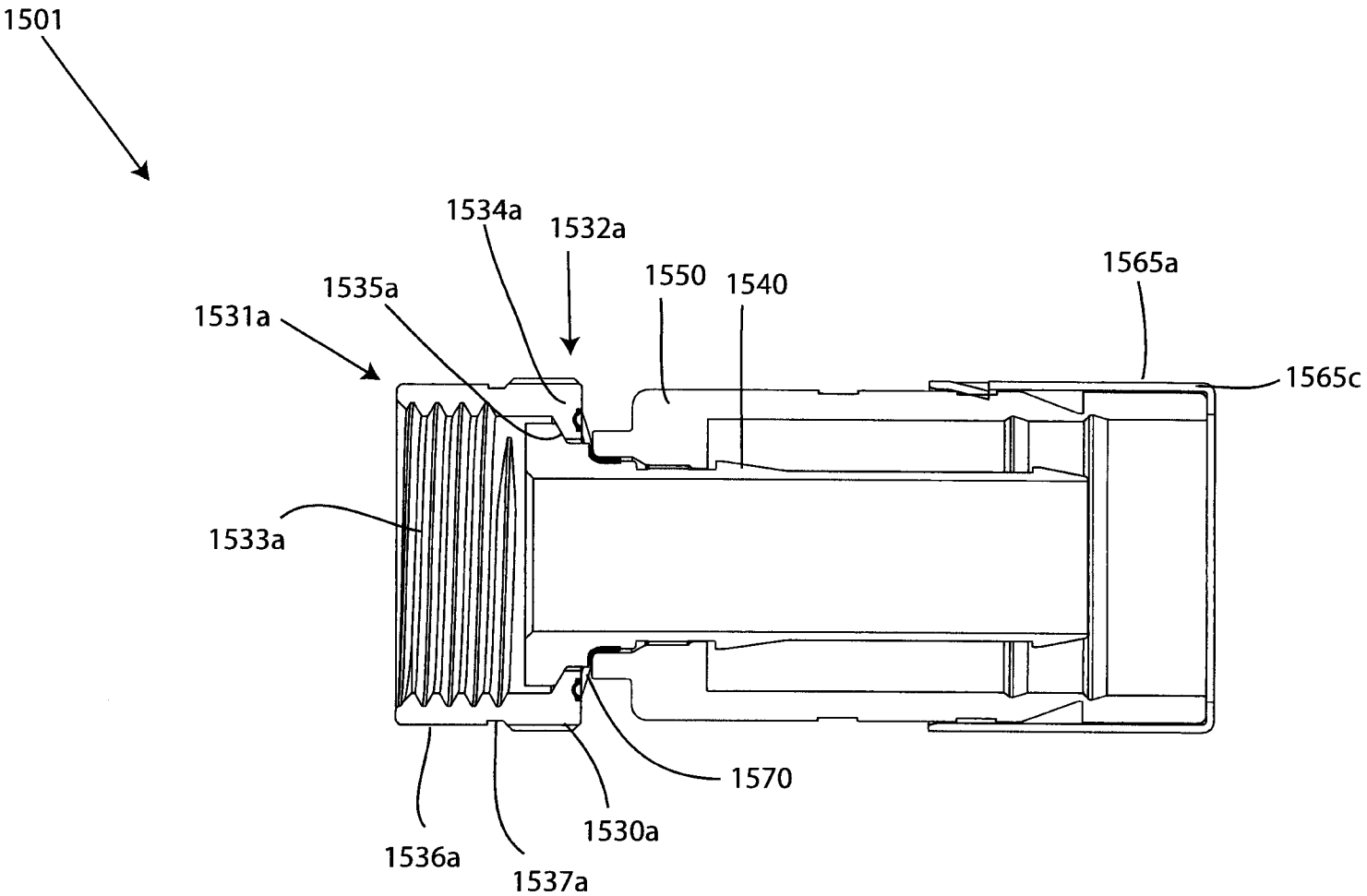
FIG. 95 depicts a cross-section view of a second embodiment of a coaxial cable connector including an embodiment of a continuity member, an embodiment of a compression portion, and an embodiment of a radial restriction member.

Referring now to FIG. 95, embodiments of connector 1501 may include a coupling member 1530*a*, a post 1540, a connector body 1550, a continuity member 1570, a compression portion 1560*a*, and a radial restriction member 1565*c*. Embodiments of radial restriction member 1565*c* may share the same or substantially the same structural and functional aspects of radial restriction member 1365*c*, as described supra. For example, radial restriction member 1565*c* may be a cap member, or similar generally annular, tubular member having an engagement surface for operable engagement with a compression tool, wherein radial restriction member 1565*c* may prevent the compression portion 1560*a* from splintering or otherwise displacing in a direction other than substantially axial towards the coupling member 1530.

Figure 96:
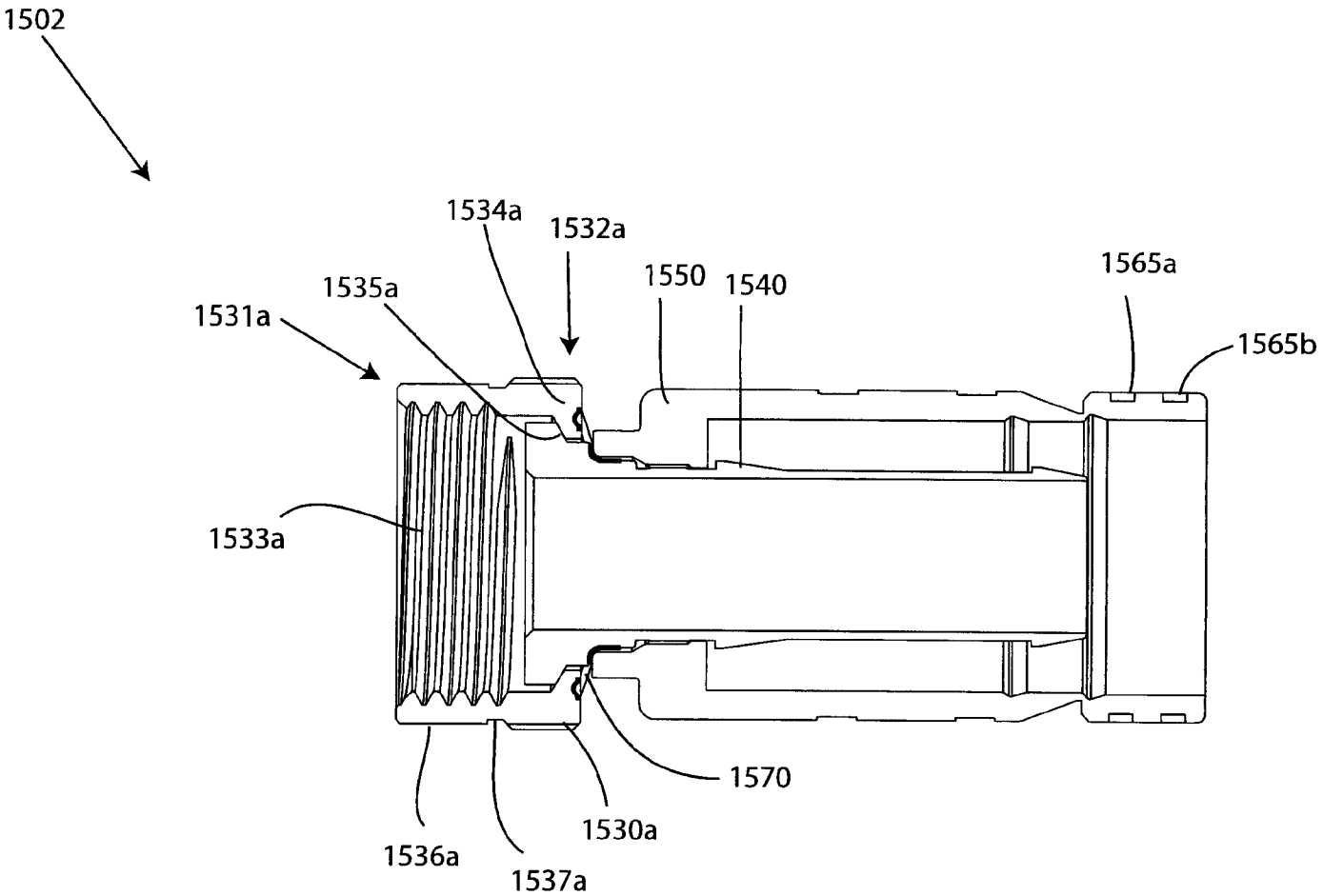
FIG. 96 depicts a cross-section view of a third embodiment of a coaxial cable connector including an embodiment of a continuity member, an embodiment of a compression portion, and an embodiment of a radial restriction member.

With reference to FIG. 96, embodiments of connector 1502 may include a coupling member 1530*a*, a post 1540, a connector body 1550, a continuity member 1570, a compression portion 1560*a*, and a radial restriction member 1565*b*. Embodiments of radial restriction member 1565*b* may share the same or substantially the same structural and functional aspects of radial restriction member 1365*b*, as described supra. For example, radial restriction member 1565*b* may be one or more straps or bands that extend annularly around or partially around the compression portion 1560*a* that may prevent the compression portion 1560*a* from splintering or otherwise displacing in a direction other than substantially axial towards the coupling member 1530.

Figure 97:
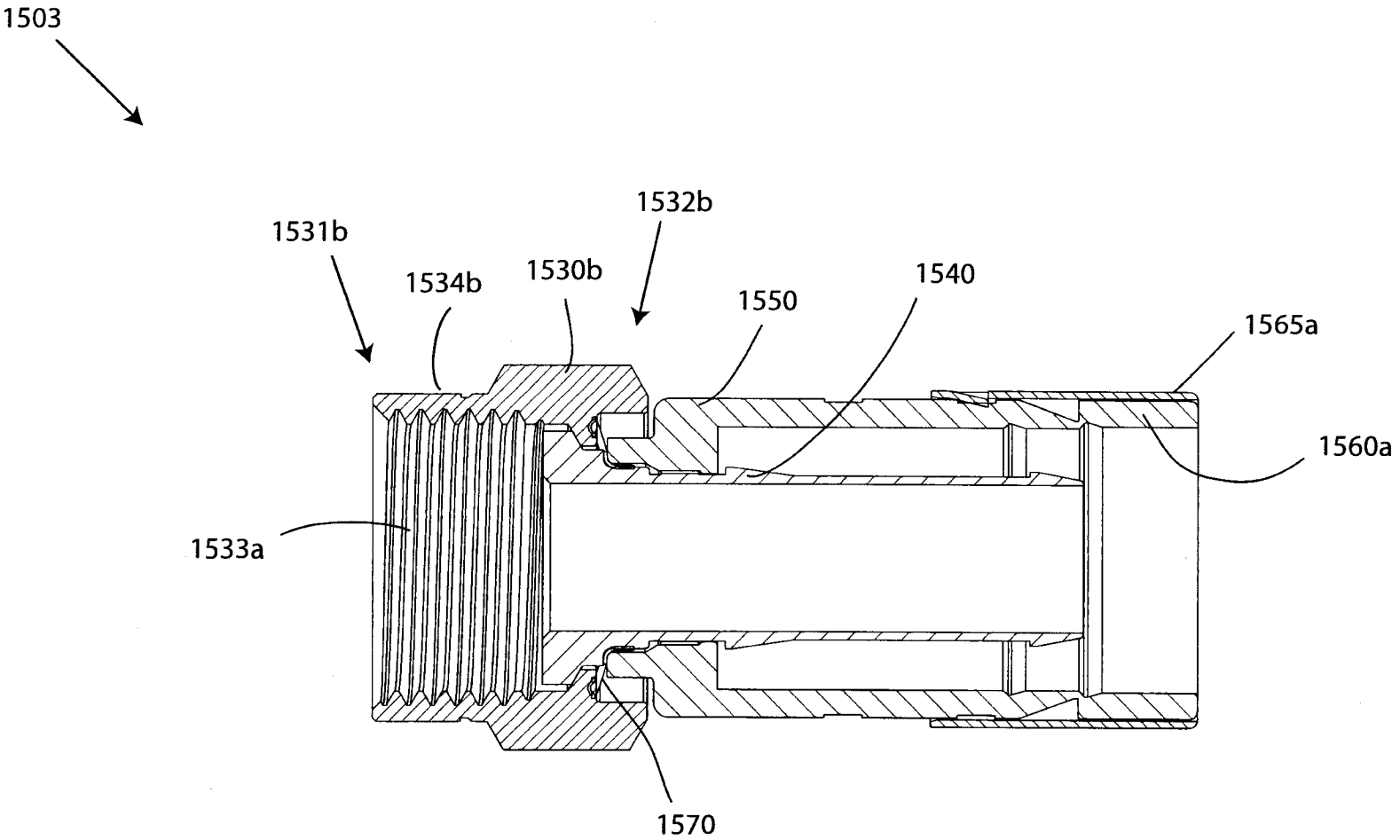
FIG. 97 depicts a cross-section view of a fourth embodiment of a coaxial cable connector including an embodiment of a continuity member, an embodiment of a compression portion, and an embodiment of a radial restriction member.
Figure 98A:
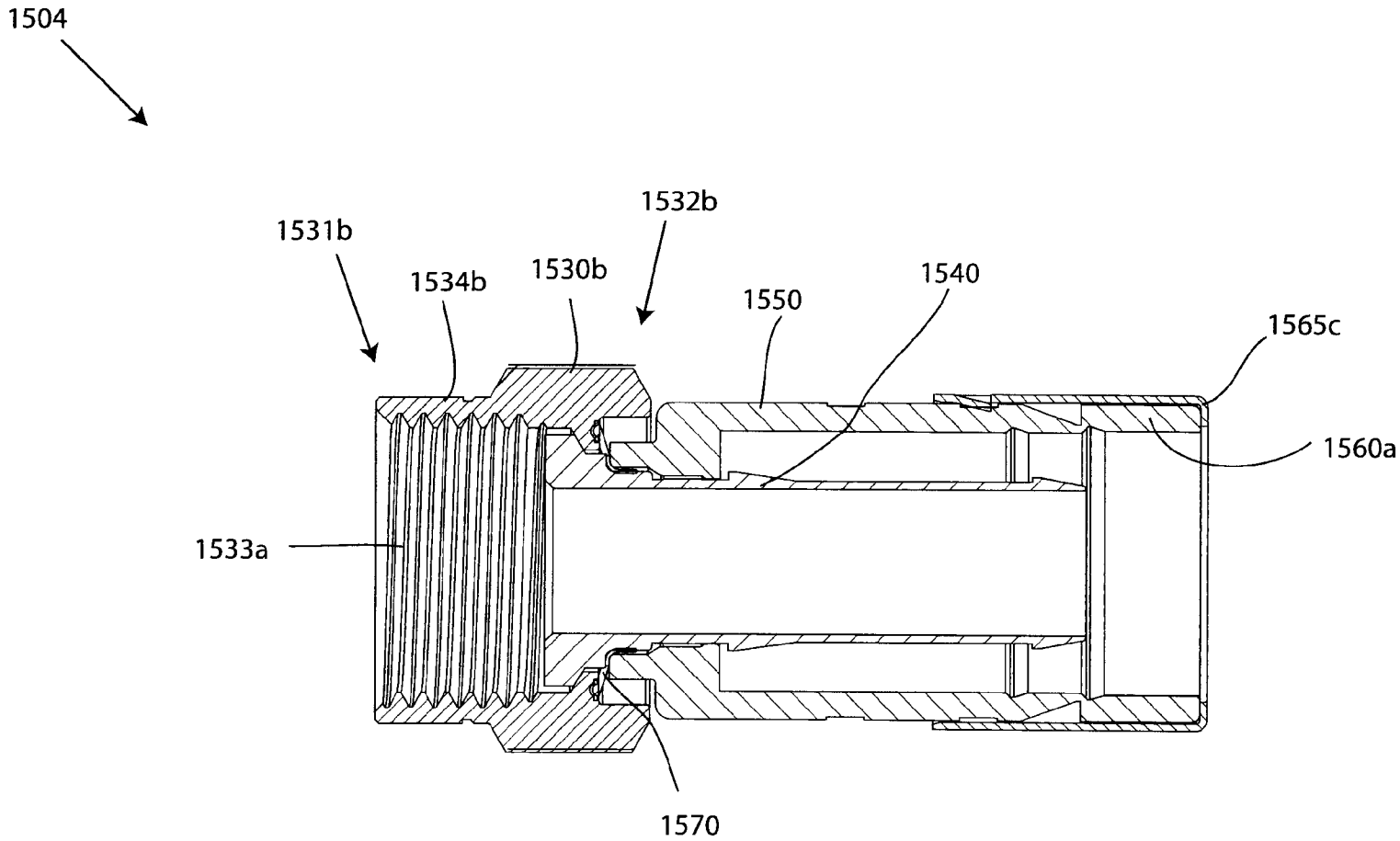
FIG. 98A depicts a cross-section view of a fifth embodiment of a coaxial cable connector including an embodiment of a continuity member, an embodiment of a compression portion, and an embodiment of a radial restriction member.
Figure 98B:
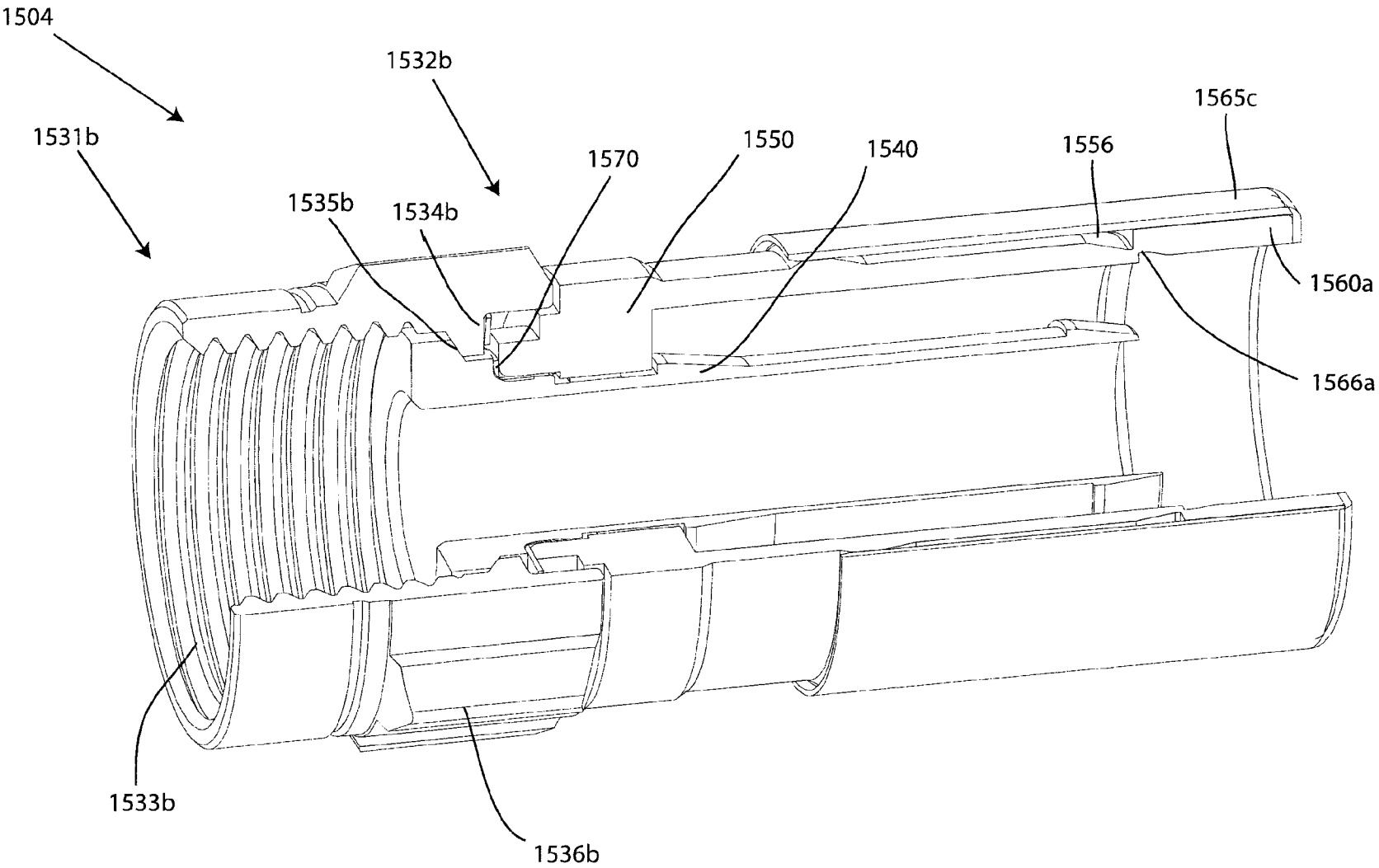
FIG. 98B depicts a perspective cut-away view of the fifth embodiment of a coaxial cable connector, as depicted in FIG. 98A.
Figure 98C:
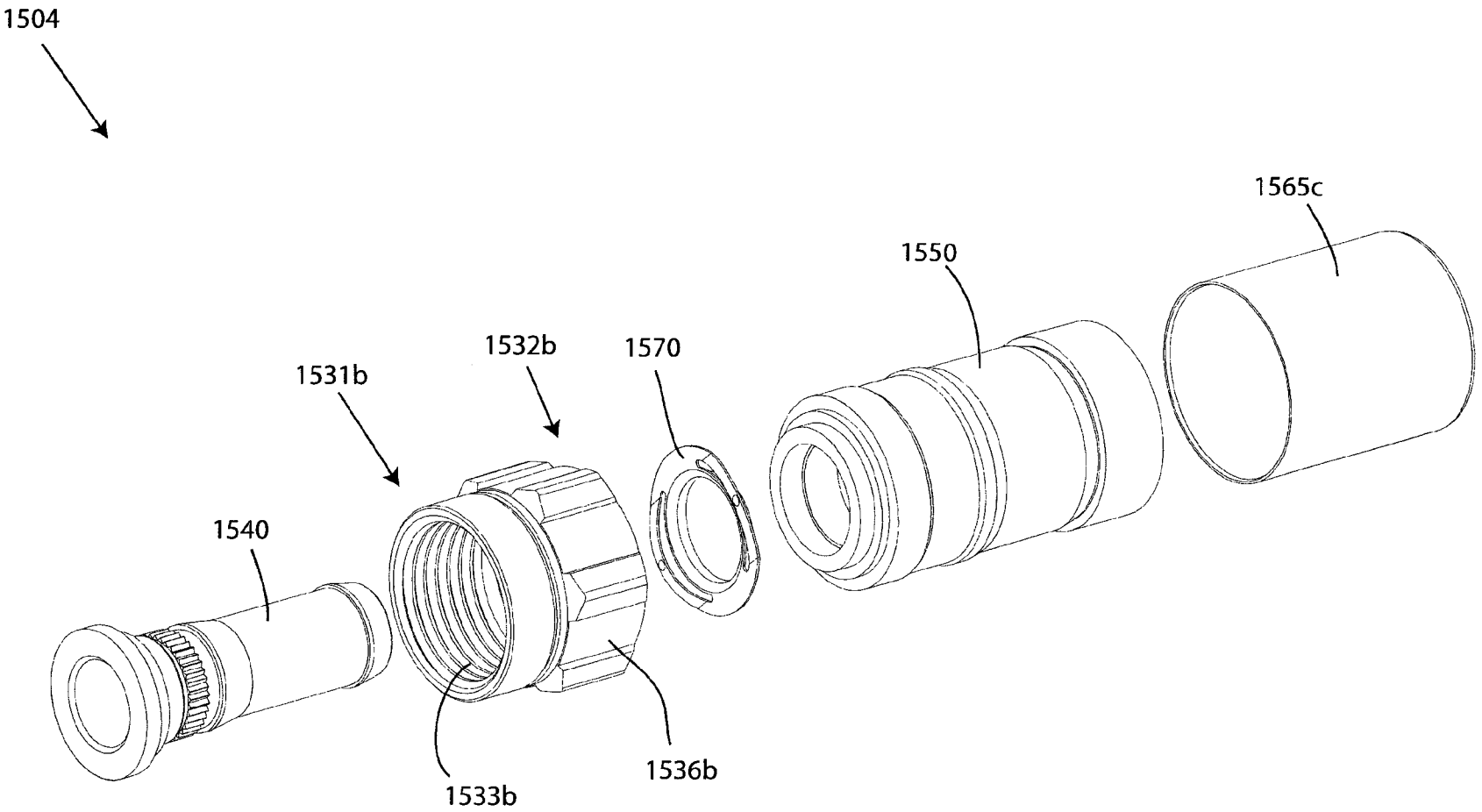
FIG. 98C depicts an exploded view of the fifth embodiment of a coaxial cable connector, as depicted in FIG. 98A.
Figure 98D:
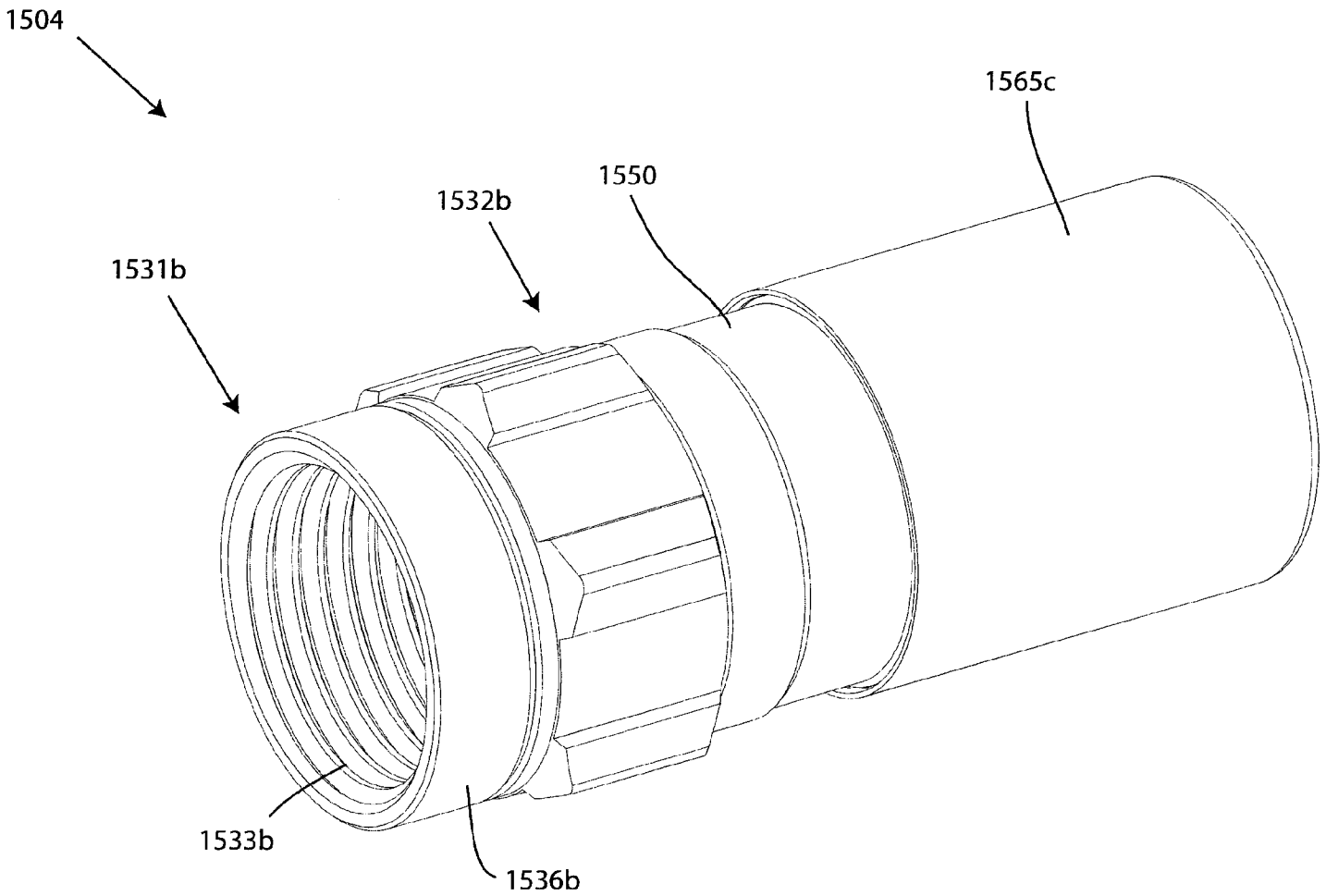
FIG. 98D depicts a perspective view of the fifth embodiment of a coaxial cable connector, as depicted in FIG. 98A.

Referring now to FIG. 97, embodiments of connector 1503 may include a coupling member 1530*b*, a post 1540, a connector body 1550, a continuity member 1570, a compression portion 1560*a*, and a radial restriction member 1565*a*. Embodiments of connector 1503 may include a coupling member 1530*b*. Coupling member 1530*b* may share the same or substantially the same structural and functional aspects of the embodiments of nut 30/930/1030/1130/1230/1330*b*/1430*b*, such as being mated, threaded or otherwise, to a corresponding interface port 20. Accordingly, coupling member 1530*b* may include a first end 1531*b*, a second end 1532*b*, an inner surface 1533*b*, an outer surface 1536*b*, an internal lip 1534*b*, such as an annular protrusion, located proximate the second rearward end 1532*b* of the coupling member 1530*b*, wherein the internal lip 1534*b* includes a surface 1535*b* facing the first forward end 1531*b* of the coupling member

1530*b*. However, coupling member 1530*b* need not include an engagement member 1597*b*, as described in association with coupling member 1330*b*/1430*b*.

FIGS. 98A-98D depict an embodiment of connector 1504. Embodiments of connector 1504 may include a coupling member 1530*b*, a post 1540, a connector body 1550, a continuity member 1570, a compression portion 1560*a*, and a radial restriction member 1365*c*.

Figure 99:
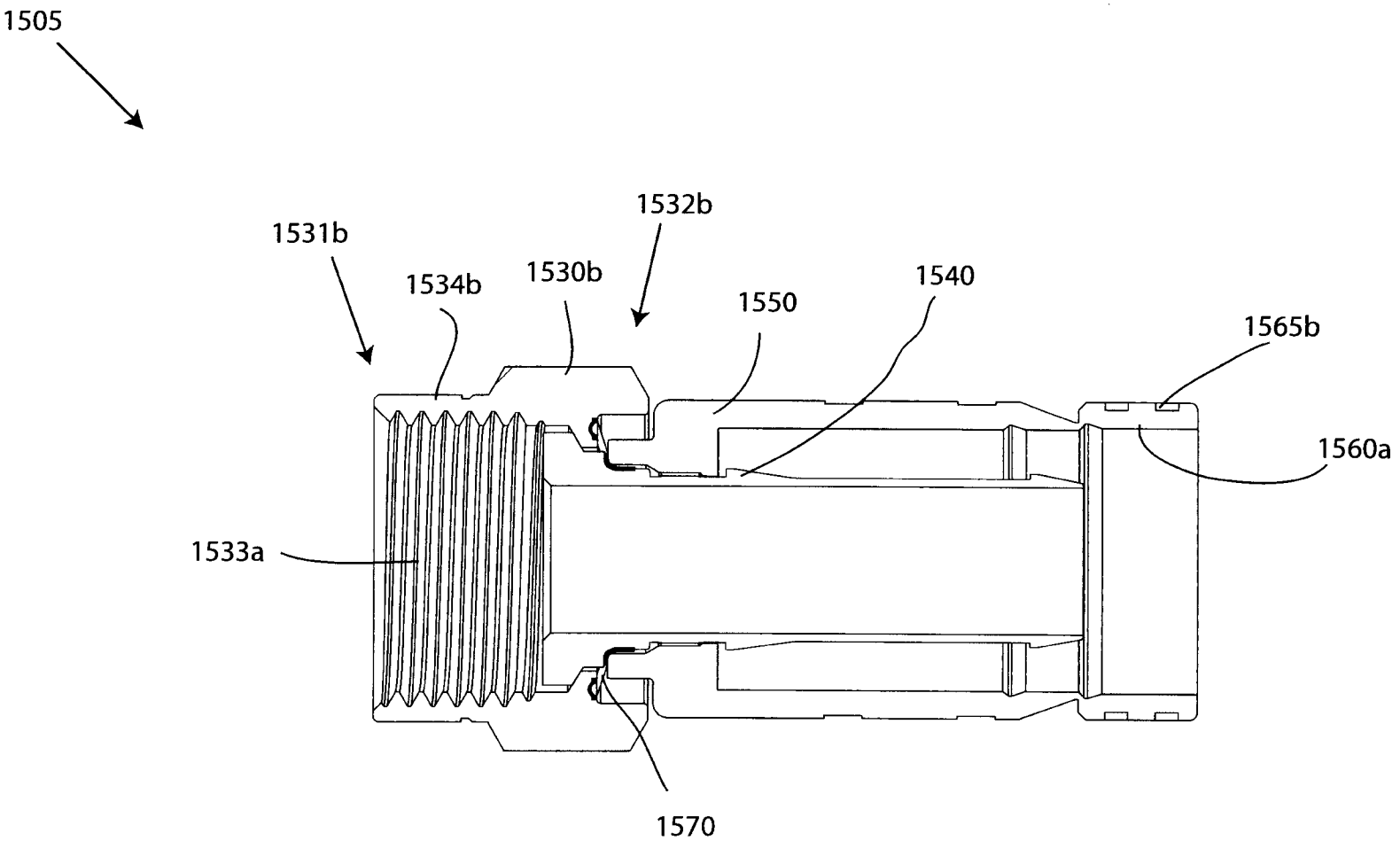
FIG. 99 depicts a cross-section view of a sixth embodiment of a coaxial cable connector including an embodiment of a continuity member, an embodiment of a compression portion, and an embodiment of a radial restriction member.

FIG. 99 depicts an embodiment of connector 1505. Embodiments of connector 1505 may include a coupling member 1530*b*, a post 1540, a connector body 1550, a continuity member 1570, a compression portion 1560*a*, and a radial restriction member 1365*b*.

Figure 100:
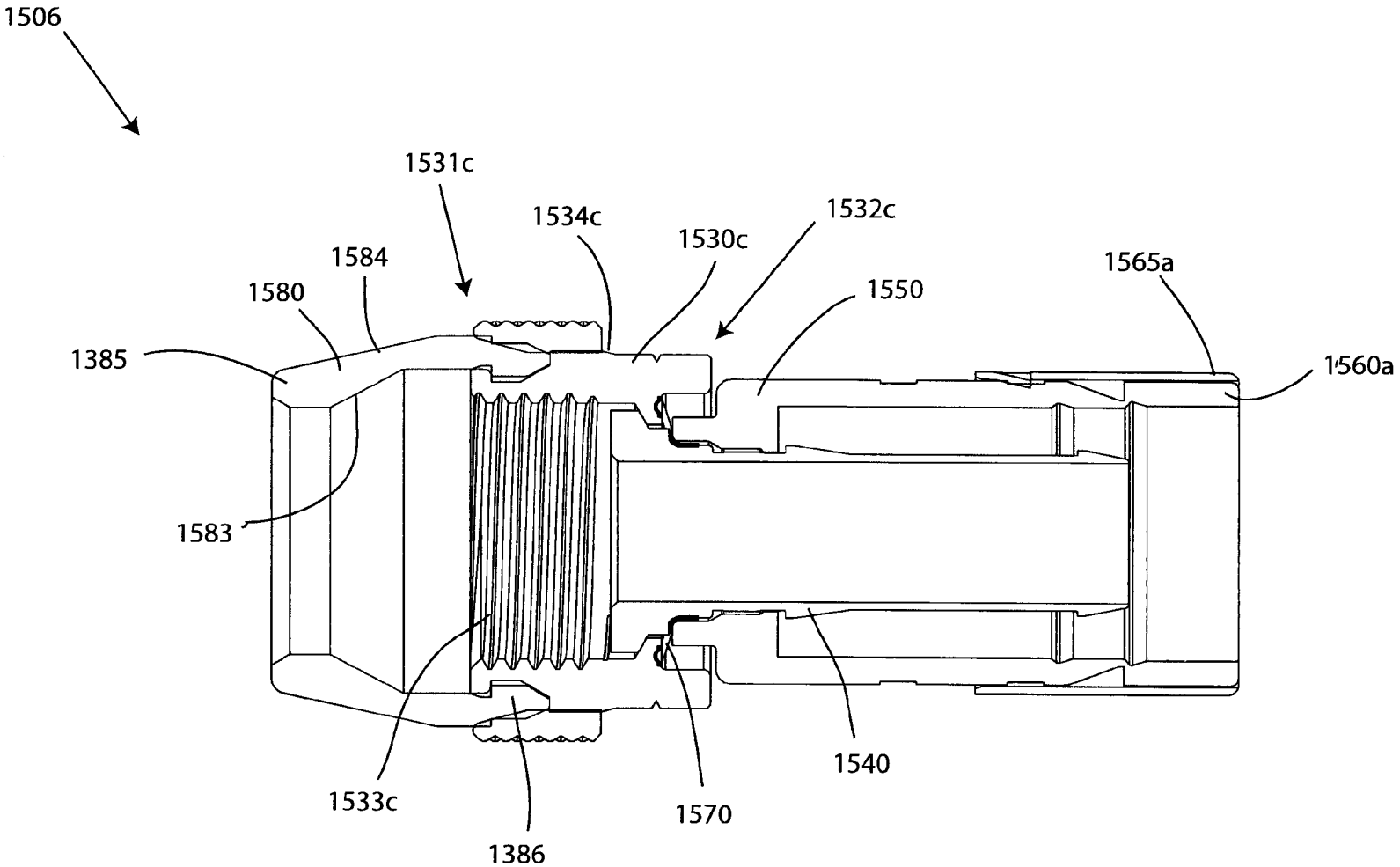
FIG. 100 depicts a cross-section view of a seventh embodiment of a coaxial cable connector including an embodiment of a continuity member, an embodiment of a compression portion, and an embodiment of a radial restriction member.

With reference now to FIG. 100, embodiments of connector 1506 may include a coupling member 1530*c*, a sealing member 1580, a post 1540, a connector body 1570, compression portion 1560*a*, and a radial restriction member 1365*a*. Embodiments of coupling member 1530*c* may share the same or substantially the same structural and functional aspects as coupling member 1330*c*/1430*c*, described supra. Embodiments of sleeve 1590*h* may share the same or substantially the same structural and functional aspects of sleeve 1390*h*/1490*h*, described supra. Similarly, embodiments of sealing member 1580 may share the same or substantially the same structural and functional aspects as sealing member 1380/1480, described supra.

Figure 101:
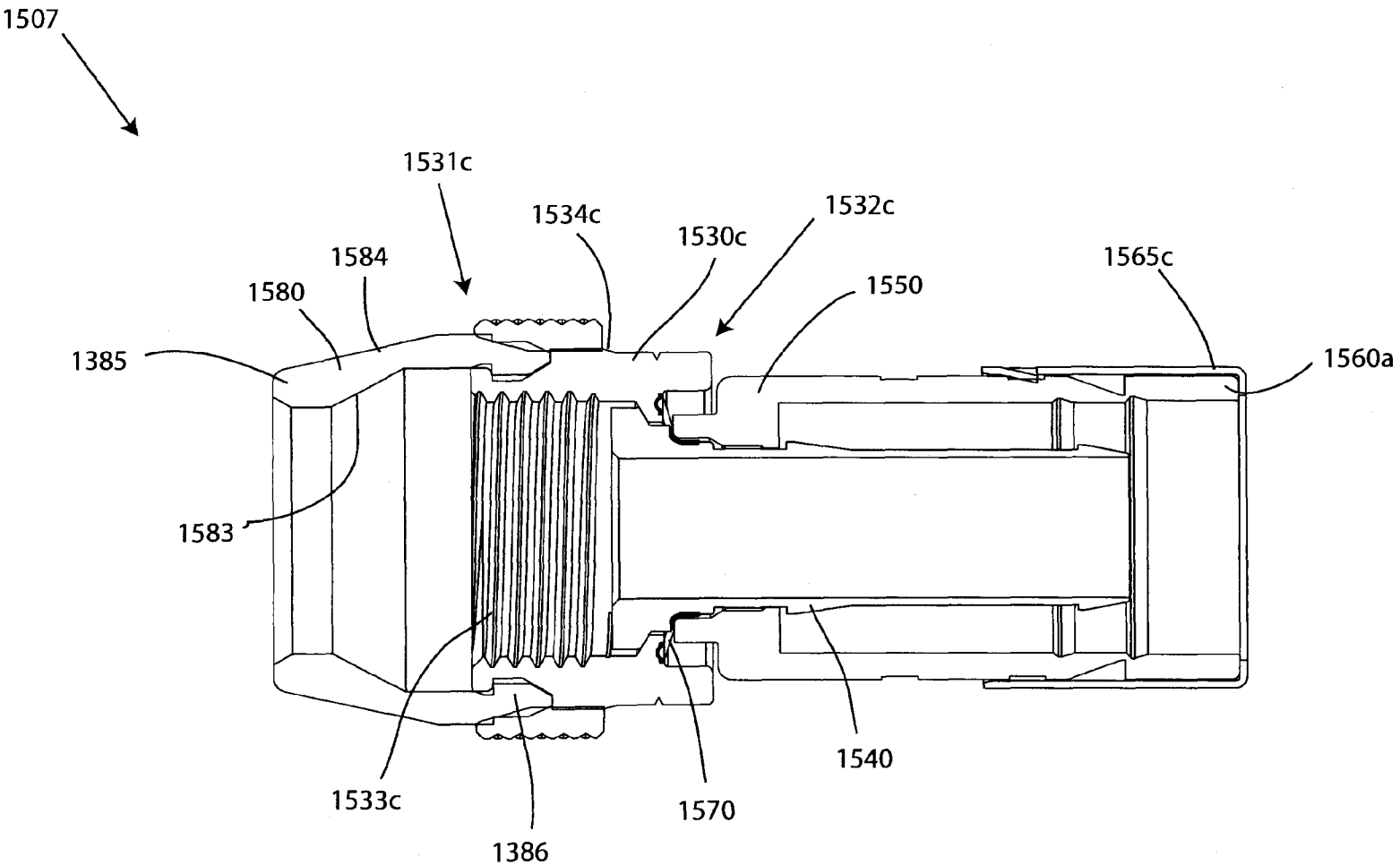
FIG. 101 depicts a cross-section view of an eighth embodiment of a coaxial cable connector including an embodiment of a continuity member, an embodiment of a compression portion, and an embodiment of a radial restriction member.

FIG. 101 depicts an embodiment of connector 1507. Embodiments of connector 1507 may include a coupling member 1530*c*, a sealing member 1580, a post 1540, a connector body 1570, compression portion 1560*a*, and a radial restriction member 1365*c*.

Figure 102:
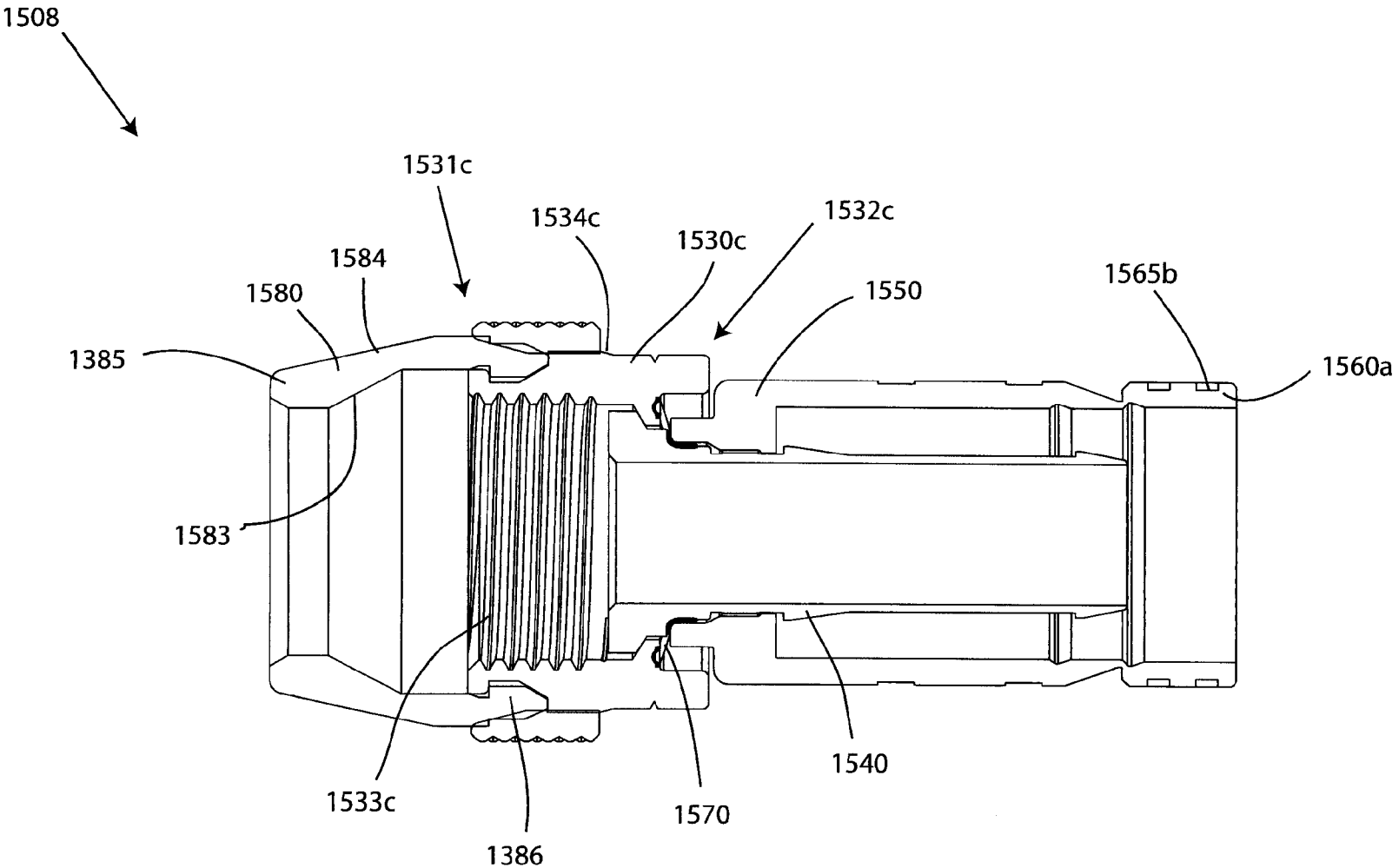
FIG. 102 depicts a cross-section view of a ninth embodiment of a coaxial cable connector including an embodiment of a continuity member, an embodiment of a compression portion, and an embodiment of a radial restriction member.

FIG. 102 depicts an embodiment of connector 1508. Embodiments of connector 1508 may include a coupling member 1530*c*, a sealing member 1580, a post 1540, a connector body 1570, compression portion 1560*a*, and a radial restriction member 1365*b*.

Referring still to the drawings, FIGS. 103-107 depict embodiments of connectors 1600-1605. Embodiments of connector 1600-1605 may include a coupling member 1630, a port face engagement member 1610, an insulator body 1625, a continuity member 1670, an extension member 1680, a sleeve 1690, a connector body 1650, a post 1640, a center conductor clamp 1615, a driver member 1620, and a compression portion 1660. Embodiments of a compression portion 1660 may be compression portion 1660*a*, compression portion 1660*b*, or compression portion 1660*c*. Embodiments of connector 1600-1602 may further include a radial restriction member 1650, wherein radial restriction member 1650 may include radial restriction member 1650*a*, radial restriction member 1650*b*, or radial restriction member 1650*c*. Furthermore, embodiments of continuity member 1670 share the same structural and functional aspects as continuity member 70/170/270/370/470/570/670/970/1070/1170/1270/1370/1470/1570, as described supra. However, continuity member 1670 may share the same structural and functional aspects of continuity member 770/870 if connector body 1650 is appropriately modified to accommodate continuity member 770/870. Connectors 1600-1604 may come in a preassembled configuration or may require additional operable attachment of connector components during installation.

Figure 103:
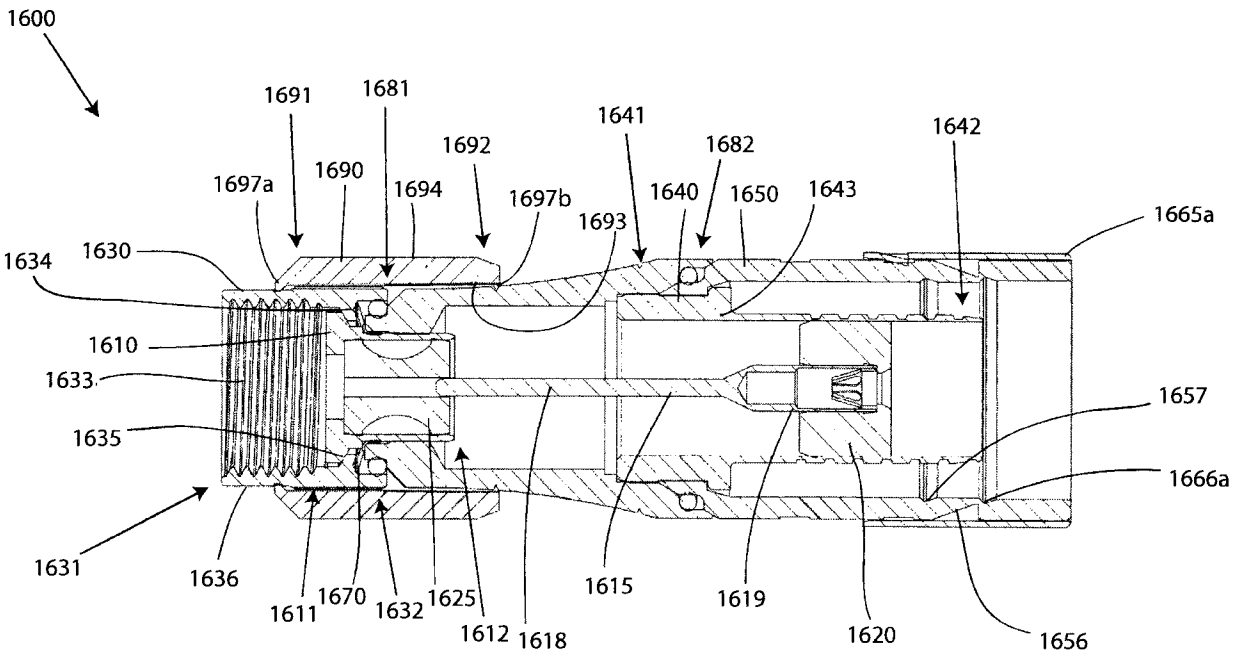
FIG. 103 depicts a cross-section view of a first embodiment of a coaxial cable connector including an embodiment of a continuity member, an embodiment of a compression portion, and an embodiment of a sleeve.

FIG. 103 depicts an embodiment of connector 1600. Embodiments of connector 1600 may include a coupling member 1630, a port face engagement member 1610, an insulator body 1625, a continuity member 1670, an extension member 1680, a sleeve 1690, a connector body 1650, a post 1640, a center conductor clamp 1615, a driver member 1620, a compression portion 1660*a*, and a radial restriction member 1650*a*.

Embodiments of connector 1600 may include a coupling member 1630. Coupling member 1630 may share the same or substantially the same structural and functional aspects of coupling member 1330/1430/1530. Accordingly, coupling member 1630 may include a first end 1631, a second end 1632, an inner surface 1633, an outer surface 1636, an internal lip 1634, such as an annular protrusion, located proximate the second rearward end 1632 of the coupling member 1630, wherein the internal lip 1634 includes a surface 1635 facing the first forward end 1631 of the coupling member 1630. Moreover, coupling member 1630*a* may include an retaining structure 1637 configured to retain, accommodate, receive, or mate with an engagement member 1697*a* of the sleeve 1690, and an outer surface feature(s) 1638 proximate or otherwise near the second end 1668 to improve mechanical interference or friction between the coupling member 1630 and the sleeve 1690. Retaining structure 1637 may share the same structural and functional aspects of retaining structure 1337*a*/1337*b*, described supra. However, coupling member 1630 may be axially rotatable with respect to a port face engagement member 1610 such that the coupling member 1630 may freely rotate about the port face engagement member 1610 and the connector body 1650.

Embodiments of the connector 1600 may include a port face engagement member 1610. Port face engagement member 1610 may be disposed within a portion of the generally axial opening of the coupling member 1630 and a portion of the generally axially opening of an extension member 1680. Embodiments of the port face engagement member 1610 may include a first end 1611, an opposing second 1612, and a flange 1613 proximate the first end 1611. The flange 1613 may include an outwardly extending portion with a tapered surface, wherein the tapered surface of the flange 1613 opposingly corresponds to the tapered surface of the lip 1634 of the coupling member 1630 for operable engagement with the coupling member 1630. The flange 1613 may also include an inwardly extending portion that is configured to engage an insulator body 1625 disposed within the tubular opening of the post face engagement member 1610. The engagement between the inwardly extending portion of the flange 1613 and the insulator body 1625 may prevent or hinder axial movement of the insulator body 1625 when accepting the center conductor pin portion 1618 of the center conductor clamp 1615 and engaging a driver member 1620. While the insulator body 1610 should be formed of materials having insulating properties, the port face engagement member 1610 should be formed of conductive materials to extend a grounding path through the coaxial cable connector to an interface port, such as interface port 20.

With continued reference to FIG. 103, embodiments of connector 1600 may include an extension member 1680. The extension member may be operably attached or engageable with the port face engagement member 1610. The extension member 1680 may include a first end 1681, a second end 1682, an inner surface 1683, and an outer surface 1684. The extension member 1680 may be disposed between the coupling member 1630 and the connector body 1650. Moreover, the extension member 1680 may include a retaining structure 1687 on the outer surface 1684 to help engage, retain, accommodate, etc., the sleeve 1690, in particular, an engagement member 1697*b* of the sleeve 1690*b*. However, the sleeve 1690 should be able to freely rotate about the extension member 1680. For instance, the retaining structure 1687 of the extension member 1680 may be sized and dimensioned so as to not overly restrict rotational movement of the sleeve 1690, and some clearance between the outer surface 1684 and the sleeve 1690 may be maintained to allow for free rotational movement of the sleeve 1690. The extension member 1680 can be formed of conductive materials. Manufacture of the extension member 1680 may include casting, extruding, cutting, turning, drilling, knurling, injection molding, spraying, blow molding, component overmolding, combinations thereof, or other fabrication methods that may provide efficient production of the component.

Embodiments of connector 1600 may further include an outer sleeve 1690. The outer sleeve 1690 may be disposed over the coupling element, or a portion thereof, and the extension member 1680, or a portion thereof. Sleeve 1690 may share the same or substantially the same structural and functional aspects of sleeve 1390*a* described supra. Accordingly, the sleeve 1690 may include a first end 1691, a second 1692, an inner surface 1693, and an outer surface 1694, and may be a generally annular member having a generally axial opening therethrough. Moreover, the sleeve 1690 may also include at least one engagement member 1697*a*, 1697*b* configured to mate or engage with at least one of (or both) the retaining structure 1637 of the coupling member 1680 and the retaining structure 1687 of the extension member 1680. The sleeve 1690 may further include internal surface features 1698 to improve the contact between the coupling member 1630 and sleeve 1690, and may include an outer surface feature(s) 1698. For example, embodiments of the sleeve 1690 may include outer surface features 1699, such as annular serrations or slots, configured to enhance gripping of the sleeve 1690 while connecting the coaxial cable connector onto an interface port.

Embodiments of connector 1600 may include a connector body 1650. Connector body 1650 may connector body 1650 may share the same or substantially the same structural and functional aspects of the embodiments connector body 50/950/1050/1150/1250/1350/1450 described supra. The connector body 1650 may be operably attached or engageable with the post 1640, and may also physically communicate with the extension member 1680 proximate the second end 1682 of the extension member 1680.

Referring still to FIG. 103, embodiments of connector 1600 may include a post 1640. Embodiments of post 1640 may share the same structural and functional aspects of post 40/940/1040/1140/1240/1340/1440 described supra. Accordingly, the post 1640 may include a first end 1641, a second end 1642, an inner surface 1643, and an outer surface 1633. The post 1640 may include a thicker portion 1643 proximate or otherwise near the first end 1641 of the post 1640 for operable engagement with the extension member 1680 and the connector body 1650.

Embodiments of connector 1600 may include a center conductor clamp 1615. Center conductor clamp 1618 may include a center conductor pin portion 1618 and a socket portion 1618. Center conductor clamp 1615 may be a conductive element that may extend or carry an electrical current and/or signal from a first point to a second point. For example, center conductor clamp 1615 may be a terminal, a pin, a conductor, an electrical contact, and the like, and should be formed of conductive materials. Furthermore, embodiments of center conductor clamp 1615 may include a socket portion 1619. Embodiments of the socket portion 1619 may include a socket that may be a clamp or basket that clamps, grips, collects, or is configured to mechanically communicate with the center conductive strand 18 of a coaxial cable 10. The socket portion 1619 may reside within an opening of a driving member 1620.

Furthermore, embodiments of connector 1600 may include a driver member 1620. The driver member 1620 may be disposed within the tubular opening of the post 1640. Embodiments of the driver member 1620 may include a first end 1621 and an opposing second 1622, and may further include a central opening to accommodate the socket portion 1619 of a center conductor clamp 1615. The end face/surface of the driver member 1620 proximate the second end 1622 may be configured to engage the dielectric 16 of the coaxial cable 10 as the cable is axially inserted into the connector. As the cable 10 is further axially inserted into the connector, the center conductor 18 enters the socket portion 1619 of the center conductor clamp 1615, and the dielectric 16 engages the driver member 1620, and the driver member 1620 moves axially along with the center conductor clamp 1615 until the driver member 1620 physically engages the insulator body 1610 disposed within the post face engagement feature 1610. Once engagement occurs with between the first end 1621 of the driver member 1620 and the insulator body 1610, the center conductor clamp 1615 may be axially stationary and the center conductor pin portion 1318 may be disposed within the general axial opening of the coupling member 1630.

Additionally, embodiments of connector 1600 may include a compression portion 1660*a*. Compression portion 1660*a* may share the same or substantially the same structural and functional aspects of compression portion 1360*a*/1560*a*. Accordingly, compression portion 1660*a* may be operably attached to the connector body 1650. For instance, the compression portion 1660*a* may be structurally integral with the connector body 1650, wherein the compression portion 1660*a* separates from the connector body 1650 upon an axial force which in turn radially compresses the second end of the connector body 1650 onto the coaxial cable 10. Moreover, the structural connection or configuration between the connector body 1650 and the compression portion 1660*a* may be defined by an internal annular notch 1666*a* or groove of the compression portion 1660*a* and an outer ramped surface 1656 of the connector body 1650.

Embodiments of connector 1600 may further include a radial restriction member 1650*a*. Radial restriction member 1665*a* may share the same structural and functional aspects of radial restriction member 1365*a*/1565*a*. Accordingly, the radial restriction member 1665*a* may be a bushing or similar annular tubular member disposed proximate the rearward second end of the connector body 1650 that may prevent the compression portion 1660*a* from splintering or otherwise displacing in a direction other than substantially axial towards the coupling member 1630. Embodiments of the compression portion 1660*a* may create an environmental seal around the coaxial cable 10 when in the fully compressed position. Those skilled in the requisite art should appreciate that the seal may be created by the compression portion 1660*a* without the radial restriction member 1665*a*. However, the radial restriction member 1665*a* significantly enhances the structural integrity and functional operability of the compression portion, for example, when it is compressed and sealed against an attached coaxial cable 10.

Figure 104:
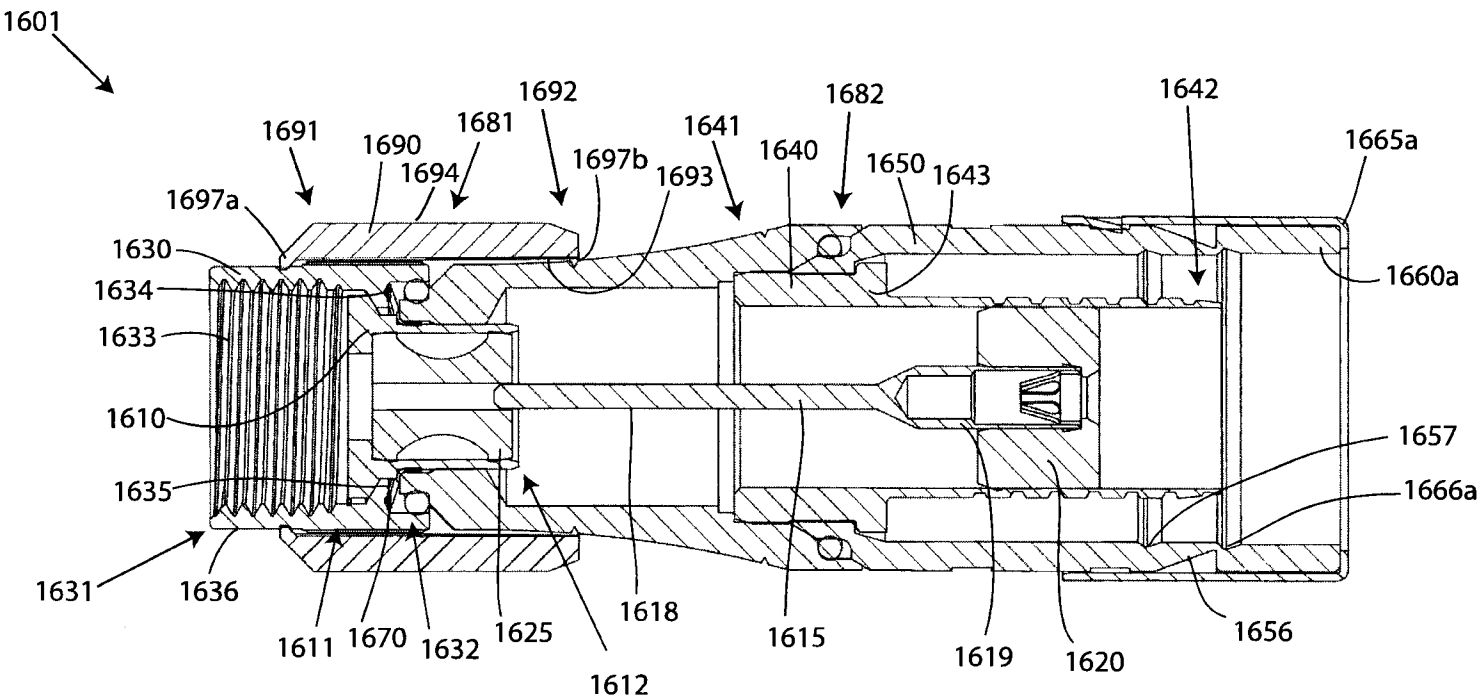
FIG. 104 depicts a cross-section view of a second embodiment of a coaxial cable connector including an embodiment of a continuity member, an embodiment of a compression portion, and an embodiment of a sleeve.

FIG. 104 depicts an embodiment of connector 1601. Embodiments of connector 1601 may include a coupling member 1630, a port face engagement member 1610, an insulator body 1625, a continuity member 1670, an extension member 1680, a sleeve 1690, a connector body 1650, a post 1640, a center conductor clamp 1615, a driver member 1620, a compression portion 1660*a*, and a radial restriction member 1650*c*. Embodiments of radial restriction member 1665*c* may share the same or substantially the same structural and functional aspects of radial restriction member 1365*c*/1565*c*, as described supra. For example, radial restriction member 1665*c* may be a cap member, or similar generally annular, tubular member having an engagement surface for operable engagement with a compression tool, wherein radial restriction member 1665*c* may prevent the compression portion 1660*a* from splintering or otherwise displacing in a direction other than substantially axial towards the coupling member 1630.

Figure 105:
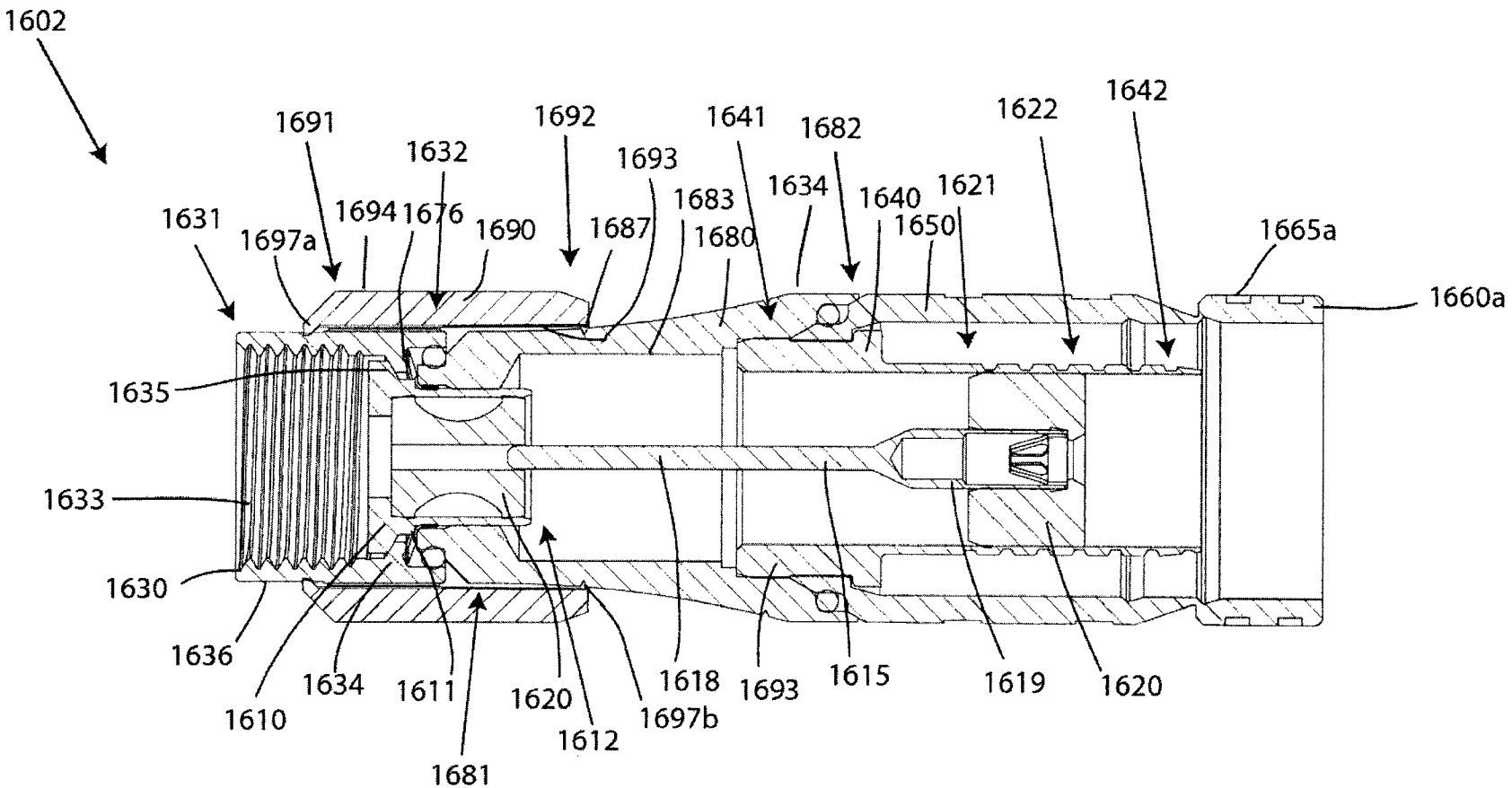
FIG. 105 depicts a cross-section view of a second embodiment of a coaxial cable connector including an embodiment of a continuity member, an embodiment of a compression portion, and an embodiment of a sleeve.

FIG. 105 depicts an embodiment of connector 1602. Embodiments of connector 1602 may include a coupling member 1630, a port face engagement member 1610, an insulator body 1625, a continuity member 1670, an extension member 1680, a sleeve 1690, a connector body 1650, a post 1640, a center conductor clamp 1615, a driver member 1620, a compression portion 1660, and a radial restriction member 1650*b*. Embodiments of radial restriction member 1665*b* may share the same or substantially the same structural and functional aspects of radial restriction member 1365*b*/1565*b*, as described supra. For example, radial restriction member 1665*b* may be one or more straps or bands that extend annularly around or partially around the compression portion 1660*a* that may prevent the compression portion 1660*a* from splintering or otherwise displacing in a direction other than substantially axial towards the coupling member 1630.

Figure 106A:
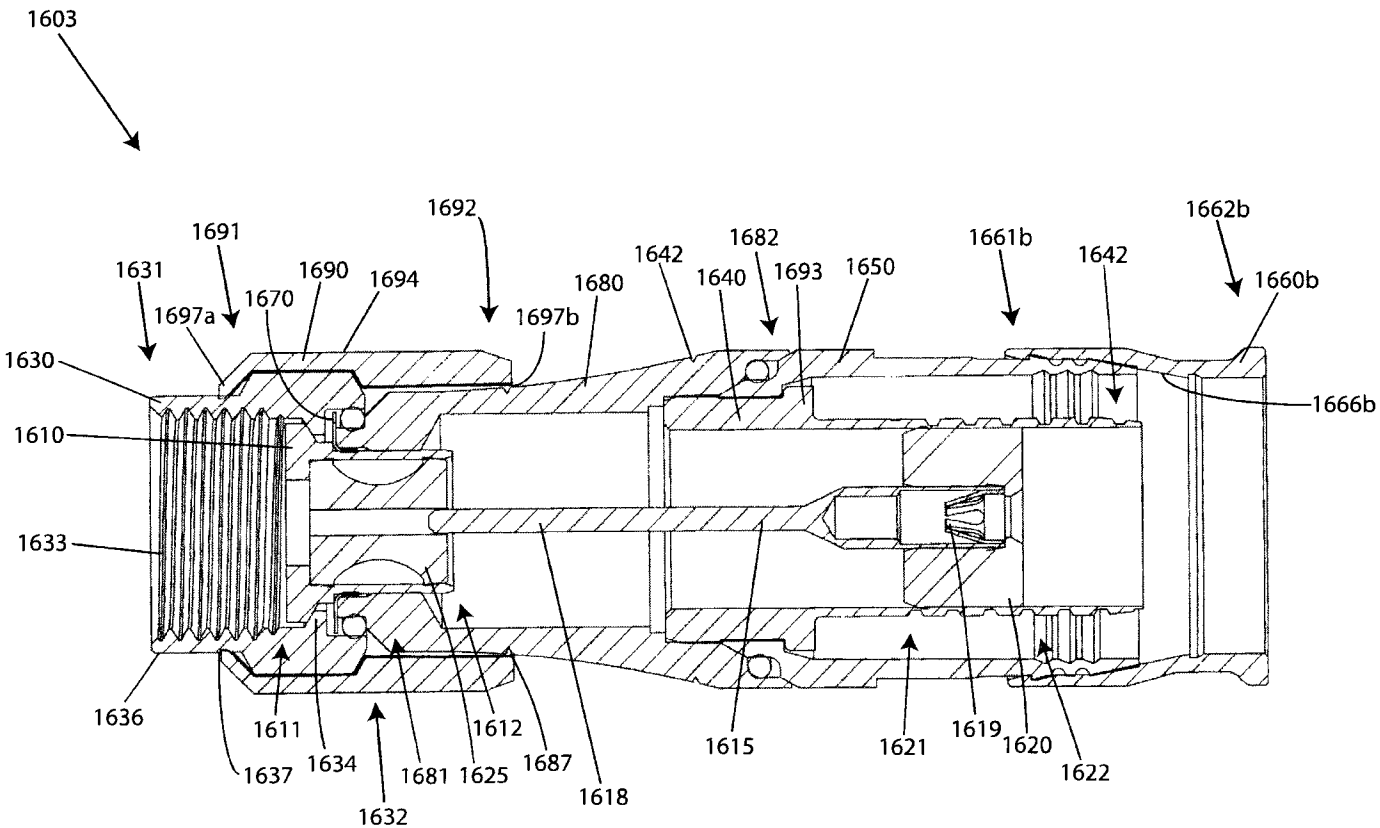
FIG. 106A depicts a cross-section view of a third embodiment of a coaxial cable connector including an embodiment of a continuity member, an embodiment of a compression portion, and an embodiment of a sleeve.
Figure 106B:
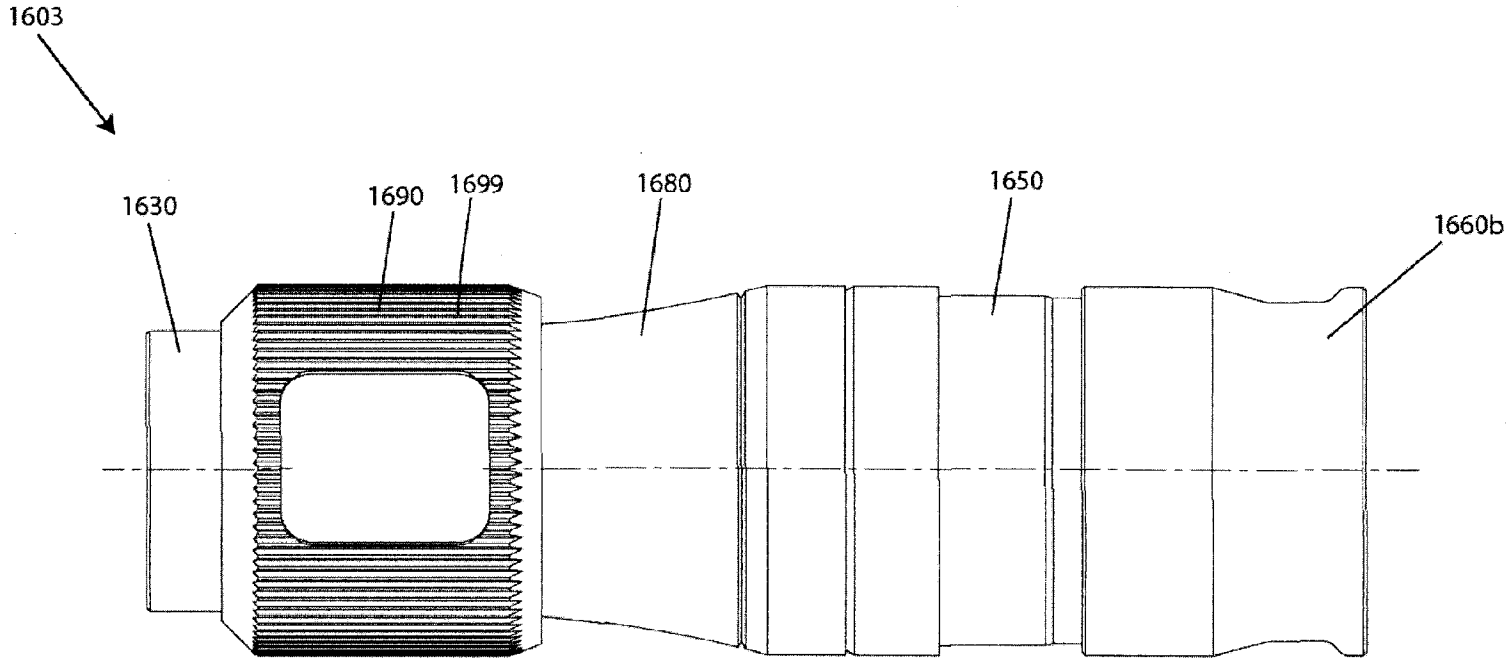
FIG. 106B depicts a perspective view of the third embodiment of a coaxial cable connector including an embodiment of a continuity member, an embodiment of a compression portion, and an embodiment of a sleeve.

FIGS. 106A-106B depict an embodiment of connector 1603. Embodiments of connector 1603 may include a coupling member 1630, a port face engagement member 1610, an insulator body 1625, a continuity member 1670, an extension member 1680, a sleeve 1690, a connector body 1650, a post 1640, a center conductor clamp 1615, a driver member 1620, and a compression portion 1660*b*.

Embodiments of connector 1603 may include a compression portion 1660*b*. Compression portion 1660*b* may share the same or substantially the same structural and functional aspects of fastener member 60 and compression portion 1460*b*, as described supra. Accordingly, compression portion 1660*b* may have a first end 1661*b* and opposing second end 1662*b*, and a ramped surface 1666*b* which may be positioned between a first opening or inner bore having a first diameter positioned proximate with the first end 1661*b* of the compression portion 1660*b* and a second opening or inner bore having a second diameter positioned proximate with the second end 1662*b* of the compression portion 1460*b* to deformably compress the outer surface of a connector body 1650 when the compression portion 1660*b* is operated to secure a coaxial cable 10.

Figure 107:
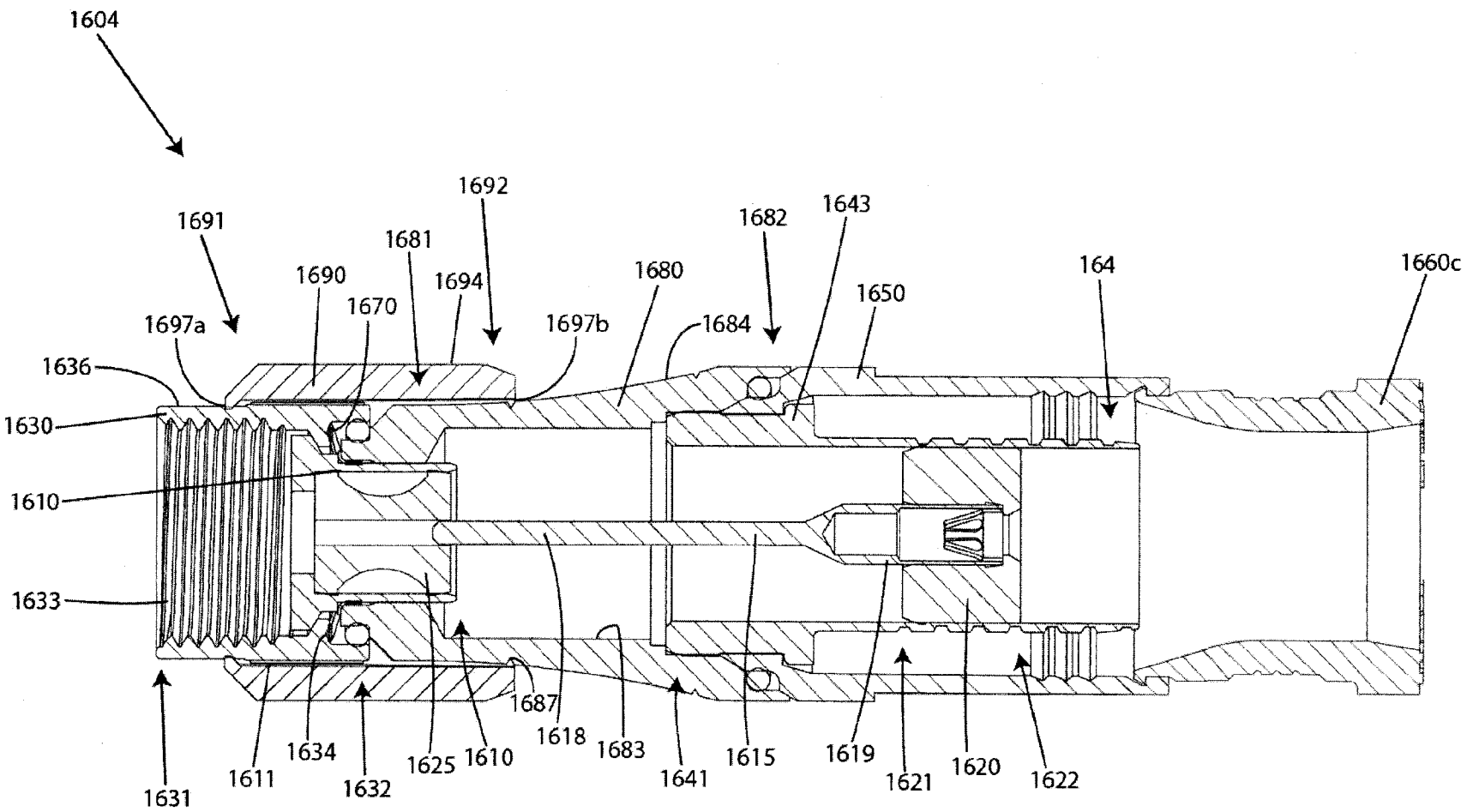
FIG. 107 depicts a cross-section view of a fourth embodiment of a coaxial cable connector including an embodiment of a continuity member, an embodiment of a compression portion, and an embodiment of a sleeve.

FIG. 107 depicts an embodiment of connector 1604. Embodiments of connector 1604 may include a coupling member 1630, a port face engagement member 1610, an insulator body 1625, a continuity member 1670, an extension member 1680, a sleeve 1690, a connector body 1650, a post 1640, a center conductor clamp 1615, a driver member 1620, and a compression portion 1660*c*.

Embodiments of connector 1604 may include a compression portion 1660*c*. Compression portion 1660*c* may share the same structural and functional aspects of compression portion 1460*c*. For example, compression portion 1660*c* may be an insertable compression sleeve or tubular locking compression member that may reside internally with respect to the connector body 1450 when in the compressed position, as described in further detail supra. The compression portion 1660*c* may include a first end 1661*c*, a second end 1662*c*, an inner surface 1663*c*, and an outer surface 1664*c*, and may include a lip 1465*c* proximate the first end 1661*c* of the compression position 1660*c*, wherein an internal groove of the connector body 1650 mates with the lip 1665*c* of the compression portion 1460*c*.

Figure 108A:
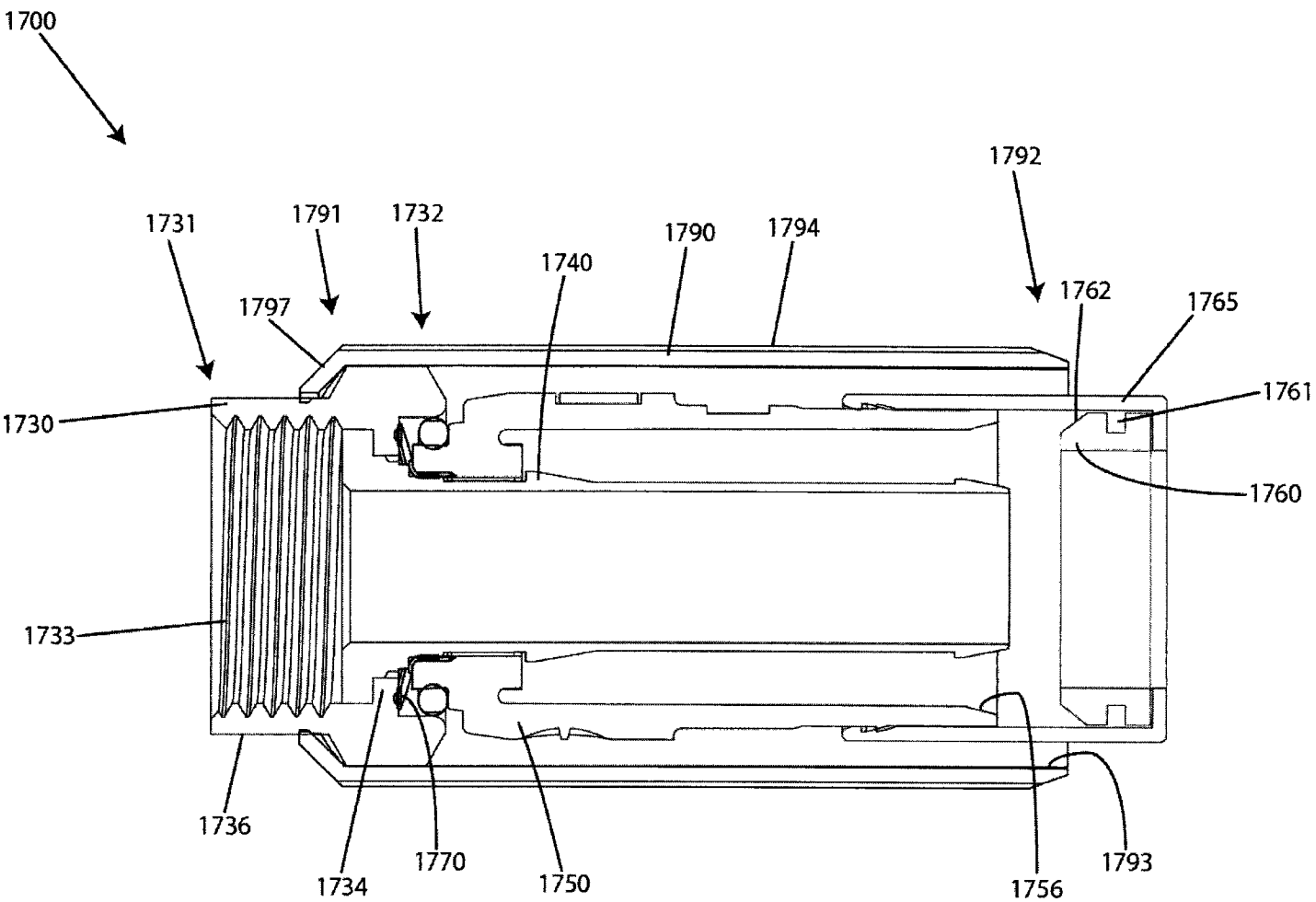
FIG. 108A depicts a cross-section view of a first embodiment of a coaxial cable connector including an embodiment of a continuity member, a first embodiment of a compression portion, and an embodiment of a sleeve.
Figure 108B:
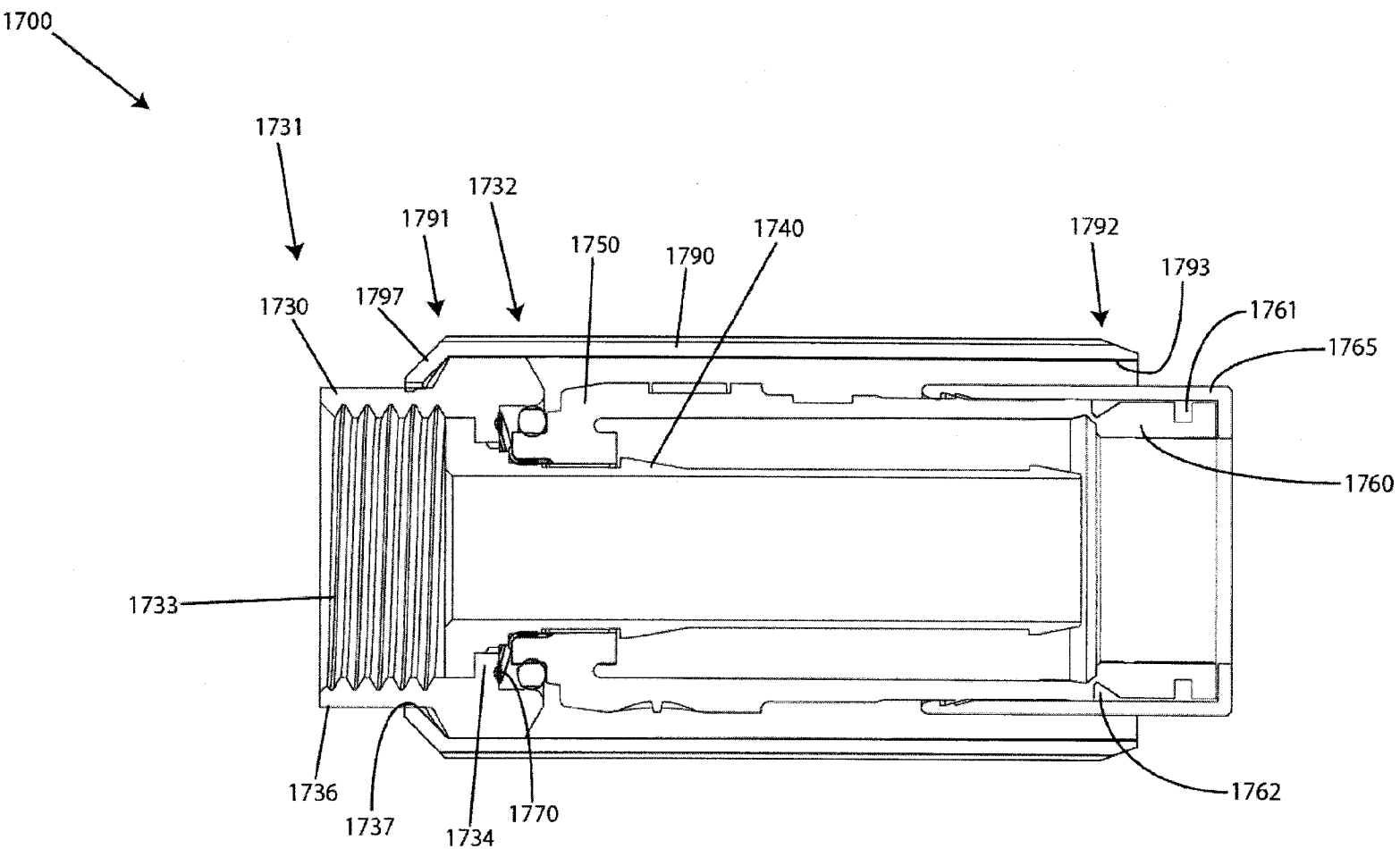
FIG. 108B depicts a cross-section view of a first embodiment of a coaxial cable connector including an embodiment of a continuity member, a second embodiment of a compression portion, and an embodiment of a sleeve.
Figure 109:
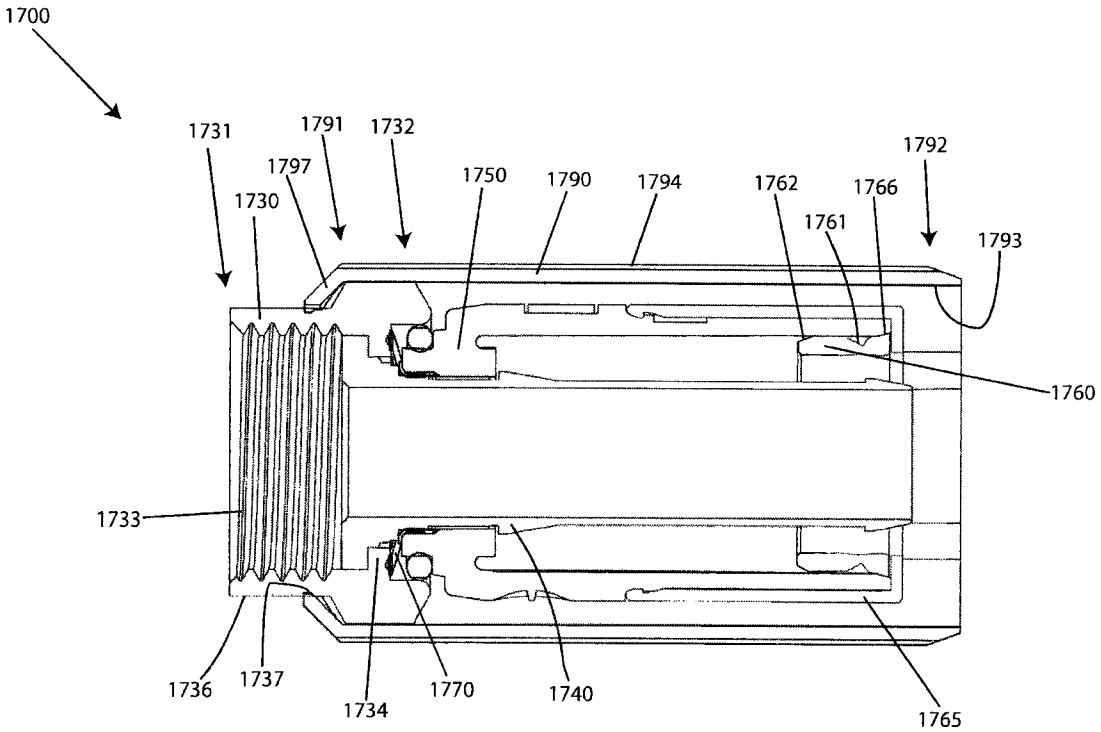
Figure 110:
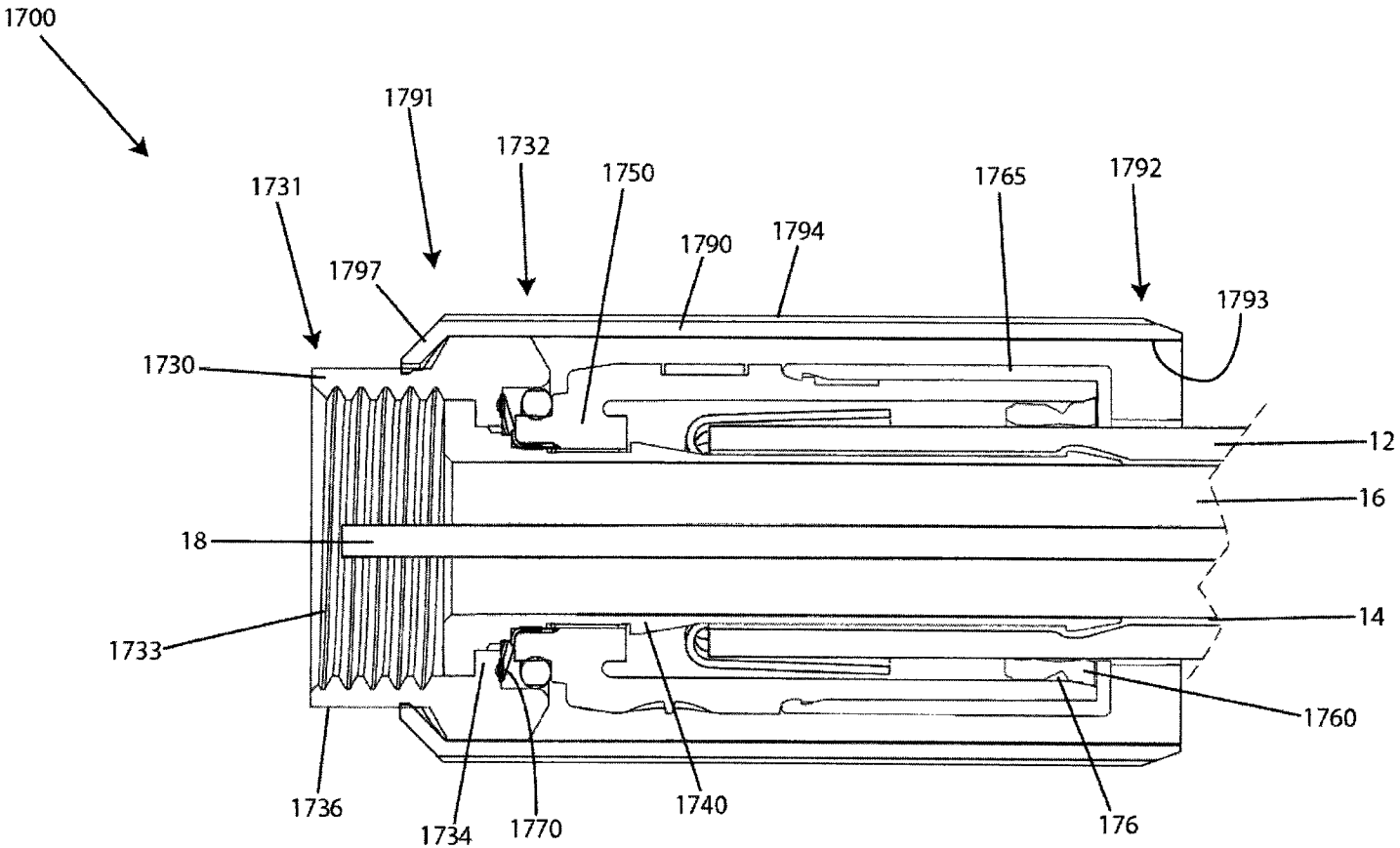

With continued reference to the drawings, FIGS. 108-110 depict embodiments of connector 1700. Embodiments of connector 1700 may include a coupling member 1730, a post 1740, a connector body 1750, a continuity member 1770, a sleeve 1790, a compression portion 1760, and a radial restriction member 1765. Embodiments of post 1740 and connector body 1750 may share the same or substantially the same structural and functional aspects of the embodiments of post 40/940/1040/1140/1240/1340/1440/1540 and connector body 50/950/1050/1150/1250/1350/1450/1550 described supra. Embodiments of continuity member 1770 may be disposed in the same or substantially the same location in a connector 100/900/1000/1100/1200/1300-1323/1400-1415/1501508 and may share the same structural and functional aspects of continuity member 70/170/270/370/470/570/670/970/1070/1170/1270/1370/1470/1570/1670, as described supra. However, continuity member 1770 may share the same structural and functional aspects of continuity member 770/870 if a connector body, such as connector body 1450, is appropriately modified to accommodate the continuity member, such as continuity member 770/870. Connector 1700 may come in a preassembled configuration or may require additional operable attachment of the sleeve 1790 to connector 1700 during installation.

Embodiments of connector 1700 may include a coupling member 1730. Coupling member 1730 may share the same or substantially the same structural and functional aspects of the embodiments of nut 30/930/1030/1130/1230, such as being mated, threaded or otherwise, to a corresponding interface port 20. Accordingly, coupling member 1730 may include a first end 1730, a second end 1730, an inner surface 1730, an outer surface 1736, an internal lip 1734, such as an annular protrusion, located proximate the second rearward end 1732 of the coupling member 1730, wherein the internal lip 1734 includes a surface 1735 facing the first forward end 1731 of the coupling member 1730. Additionally, coupling member 1730 may include a retaining structure 1737 on the outer surface 1736 of the coupling member 1730, similar to retaining structure 1337*b*, described supra to engage, retain, etc. sleeve 1790.

Embodiments of connector 1700 may include an outer sleeve 1790. Embodiments of sleeve 1790 may share the same structural and functional aspects of sleeve 1390*b* described in association with, for example, connector 1303. Accordingly, sleeve 1790 may include an engagement member 1797 that is configured to mate or engage with a retaining structure 1737 of the coupling member 1730. For example, the sleeve 1790 may include a first end 1791, a second end 1792, an inner surface 1793, and an outer surface 1794, and may be a generally annular member having a generally axial opening therethrough. However, the sleeve 1790 may be radially disposed over the coupling member 1730, or a portion thereof, the post 1740, the connector body 1750, or a portion thereof, and the compression portion 1760, or a portion thereof, while operably assembled and/or in a compressed position. Additionally, the sleeve 1790 may include an annular ramped surface 1795 or chamfer proximate or otherwise near the first end 1791 to accommodate an increased diameter or general size of the coupling member 1730 proximate a second, rearward end 1732 of the coupling member 1732. Embodiments of the ramped surface 1795 may be structurally integral with the engagement member 1797 and the body of the sleeve 1790.

Furthermore, embodiments of connector 1700 may include a compression portion 1760. Compression portion 1760 may be a separate component from the connector body 1750 (as shown in FIG. 108A) or may be structurally integral with the connector body 1750 having a frangible connection therebetween (as shown in FIG. 108B) that may deform upon engagement with the connector body 1750; engagement with the connector body 1750 occurs when an axial force is applied, by a compression tool, or other means of axial compression. For instance, compression portion 1760 may be a generally annular member having an opening therethrough that may be compressed/deformed onto the cable 10 by the inner surface of the connector body 1750. The compression portion 1760 may include one or more notches 1761 to facilitate the deformation of the compression portion 1760. Moreover, the compression portion 1760 may include a tapered or ramped surface 1763 to facilitate even engagement with the connector body 1750, and to further facilitate deformation of the compression portion. The connector body 1750 may include an inner ramped surface 1766 that may opposingly correspond to the ramped surface 1763 of the compression portion. FIGS. 109 and 110 show the manner in which the compression portion deforms upon engagement with the connector body 1750 and ultimately is axially displaced within the connector body 1750 and compressed onto the cable to create a seal around the cable jacket 12. Embodiments of the compression portion 1760 may be made of metal or plastic, or any material that permits deformation under compressive engagement with the connector body 1750.

Embodiments of connector 1700 may further include a radial restriction member 1765. The radial restriction member 1765 may be a bushing or similar annular tubular member having an inwardly extending lip disposed partially over a rearward second end of the connector body 1750, and around the compression portion while in an uncompressed position, as shown in FIG. 108A. For instance, the radial restriction member 1765 may be a generally annular, hollow cylindrically-shaped sleeve-like member comprised of stainless steel or other substantially rigid materials which may structurally assist the compress-seal process of compression portion 1760. Moreover, when the compression portion 1760 is axially compressed in a direction towards the coupling member 1730, the radial restriction member 1760*a* may axially displace along with the compression portion 1760 and may prevent the compression portion 1730 from splintering or otherwise displacing in a direction other than substantially axial towards the coupling member 1730. Additionally, radial restriction member 1765 may be a cap-like member, or similar generally annular, tubular member having an engagement surface for operable engagement with a compression tool. For instance, embodiments of the radial restriction member 1765 may include an internal annular lip or inwardly extending flange proximate a rearward end of the radial restriction member 1765. The internal lip proximate the rearward end of the radial restriction member 1765 may provide an engagement surface for operable engagement with a compression tool, or other device/means that provides the necessary compression to compress seal connector 1700.

Figure 111A:
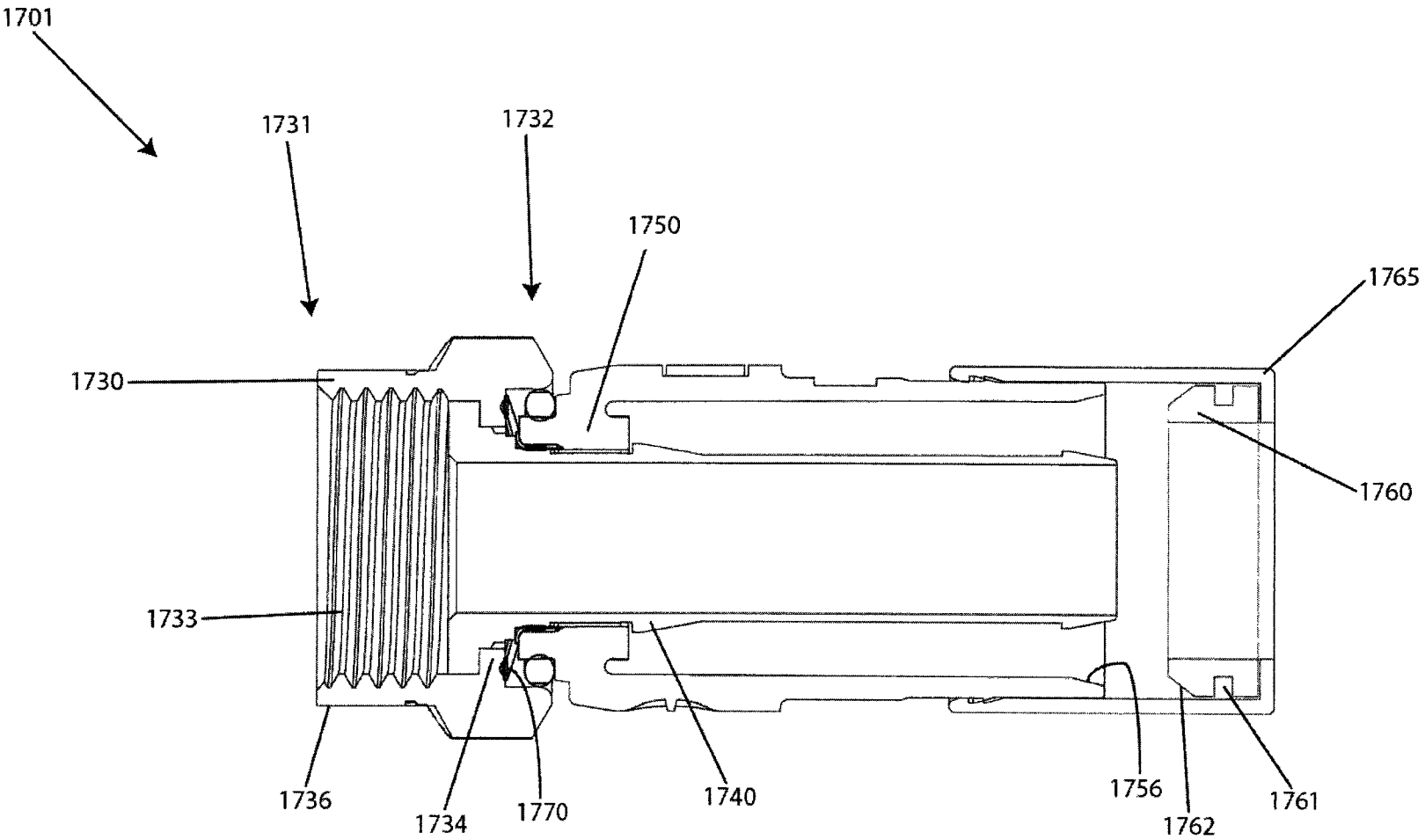
Figure 111B:
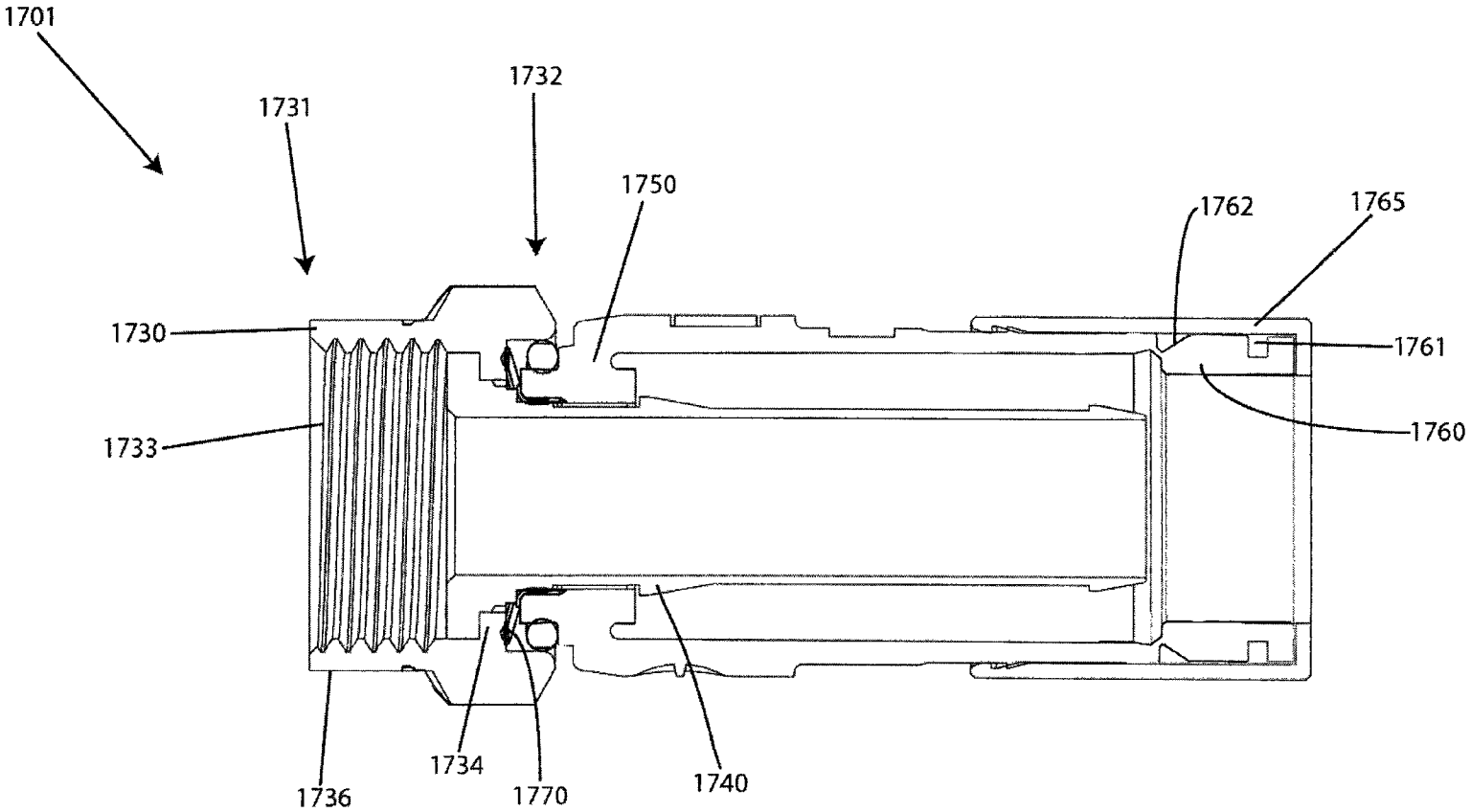

Referring still to the drawings, FIGS. 111A-113 depict embodiments of connector 1701. Embodiments of connector 1701 may include a coupling member 1730, a post 1740, a connector body 1750, a continuity member 1770, a compression portion 1760, and a radial restriction member 1765. As described supra, embodiments of compression 1760 may be structurally independent of or structurally connected to the connector body 1750, as shown in FIG. 111A and FIG. 111B, respectively. FIGS. 112 and 113 show the manner in which the compression portion deforms upon engagement with the connector body 1750 and ultimately is axially displaced within the connector body 1750 and compressed onto the cable to create a seal around the cable jacket 12.

Referring now to FIG. 114, embodiments of connector 1800 may include a coupling member 1830, a post 1840, a connector body 1850, a continuity member 1870, an outer sleeve 1890, and a compression portion 1860. Embodiments of coupling member 1830 may share the same or substantially the same structural and functional aspects of nut 30/930/1030/1130/1230, and coupling member 1330*b*/1430*b*/1530*b*/1730 such as being mated, threaded or otherwise, to a corresponding interface port 20. Embodiments of sleeve 1890 may share the same or substantially the same structural and functional aspects of the outer sleeve 1390*b*/1490*b*/1590*b*. Similarly, embodiments of post 1840 and connector body 1850 may share the same or substantially the same structural and functional aspects of the embodiments of post 40/940/1040/1140/1240/1340/1440/1540/1740 and connector body 50/950/1050/1150/1250/1350/1450/1550/1750 described supra. Embodiments of continuity element 1870 may be disposed in the same or substantially the same location in connector 1800 and may share the same structural and functional aspects as continuity member 70/170/270/370/470/570/670/970/1070/1170/1270/1370/1470/1570/1670/1770, as described supra. However, continuity member 1870 may share the same structural and functional aspects of continuity member 770/870 if connector body 1850 is appropriately modified to accommodate continuity member 770/870. Connector 1800 may come in a preassembled configuration or may require additional operable attachment of connector components during installation.

Embodiments of connector 1800 may include compression portion 1860. Compression portion 1860 may be structurally integral with the connector body 1850; however, the compression portion 1860 may be configured to be crimped onto a coaxial cable 10. For example, the compression portion 1860 may be a portion of the connector body 1850 that may be compressed, by a tool or other crimping means, tightly around the jacket 12 of the coaxial cable 10. In most embodiments, the sleeve 1890 may be operably assembled after the crimping of compression portion 1860. The operable attachment of the outer sleeve is described in detail supra.

With reference now to FIG. 115, embodiments of connector 1900 may include a coupling member 1930, a post 1940, a connector body 1950, a continuity member 1970, and an outer sleeve 1990. Embodiments of coupling member 1930 may share the same or substantially the same structural and functional aspects of coupling member 1630 such as being mated, threaded or otherwise, to a corresponding interface port 20. Embodiments of sleeve 1990 may share the same or substantially the same structural and functional aspects of the outer sleeve 1390*a*/1490*a*/1590*a*. Similarly, embodiments of post 1840 may share the same or substantially the same structural and functional aspects of the embodiments of post 40/940/1040/1140/1240/1340/1440/1540/1740/1840 described supra. Embodiments of continuity element 1970 may be disposed in the same or substantially the same location in connector 1800 and may share the same structural and functional aspects as continuity member 70/170/270/370/470/570/670/970/1070/1170/1270/1370/1470/1570/1670/1770/1870, as described supra. However, continuity member 1970 may share the same structural and functional aspects of continuity member 770/870 if connector body 1950 is appropriately modified to accommodate continuity member 770/870. Connector 1900 may come in a preassembled configuration or may require additional operable attachment of connector components during installation.

Embodiments of connector 1900 may include a connector body 1950. Connector body 1950 may share the same structural and functional aspects of connector body 50/950/1050/

1150/1250/1350/1450/1550/1750. However, connector body may include internal threads 1955 along an inner surface 1953 of the connector body 1950. The internal threads 1955 of the connector body 1950 may correspond to threads of a hardline cable, or other coaxial cable having a threadable outer, rigid conductive strand.

Those skilled in the art should appreciate that various combinations and embodiments disclosed and described in detail herein may include a body sealing element, such as sealing element 80, to provide an environmental seal for the coaxial cable connector.

With reference to FIGS. 54A-115, a method of obtaining electrical continuity for a coaxial cable connection may include the steps of providing a coaxial cable connector including: a connector body 50/950/1050/1150/1250/1350/1450/1550/1750/1850/1950, a post 40/940/1040/1140/1240/1340/1440/1540/1740/1840/1940 operably attached to the connector body 50/950/1050/1150/1250/1350/1450/1550/1750/1850/1950, the post 40/940/1040/1140/1240/1340/1440/1540/1740/1840/1940 having a flange 44, a coupling member 1330/1430/1530/1630/1730/1830/1930 axially rotatable with respect to the post 40/940/1040/1140/1240/1340/1440/1540/1740/1840/1940 and the connector body 50/950/1050/1150/1250/1350/1450/1550/1750/1950, the coupling member 1330/1430/1530/1630/1730/1830/1930 including a lip 34/1334*a*/1334*b*/1434*a*/1434*b*/1534*a*/1534*b*/1634*a*/1634*b*/1734*a*/1734*b* continuity member 70/170/270/370/470/570/670/970/1070/1170/1270/1370/1470/1570/1670/1770/1870/1970 located between the post 40/940/1040/1140/1240/1340/1440/1540/1740/1840/1940 and the coupling member 1330/1430/1530/1630/1730/1830/1930, an outer sleeve 1390/1490/1590/1690/1790/1890/1990 engageable with the coupling member 1330/1430/1530/1630/1730/1830/1930, and a compression portion 1360/1460/1560/1660/1760/1760/1860/1960 structurally integral with the connector body 50/950/1050/1150/1250/1350/1450/1550/1750/1850/1950, wherein the compression portion 1360/1460/1560/1660/1760/1760/1860/1960 is configured to break apart from the connector body 50/950/1050/1150/1250/1350/1450/1550/1750/1850/1950 when axially compressed; securely attaching a coaxial cable 10 to the connector so that the grounding shield of the cable 10 electrically contacts the post 40/940/1040/1140/1240/1340/1440/1540/1740/1840/1940, by axially compressing the compression portion 1360/1460/1560/1660/1760/1760/1860/1960 so that the compression portion 1360/1460/1560/1660/1760/1760/1860/1960 breaks away from the body 50/950/1050/1150/1250/1350/1450/1550/1750/1850/1950 and securely connects to the coaxial cable 10; extending electrical continuity from the post 40/940/1040/1140/1240/1340/1440/1540/1740/1840/1940 through the continuity member 70/170/270/370/470/570/670/970/1070/1170/1270/1370/1470/1570/1670/1770/1870/1970 to the coupling member 1330/1430/1530/1630/1730/1830/1930; and fastening the coupling member 1330/1430/1530/1630/1730/1830/1930 to a conductive interface port 20 to complete the ground path and obtain electrical continuity in the cable connection.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector for coupling an end of a coaxial cable, the coaxial cable having a center conductor surrounded by a dielectric, the dielectric being surrounded by a conductive grounding shield, the conductive grounding shield being surrounded by a protective outer jacket, the connector comprising;

a post including a forward post end, a rearward post end, and a flange having a forward facing flange surface, a rearward facing flange surface, a lip surface extending from the rearward facing flange surface, and a continuity post engaging surface extending from the lip surface, wherein the rearward post end is configured to be inserted into the end of the coaxial cable around the dielectric and under at least a portion of the conductive grounding shield thereof to make electrical contact with the conductive grounding shield of the coaxial cable;

a connector body having a forward body end, a rearward body end, and a continuity body engaging surface configured to fit the continuity post engaging surface of the flange of the post when the connector body is positioned around a portion of the post;

a coupler configured to rotate relative to the post and the connector body, the coupler including a forward coupler end configured for fastening to an interface port and to move between a partially tightened coupler position on the interface port and a fully tightened coupler position on the interface port, a rearward coupler end, and an internal lip having a forward facing lip surface facing the forward coupler end and configured to rotate relative to the rearward facing flange surface of the flange of the post and allow the post to pivot relative to the coupler, a rearward facing lip surface facing the rearward coupler end, and an intermediate surface between the forward facing lip surface and the rearward facing lip surface, the intermediate surface configured to fit the lip surface of the post that extends from the rearward facing flange surface of the flange of the post;

an electrical continuity member positioned to contact the post, the connector body, and the coupler, wherein the electrical continuity member contacts and electrically couples the post to the coupler at a position other than between the rearward facing flange surface of the flange of the post and the forward facing lip surface of the coupler, wherein the continuity member is configured to contact the rearward facing lip surface of the coupler and reside between a portion of the post and a portion of the connector body;

an outer sleeve engageable with the coupler, the outer sleeve configured to rotate the coupler; and a compression portion structurally integral with the connector body, wherein the compression portion is configured to break apart from the connector body when axially compressed.

2. The coaxial cable connector of claim 1, wherein the outer sleeve extends to the first end of the coupler.

3. The coaxial cable connector of claim 1, wherein the outer sleeve extends beyond the first end of the coupler, to guide the coupler onto the interface.

4. The coaxial cable connector of claim 1, wherein the outer sleeve includes an engagement member configured to mate with a retaining structure of the coupler.

5. The coaxial cable connector of claim 1, further comprising a radial restriction member, wherein at least some part of the radial restriction member is disposed radially extent of the compression portion to restrict radial expansion of the compression portion.

6. The coaxial cable connector of claim 5, wherein the radial restriction member comprises at least one strap positioned around at least a section of the compression portion.

7. The coaxial cable connector of claim 5, wherein the radial restriction member includes an inwardly extending lip.

8. A method of obtaining electrical continuity for a coaxial cable connection, the method comprising:

providing a coaxial cable connector including:

a post including a forward post end, a rearward post end, and a flange having a forward facing flange surface, a rearward facing flange surface, a lip surface extending from the rearward facing flange surface, and a continuity post engaging surface extending from the lip surface, wherein the rearward post end is configured to be inserted into the end of the coaxial cable around the dielectric and under at least a portion of the conductive grounding shield thereof to make electrical contact with the conductive grounding shield of the coaxial cable;

a connector body having a forward body end, a rearward body end, and a continuity body engaging surface configured to fit the continuity post engaging surface of the flange of the post when the connector body is positioned around a portion of the post;

a coupler configured to rotate relative to the post and the connector body, the coupler including a forward coupler end configured for fastening to an interface port and to move between a partially tightened coupler position on the interface port and a fully tightened coupler position on the interface port, a rearward coupler end, and an internal lip having a forward facing lip surface facing the forward coupler end and configured to rotate relative to the rearward facing flange surface of the flange of the post and allow the post to pivot relative to the coupler, a rearward facing lip surface facing the rearward coupler end, and an intermediate surface between the forward facing lip surface and the rearward facing lip surface, the intermediate surface configured to fit the lip surface of the post that extends from the rearward facing flange surface of the flange of the post;

an electrical continuity member positioned to contact the post, the connector body, and the coupler, wherein the electrical continuity member contacts and electrically couples the post to the coupler at a position other than between the rearward facing flange surface of the flange of the post and the forward facing lip surface of the coupler, wherein the continuity member is configured to contact the rearward facing lip surface of the coupler and reside between a portion of the post and a portion of the connector body; and an outer sleeve engageable with the coupler, the outer sleeve configured to rotate the coupler; and a compression portion structurally integral with the connector body, wherein the compression portion is configured to break apart from the connector body when axially compressed;

securely attaching a coaxial cable to the coaxial cable connector so that the grounding shield of the coaxial cable electrically contacts the post by axially compressing the compression portion so that the compression portion breaks away from the connector body and securely connects to the coaxial cable;

extending electrical continuity from the post through the continuity member to the coupler; and fastening the coupler to a conductive interface port to complete the ground path and obtain electrical continuity in the cable connection.

9. A coaxial cable connector for coupling an end of a coaxial cable, the coaxial cable having a center conductor surrounded by a dielectric, the dielectric being surrounded by a conductive grounding shield, the conductive grounding shield being surrounded by a protective outer jacket, the connector comprising;

a post including a forward post end, a rearward post end, and a flange having a forward facing flange surface, a rearward facing flange surface, a lip surface extending from the rearward facing flange surface, and a continuity post engaging surface extending from the lip surface, wherein the rearward post end is configured to be inserted into the end of the coaxial cable around the dielectric and under at least a portion of the conductive grounding shield thereof to make electrical contact with the conductive grounding shield of the coaxial cable;

a connector body having a forward body end, a rearward body end, and a continuity body engaging surface configured to fit the continuity post engaging surface of the flange of the post when the connector body is positioned around a portion of the post;

a coupler configured to rotate relative to the post and the connector body, the coupler including a forward coupler end configured for fastening to an interface port and to move between a partially tightened coupler position on the interface port and a fully tightened coupler position on the interface port, a rearward coupler end, and an internal lip having a forward facing lip surface facing the forward coupler end and configured to rotate relative to the rearward facing flange surface of the flange of the post and allow the post to pivot relative to the coupler, a rearward facing lip surface facing the rearward coupler end, and an intermediate surface between the forward facing lip surface and the rearward facing lip surface, the intermediate surface configured to fit the lip surface of the post that extends from the rearward facing flange surface of the flange of the post;

an electrical continuity member positioned to contact the post, the connector body, and the coupler, wherein the electrical continuity member contacts and electrically couples the post to the coupler at a position other than between the rearward facing flange surface of the flange of the post and the forward facing lip surface of the coupler, wherein the continuity member is configured to contact the rearward facing lip surface of the coupler and reside between a portion of the post and a portion of the connector body; and an outer sleeve engageable with the coupler, the outer sleeve configured to rotate the coupler.

10. The coaxial cable connector of claim 9, further comprising a compression portion structurally integral with the connector body, wherein the compression portion is configured to break apart from the body when axially compressed.

11. The coaxial cable connector of claim 9, further comprising a separate fastener member radially disposed over the connector body.

12. The coaxial cable connector of claim 9, further comprising a separate insertable compression sleeve configured to be inserted within an opening of the connector body proximate a rearward end of the connector body.

13. The coaxial cable connector of claim 9, wherein the outer sleeve extends to the first end of the coupler.

14. The coaxial cable connector of claim 9, wherein the outer sleeve extends beyond the first end of the coupler to guide the coupler onto the interface port.

15. The coaxial cable connector of claim 9, wherein the outer sleeve includes an engagement member configured to mate with a retaining structure of the coupler.

16. A coaxial cable connector for coupling an end of a coaxial cable, the coaxial cable having a center conductor surrounded by a dielectric, the dielectric being surrounded by a conductive grounding shield, the conductive grounding shield being surrounded by a protective outer jacket, the connector comprising;

a post including a forward post end, a rearward post end, and a flange having a forward facing flange surface, a rearward facing flange surface, a lip surface extending from the rearward facing flange surface, and a continuity post engaging surface extending from the lip surface, wherein the rearward post end is configured to be inserted into the end of the coaxial cable around the dielectric and under at least a portion of the conductive grounding shield thereof to make electrical contact with the conductive grounding shield of the coaxial cable;

a connector body having a forward body end, a rearward body end, and a continuity body engaging surface configured to fit the continuity post engaging surface of the flange of the post when the connector body is positioned around a portion of the post;

a coupler configured to rotate relative to the post and the connector body, the coupler including a forward coupler end configured for fastening to an interface port and to move between a partially tightened coupler position on the interface port and a fully tightened coupler position on the interface port, a rearward coupler end, and an internal lip having a forward facing lip surface facing the forward coupler end and configured to rotate relative to the rearward facing flange surface of the flange of the post and allow the post to pivot relative to the coupler, a rearward facing lip surface facing the rearward coupler end, and an intermediate surface between the forward facing lip surface and the rearward facing lip surface, the intermediate surface configured to fit the lip surface of the post that extends from the rearward facing flange surface of the flange of the post;

an electrical continuity member positioned to contact the post, the connector body, and the coupler, wherein the electrical continuity member contacts and electrically couples the post to the coupler at a position other than between the rearward facing flange surface of the flange of the post and the forward facing lip surface of the coupler, wherein the continuity member is configured to contact the rearward facing lip surface of the coupler and reside between a portion of the post and a portion of the connector body; and a compression portion structurally integral with the connector body, wherein the compression portion is configured to break apart from the body when axially compressed.

17. The coaxial cable connector of claim 16, further comprising a radial restriction member, wherein at least some part of the radial restriction member is disposed radially extent of the compression portion to restrict radial expansion of the compression portion.

18. The coaxial cable connector of claim 17, wherein the radial restriction member comprises at least one strap positioned around at least a section of the compression portion.

19. The coaxial cable connector of claim 17, wherein the radial restriction member includes an inwardly extending lip.

* * * * *